US009855189B2

(12) United States Patent
Eveleigh et al.

(10) Patent No.: US 9,855,189 B2
(45) Date of Patent: Jan. 2, 2018

(54) FLUSHING SYSTEM FOR A SAFETY SYSTEM

(71) Applicant: Magarl, LLC, Naples, FL (US)

(72) Inventors: Robert B. Eveleigh, Naples, FL (US); Thomas R. Baker, Noblesville, IN (US); Cameron West, Greenfield, IN (US)

(73) Assignee: Magarl, LLC, Naples, FL (US)

( * ) Notice: Subject to any disclaimer, the term of this patent is extended or adjusted under 35 U.S.C. 154(b) by 0 days.

(21) Appl. No.: 14/753,963

(22) Filed: Jun. 29, 2015

(65) Prior Publication Data

US 2016/0095794 A1 Apr. 7, 2016

Related U.S. Application Data

(60) Provisional application No. 62/113,028, filed on Feb. 6, 2015, provisional application No. 62/018,278, filed on Jun. 27, 2014.

(51) Int. Cl.
*A61H 33/00* (2006.01)
*A61H 35/02* (2006.01)

(52) U.S. Cl.
CPC ..... *A61H 35/02* (2013.01); *A61H 2201/0188* (2013.01); *A61H 2201/0207* (2013.01); *A61H 2201/0228* (2013.01); *A61H 2201/5058* (2013.01); *A61H 2201/5082* (2013.01)

(58) Field of Classification Search
CPC ..... A61H 55/02
USPC ..... 4/620
See application file for complete search history.

(56) References Cited

U.S. PATENT DOCUMENTS

| | | | |
|---|---|---|---|
| 2,527,836 | A | 10/1950 | Miller |
| D218,237 | S | 8/1970 | Cline |
| 3,925,829 | A | 12/1975 | Bost |
| 3,962,733 | A | 6/1976 | Parry |
| 4,012,798 | A | 3/1977 | Liautaud |
| 4,084,270 | A | 4/1978 | Kersten, Jr. |

(Continued)

FOREIGN PATENT DOCUMENTS

| | | |
|---|---|---|
| AU | 2004100671 | 9/2004 |
| AU | 2009249423 | 11/2009 |

(Continued)

OTHER PUBLICATIONS

Product information sheet for Speakman Heat Traced Combination Shower with Eye/Face Wash System SE-7000, 2 pgs Jan. 1, 2015.

(Continued)

*Primary Examiner* — Lori Baker
(74) *Attorney, Agent, or Firm* — John V. Daniluck; Bingham Greenebaum Doll LLP

(57) ABSTRACT

Methods and apparatus for improving emergency wash systems. Various embodiments pertain to compact, low flow emergency eyewash systems that provide tepid water at low flow rates. Still further embodiments pertain to emergency washing systems that are adapted and configured to reduce the exposure of users to Legionnaire's Disease with washing system features that permit quick, efficient, high flow rate flushing of the plumbing providing water to the washing system. Still further embodiments pertain to emergency eyewash systems that provide tepid water from a thermostatically controlled mixing valve that has a multi-function body.

31 Claims, 86 Drawing Sheets

(56) References Cited

U.S. PATENT DOCUMENTS

| | | | | |
|---|---|---|---|---|
| 4,259,953 | A | 4/1981 | Shaw | |
| 4,585,175 | A | 4/1986 | Formentos | |
| 4,675,924 | A * | 6/1987 | Allison | A61H 35/02 4/615 |
| 5,157,798 | A | 10/1992 | Van Kammen | |
| 5,251,345 | A | 10/1993 | Pechner | |
| 5,265,288 | A | 11/1993 | Allison | |
| 5,331,694 | A | 7/1994 | Mackenzie et al. | |
| 5,343,574 | A | 9/1994 | Butte | |
| 5,350,112 | A | 9/1994 | Stein | |
| 5,381,567 | A | 1/1995 | Tanner et al. | |
| 5,530,972 | A | 7/1996 | Tanner | |
| 5,623,990 | A | 4/1997 | Pirkle | |
| 5,647,531 | A | 7/1997 | Kline et al. | |
| D388,507 | S | 12/1997 | Gurries, II | |
| 5,740,569 | A | 4/1998 | Gurries, II et al. | |
| 5,754,990 | A | 5/1998 | Gurries, II | |
| 5,918,323 | A | 7/1999 | Smith | |
| 5,924,148 | A * | 7/1999 | Flowers, Sr. | A47K 10/48 134/95.2 |
| D414,548 | S | 9/1999 | Westcott et al. | |
| 3,070,279 | A | 6/2000 | Lundstedt | |
| 6,119,947 | A * | 9/2000 | Couture | G05D 23/1366 236/12.11 |
| D435,892 | S | 1/2001 | Henry et al. | |
| 6,173,458 | B1 | 1/2001 | Maddux | |
| D438,983 | S | 3/2001 | Stein | |
| 6,261,275 | B1 | 7/2001 | Hayes | |
| 6,279,179 | B1 | 8/2001 | Register | |
| 6,296,626 | B1 | 10/2001 | Stein | |
| 6,385,794 | B1 | 5/2002 | Miedzius et al. | |
| D466,589 | S | 12/2002 | Miedzius | |
| 6,520,431 | B2 | 2/2003 | Donovan | |
| 6,553,947 | B2 | 4/2003 | Bradenbaugh | |
| 6,611,972 | B2 | 9/2003 | Underbrink et al. | |
| 6,711,758 | B1 * | 3/2004 | Terek | A47K 3/286 4/617 |
| 6,729,344 | B1 | 5/2004 | Hung | |
| 6,782,568 | B2 | 8/2004 | Novak et al. | |
| 6,976,279 | B1 | 12/2005 | Berke et al. | |
| D514,197 | S | 1/2006 | Gilbert | |
| 7,007,316 | B2 | 3/2006 | Lutz | |
| 7,011,652 | B1 | 3/2006 | Berke et al. | |
| 7,159,252 | B2 | 1/2007 | Underbrink et al. | |
| 7,188,846 | B2 | 3/2007 | Deavila | |
| 7,201,732 | B2 | 4/2007 | Anderson et al. | |
| 7,240,852 | B2 | 7/2007 | Taylor | |
| 7,240,853 | B2 | 7/2007 | Taylor | |
| 7,243,381 | B2 | 7/2007 | Lutz, II | |
| 7,244,246 | B2 | 7/2007 | Madritsch et al. | |
| D559,365 | S | 1/2008 | Plikuhn | |
| D585,117 | S | 1/2009 | Slothower | |
| D588,240 | S | 3/2009 | Hanna | |
| 7,799,003 | B2 | 9/2010 | Johnson et al. | |
| 7,806,348 | B2 | 10/2010 | Kline et al. | |
| 7,857,795 | B2 | 12/2010 | Perrin et al. | |
| 7,971,601 | B2 | 7/2011 | Lum et al. | |
| 8,034,036 | B2 | 10/2011 | Osborne | |
| 8,060,957 | B2 * | 11/2011 | Johnson | A61H 35/02 4/619 |
| 8,064,758 | B2 | 11/2011 | Fabrizio | |
| D662,219 | S | 6/2012 | Perrin et al. | |
| D662,605 | S | 6/2012 | Perrin et al. | |
| 8,205,279 | B2 | 6/2012 | Devinat et al. | |
| D671,228 | S | 11/2012 | Perrin et al. | |
| 8,313,472 | B2 | 11/2012 | Devinat et al. | |
| 8,316,477 | B2 | 11/2012 | Smith et al. | |
| 8,316,478 | B2 | 11/2012 | Strandberg et al. | |
| D673,298 | S | 12/2012 | Perrin | |
| 8,371,825 | B2 | 2/2013 | Devinat et al. | |
| 8,435,220 | B2 | 5/2013 | Smith et al. | |
| D685,920 | S | 7/2013 | Perrin | |
| 8,490,895 | B2 | 7/2013 | Jaworski et al. | |
| 8,566,974 | B2 | 10/2013 | Strandberg et al. | |
| 8,591,479 | B2 | 11/2013 | Boissonneault et al. | |
| 8,747,374 | B2 * | 6/2014 | Strandberg | A61H 35/02 239/11 |
| 2003/0218074 | A1 | 11/2003 | Beck et al. | |
| 2005/0054992 | A1 | 3/2005 | Madritsch et al. | |
| 2006/0096026 | A1 | 5/2006 | Lutz, II | |
| 2007/0089232 | A1 | 4/2007 | Smith et al. | |
| 2007/0089233 | A1 | 4/2007 | Smith et al. | |
| 2007/0089234 | A1 | 4/2007 | Copeland et al. | |
| 2007/0089235 | A1 | 4/2007 | Devinat et al. | |
| 2007/0092388 | A1 | 4/2007 | Devinat et al. | |
| 2007/0186341 | A1 | 8/2007 | Uffner et al. | |
| 2007/0204398 | A1 | 9/2007 | Dubois | |
| 2007/0278757 | A1 | 12/2007 | Deavila | |
| 2008/0039808 | A1 | 2/2008 | Val Madritsch et al. | |
| 2008/0281280 | A1 | 11/2008 | Jaworski et al. | |
| 2009/0308494 | A1 | 12/2009 | Linn | |
| 2010/0107327 | A1 | 5/2010 | Eveleigh et al. | |
| 2011/0046582 | A1 | 2/2011 | Devinat et al. | |
| 2011/0056015 | A1 | 3/2011 | Perrin | |
| 2011/0225725 | A1 | 9/2011 | Kersten | |
| 2012/0057857 | A1 | 3/2012 | Kenney et al. | |
| 2012/0096639 | A1 | 4/2012 | Stanley et al. | |
| 2012/0240328 | A1 | 9/2012 | Dudley | |
| 2012/0324643 | A1 | 12/2012 | Ferry | |
| 2013/0042403 | A1 | 2/2013 | Strandberg et al. | |
| 2013/0283522 | A1 | 10/2013 | Novak | |
| 2013/0340160 | A1 * | 12/2013 | Eveleigh | A61H 35/02 4/620 |
| 2015/0113725 | A1 * | 4/2015 | Eveleigh | A61H 35/02 4/620 |
| 2016/0095794 | A1 * | 4/2016 | Eveleigh | A61H 35/02 4/620 |

FOREIGN PATENT DOCUMENTS

| | | |
|---|---|---|
| CA | 2570161 | 12/2005 |
| EP | 0723769 | 7/1996 |
| GB | 2485724 | 5/2012 |
| WO | 2011031674 | 3/2011 |

OTHER PUBLICATIONS

Product information for Speakman Optimus Wall Mounted Eye and Face Wash Bowl SE-1000, 2 pgs. Oct. 1, 2014.

Product information for Speakman Optimus Wall Mounted Eye and Face Wash Bowl SE1050, 2 pgs Oct. 1, 2014.

Product information for Speakman Optimus Wall Mounted Eye and Face Wash Bowl SE1055 2 pgs Oct. 1, 2014.

Product Information for Speakman Heat Traced Combination Shower with Eye Face Wash System SE7001 Jan. 1, 2015.

Product Information for Guardian G1950P Safety Station with Eye Face Wash Plastic Bowl 2 pgs Jan. 1, 2014.

Product Information for Bradley Combination Drench Shower and Halo Eyewash or Eye Face Wash S19314 Series 5 pgs May 19, 2014.

Haws Catalog of Axion Thermostatic Mixing Valves 6 pgs Jan. 1, 2014.

Product Information for Encon Galvanized Pipe wwwenconsafetycom 3 pgs Jul. 13, 2015.

Product Information Sheet for Speakman Heat Traced Combination Shower with Eye Face Wash System SE7000 2 pgs Jan. 1, 2015.

U.S. Appl. No. 13/841,056, NF Office Action dated Jul. 28, 2016, 14 pages.

U.S. Appl. No. 13/841,056, Applicant Response dated Jan. 30, 2017, 32 pages.

U.S. Appl. No. 14/528,404, NF Office Action dated Dec. 7, 2016, 9 pages.

U.S. Appl. No. 14/528,404, Applicant Response dated May 8, 2017, 21 pages.

* cited by examiner

SECTION C-C

SECTION E-E

SECTION A-A

SECTION D-D

SECTION F-F

FLUSHING SYSTEM FOR A SAFETY SYSTEM

CROSS REFERENCE TO RELATED APPLICATIONS

This application claims the benefit of priority to U.S. Provisional Patent Application Ser. No. 62/113,028, filed Feb. 6, 2015, and U.S. Provisional Patent Application Ser. No. 62/018,278, filed Jun. 27, 2014; both of which are incorporated herein by reference.

FIELD OF THE INVENTION

Various embodiments of the present invention pertain to methods and apparatus for emergency washing, and in particular to eyewash, facewash, or bodywash apparatus.

BACKGROUND OF THE INVENTION

Emergency eyewashes and showers are used in a variety of industrial, educational, and governmental settings in which dangerous chemicals are present. Should a user's eyes become contaminated (or the user's body become contaminated) a nearby, easy to use, and safe emergency washing system can provide quick and thorough flushing of the contamination.

However, some emergency wash systems may not be completely safe to use. Some systems are provided with pressurized water from a plumbing system in which the washing system is placed at a "dead end" of the plumbing, meaning that the emergency wash system provides the only exit for water within the dead ended plumbing. Since emergency washing systems are not used often, the water in the building plumbing is stagnant. Any contaminants that find their way into this plumbing (such as by leakage past seals, corrosion, or other ways) will remain in the dead end plumbing leg. If this contaminated feed water is not removed, then it may be applied to flush other contamination off of a user, even though the water is not safe for such flushing, and further showers the user with yet other contaminants.

Further yet, some emergency washing systems are configured to provide tepid water to the emergency washing system. This tepid water is often produced in a thermostatically controlled mixing valve, in which the mixing valve is provided with water from the building plumbing to a valve cold inlet, and in which water from the building plumbing is further provided to a water heater. Heated water is also provided to the mixing valve, which then provides a controlled mixing of cold and hot flow streams to achieve a tepid temperature.

However, a problem arises if the thermostatic mixing valve is provided with water having a high mineral content. These minerals may precipitate and coat various surfaces within the mixing valve. These coatings can cause improper operation of the mixing valve, including seepage of hot water provided by the water heater in a reverse direction into the source water of the dead end leg connected to the mixing valve cold inlet. In such cases, it is possible that the seepage is consistent enough to slightly increase the temperature within the dead end leg of the building plumbing.

The presence of this slight elevation in temperature in a dead ended plumbing leg can result in potentially dangerous contamination. It is possible that some dead ended plumbing legs may include the bacterium *Legionella* in some parts of a building's water system. The presence of *Legionella* bacteria may not by itself result in Legionnaires' disease (LD). LD is contracted by the user aspirating the colonized water into the user's lungs. Unfortunately, the use of spraying nozzles on an emergency eye wash system can increase the danger of transmitting the bacteria. In the case of an emergency eye wash system as discussed above, the warm water temperature in the dead end leg promotes the growth of *Legionella*.

One manner of removing the contaminated water from the dead ended leg is to periodically flush the system. However, currently used flushing techniques have shown to be ineffective in thoroughly flushing the dead ended leg. It appears that this ineffectiveness is a result of at least three factors: (1) building plumbing systems typically use large diameter pipe capable of providing high flow rates over long distances, which results in a large internal volume of dead ended water; (2) some emergency eye systems are designed to provide only modest water flow (such as 3-5 gallons per minute); and (3) the technician that is tasked with periodically flushing the dead ended leg often simply turns on the emergency wash system for a longer than usual period. However, the period of flushing (3) is typically not long enough at the low flow rate (2) to fully purge the large, internal dead space (1). Therefore, the typical flush of an emergency wash system does not re-establish a safe water supply in the dead end let.

Yet another factor that complicates the problems thus discussed is the desire to use less water in any new water-handling device. Emergency wash systems can benefit from lower flow rates by producing a gentler and more predictable upward stream of water to flush the user's eyes or face. If an emergency washing system is not comfortable, then it is less likely to be used, which defeats the purpose of the emergency wash system. It has been observed that some eye washing systems produce output sprays that are too strong or flow too high to be comfortably used.

This variation in the emergency spray may require the complexity of a separate, manually adjustable flow valve, along with the expense of the labor necessary to set the adjustment properly. Achieving a proper and comfortable spray pattern can be a problem when considering the wide range of water pressures that exist in a building plumbing system. The pressure of the leg of the plumbing system that provides the emergency wash may range from very low to very high values, depending upon the size of the pipes, the age and material buildup within the pipes, whether or not other devices are provided with water from the same leg, or the unpredictable, on and off nature of other devices receiving water from the same plumbing leg.

Yet another problem with many emergency washing systems is their susceptibility to breakage during maintenance and usage. Many current eye washing systems have one rigid pipe that provides water to the washing system, and a second rigid pipe that takes away the water drained from the emergency system. These two rigid pipes are typically used for supporting the collection basin of an emergency eye wash system. However, it has been found that some systems are installed with rigid pipes that are of inadequate strength to support the wash basin, especially when a maintenance technician needs to perform maintenance (such as flushing), and must apply excessive loads to the emergency wash system in order to disassemble it. Still further, these rigid pipes are typically coupled to the basin, plumbing, or shut off valve, etc., with pipe connections that, although leak tight, are unable to resist a torque applied to the wash system during disassembly—the joints simply slip. Yet further damage to an emergency washing system can arise when the user, who is typically in a hurry and distracted, bears his weight against the wash basin. The rigid pipes and slipping connections may not be strong enough to support the user's weight. Current emergency washing systems often do not include any structure that is capable of supporting the high maintenance loads or the user's weight. Attaching the basin to a wall or providing a separate floor stand presents still further problems. A connection from a wall to the basin is spatially independent of the basin plumbing, but it is often a bad design practice to try to positively locate one item (the drain basin) to two different objects (the wall vs. the plumbing system). A problem with a separate vertical stand for the drain basin can be a lack of available floor space. Especially in industrial settings, floor space is highly prized. An emergency wash system that does not contact the floor is therefore more shop-friendly than a system that requires its own stand, and therefore more likely to be placed in more locations within an industrial facility. Thus improves the overall efficacy of providing emergency washing to contaminated users.

Yet another aspect of a low flow emergency system according to some embodiments of the present invention is to provide tepid water by means of a thermostatically controlled cartridge valve that is adapted and configured to shut off the flow of how water if there is a failure of the thermostat. It has been found that an emergency washing system adapted and configured to provide a low flow rate of tepid water can be susceptible to variations as to overall low delivery pressures, as well as relative differences in pressure between the hot and cold inlets. It has been found that utilizing a thermostatically controlled valve assembly adapted and configured to provide a positive shut off in the event of a thermostat failure also provides improved operation of a low flow system.

What is needed are improvements that address one or more of the aforementioned problems. Various embodiments of the present invention provides such novel and nonobvious solutions.

SUMMARY OF THE INVENTION

Various embodiments of the present invention pertain to improvements in residential and emergency washing systems.

Still further descriptions of various embodiments of the present invention can be found in the paragraphs X1 through Xn (and including the paragraphs that modify these paragraphs X1 through Xn) located toward the end of the specification.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

DESCRIPTION OF THE DRAWINGS

Some of the figures shown herein may include dimensions. Further, some of the figures shown herein may have been created from scaled drawings or from photographs that are scalable. It is understood that such dimensions, or the relative scaling within a figure, are by way of example, and not to be construed as limiting.

ELEMENT NUMBERING

Figure 1:
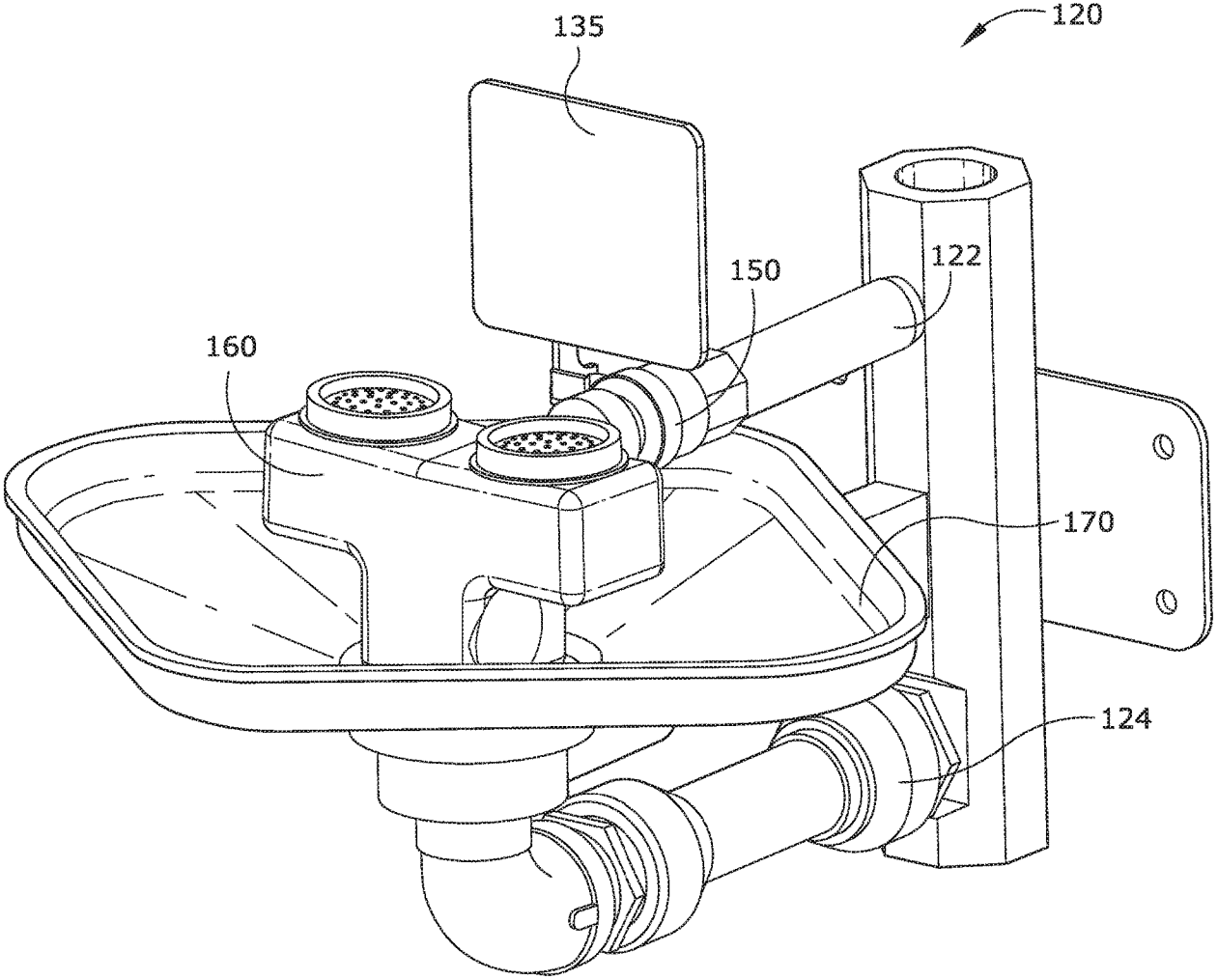
FIG. 1 is a right side, top perspective view of an emergency eye wash according to one embodiment of the present invention.
Figure 2:
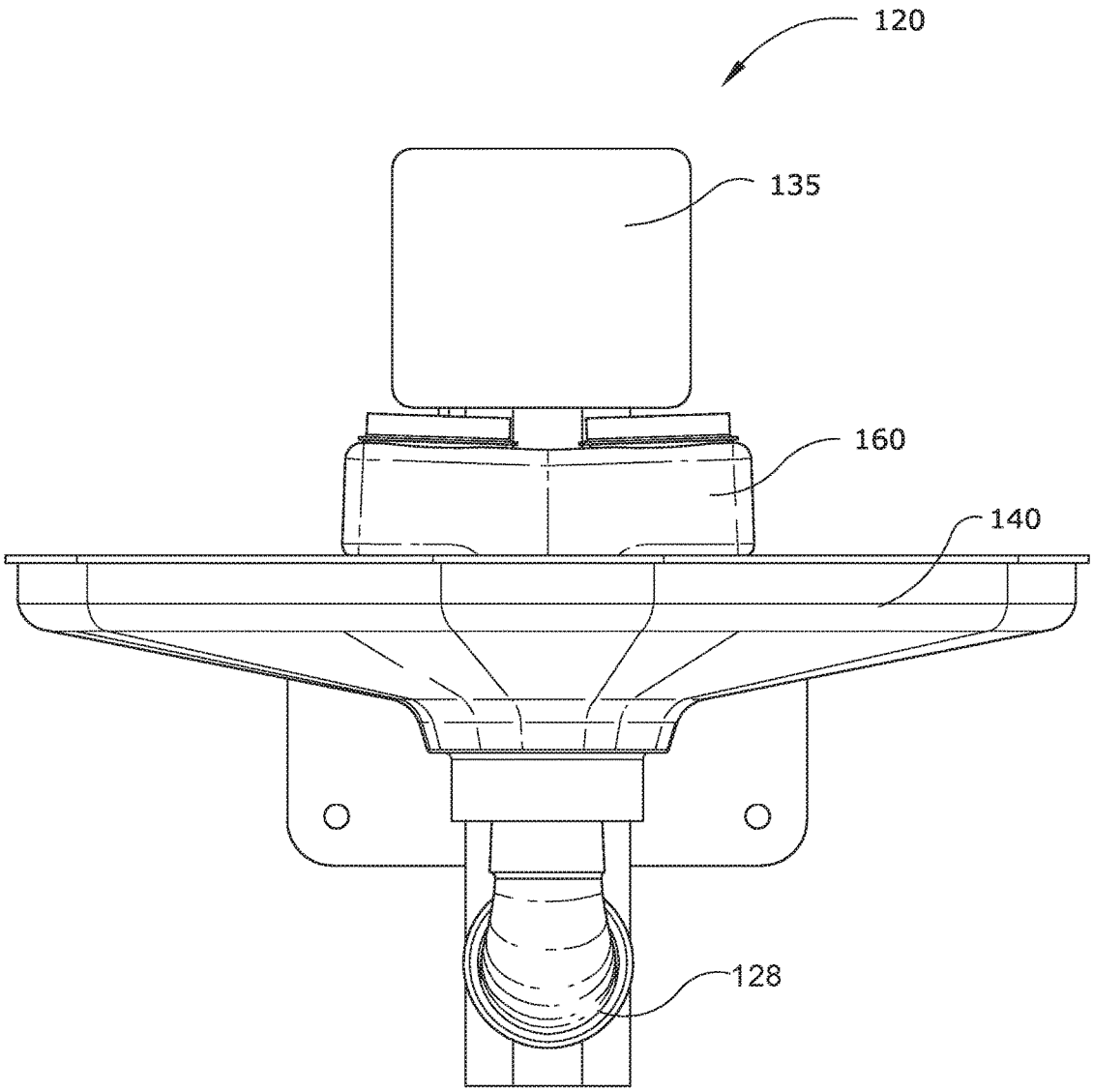
FIG. 2 is a front elevational view of the apparatus of FIG. 1.

The following is a list of element numbers and at least one noun used to describe that element. It is understood that none of the embodiments disclosed herein are limited to these nouns, and these element numbers can further include other words that would be understood by a person of ordinary skill reading and reviewing this disclosure in its entirety.

| | |
|---|---|
| 10 | System |
| 11 | cart |
| 12 | deck |
| 13 | legs |
| 14 | wheels |
| 15 | lid |
| 20 | eye wash system |
| 21 | dispensing caps; spray nozzle assembly |
| a | apertures |
| b | smaller apertures |
| c | larger apertures |
| d | aerated faucet |
| 22 | water tank/cold water |
| 23 | quick connect fitting |
| 24 | hot source |
| 25 | support arm |
| b | support arm aperture |
| 26 | stand |
| 28 | drain |
| .1 | water return port |
| 29 | catch basin |
| 30 | thermostatically controlled valve |
| 31 | cold inlet |
| 32 | tempered fluid outlet; water supply to shutoff valve |
| b | tempered fluid outlet to shower |
| 33 | hot inlet |
| 34 | body; housing |
| a | first water compartment |
| b | second water compartment |
| 35 | panel |
| 36 | cartridge |
| a | first cartridge body |
| b | second cartridge body |
| c | thermostat |
| d | shuttle valve |
| e | spring |
| f | hot inlet |
| g | cold inlet |
| h | mixing chamber |
| i | mixed flow outlet |
| 37 | mixing outlets |
| 38 | metering section/flow restrictor |
| 39 | check valve |
| 40 | diffusing heat exchanger; accumulator |
| 41 | inlet |
| 42 | outlet |
| 43 | serpentine passage |
| 44 | apertures |
| 45 | 3-way valve assy. |
| 45a | lever |
| 45b | inlet |
| 45c | outlet |
| 45d | outlet |
| 46 | flush tube; flushing housing |
| .1 | supply equipment flush line; fluid conduit |
| .2 | system flush line |
| .3 | system flush line |
| .4 | coupling member |
| .5 | set screw |
| 47 | tee fitting |
| 50 | shut-off valve |
| 51 | quick connect |
| 52 | paddle shut-off |
| 53 | purge line |
| 56 | drain; adjustable drain |
| 57 | pressure modifying valve |
| .1 | pressure regulating valve |
| .2 | pressure reducing valve |
| .3 | pressure balancing valve |
| H | hot water |
| C | cold water |
| .4 | pressure communication line |
| a | groove |

-continued

| | |
|---|---|
| 58 | expulsion valve |
| a | inlet |
| b | outlet |
| c | flapper |
| d | spring |
| e | pushbutton |
| 60 | outlet valve; emergency eyewash housing; emergency eyewash assembly |
| 61 | body |
| a | indexing |
| 62 | internal flow passage |
| b | lateral internal chamber |
| c | central internal flow chamber |
| 63 | water inlet |
| a | secondary outlet |
| 64 | eyewash outlets |
| 64a | filters |
| 65 | internal connection |
| 66 | variable orifice valve; flow regulator; Neoperl ® flow control valve |
| a | fixed member |
| b | flexible member |
| 67 | interface |
| 68 | outlet |
| 69 | seal |
| 70 | return wash basin |
| 71 | indexing feature |
| 72 | drain; variable drain; fixed drain |
| 73 | attachment feature |
| 74 | tactile features |
| 75 | lip |
| 80 | shower head assembly |
| 80.1 | shutoff valve |
| 80.2 | actuating handle |
| 81 | inlet |
| 82 | bowl |
| 83 | depressions |
| 84 | dispersing member |
| 85 | stand offs |
| a | peripheral |
| b | central |
| 86 | central deflector |
| a | aligned aperture |
| b | central attachment |
| 87 | apertures |
| a | aligned aperture |
| 88 | ridges |
| 90 | heater |
| 90C | cold inlet |
| 91 | source of electricity |
| 92 | shock mounts |
| 94 | heat exchanger |
| 96 | thermal switch |
| 98 | visual indicator |
| a | light |
| b | battery |
| c | sensor, water or position |
| d | light emitting material |
| 99 | Thermometer |
| VCL | vertical center line |
| LCL | lateral center line |

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention.

It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "preferably," refers to features and aspects that are present in at least one embodiment, but which are optional for some embodiments.

The use of an N-series prefix for an element number (NXX.XX) refers to an element that is the same as the non-prefixed element (XX.XX), except as shown and described. As an example, an element 1020.1 would be the same as element 20.1, except for those different features of element 1020.1 shown and described. Further, common elements and common features of related elements may be drawn in the same manner in different figures, and/or use the same symbology in different figures. As such, it is not necessary to describe the features of 1020.1 and 20.1 that are the same, since these common features are apparent to a person of ordinary skill in the related field of technology. Further, it is understood that the features 1020.1 and 20.1 may be backward compatible, such that a feature (NXX.XX) may include features compatible with other various embodiments (MXX.XX), as would be understood by those of ordinary skill in the art. This description convention also applies to the use of prime (′), double prime (″), and triple prime (‴) suffixed element numbers. Therefore, it is not necessary to describe the features of 20.1, 20.1′, 20.1″, and 20.1‴ that are the same, since these common features are apparent to persons of ordinary skill in the related field of technology.

Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise explicitly noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

Various references may be made to one or more processes, algorithms, operational methods, or logic, accompanied by a diagram showing such organized in a particular sequence. It is understood that the order of such a sequence is by example only, and is not intended to be limiting on any embodiment of the invention.

Various references may be made to one or more methods of manufacturing. It is understood that these are by way of example only, and various embodiments of the invention can be fabricated in a wide variety of ways, such as by casting, centering, welding, electro-discharge machining, milling, as examples. Further, various other embodiment may be fabricated by any of the various additive manufacturing methods, some of which are referred to 3-D printing.

This document may use different words to describe the same element number, or to refer to an element number in a specific family of features (NXX.XX). It is understood that such multiple usage is not intended to provide a redefinition of any language herein. It is understood that such words demonstrate that the particular feature can be considered in various linguistical ways, such ways not necessarily being additive or exclusive.

Reference will be made to an eyewash system and various components of the system. It is understood that the system and various components are further compatible with face wash and body wash systems and components.

Some embodiments of the present invention pertain to eyewash systems that include thermostatically controlled valves with positive shut-off of the hot water inlet if there are certain failures of the valve. Further explanation of this operation will be provided later in this text. Still further support for a thermostatically controlled valve having a failure mode that results in a positive shut-off of hot water can be found in U.S. Pat. No. 8,544,760, titled MIXING VALVE, incorporated herein by reference to the extent necessary to provide support for any claims.

Some embodiments of the present invention pertain to methods and apparatus for providing a proper flushing of the plumbing of a building that provides water to an emergency washing system. In some embodiments, the emergency washing system includes a shut off valve receiving water from the building plumbing, the shut off valve including any style of quick-connect, water-tight fittings. The shut off valve provides water through the quick connection fitting to an emergency eye wash housing. The inlet of the eye wash housing includes a second quick-connecting, water-tight inlet that readily and easily connects to the outlet of the shut off valve. The eyewash housing further includes a flow control valve that permits the passage of water at a substantially constant flow rate, even as the source system pressure varies over a range of supply pressures. The washing system further includes a plurality of upwardly-directed spray nozzles that receive the constant flow rate water and spray the water upwards in a pattern that preferably complies with both governmental standards and industry best practices to provide water onto the eyes of a user looking down at the spray nozzles.

The embodiment preferably further includes a flush housing that can be substituted for the eyewash housing. Whereas the eyewash housing includes a flow control valve, the flush housing provides a flowpath from inlet to outlet that is substantially unobstructed to the flow of water, although it is recognized that the flowpath may include changes in cross sectional flow area, changes in flow coefficient, and the like. The flush housing also includes a quick-connecting feature at the inlet that is compatible with the quick connection feature at the outlet of the shut off valve. In some embodiments, the connection feature of the flush housing is identical to the connection feature of the eyewash housing, whereas in other embodiments the connection of the flush housing includes minor differences, and may not be a water-tight connection.

This embodiment of the emergency washing system can operate in two modes. In a first, washing mode the eyewash housing is connected to the shut off valve, and when the shut off valve is open, provides a substantially constant flow of water to the spray nozzles. In a second, flushing mode the eyewash housing is removed and replaced with the flush housing. The flush housing includes an outlet that permits drainage of water (when the shut off valve is open) from the building plumbing at a flow rate that is substantially higher than the constant flow rate permitted by the flow control valve. In some embodiments, the flushing flow rate is at least five times the rate of the constant flow rate. In yet other embodiments the flushing flow rate is at least twice the constant flow rate.

Still further embodiments of the present invention pertain to other methods of flushing the plumbing system providing water to an emergency washing system. In a method according to one embodiment, there is an eyewash housing having an inlet with a quick connection feature, and a flow control valve that provides a substantially constant exit flow rate of water over a range of inlet pressures. Water from the flow control valve is provided to a plurality of spray nozzles mounted to the eyewash housing. Preferably, the spray nozzles can be quickly and easily removed from the housing, and preferably without the need for many different tools. In some embodiments, the spray nozzles are elastomeric caps that are stretched to cover an outlet of the eyewash housing, or nozzle members threadably coupled to the eyewash housing, nozzle disks that can be slid into a receiving groove on the eyewash housing, or the like. In this method, the washing system can be operated in a washing mode (substantially as described above), or in flushing mode, the latter expelling water at a substantially higher flowrate than the constant rate. To achieve the flushing mode, the method includes removing the flow control valve and filters, removing the readily removable spray nozzles, and orienting the eyewash housing so that the outlets point downward, preferably toward a basin or drain.

In yet another embodiment of the present invention, there is a method for flushing the water in a plumbing system in fluid communication with an emergency wash system that includes the use of a kit of parts. The kit includes a pair of substantially identical emergency eyewash housings. Each housing includes a quick-connecting feature at the inlet. Each housing preferably includes an outlet adapted and configured to support a spray nozzle. One of the identical housings includes a flow control valve that provides a substantially constant flow rate of water toward the outlet, and at least on spray nozzle member placed over the housing outlet so as to force water through a plurality of apertures in the spray nozzle member.

This method of operation includes installing the first eyewash housing (with the flow control valve) into an eye washing system, and using the system in a washing mode when a user desires to be washed. The system is operated in a flushing mode by removing the first eyewash housing from the washing system, and substituting the second eyewash housing (without the flow control valve). Preferably, the second eyewash housing is oriented downward toward a basin or drain.

Still other embodiments of the present invention pertain to a low flow emergency eye washing system. Preferably, some embodiments include an electric water and a thermostatically controlled mixing assembly, both of which receive water from a source of pressurized water. The mixing assembly further receives heated water from the electric heater. The mixing assembly comprises a body adapted and configured to receive a cartridge valve. The cartridge valve includes a thermostat that controls the position of a movable valve member so as to provide controlled mixing of the hot water and source water. The cartridge valve is adapted and configured such that the movable valve member is biased by a spring to shut off the supply of water from the water heater in the event of the failure of the thermostat.

The water mixed by the cartridge valve Flows from an outlet of the mixing assembly to a flow control valve that is adapted and configured to provide a constant outlet flow, even as the water pressure of the source varies over a range. In some embodiments, the flow control valve operates to limit the outlet flow to less than about two gallons per minute. In yet other embodiments, the constant flow is less than about one and a half gallons per minute.

The controlled, constant flow of mixed water is provided to the inlet of an emergency eyewash assembly. The assembly flowpath incudes an internal chamber that receives water from the inlet, the internal chamber having a cross sectional flow area that is substantially larger than the cross sectional flow area of the inlet. Because of this large increase in area, there is a subsequent substantial decrease in the velocity of the water as it flows into the chamber. The exit of the flow chamber has a cross sectional flow area that is preferably about the same as the cross sectional area of the internal chamber. Therefore, water flowing from the inlet into the chamber is provided uniformly and in parallel to a plurality of spray nozzles present at the outlet. The spray nozzle includes a plurality of small apertures, each aperture being supplied with mixed water at substantially the same pressure as each other aperture.

In yet other embodiments the eyewash assembly includes a single inlet that provides water to a pair of large, laterally placed internal chambers simultaneously. Each of the internal chambers has substantially the same cross sectional flow area and flow characteristics. Each of the chambers receives mixed water through the inlet at a first, relatively high velocity. Because of the large increase in flow area along the internal flowpath, this mixed water incurs a substantial decrease in velocity within the chamber. Each chamber terminates in a corresponding outlet that provides mixed water in parallel to each of a plurality of small spray apertures. In some embodiments, the internal chambers are sized so as to promote laminar flow within the chamber.

Yet another aspect of a low flow emergency system according to some embodiments of the present invention is to provide tepid water by means of a thermostatically controlled cartridge valve that is adapted and configured to shut off the flow of how water if there is a failure of the thermostat. It has been found that an emergency washing system adapted and configured to provide a low flow rate of tepid water can be susceptible to variations as to overall low delivery pressures, as well as relative differences in pressure between the hot and cold inlets. It has been found that utilizing a thermostatically controlled valve assembly adapted and configured to provide a positive shut off in the event of a thermostat failure also provides improved operation of a low flow system.

Yet another embodiment of the present invention pertains to an emergency washing system in which there is a thermostatically controlled mixing valve that not only provides controlled mixing of hot and cold water flows, but further provides structural support to a catch basin. In one embodiment, the emergency washing system includes an eyewash housing that includes a plurality of upwardly-directed spray nozzles, and a catch basin located beneath the spray nozzles. Tepid water from the mixing valve exits the spray nozzles in a gentle upward pattern, and the water falls back under the influence of gravity onto the catch basin, where the water is collected in a draining aperture. Tempered water for the eyewash housing and spray nozzles is provided from a thermostatically controlled mixing valve. The valve includes a body (preferably but not necessarily a casting) that has two separate and distinct water compartments. Preferably the water compartments are placed vertically, with a first compartment located directly above a second compartment. Located between the two water compartments is a structural portion of the valve body that defines a support aperture.

The first water compartment is pressurized with water that is substantially at the pressure at the water source. The body includes an inlet for hot water and an inlet for cold water. These inlets provide water to a thermostatic cartridge valve, which provides for controlled mixing of the two flows of water to achieve a tepid-temperature mixed water. This mixed water is provided from the outlet of the first water compartment to the eyewash housing.

The second water compartment is substantially at atmospheric pressure. The second water compartment includes an inlet that receives water collected in the drain of the catch basin. This second water compartment further includes an outlet for directing this drain water to water return of the plumbing system, which is typically in fluid communication with a municipal sewer system.

The central support structure of the mixing valve body includes a support aperture. One end of a readily separable support arm is received within this aperture. The other end of the support arm is coupled to the catch basin. Any force applied to the catch basin can be transmitted through the support arm into the structure of the body surrounding the support aperture. Mixing valves constructed in this three part matter (top water compartment, middle basin support structure, and bottom water compartment) efficiently provides for multiple attachment of a plurality of connections onto a single structure, thus providing an emergency washing system that is quick, efficient, and cheap to construct and install, and which makes more efficient use of the inherent strength in the walls of a valve body. In some embodiments, the body includes three water inlets (hot water, cold water, and drained water), two fluid outlets (mixed water and return water), and structural support of the catch basin with a strength that is in excess of the strength attainable in currently existing eyewash systems.

Eyewash 120 includes a valve block 160 provided with water from an inlet 122, and providing a spray of water through a pair of eyepieces 121 to a person needing an emergency eyewash. Apparatus 120 can be attached to a wall by a support bracket 126, which can be coupled to an attachment plate 124 attached to the wall. Water flowing out of block 160 is captured in a bowl 170 that provides the water to and outlet drain 124.

Figure 3:
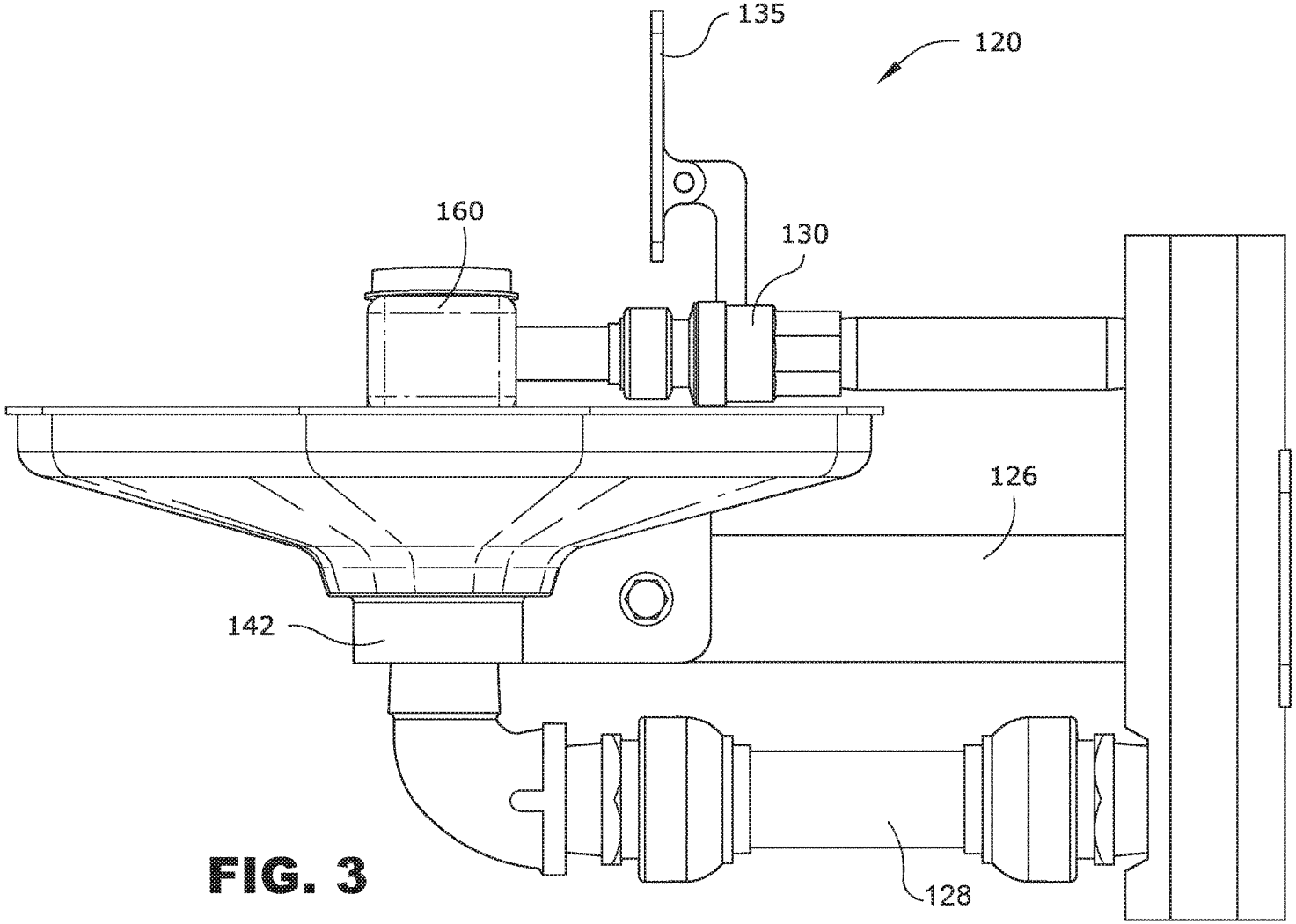
FIG. 3 is a side elevational view of the apparatus of FIG. 1.

Eyewash 120 includes a shutoff valve 160 that must be actuated by the user before water will exit from eyepieces 121. As best seen in FIG. 3, shutoff valve 150 is placed in the central inlet line 122, and in some embodiments is a ball-type valve. The ball can be rotated so as to begin the flow of water by the user pushing forward on centrally located paddle 152. Panel 152 is connected by an arm of 135 to the axis of ball valve 150. Preferably, panel 152 is centrally located relative to eyepieces 121, so that persons that are left-handed can use eyewash 120 as easily as persons that are right-handed.

It has been found that other emergency eyewash typically have a mechanism on the right side of the eyewash that must be operated in order to achieve the washing flow. With such eyewash is, a person that is left-handed is largely put at a disadvantage, and may waste time trying to locate the right-handed mechanism. Further, panel 152 is up right and prominent, making it easy to see. In some embodiments, panel 152 includes a large, substantially flat surface upon which warning labels and instructional labels can be applied.

Figure 4:
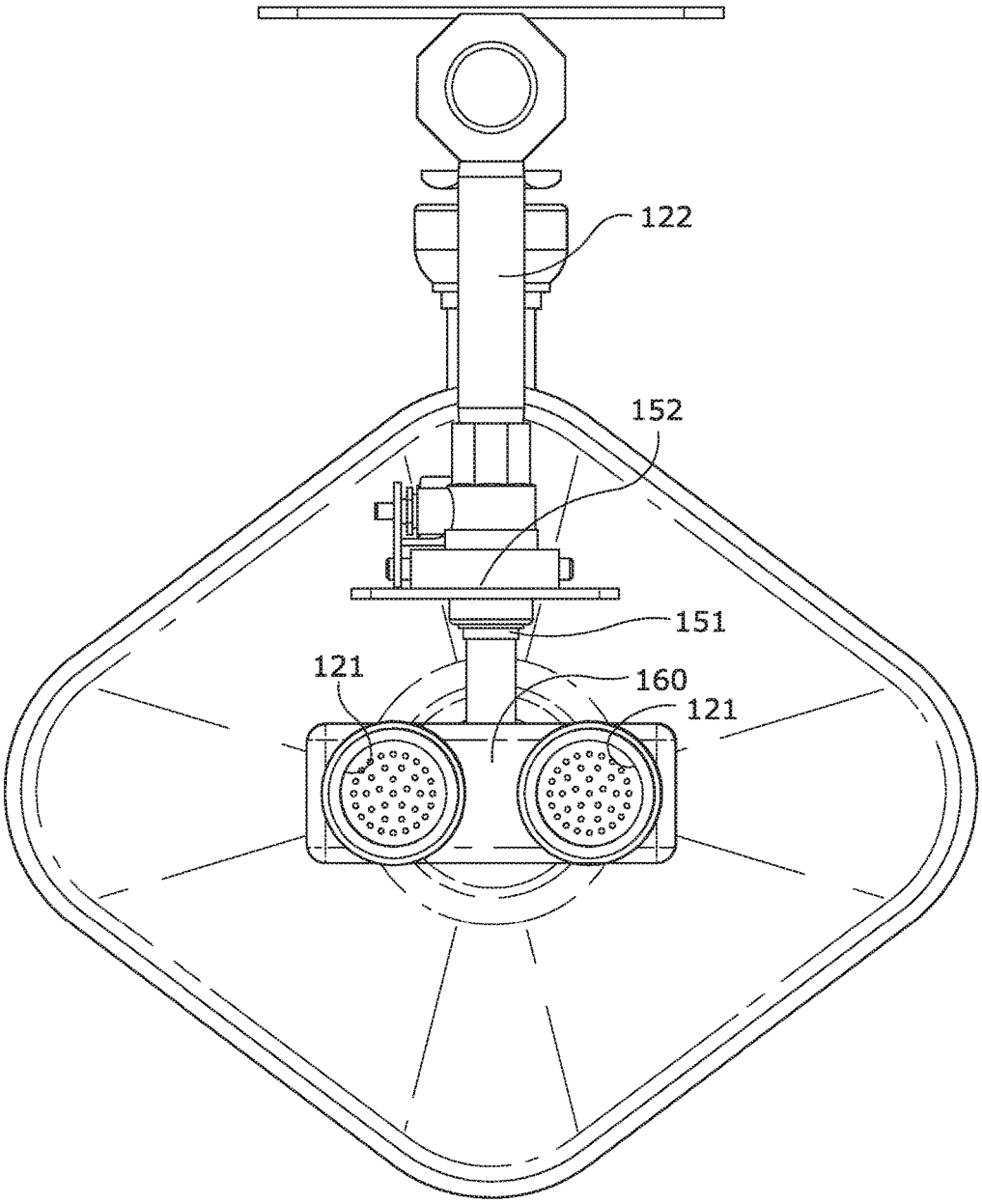
FIG. 4 is a top plan view of the apparatus of FIG. 1.
Figure 5:
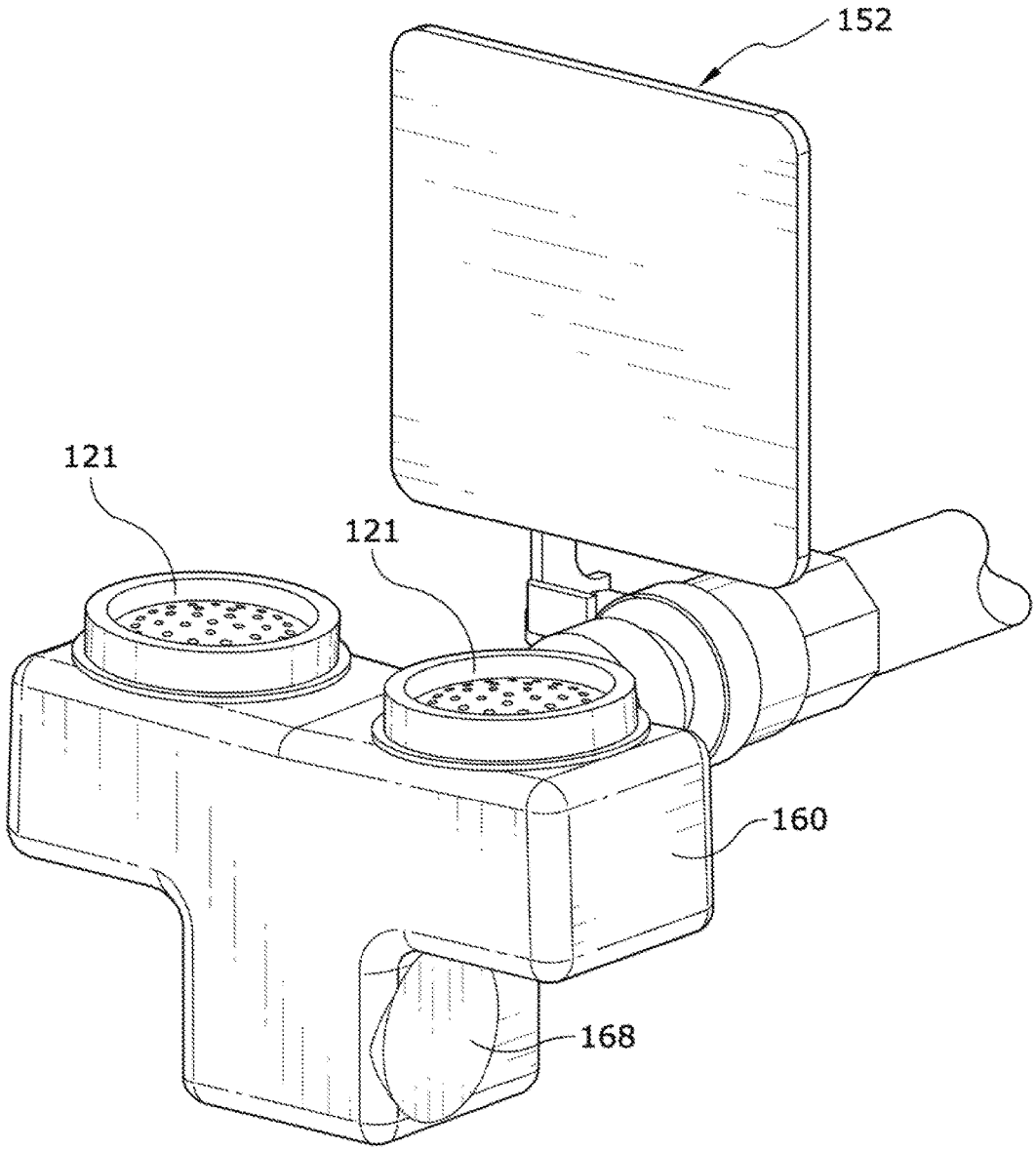
FIG. 5 is a right side perspective view of a portion of the apparatus of FIG. 1.
Figure 6:
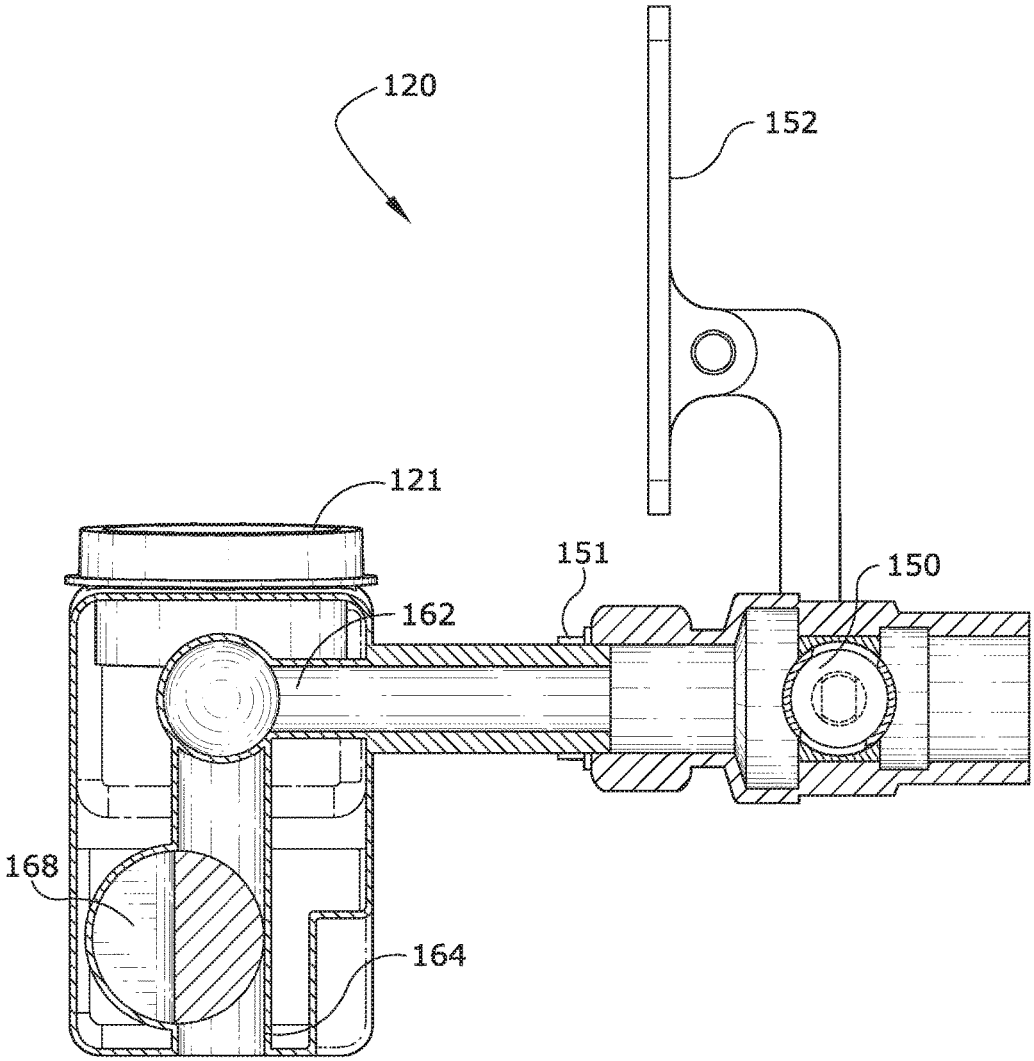
FIG. 6 is a right side cross-sectional view of the apparatus of FIG. 5, shown in solid.
Figure 7:
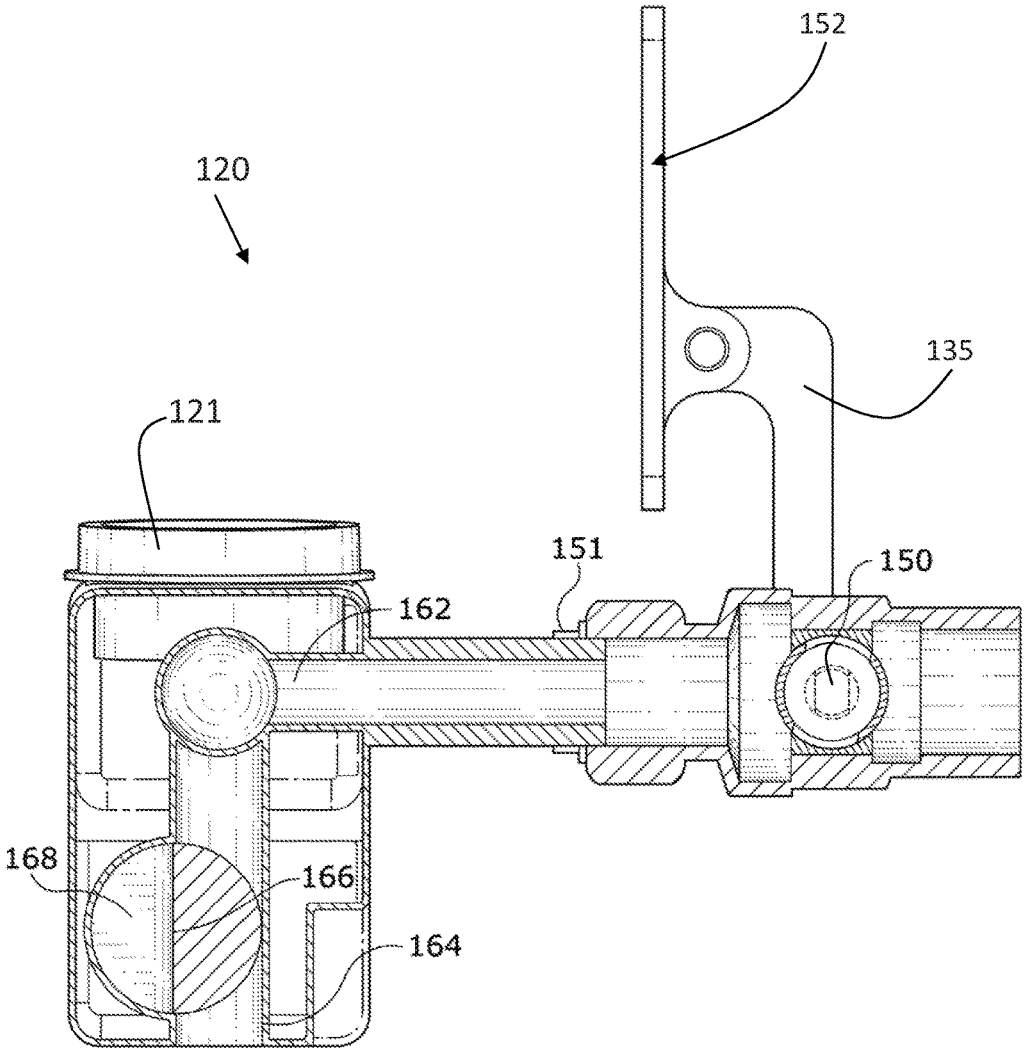
FIG. 7 is a right side cross sectional view of the apparatus of FIG. 5, shown in cross sectional view.
Figure 8:
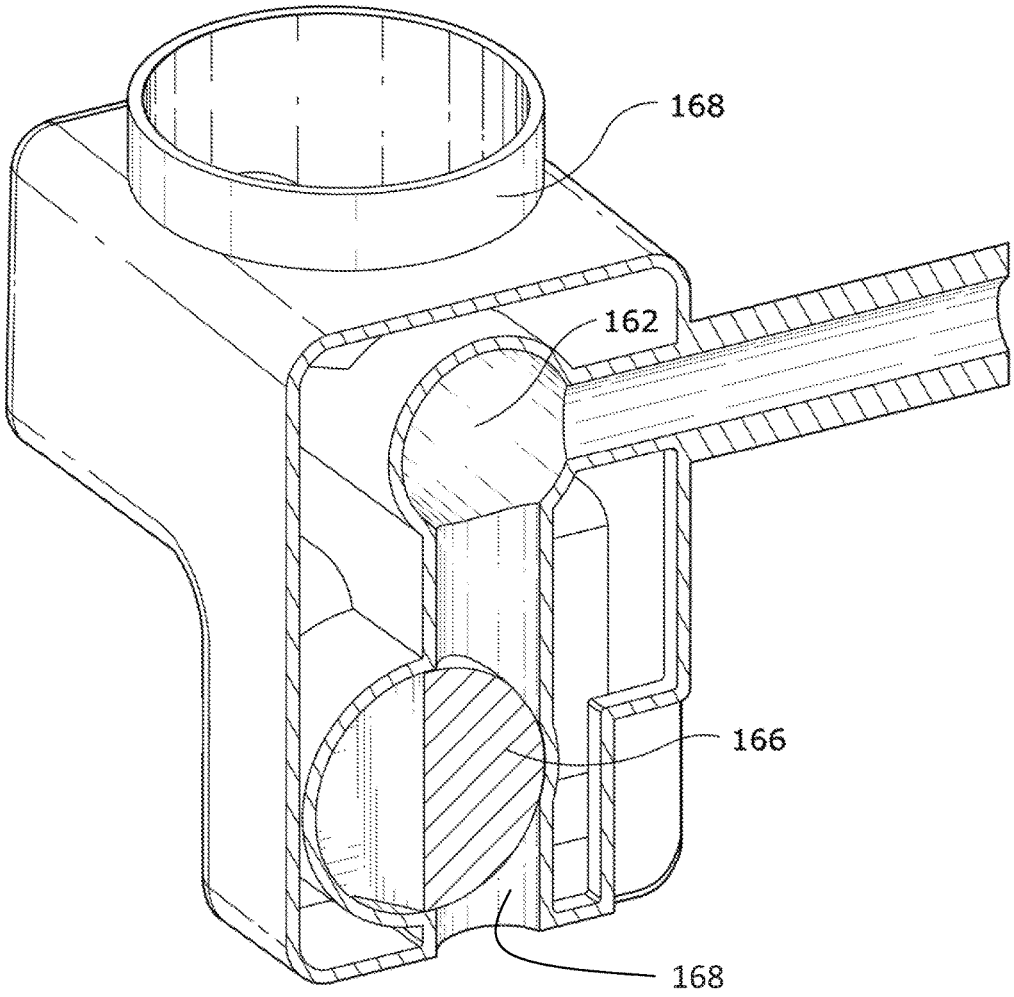
FIG. 8 is a right, top, perspective cutaway of the apparatus of FIG. 7.

Referring to FIG. 4, head block 160 connects to shutoff valve 150 by way of a 2 and quick-release seal 169. In some embodiments, seal 169 includes a plurality of "shark teeth"

that can provide a quickly-made seal between the inlet pipe of head block 160 and the outlet of shutoff valve.

In some embodiments head block 160 includes right and left hinged panels by which the user can quickly disconnect head block 160 from eyewash 120. The person can place their fingers on the panels, and rotate the paddles such that the distal ends of the paddles press against the face of seal 160. In so doing, the user can easily remove head block 160 by simply pulling it toward them while the seals are compressed. Preferably, head block 160 is not mechanically linked to the drain of bowl 170, such that the connection between the inlet pipe of the head block and the outlet of the shutoff valve is the only connection that needs to be made.

FIGS. 5, 6, 7, and 8 show various details of head block 160 and shutoff valve 150. It can be seen that head block 160 includes an inlet passage 162 that provides water from shutoff valve 130 to a central manifold 164. Manifold 164 extends both right and left toward eyepieces 120, and further extends downward toward a cavity 168.

In some embodiments, cavity 168 includes material for conditioning the water that is sprayed out of eyepieces 121. This material can be a filter material, activated charcoal, and astringent, or other apparatus useful to protect and wash eyes that have been exposed to a damaging chemical. Further, this protective material can be easily removed from head block 160, which is useful for those protective materials that lose their beneficial qualities after a period of time.

Figure 9:
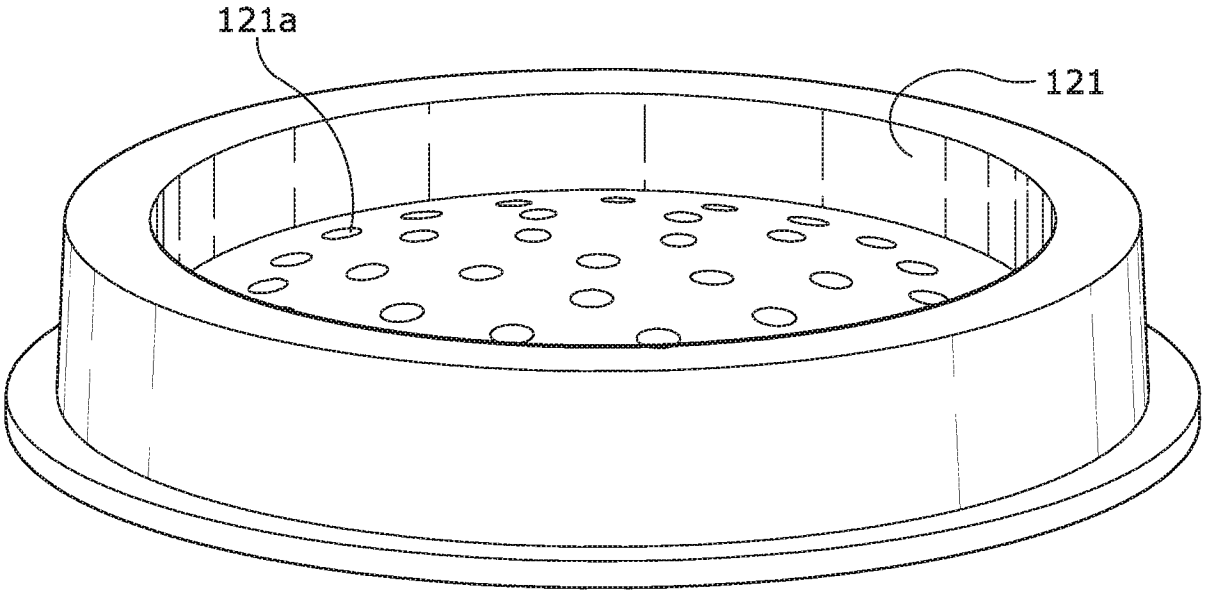
FIG. 9 is a top, perspective view of an eyepiece according to one embodiment of the present invention.

FIG. 9 shows a close-up of an eyepiece 121. Eyepiece 120 includes a plurality of spray holes, some of which are located in an outermost ring 121*a*, others of which are located in a middle ring 121*b*, and yet others that are centrally located. Eyepiece 120 further includes a sealing lip 121*e* that provides for easy installation and removal of eyepiece 120. Preferably, eyepiece 120 is fabricated from a flexible material that a person can easily manipulate to break off scale deposits.

Figure 10A:
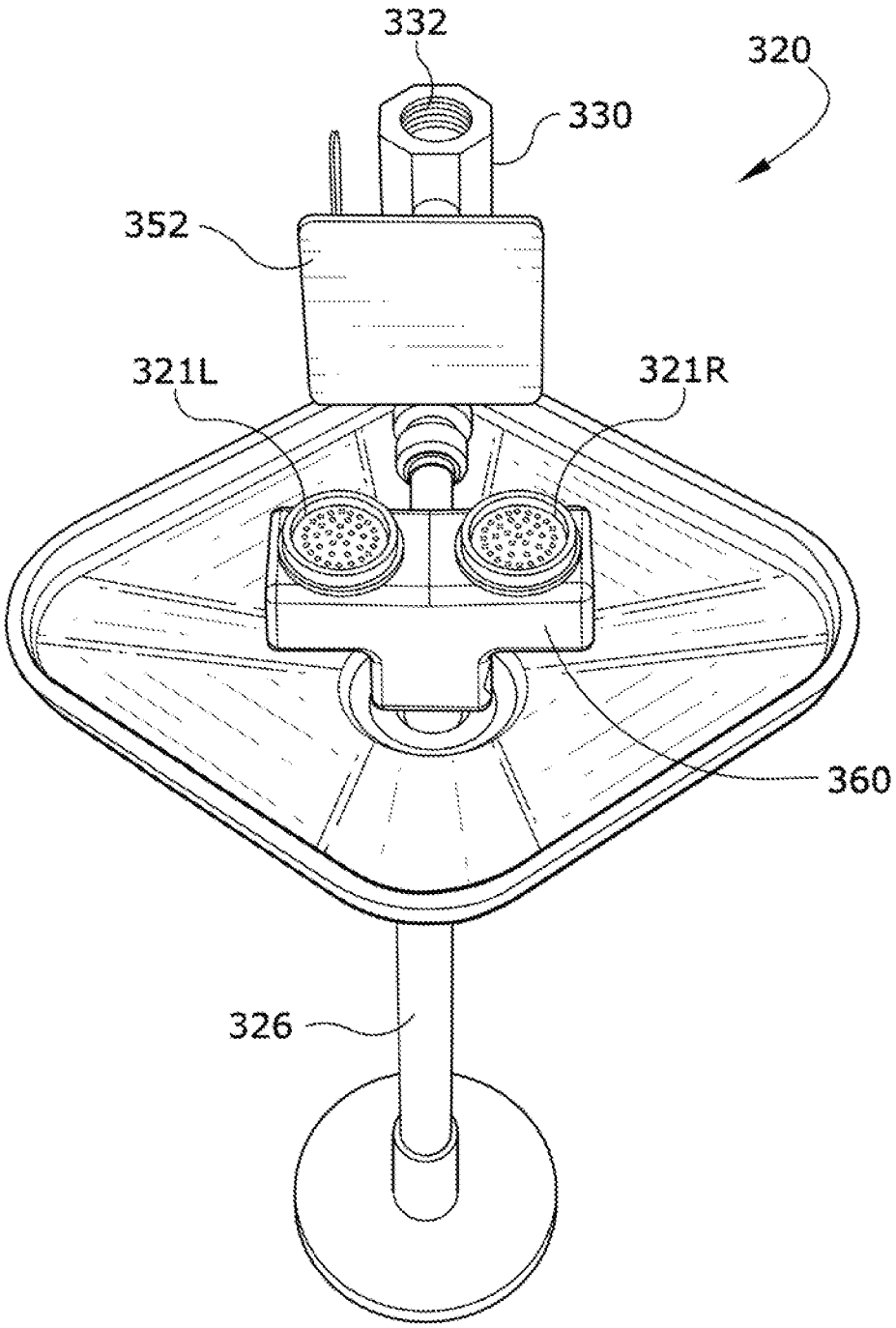
FIG. 10A is a front, top, perspective drawing from a photographic representation of an apparatus according to one embodiment of the present invention.
Figure 10B:
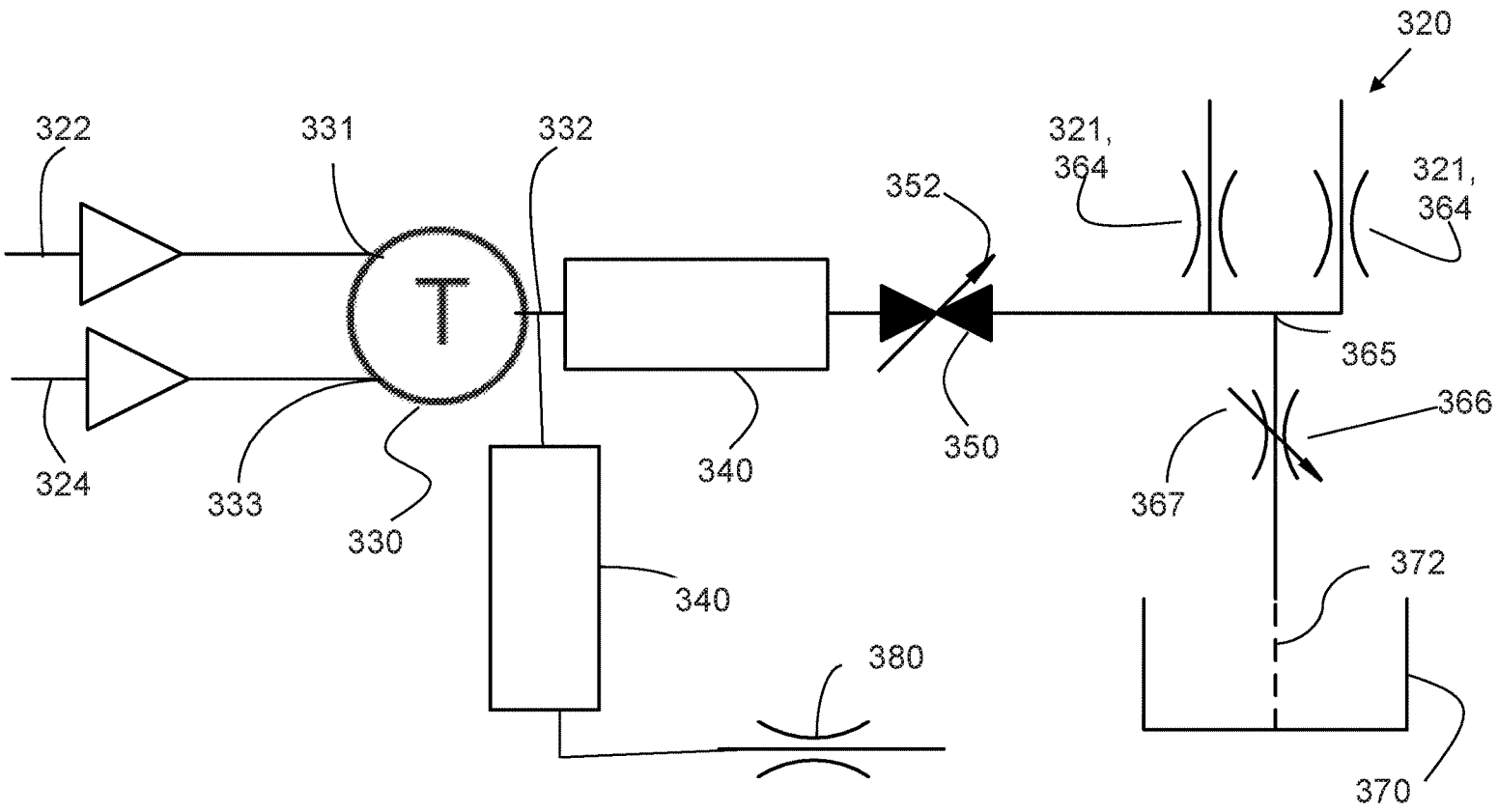
FIG. 10B is a symbolic schematic representation of the flow system of the apparatus of FIG. 10A.
Figure 10C:
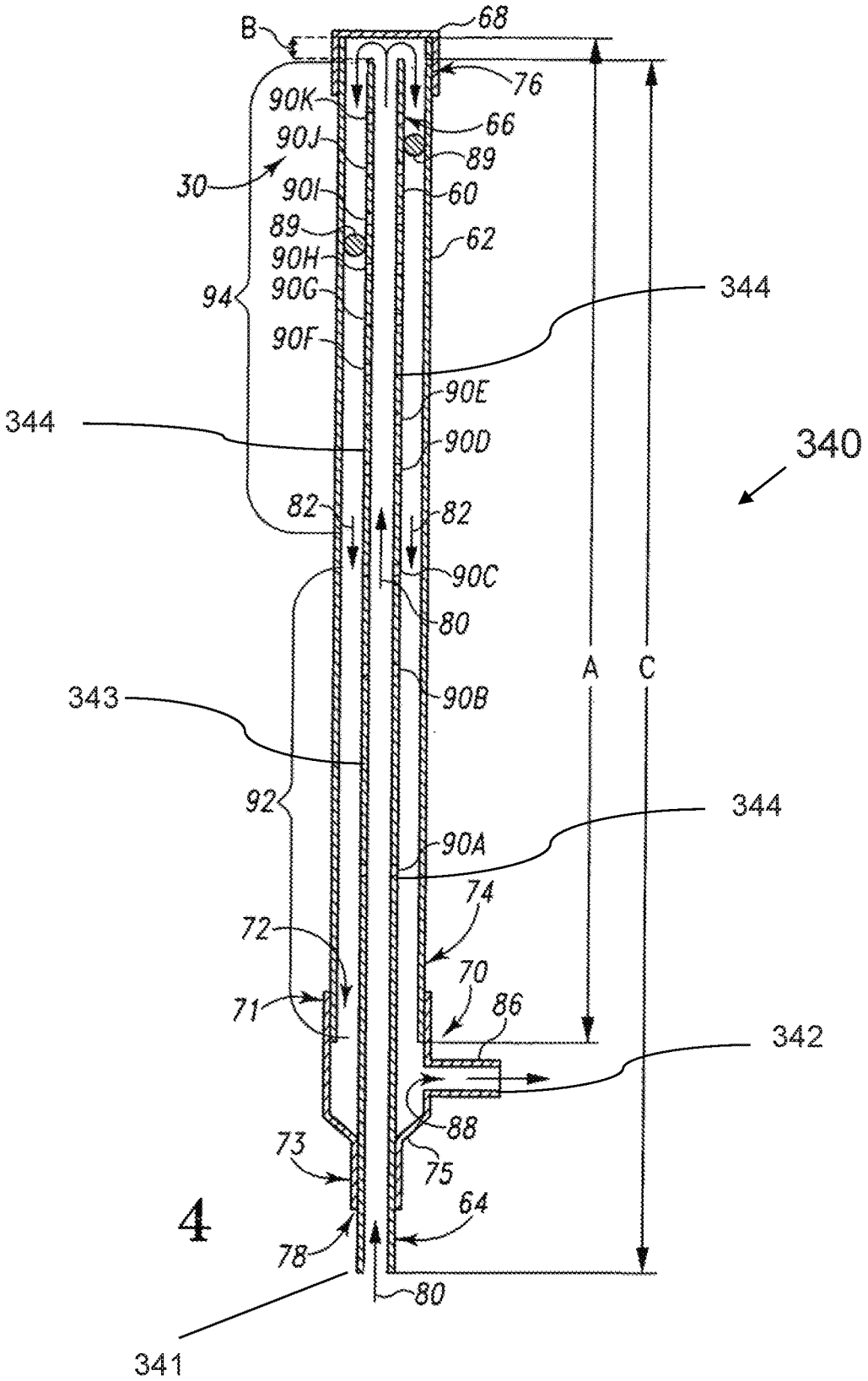
FIG. 10C is a cutaway side view of an accumulator (diffuser) according to one embodiment of the present invention.
Figure 11:
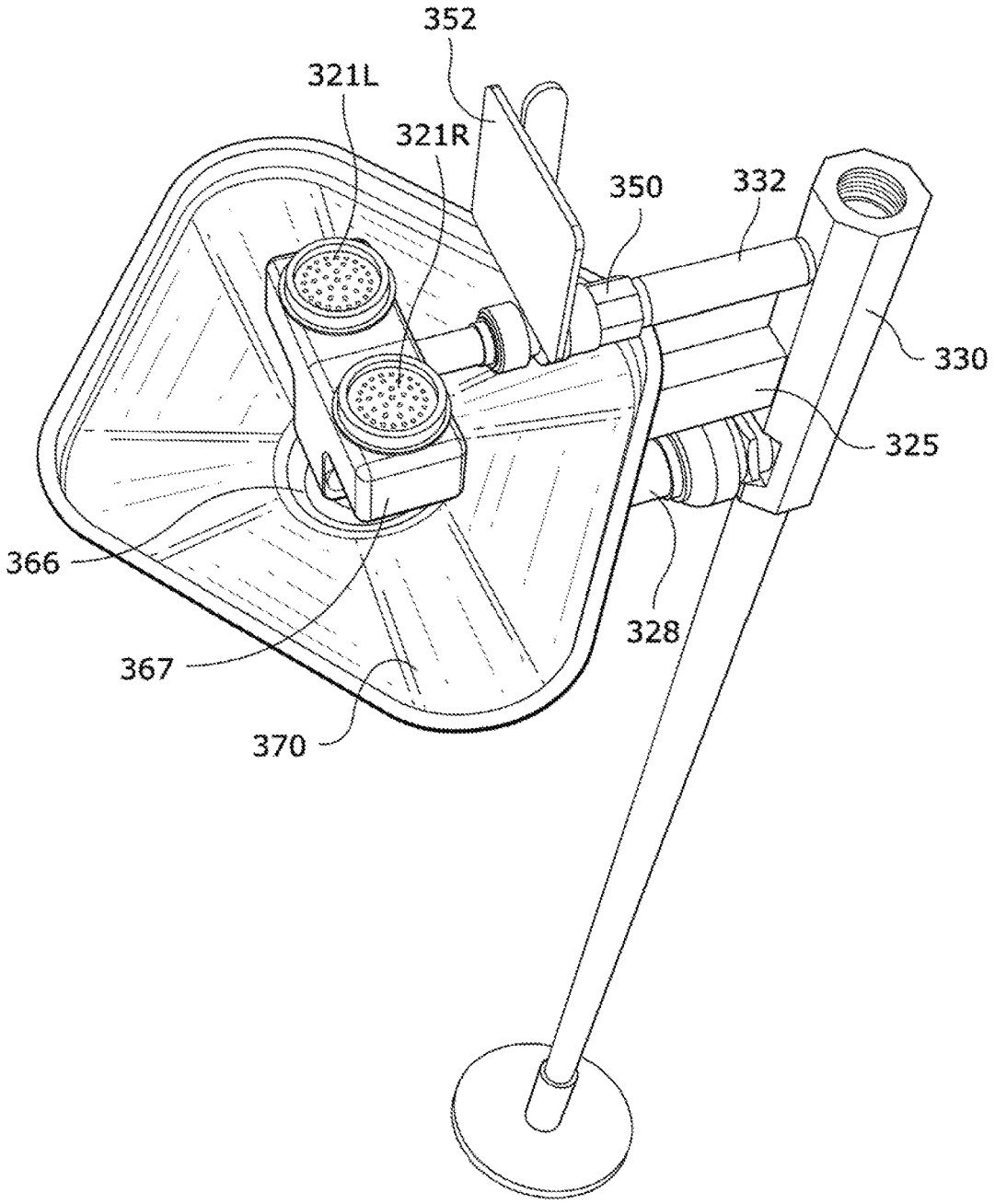
FIG. 11 is a top and side perspective drawing from a photographic representation of the apparatus of FIG. 10A.

FIGS. 10 and 11 show various views of an emergency wash 320 according to one embodiment of the present invention. Emergency wash system 320 includes a thermostatically controlled valve 330 that provides tempered water to a pair of eyewash dispensing caps 321, and in some embodiments, further provides tempered water through a top outlet 332 to a showerhead assembly 380.

Figure 12:
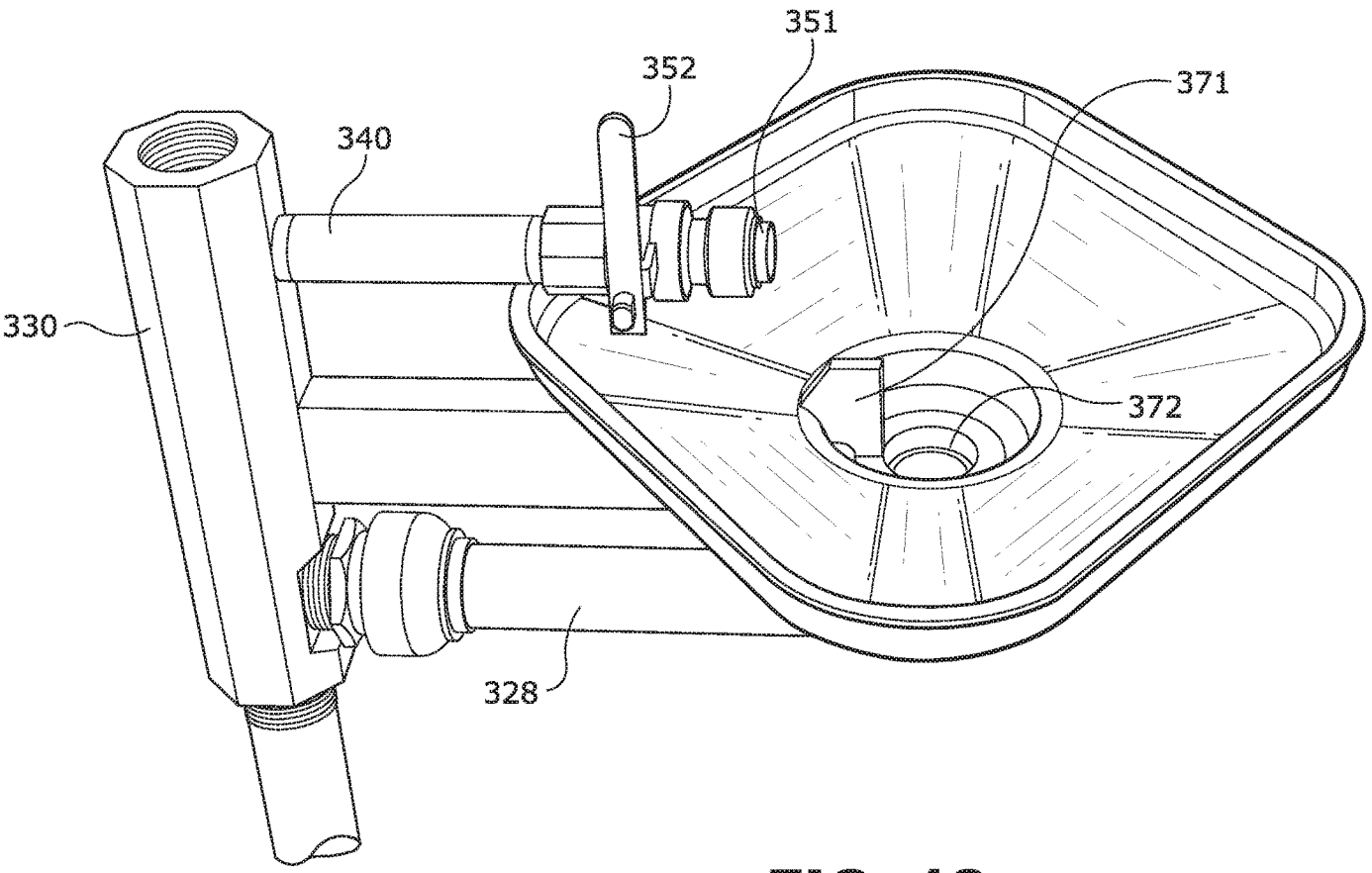
FIG. 12 is a left side, top perspective drawing from a photographic representation of the apparatus of FIG. 10A.

Control valve 330 (and other portions of wash assembly 320) is supported from the floor by a stand 326. Preferably stand 326 and system 320 are adapted and configured such that dispensing caps 321 are located at a height that is wheelchair accessible. Further, as best seen in FIGS. 11 and 12, the return line 328 from basin 370 extends rearward so as to provide a clear volume underneath return line 328 to accommodate the front of the wheelchair.

Water is provided to control valve 330 from a source 322 of cold fluid and a source 324 of hot fluid. In some embodiments, hot source 324 receives water from the outlet of a water heater (not shown). In some embodiments, water from one or both of the sources 322 and 324 flows through a flow restrictor that provides generally constant flow, such as the variable restrictors sold by Neoperl.

Figure 13B:
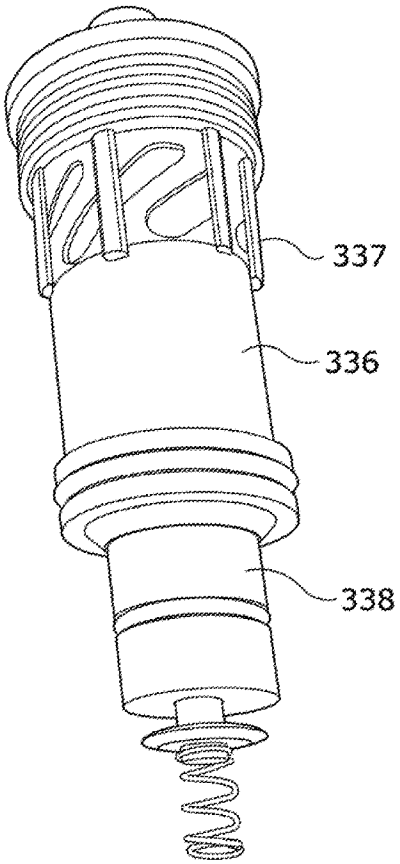
FIG. 13 is a drawing from a photographic representation of a thermostatic control valve from the apparatus of FIG. 10A.
Figure 13A:
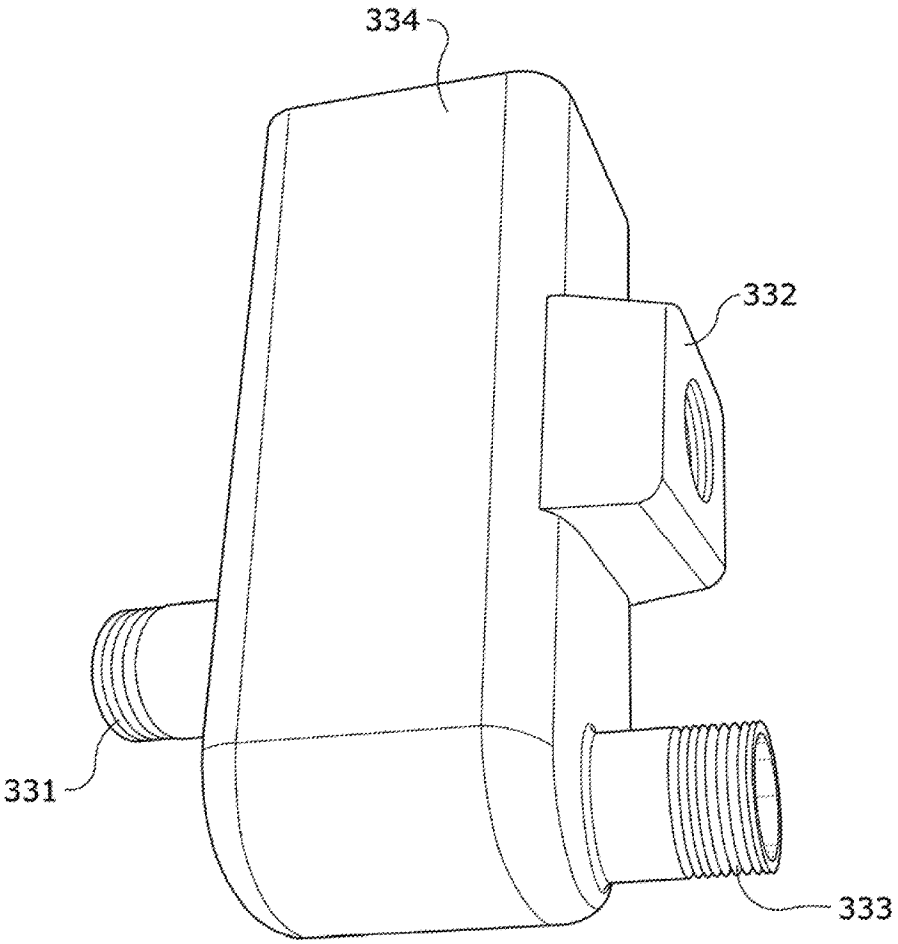

FIG. 10B shows a simplified schematic representation of symbols representing the flowpath of a system 320 according to one embodiment of the present invention. Cold water source 322 and hot water source 324 provide water to hot and cold inlets 331 and 333, respectively, of thermostatically controlled valve 330. Referring briefly to FIG. 13, valve 330 includes a cartridge valve 336 received within a body 334. Cartridge 336 includes a metering section 338 that controls the flow of hot water to a thermostat (not shown) within cartridge 336. The mixture of hot and cold water exiting metering section 338 is turbulently mixed by one or more mixing outlets 337, and then provided to an outlet 332 as tempered water. Mixing outlets 337 are adapted and configured to provide turbulent mixing of hot and cold flows within valves 330. Further examples of such means for creating turbulence or mixing can be found in U.S. patent application Ser. No. 13/657,218, filed 22 Oct. 2012, and titled METHODS AND APPARATUS FOR CREATING TURBULENCE IN A THERMOSTATIC MIXING VALVE, incorporated herein by reference.

As shown in FIG. 13, body 334 includes a single tempered outlet 332 that provides tempered water to the eyewash dispensing caps 321. However, yet other embodiments include an additional tempered fluid outlet 332 that provides tempered water to the showerhead assembly 380, such as by the top mounted outlet 332 best seen in FIG. 10A.

Referring again to FIG. 10B, the tempered fluid exiting valve 330 from outlet 332 passes through an accumulator (diffuser) 340 in some embodiments. A cross-sectional view of accumulator (diffuser) 340 in one embodiment is shown in FIG. 10. Diffuser 340 includes an inlet 341 and outlet 342 that are in fluid communication by way of a serpentine passage 343. Passage 343 includes a plurality of apertures in the sidewalls of the passageway that encourage fluid mixing along the length of the passageway. Further discussion of diffuser 340 can be found in U.S. patent application Ser. No. 13/213,811, filed Aug. 19, 2011, SYSTEM AND METHOD FOR PROVIDING TEMPERED FLUID, incorporated herein by reference, such discussion of the diffuser being incorporated herein by reference. Diffuser 340 reduces any sharp temperature rise that would otherwise be seen when tempered water first flows out of the outlet 332 valve 330. It is further understood that a second diffuser 340 can further be installed in the fluid pathway from the outlet of control valve 332 showerhead assembly 380.

Tempered fluid exiting accumulator (diffuser) 340 flows to a manually operated, normally closed shutoff valve 350. In one embodiment, valve 350 is a ball valve. A paddle and handle 352 control the state of shutoff valve 350. Referring to FIGS. 10A and 11, it can be seen that handle 352 is located generally in the center of return basin 370, and behind the eyewash dispensing caps 321. With this central design, paddle 352 is readily accessed by either left-handed or right-handed persons needing an eyewash. To open valve 350, paddle 352 (and its handle) are pushed backwards, away from dispensing caps 321. Preferably, the outlet of valve 350 includes a quick disconnect type of fitting, so as to facilitate removal of outlet valve 360.

Water exiting shell 350 is provided to dispensing valve 360. Valve 360 includes three separate flow channels: two eyewash outlets 364 that provide tempered water to dispensing caps 321, and a variable orifice 356 that provides fluid to drain 372. In some embodiments valve 360 includes an internal chamber for receiving a filter, such as a charcoal filter. Preferably, valve 360 is coupled to valve 350 by a quick connect coupling that permits easy removal and replacement (or refurbishment) of valve 360. Preferably valve 360 is adapted and configured such that there are no internal volumes in which water is permitted to sit when system 320 is not in use. Instead, after a user has opened shutoff valve 350 for emergency wash, any water within valve 360 flows out of outlet 368 and into drain 372.

Figure 14B:
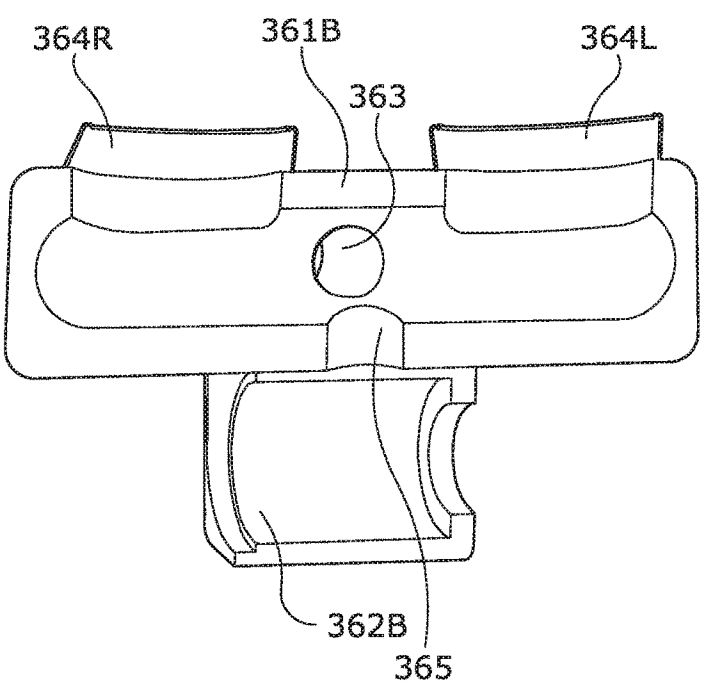
FIGS. 14A and 14B are drawings from a photograph of the front and back halves, respectively, of the eye/face wash block (outlet valve) of FIG. 10A.
Figure 14A:
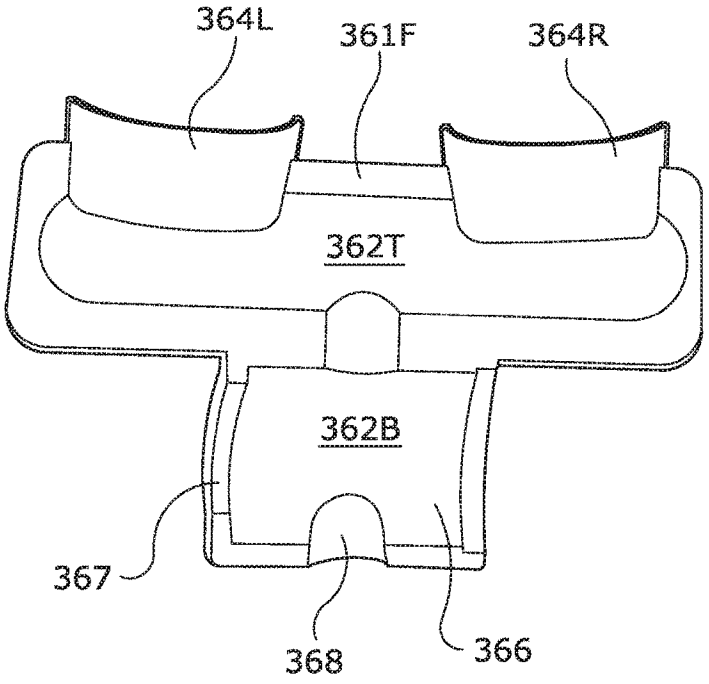

Variable orifice 356 includes an internal valve the position of which can be manually adjusted by the user at an interface 367 on one side of valve 360. FIGS. 14A and B shows front and back halves 361F and 361B, respectively, which comprise the body of outlet valve 360. Tempered water flows into the inlet 363 of valve 360 and flows into internal chambers 362T and 362B. The amount of water that flows from the right and left outlets 364R and 364L, respectively, can be adjusted by varying the flow resistance of valve 356. In some embodiments, there is an internal stop that prevents full closure of valve 356, so that water within valve 360 can always drain out.

By way of interface 367, valve 356 can be rotated to a substantially closed position, in which most of the fluid received through inlet 363 flows out of outlets 364R and 364R. If the user rotates valve 356 to the fully open position, then some of the water entering through inlet 361B flows out of outlet 368 into drain 372. Dispensing valve 360 therefore permits accurate adjustment of the amount of water dispensed through outlets 364R and 364L by adjustment of variable orifice valve 356.

Water exiting through dispensing caps 321 or valve outlet 368 flows into a return basin 370. As best seen in FIG. 12, outlet valve 360 is generally suspended above the drain surface of the basin 370 by shutoff valve 350. Therefore, wash system 320 is substantially self-draining for all water that exits shutoff valve 350.

Figure 15:
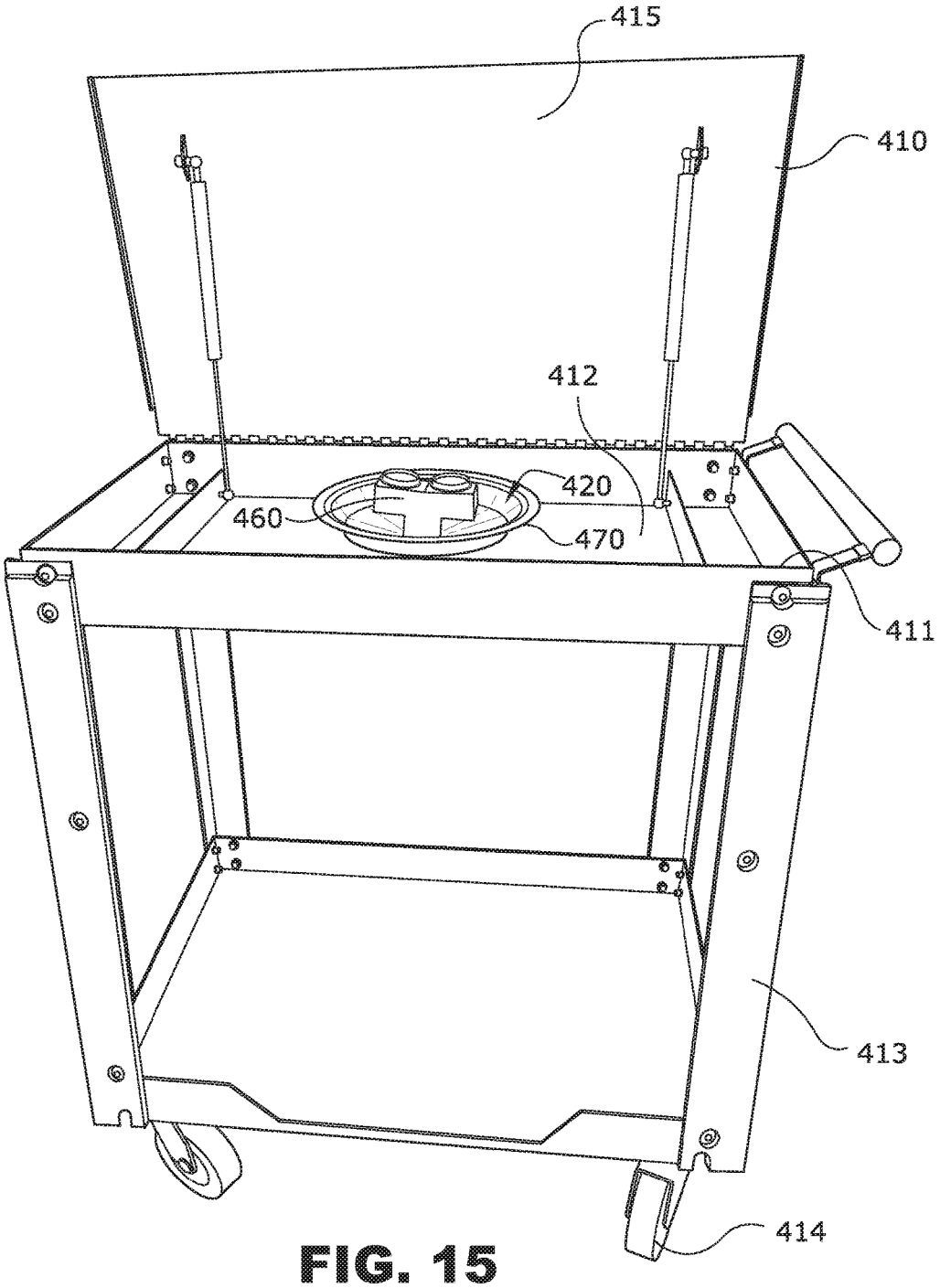
FIG. 15 is a drawing from a photographic representation of a transportable eyewash according to one embodiment of the present invention.

FIGS. 15, 16, 17A, and 17B depict a transportable eyewash system 410 according to another embodiment of the present invention. System 410 includes an eyewash system 420 located on an easily transportable cart 411. In one embodiment, cart 411 includes a deck 412 supported by a plurality of legs 413, and movable over a floor by way of wheels 414. In some embodiments, cart 410 further includes a lid 415 that can be used to enclose eyewash system 420 when not in use. It is understood that FIG. 15 is a drawing from a photographic representation of portions of the eyewash system 410, and not the entire system, which will be now be described.

Figure 16:
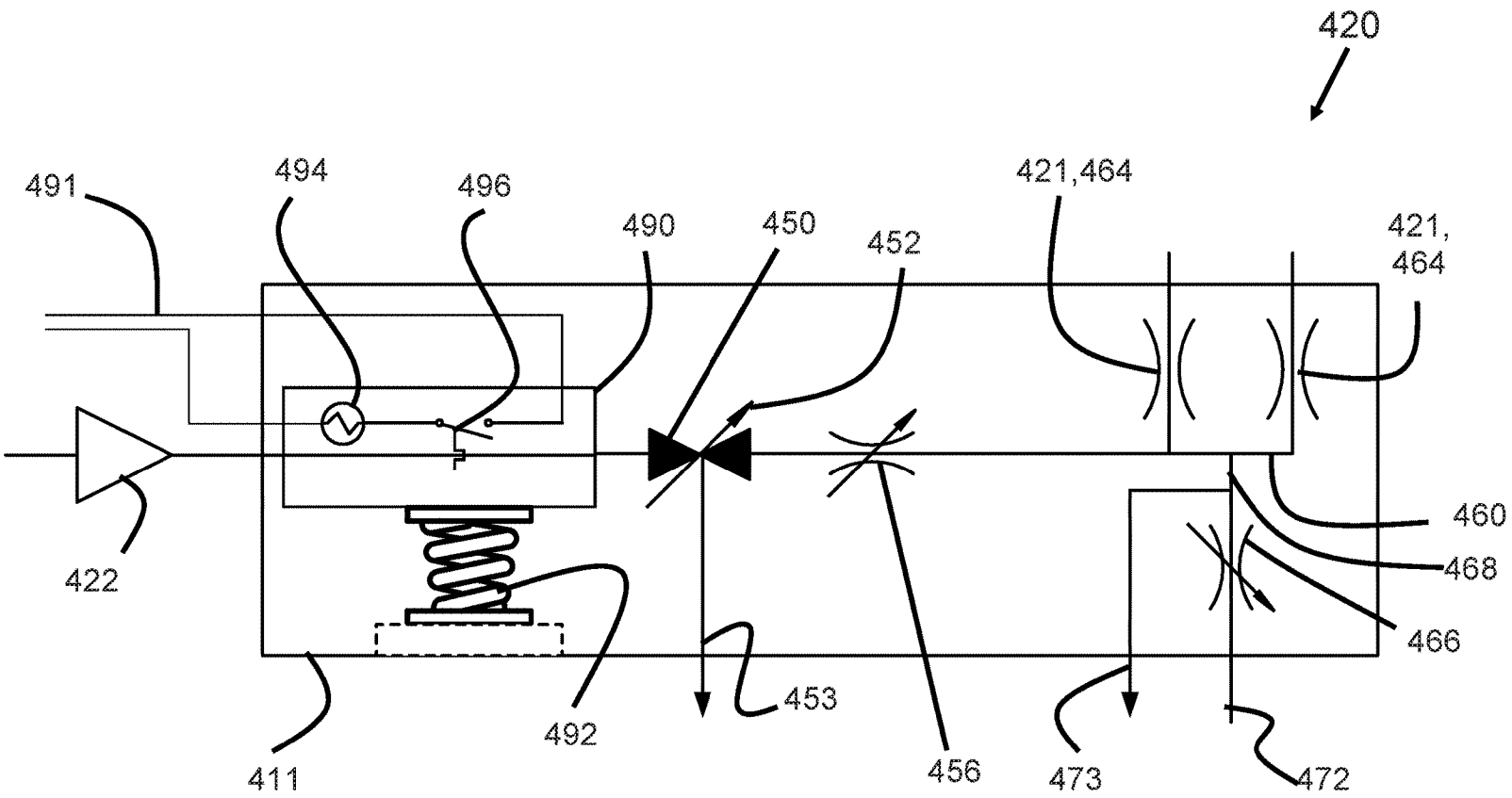
FIG. 16 is a schematic flowchart of the eyewash system of FIG. 15.

FIG. 16 is a schematic representation of the various elements of eyewash system 420. In one embodiment, eyewash system 420 receives water from an external tank 412. As one example, water tank 422 is kept locally to eyewash system 420, and is substantially at ambient temperature. As another example, tank 422 is a water tank that is attached to a trailer, such as a transporter for automobiles, or in another embodiment a truck that carries emergency equipment, such as fire truck. Tank 422 is coupled to system 420 preferably by quick connect fittings (not shown). Water from tank 422 is provided to the inlet of a water heater 490. Water heater 490 preferably heats fluid by way of a heat exchanger 494, such as an electrical resistance heater. FIG. 16 shows heater exchanger 494 receiving electrical power from a source 491 of electricity. In some embodiments, heat exchanger 494 is provided with electricity by way of a thermal switch 496. Switch 496 permits the flow of current through heat exchanger 494 when water temperature is below a predetermined limit. However, if water temperature exceeds the predetermined limit thermal switch 496 opens the circuit and prevents further heating by heater 490.

In some embodiments, heater 490 is mounted to cart 411 by way of one or more vibration isolators or shock mounts 492. These mounts provide isolation of heater 490 from shock or vibratory inputs that are higher in frequency. Preferably, shock mounts 492 are selected to provide isolation from the types of handling acceleration inputs that are typically encountered when moving system 410 on or off a vehicle, or during collisions with system 410 and other objects, or related dynamic inputs. In some embodiments, the water and electrical hook-ups to heater 490 are selected to be relatively flexible, so that shock or displacement inputs from electrical cabling or water plumbing are attenuated before being received by heater 490.

Water exiting heater 490 is elevated in temperature relative to the temperature of water entering heater 490. This hotter water is provided to a shutoff valve 450. Valve 450 is preferably a three-way valve, including one inlet and two outlets. Water flows out of valve 450 toward either flow regulator 456 or out of drain 453 based on the position of a handle 452. Over one range of positions, handle 452 permits the flow of water from heater 490 toward flow regulator 456. However, in a different range of positions, handle 452 also allows water from heater 490 to exit from purging drain 453. When purge drain 453 is open, any air that is trapped within heater 490 can be purged out, to help ensure that heat exchanger 494 contains only water and no trapped gas. Handle 452 can be positioned such that both outlets are closed, thereby maintaining the purged conditions of heater 490. Handle 452 can also be opened to allow flow toward flow regulator 456, but still maintain drain 450 in a closed position. It is further noted that in some embodiments heater 490 is oriented on cart 411 such that water from tank 422 is provided at a location horizontally below the outlet of heater, so that trapped air tends to rise upward within heater 490 from the heater inlet to the heater outlet, thus encouraging a gas-purged state.

Water exiting shutoff valve 450 is received by a pressure compensated flow regulator 466, such as those made by Neoperl. Compensator 466 acts to maintain relatively constant flow conditions over a range of input pressures. As water pressure received at the inlet of compensator 466 increases, a resilient member within compensator 466 (such as O-ring) changes shape or configuration to increase the overall flow resistance (such as by decreasing the valve's flow number and/or decreasing the cross sectional flow area) of regulator 466, and thereby reduce the amount of flow that would have occurred as a result of the higher pressure, had there been no flow compensation.

Flow exiting regulator 466 is received at an outlet valve 460 located on a wash basin 470. In a manner similar to that described earlier, flow received at the inlet of valve 460 is provided to a pair of eyewash outlets 464, each of which is preferably covered by a dispensing cap 421. Outlets 164 and caps 421 are adapted and configured to provide an eyewash to a person bending over and facing toward valve 460.

Figure 17B:
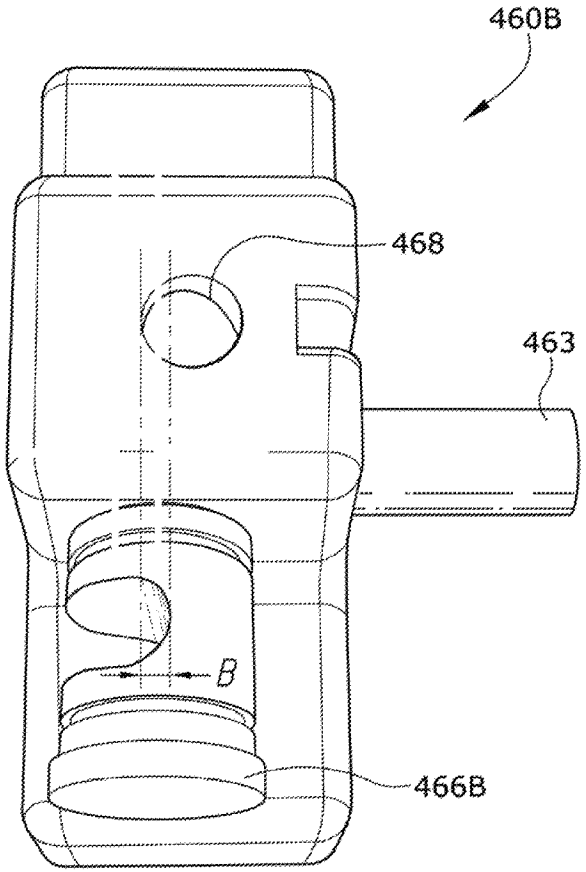
FIG. 17B is a drawing from a photographic representation of the block (valve body) of the system of FIG. 15, with the inner diverter pin (valve) removed and positioned to be closed, and emphasizing a nonclosable flow area.
Figure 17A:
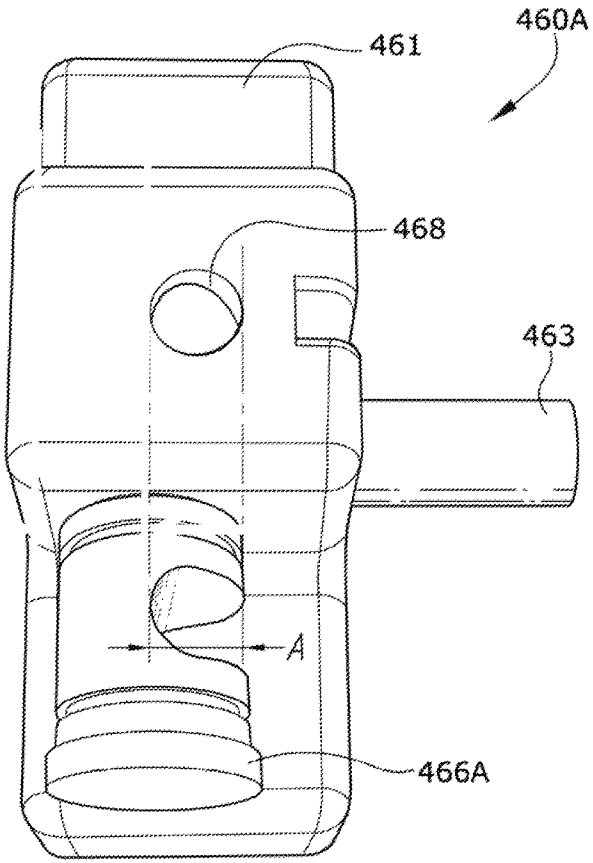
FIG. 17A is a drawing from a photographic representation of the valve body of the system of FIG. 15, with the inner valve removed and positioned to be fully opened.
Figure 18:
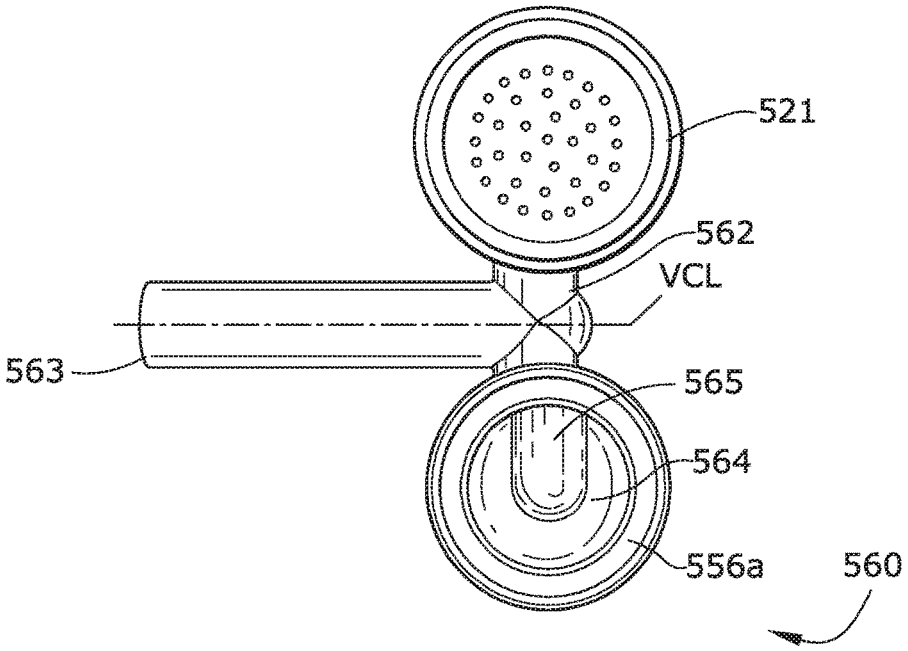
FIG. 18 is a top drawing from a photographic representation of an eyewash valve assembly according to one embodiment of the present invention.

Further, as previously discussed, valve 460 includes a manual flow adjuster 466 that can be used to set up a desired spray pattern from outlets 464. Preferably, valve 160 further includes a non-closable drain 473 that operates in parallel around drain 472. Referring to FIGS. 17A and 17B, the adjustable valve 466 is shown removed from the body 461 of valve 460. In FIG. 17A, valve 466 is shown in the fully opened position, and it can be seen that the flow area of outlet 468 can be maintained substantially opened and unrestricted by valve 466 when valve 466 is in the A, or fully opened position. FIG. 17B depicts the position of valve 466 when fully closed, showing that even under full closure there is a flow area B of valve 466 that still aligns with a portion of the outlet area of outlet 468. Therefore, even when fully closed, water can still flow out of outlet 468. In those embodiments in which valve 460 is not fully closable, the draining of any remaining water within portions of eyewash system 420 is encouraged, thus preventing the accumulation of stagnant water. It is further envisioned some embodiments that outlet 468 will be located lower than the outlet of shutoff valve 450.

FIGS. 18 through 31 depict and explain various features pertaining to an eyewash system 520 according to one embodiment of the present invention.

FIGS. 18 through 21 depict various external views of an eyewash nozzle assembly or outlet valve 560 according to one embodiment of the present invention. It will be appreciated that valve 560 is related and similar to the previously defined outlet valves 160, 360, and 460, even though there are external differences in shape. It is further understood that the various functions that will now be described for valve 560 apply equally to these other outlet valves disclosed herein.

Valve assembly 560 includes an inlet 563 for water and a pair of outlets 568 which can be capped with dispensing caps 521. Preferably, the housing of outlet valve 560 includes a groove 556*a* that is adapted and configured to hold within it a filter disk 556. In some embodiments, these features are arranged symmetrically about a vertical centerline (VCL) that extends forward toward the user when valve 560 is installed in an eyewash system.

The inlet 563 includes within it a flow regulator or variable orifice valve 566, such as those made by Neoperl. These flow regulators provide a substantially constant flow of water there through; especially after a threshold pressure has been obtained. As one example, with a flow regulator from Neoperl of the type MR03 US Type, flows can be selected to flow from about one gallon per minute to about two and two-tenths gallons per minute within a tolerance band. Preferably, the flow regulators are press fit into the housing at the inlet 563.

Valve assembly 560 includes a central passage 562 that interconnects inlet 563 to an internal connection 565 and outlets 564. By transitioning from central passage 562 with a relatively small cross section to the larger eyewash outlets 564 (which are capped with dispensing caps 521), the velocity of water within valve 560 is reduced greatly and thereby emerges from the apertures 521*a* of cap 521 more gently, yet extends upwardly the required distance of eight inches as noted in Enzi standard Z358-1-2009. Further, it has been found that the velocity of water is not so great as to extend greatly beyond this eight inch limit, thus making the eyewash system more user-friendly, and therefore more likely to be used. In some embodiments, the area ratio (the combined cross sectional area of outlets 564 to the cross sectional area of central passage 562) is from about 8 to about 11, with a preferred range being greater than about 9. With this sizing, it has been determined that a wash flow less than about two gallons per minute can be provided. In this manner, the flow valve 560 is less wasteful of water during usage.

Figure 20:
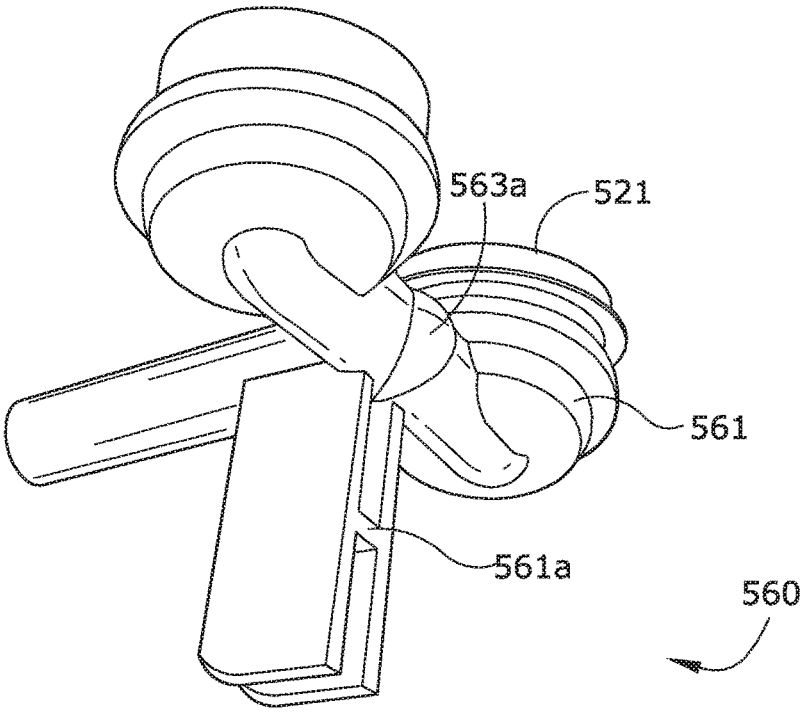
FIG. 20 is a perspective drawing from a photographic representation of the apparatus of FIG. 18.
Figure 21:
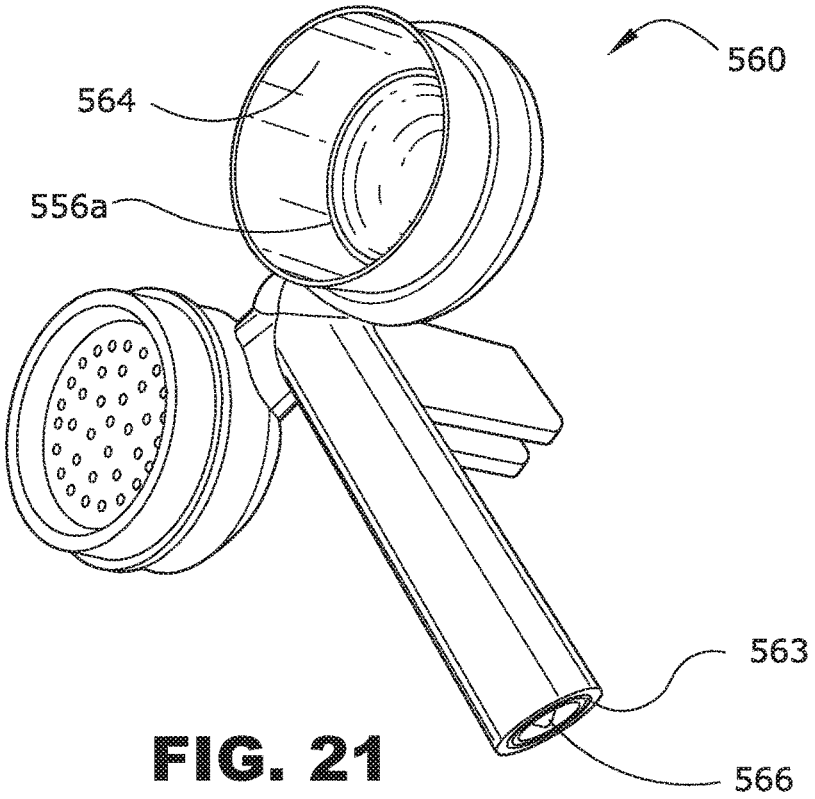
FIG. 21 is a perspective drawing from a photographic representation of the apparatus of FIG. 18.

In some embodiments, central passage 562 terminates at a distal-most end 563*a*, as best seen in FIG. 20. Some versions of valve assembly 560 include an aperture at the termination 563*a* of internal chamber 562. This aperture can be provided with a male or female feature that can be coupled to the inlet 563 of a second valve assembly 560. This coupling of two valve assemblies provides four eyewash nozzles, and this modular construction thus makes valve 560 suitable for emergency eyewash applications and emergency face wash applications. A corresponding flow schematic can be seen in FIG. 30, where the additional valve 560 is represented by outlets 564' and dispensing caps 261'. Further, the modified, inlet is identified as element 563', and the secondary outlet of the first valve is identified as 563*a*.

Figure 19:
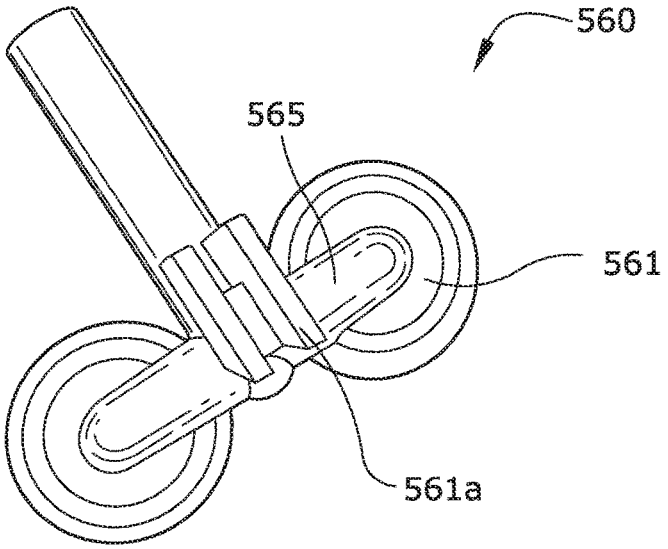
FIG. 19 is a bottom drawing from a photographic representation of the apparatus of FIG. 18.
Figure 24:
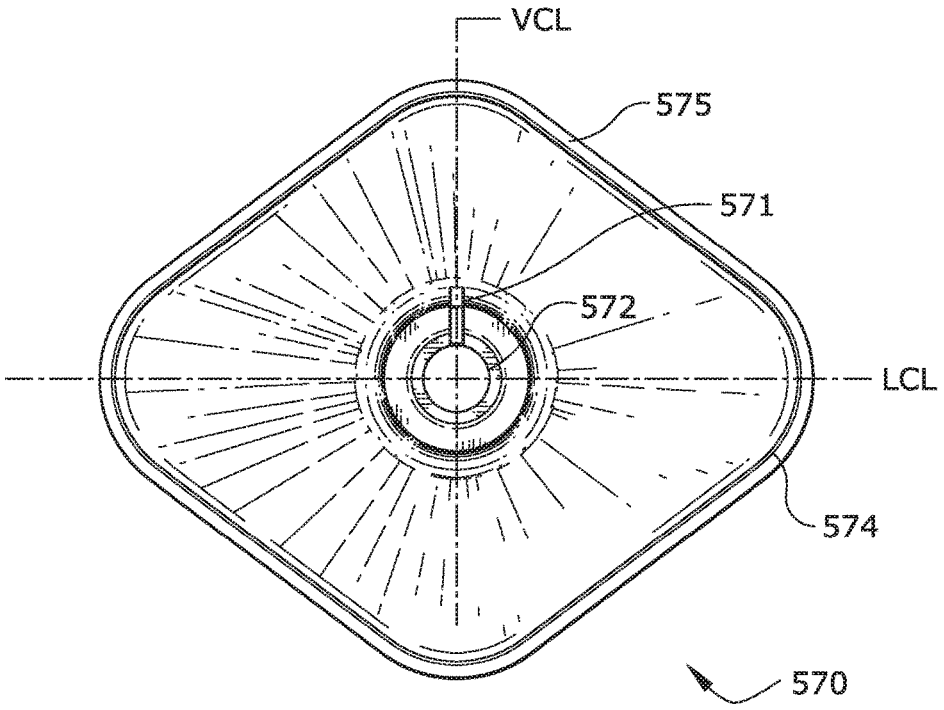
FIG. 24 is a top drawing from a photographic representation of a basin according to one embodiment of the present invention.
Figure 25:
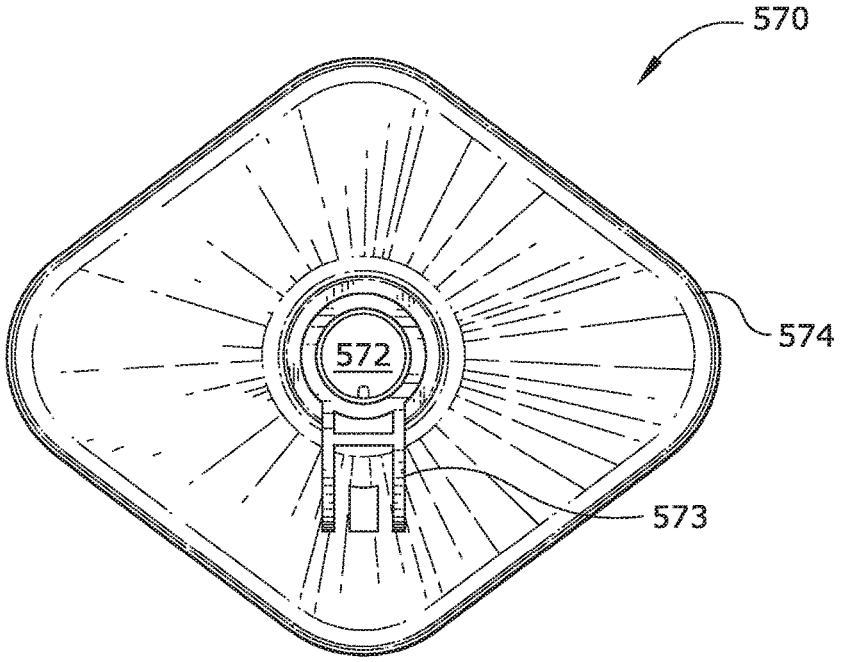
FIG. 25 is a drawing from a photographic representation of the bottom of the apparatus of FIG. 24.
Figure 26:
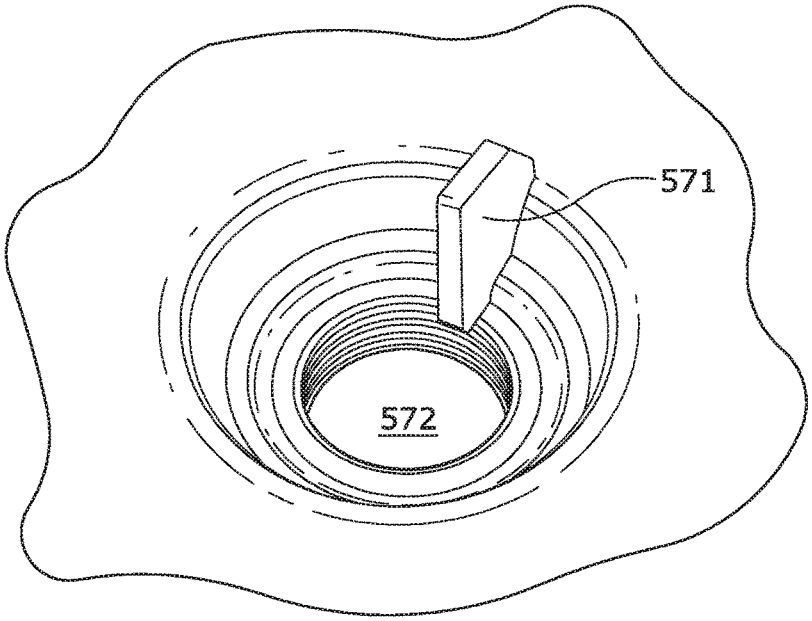
FIG. 26 is a close-up drawing from a photograph of a portion of the apparatus of FIG. 24.

Valve 560 further includes an indexing feature 561*a* located centrally on the bottom of the housing 561. As best seen in FIGS. 19 and 20, indexing feature 561*a* includes a pair of downwardly extending arms that define a gap therebetween. Referring briefly to FIGS. 24 and 26, it can be seen that this gap is sized to accept therebetween the indexing feature 571 of wash basin 570. This indexing feature combined with the quick connect fittings on outlet of the shut-off valve 550 and the inlet to the outlet valve 560 combine to make valve 560 modular and easily replaceable by an unskilled person. The quick connect fittings of the shut-off valve and the outlet valve combine to align valve 560 along the length of the vertical axis VCL. The indexing features 561*a* and 771 do not interfere with this fore and aft alignment, since indexing feature 571 can fit easily between the parallel arms of indexing feature 561*a*. However, the indexing features 561*a* and 571 combine to laterally locate valve 560 in a lateral direction (i.e., as along the lateral centerline LCL, best seen in FIG. 5-7). Valve 560 is preferably not attached to basin 570. Therefore, the person replacing valve 560 has only a single quick connection to achieve, and does not have to further connect body 561*a* to basin 570. It can be further seen that the shape of feature 561 is generally complementary in shape to indexing feature 571.

Figure 22:
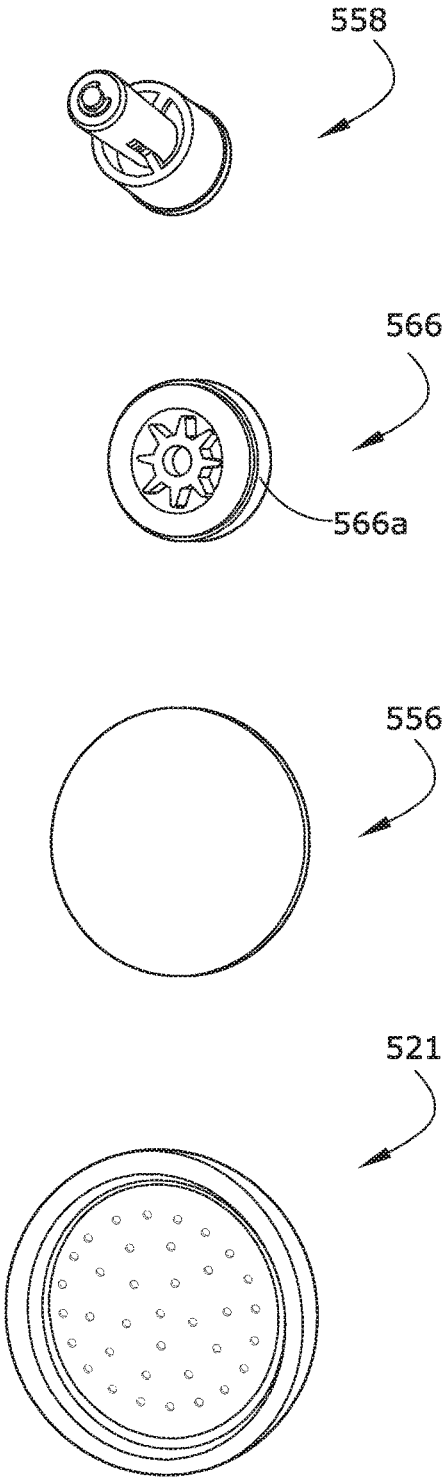
FIG. 22 is a drawing from a photographic top side view of various components of the apparatus of FIG. 18.
Figure 23:
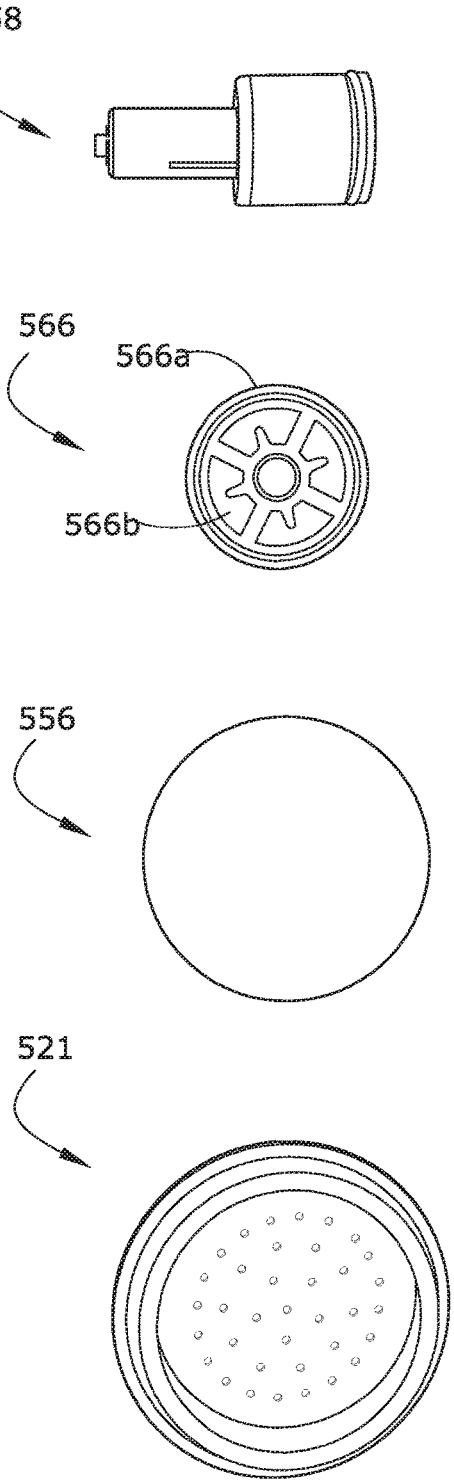
FIG. 23 is a drawing from a photographic bottom side view of various components of the apparatus of FIG. 18, with the exception that the apparatus at the top is a side drawing from a photographic representation.

FIGS. 22 and 23 show various components located internally in some embodiments of valve 560. Filters 556 in one embodiment are preferably porous, sintered metal wafers. In one example, housing 561 is a two-piece, molded plastic housing having a groove within wash outlet 564. During manufacturing, a filter 556 is inserted in the groove of one-half of the housing 561, and the other half is then mated with the first half, trapping filter 556 in place. A Neoperl regulator 566 is shown in FIGS. 22 (from one side) and FIG. 23 (from the other side). Each regulator includes a static, generally rigid structure 556*b* that cooperates with the rigid members 556*a* that cooperates with a resilient member 566*b*, such as an O-ring to produce a variable orifice effect.

FIGS. 22 and 23 show end and side views, respectively, of an expulsion valve 558. In some embodiments, valve 558 is press fit into an orifice created at secondary outlet 563*a* of body 561.

Figure 29:
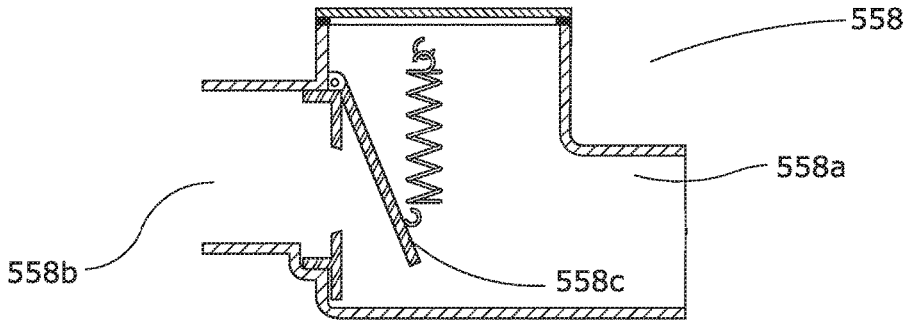
FIG. 29 is a schematic cutaway representation of an expulsion valve according to one embodiment of the present invention.
Figure 30:
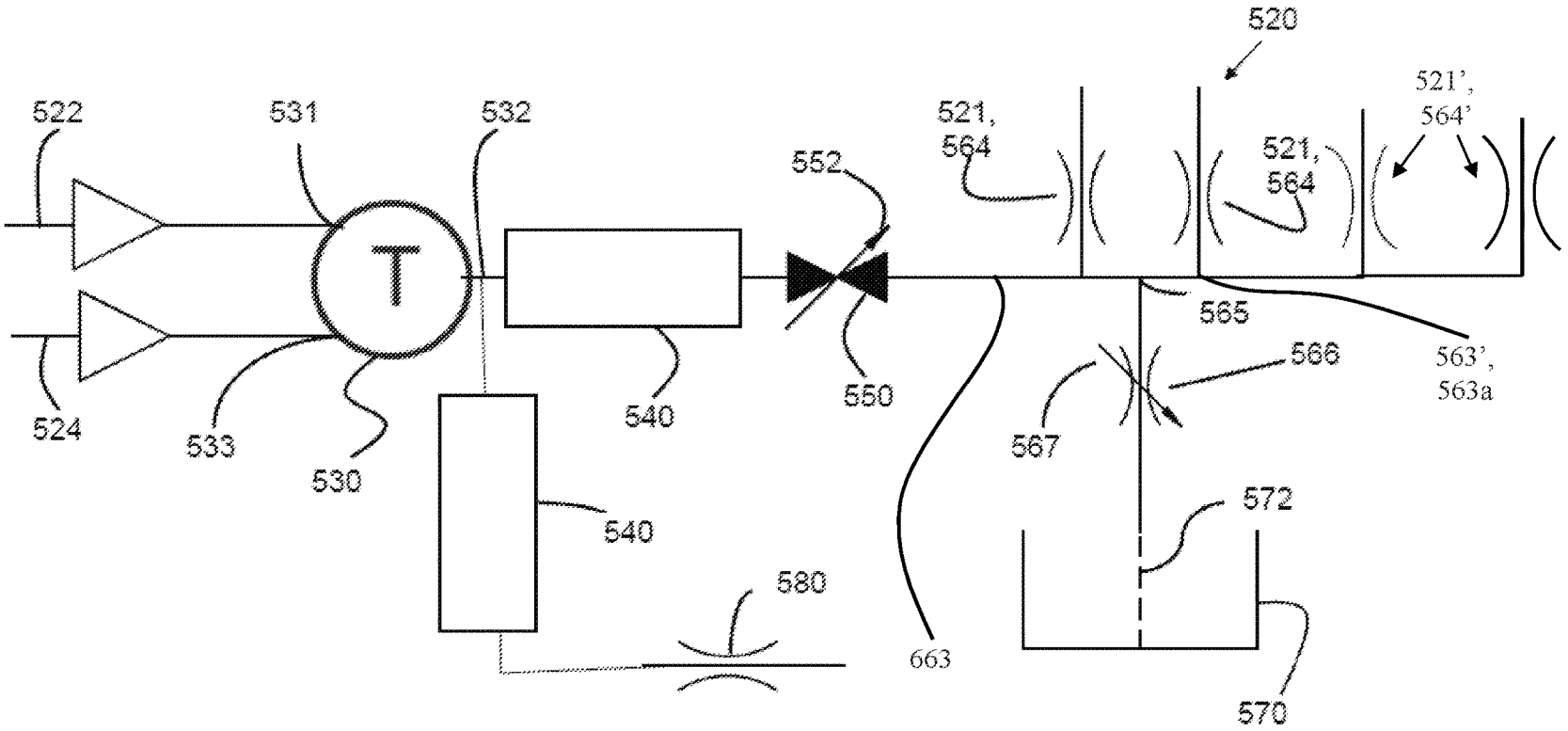
FIG. 30 is a hydraulic schematic representation of a system according to one embodiment of the present invention.
Figure 31:
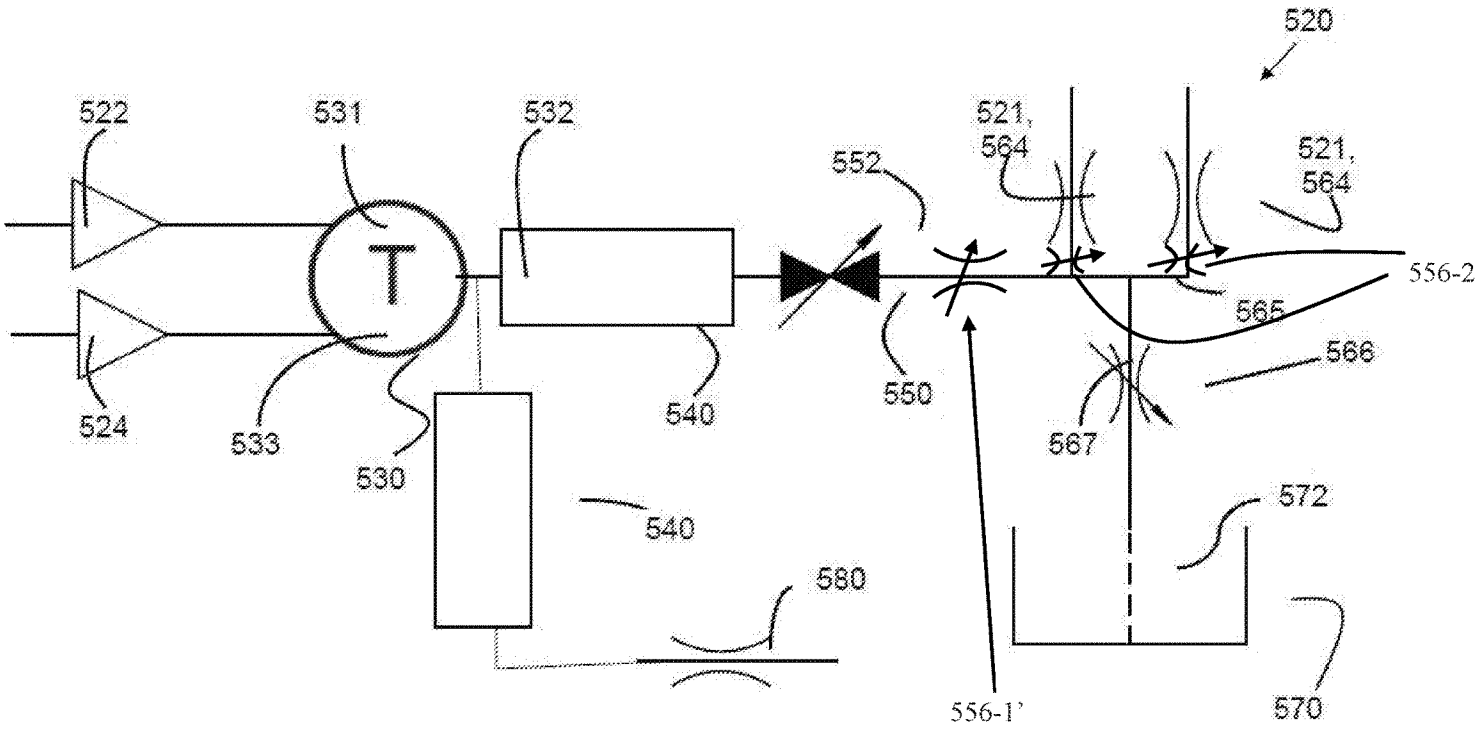
FIG. 31 is a hydraulic schematic representation of a system according to one embodiment of the present invention.

FIG. 29 schematically describes operation of expulsion valve 558. Flow is received within the valve from inlet 563 as shown in the direction of the arrow. After this flow has reached a sufficient value, its impingement on flapper 558*c* causes the flapper to shut drainage outlet 558*b*. The flow is thereby directed upward (with reference to FIG. 29) and onto the eyewash chambers 564. When the inlet flow stops, flapper 558*c* is biased to the open position (as shown schematically by the spring), and thereby releases any trapped water within valve assembly 560 by way of the open flowpath to drainage outlet 558*b* (which releases the water into basin 570). It is appreciated that flapper 558*c* can be biased open by spring, by weight, or by any other means.

FIGS. 24 through 27 depict various features of basin 570. In one embodiment, basin 570 is of a rounded diamond shape, and symmetrical about a vertical centerline VCL, and further symmetrical about a lateral centerline LCL. A drainage aperture 562 is located at a low point within basin 570 so as to achieve a gravity drain. A lip 575 extends upwardly from the bottom of the basin, and around the edges of the basin. Basin 570 includes an indexing feature such as the rib 571 extending upward from the bottom of the basin, and located proximate to the drainage aperture 572. As previously discussed, this indexing feature 571 cooperates with an indexing feature of the valve body assembly so as to assist a user in replacing the valve assembly 560. Preferably, the indexing features provide an indexing and location function in a single direction, and do not limit indexing or location in directions orthogonal to that direction. As seen herein, indexing features 571 and 561*a* provide a locating function along the length of centerline LCL but do not provide any location along the length of vertical centerline VCL, and further does not provide any limitation on the upwards location of the valve assembly.

Figure 27:
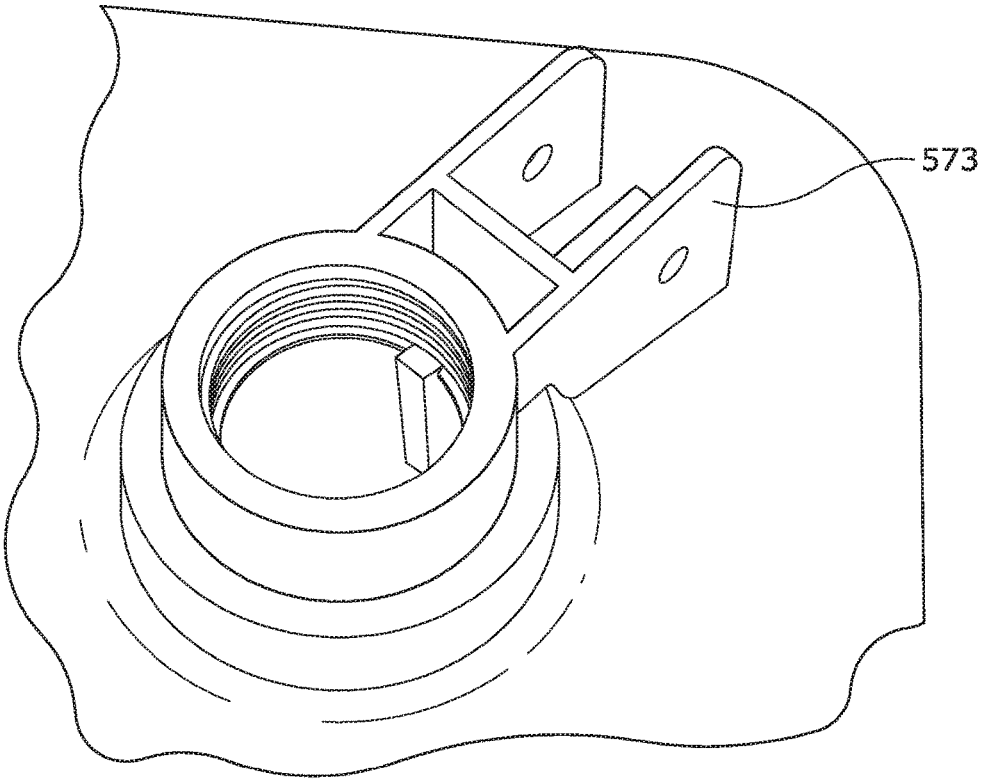
FIG. 27 is a drawing from a photographic representation of a portion of the apparatus of FIG. 25.
Figure 28:
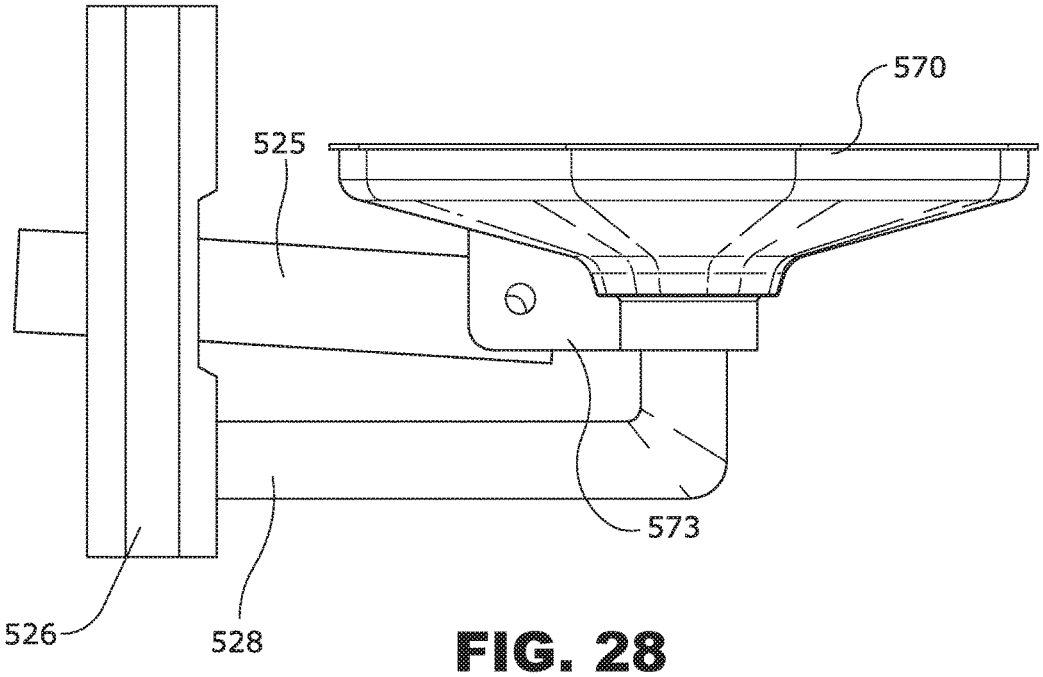
FIG. 28 is a side drawing from a photographic representation of a portion of an eyewash assembly according to one embodiment of the present invention.

Basin 570 further includes an attachment feature 573 located on the bottom of basin 570, and best seen in FIGS. 27 and 28. Locating feature 573 in one embodiment includes a pair of spaced apart members that receive between them a support arm 525. The members further include an attachment hole that aligns with an attachment hole in the arm 525. Referring to FIG. 28, a person installing a basin 570 makes the appropriate plumbing connection from drain 572 to drain 528 and then to the draining feature of stand 526. Arm 525 is pinned to basin 570 at one end, and further pinned or otherwise fastened to stand 526. Preferably, support arm 525 is provided in at least one embodiment at a length suitable for spacing basin 570 away from stand 526 such that person in a wheelchair can approach the basin, get their legs under the basin, and use the eyewash. Arm 525 is preferably a tight fit within a machine slot of stand 526.

Some embodiments of the present invention use a basin 570 that is adapted and configured to provide a tactile indication to the user of their location relative to the eyewash outlets 564. It has been observed that some existing emergency eyewash basins have a circular shape, or other shape, that does not give a tactile indication to a person without vision of their relative location, such as for existing eyewash basins that are circular. In such a case, the person with impaired vision would have difficultly aligning their eyes with the spaced apart eyewash outlets.

Referring to FIG. 24, it can be seen that basin 570 includes rounded corners at opposing lateral extremes along centerline LCL, and these comprise tactile features 574 that can be gripped or touched by the person using the eyewash basin. The person would be able to feel the rounded corners of the diamond shape in the lateral directions, and therefore intuitively know where to place their head and eyes. In some embodiments, the tactile features are corners (whether rounded or not) of the basin, but further can be handles, finger or thumb grooves located in the lip 575, inwardly-extending pockets adapted to receive the person's fingers in the lip, or similar features. It is preferred that the tactile features 574 be located the greatest lateral distance from the centerline between the eyewash outlets.

Flow schematic 31 depicts yet another embodiment of the present invention. Various embodiments contemplate one, two, or there flow regulators 566 within valve assembly 560. As has been previously discussed, a first flow regulator 566-1 is selected to provide a total eyewash flow to both eyewash outlets 564. However, in yet other embodiments this first, central flow regulator is not needed, and the valve assembly can otherwise include a pair of flow regulators 566-2 each selected for regulation of flow to a single eyewash outlet 564.

Figure 32:
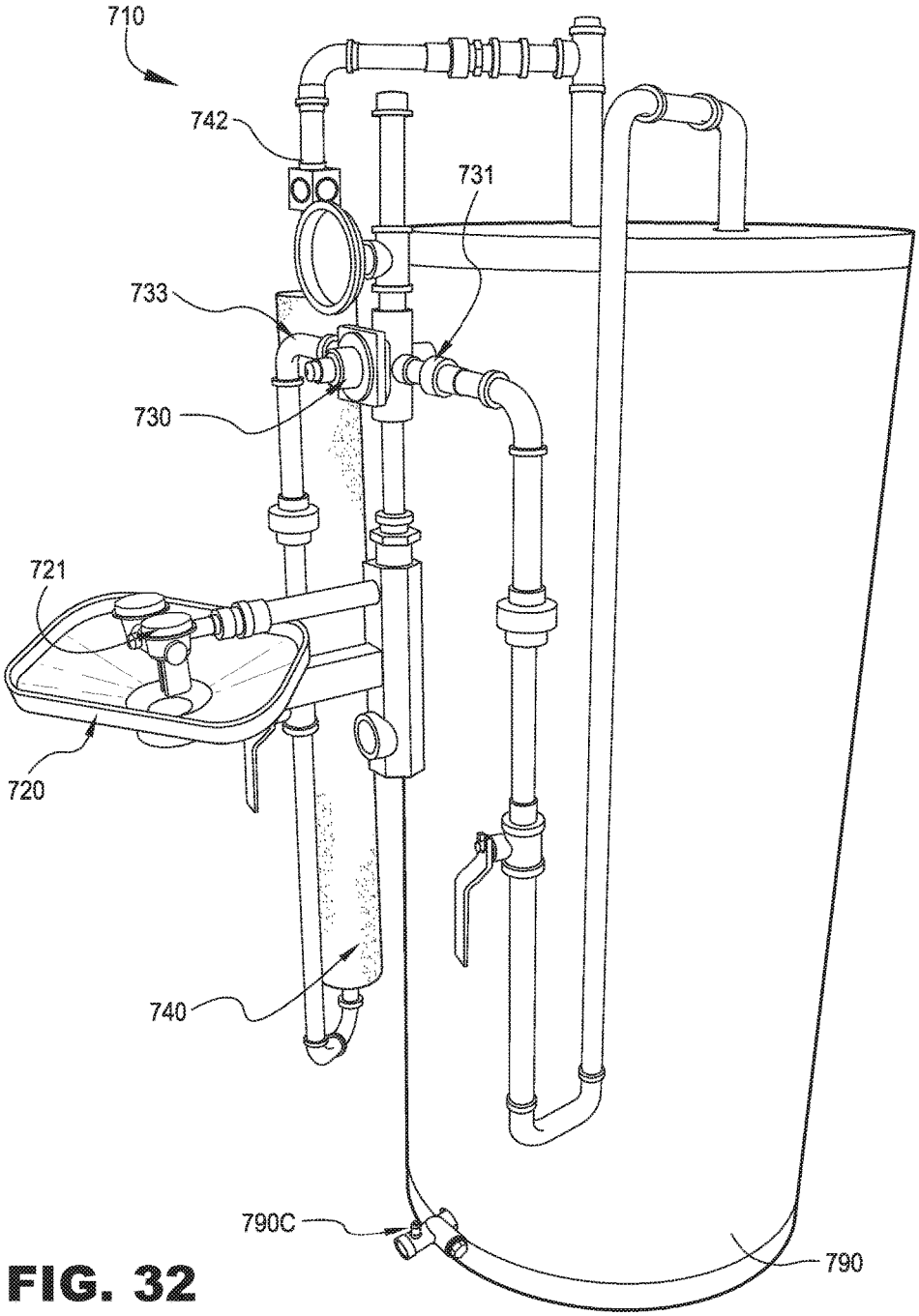
FIG. 32 is a drawing from a photographic representation from the side of an emergency eye wash system according to one embodiment of the present invention.
Figure 33:
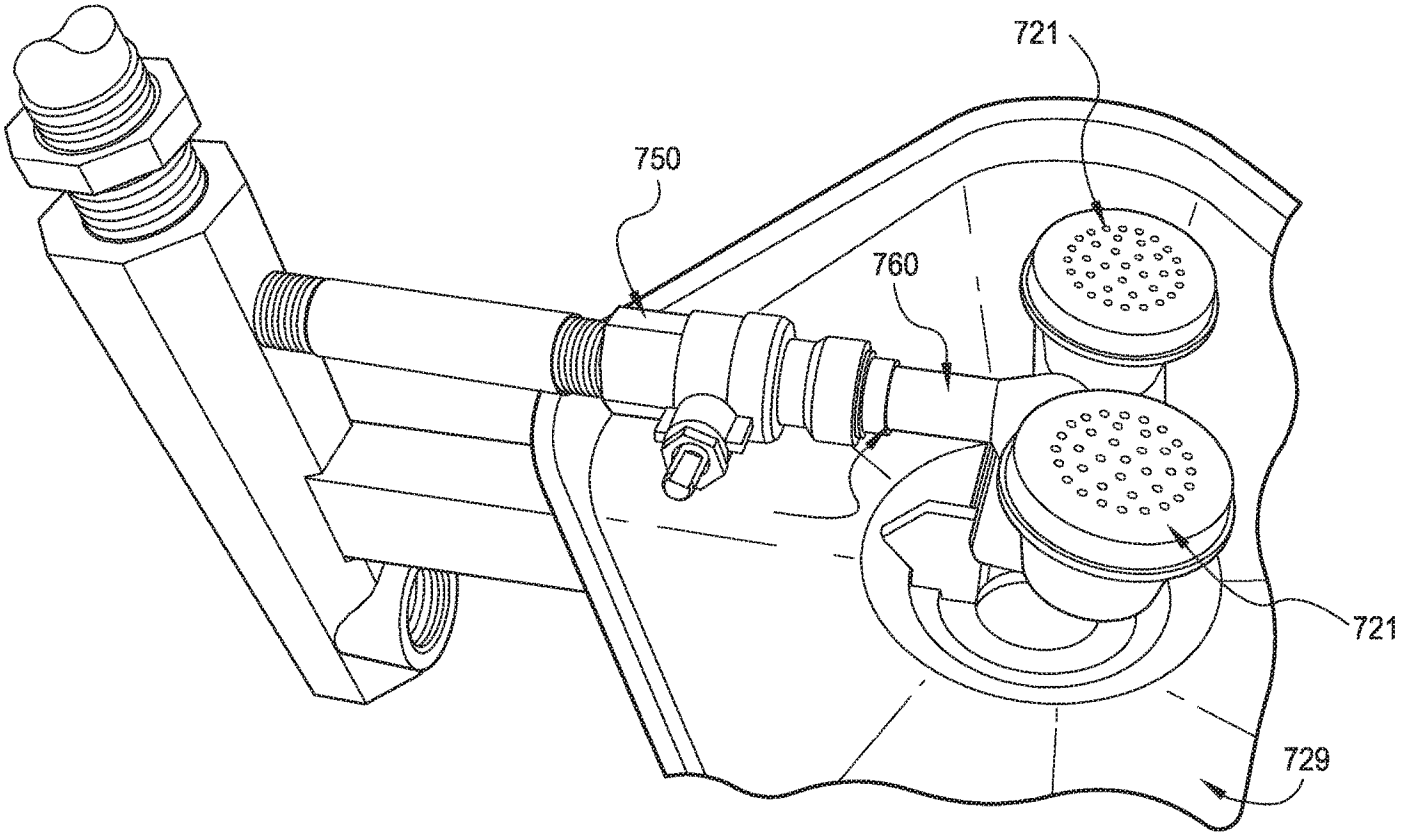
FIG. 33 is a close up drawing from a photographic representation of a portion of the system of FIG. 32.

FIGS. 32 and 33 are drawings from photographic representations of an emergency eye wash system 710 according to one embodiment of the present invention. Eye wash system 710 includes a heater 790, such as a gas or electric heater that receives cold water from an inlet 790C. System 710 is adapted and configured such that cold water from inlet 790C is provided both to an internal heating unit for the subsequent production of heated water, and also to a cold water inlet 731 of thermostatically controlled valve 730. The hot water inlet 733 of valve 730 is provided with heated fluid from a diffuser 740. During typical operation, diffuser 740 contains a supply of water that is more or less at room temperature. During operation, the inlet 742 of diffuser 740 receives heated water from an outlet of heater 790. Diffuser 740 provides mixing of the stored internal volume with new heated fluid, and thereby provides water to the hot inlet 733 of valve 730 that has a relatively slow increase in temperature. Therefore, diffuser 740 helps prevent spikes in temperature when eye wash 720 is first turned on.

Further during operation, FIG. 33 shows that water is provided to right and left dispensing caps that provide an upward flow of tempered water. This water is received for drainage within basin 729, and subsequently drained out (the drainage attachment not being shown). Dispensing caps 721 are provided to an outlet valve 760 that is coupled by a quick connect fitting 751 to a shut off valve 750.

Figure 34:
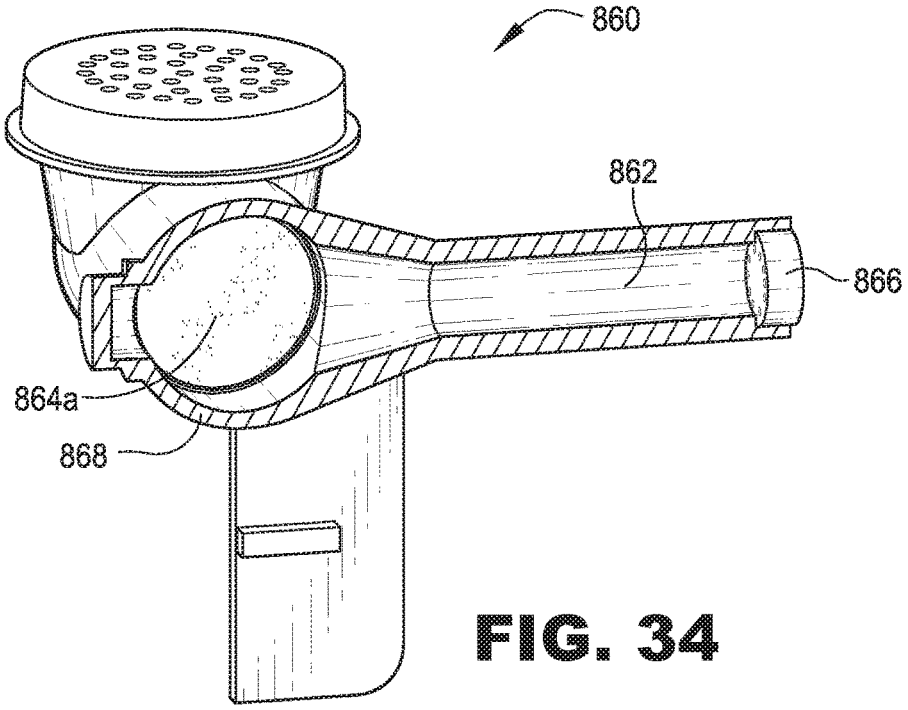
FIG. 34 is a cutaway view of a drawing from a CAD model of an outlet valve according to another embodiment of the present invention.
Figure 35:
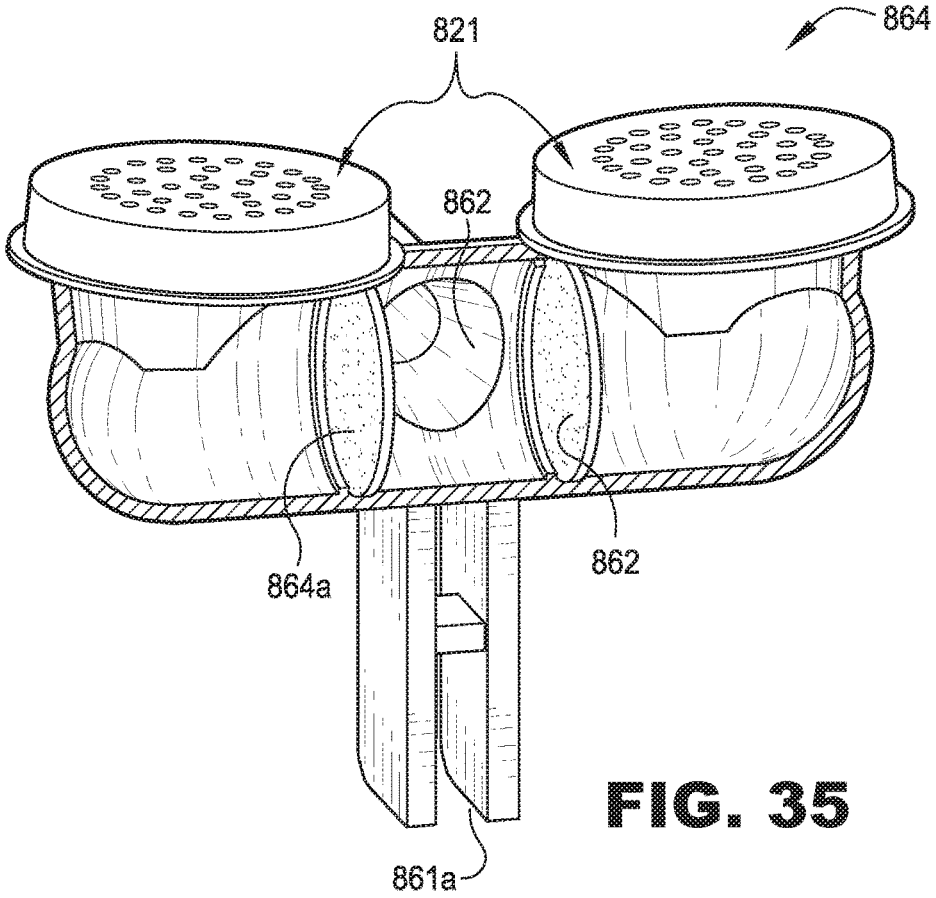
FIG. 35 is a different cutaway of the outlet valve of FIG. 34.

FIGS. 34 and 35 show cut away views of an outlet valve 860 according to another embodiment of the present invention. Outlet valve 860 can be used in an eye was system X20, as described elsewhere herein. Valve 860 includes a variable orifice 866 that provides a predetermined range of flows of tempered water from the outlet of the shut off valve (not shown) to an internal flow chamber 862.

Water from central chamber 862 is then provided to right and left eye wash outlets 864 through respective filter elements 864*a*. Each of the filter elements 864*a* provide some resistance to flow, and therefore, each assists in pressure balancing the central flow of water as it is provided to the right and left outlets. In some embodiments, the filters 864*a* have a nominal filter rating in the range of forty to sixty microns. In yet other embodiments, the filters are equivalent to about two hundred mesh or about seventy to eighty microns.

In some embodiments, valve 860 further includes a drainage outlet 868 that is located between the inlets to the right and left filters 864*a*, and preferably located lower that the centerline of internal chamber 862. During operation, water exiting the shut off valve fills chamber 862 under sufficient pressure to force the water through respective right and left filter elements 864*a*. Filtered water is then provided to right and left chambers 864, and subsequently through right and left dispenser caps 821 to the user. Location of the drainage outlet 868 as described can provide, in some embodiments, several features. One such feature is to drain the internal chamber 862 and 864 under the influence of gravity. Yet another feature is to assist in a backwashing through filters 864*a*. During backwashing, as the shut off valve is closed, any water collected in right and left chambers 864 will flow in reverse direction (i.e., from outlet to inlet though filters 864A), and subsequently out of drain 868. This backwashing feature can increase the usable life of filters 864*a*.

FIGS. 36 to 39 show pairs of dispensing caps 921 according to various embodiments of the present invention. These caps provide various flow distributions to the water exiting the caps, and in some embodiments are tailored to varying requirements for an individual eye, and in other embodiments for varying requirements to the pair of eyes presented on the user face.

Figure 36:
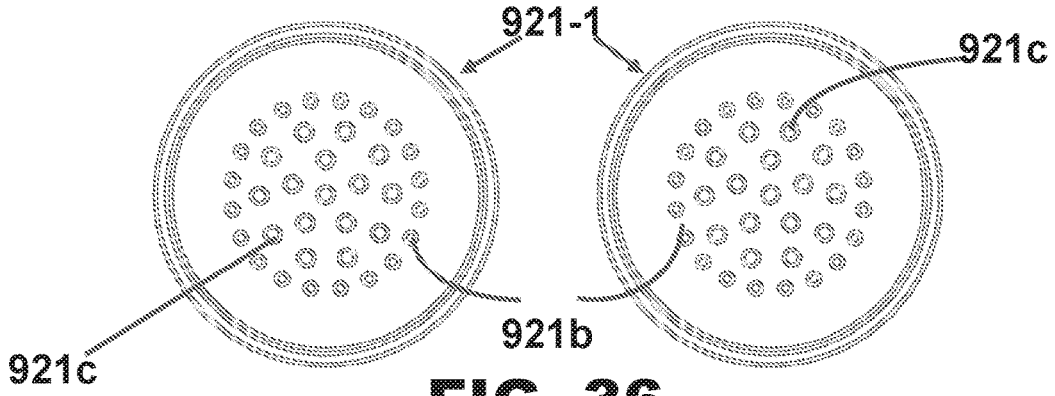
FIG. 36 is a top view of right and left of eye wash dispensing caps according to another embodiment of the present invention.
Figure 37:
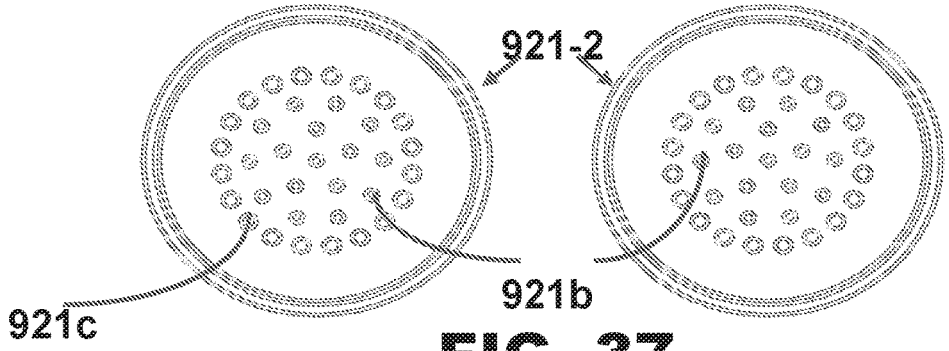
FIG. 37 is a top view of right and left of eye wash dispensing caps according to another embodiment of the present invention.

FIG. 36 shows right and left dispensing caps 921-1. Each of these dispensing caps includes a plurality of flow apertures adapted and configured to provide increased flow rates of filtered water toward the center of a user's eye. It can be seen that the plurality include an outermost portion 921*b* of relatively smaller apertures. That plurality of smaller apertures in some embodiments is oriented in a ring around a plurality of apertures 921*c* that are generally larger (i.e. either increased area, increased flow number, or a combination of the two). Therefore, dispensing caps 921-1 provide a flow pattern that is tailored for individual eyes with the flow in the center of each pattern being higher than the flow toward the periphery of the pattern. FIG. 37 shows right and left dispensing caps 921-2 of the generally opposite configuration, such that the innermost flow apertures 921*b* are smaller than the flow apertures 921*c*.

Figure 38:
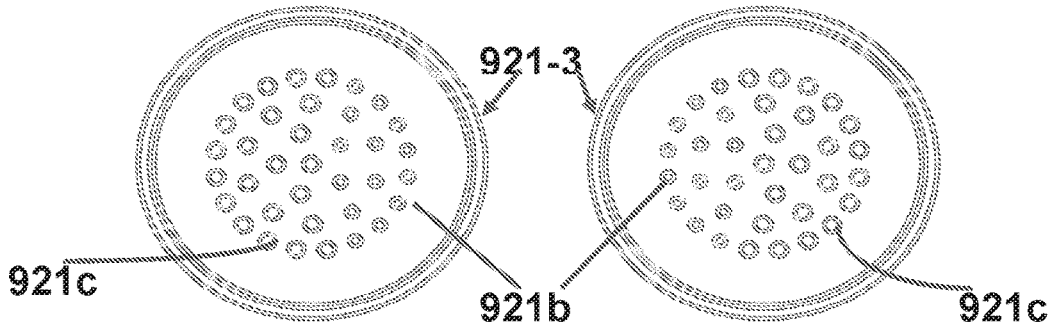
FIG. 38 is a top view of right and left of eye wash dispensing caps according to another embodiment of the present invention.
Figure 39:
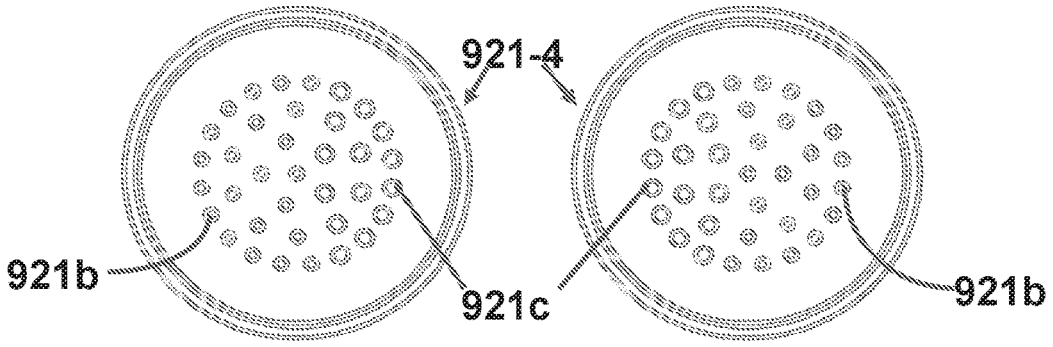
FIG. 39 is a top view of right and left of eye wash dispensing caps according to another embodiment of the present invention.

FIGS. 38 and 39 show arrangements of flow apertures adapted and configured to consider the user's face as a whole. Right and left dispensing caps 921-3 each include a plurality of smaller size (or lower flow) apertures arranged centrally toward the centerline of the supporting outlet valve 960 (not shown). The outermost flow apertures are of a larger size (or high flow), and shown as flow apertures 921*c*. The right and left dispensing caps 921-4 of FIG. 39 show a generally opposite orientation. The higher flow apertures 921*c* are oriented toward the centerline of the output valve, and the lower flow apertures are located away from that center line.

Figure 40:
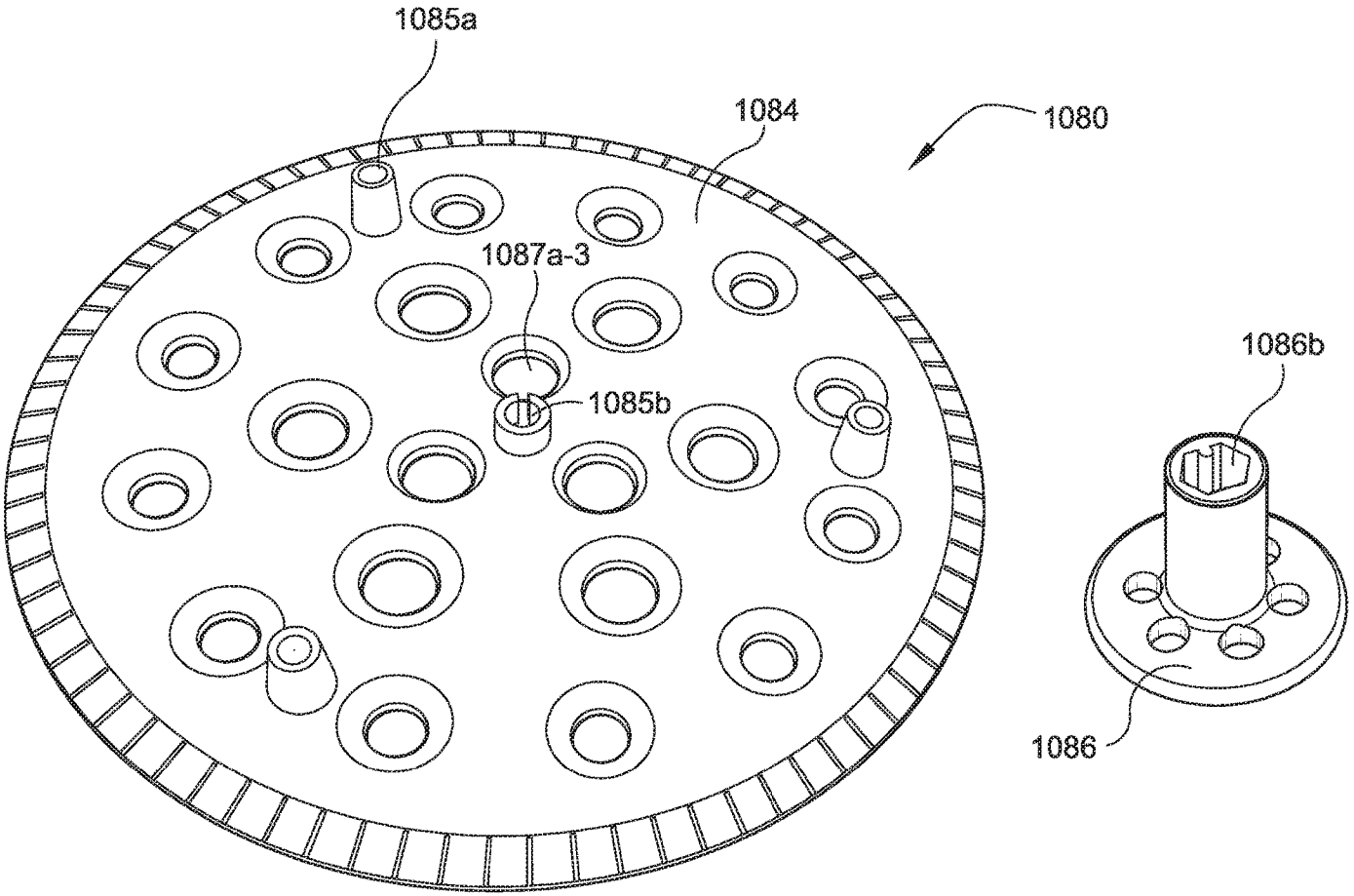
FIG. 40 is a drawing from a photographic representation of portions of a showerhead assembly according to another embodiment of the present invention.
Figure 41:
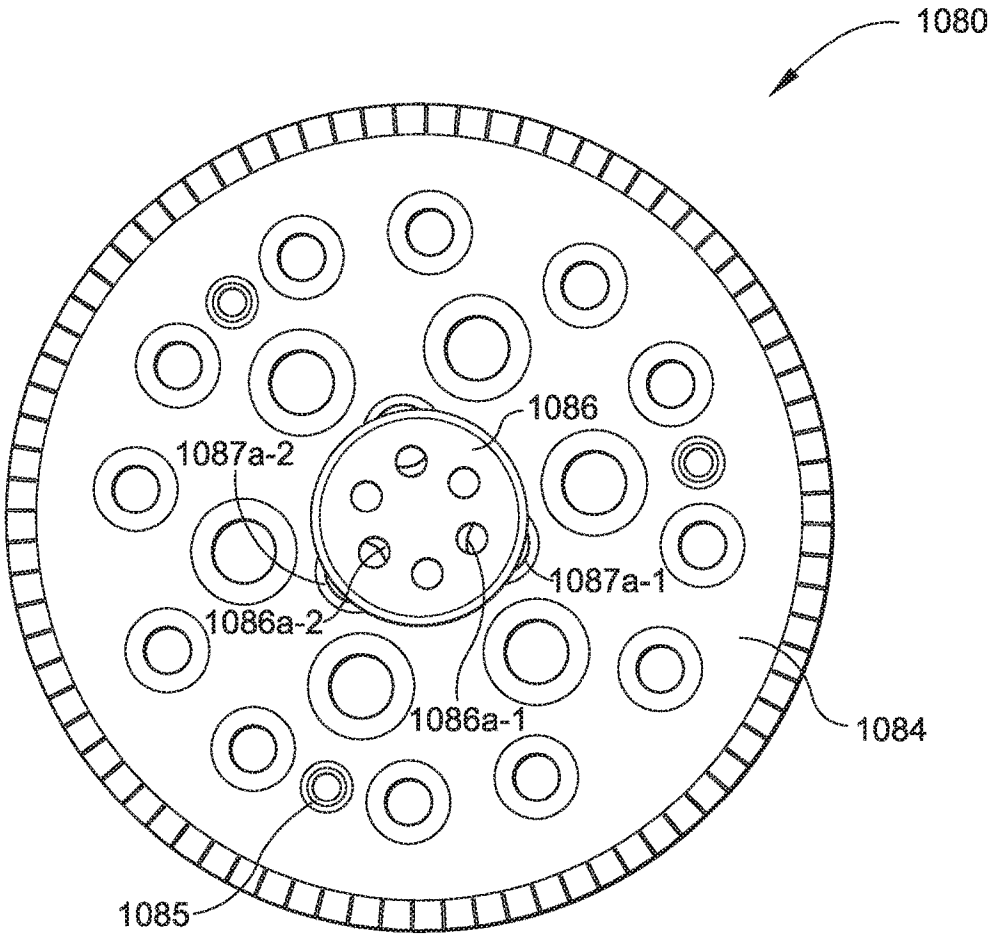
FIG. 41 is a drawing from a photographic representation of the components of FIG. 40 attached to one another.

FIGS. 40, 41, and 42 depict various aspect of a shower head assembly 1080 according to another embodiment of the present invention. FIGS. 40 and 41 show the dispersing member 1084 and central deflector 1086. FIG. 42A, B, C, and D show the central deflector 1086.

Figure 42A:
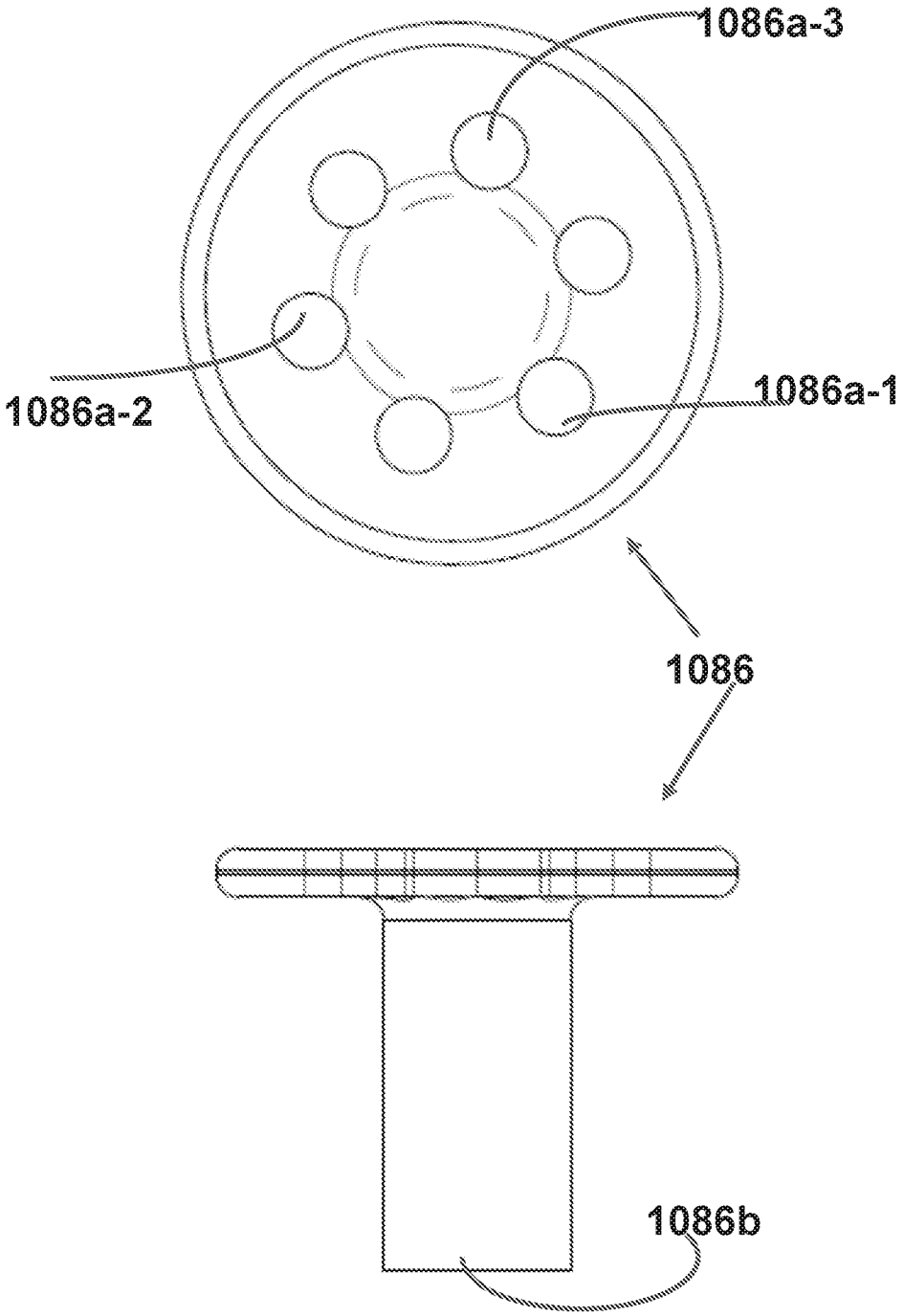
FIG. 42A shows top and side orthogonal views of the central deflector of FIG. 41.

FIGS. 40 and 41 show a dispersing member 1084 including a plurality of flow apertures 1087. Some of these flow apertures are aligned to receive flow more directly from certain flow apertures 1086*a* of a central deflector 1086. Referring to FIG. 41, it can be seen that when central deflector 1086 is aligned within standoff 1085*b*, that flow apertures 1086*a*-1 is angularly aligned with a corresponding aperture 1087*a* -1 of member 1084. It can also be seen that there is a second pair of similarly, angularly aligned flow passages 1086*a*-2 and 1087*a*-2. Central standoff 1086 and member 1084 likewise share a third pair of angularly aligned flow apertures 1086*a*-3 (as best seen in the top of FIG. 42A) and a corresponding flow aperture 1087*a*-3. Preferably, the three pairs of aligned apertures (-1, -2, and -3) are spaced apart equally, at 120° increments to provide an unexpectedly superior balance of the total flow exiting from member 1084. It has been found that dispersing members that are not aligned with the outlet member have insufficient flow toward the center part of the flow member, thus depriving the user of sufficient emergency wash in the center of the shower area (which is often pointed at the area of the user most in need of the emergency shower). This alignment between flow apertures 1086*a* and 1087*a* is achieved by a pair of indexing features 1085*b* and 1086*b*. In one embodiment, the central standoff post of deflector 1086 includes a male alignment feature 1086*b* that is received within a female alignment feature 1085*b* of the central standoff 1085. Member 1084 includes a plurality of other standoffs 1085 for alignment of member 1084 with a bowl 1082 (not shown).

Figure 42B:
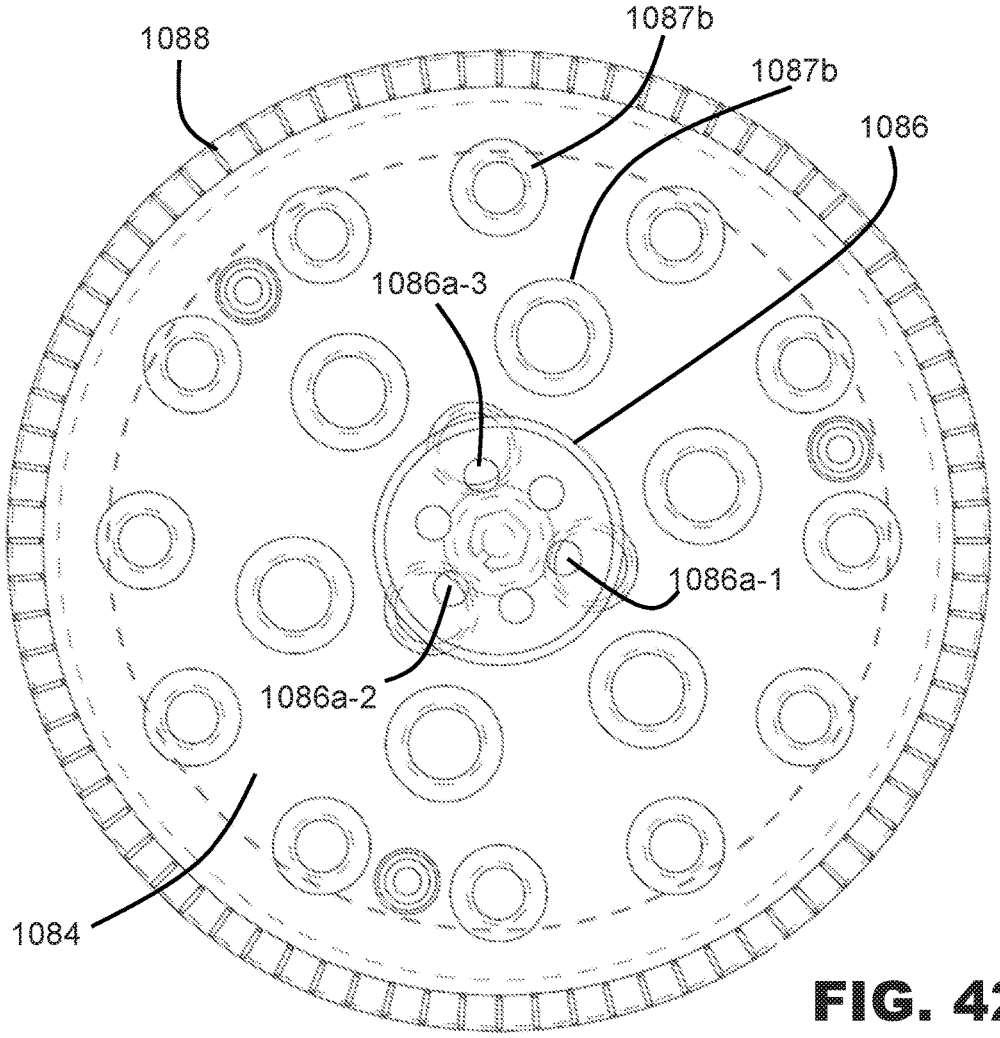
FIG. 42B is a top plan scaled line drawing of the apparatus of FIG. 41.
Figure 42C:
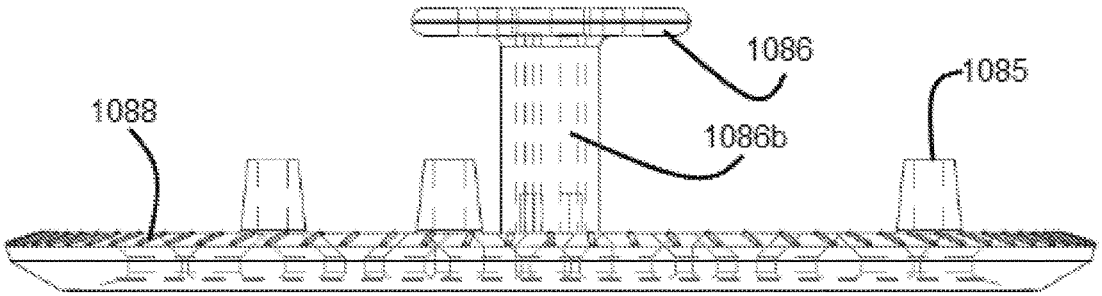
FIG. 42C is a side elevational and orthogonal scaled line drawing of the apparatus of FIG. 42B.
Figure 42D:
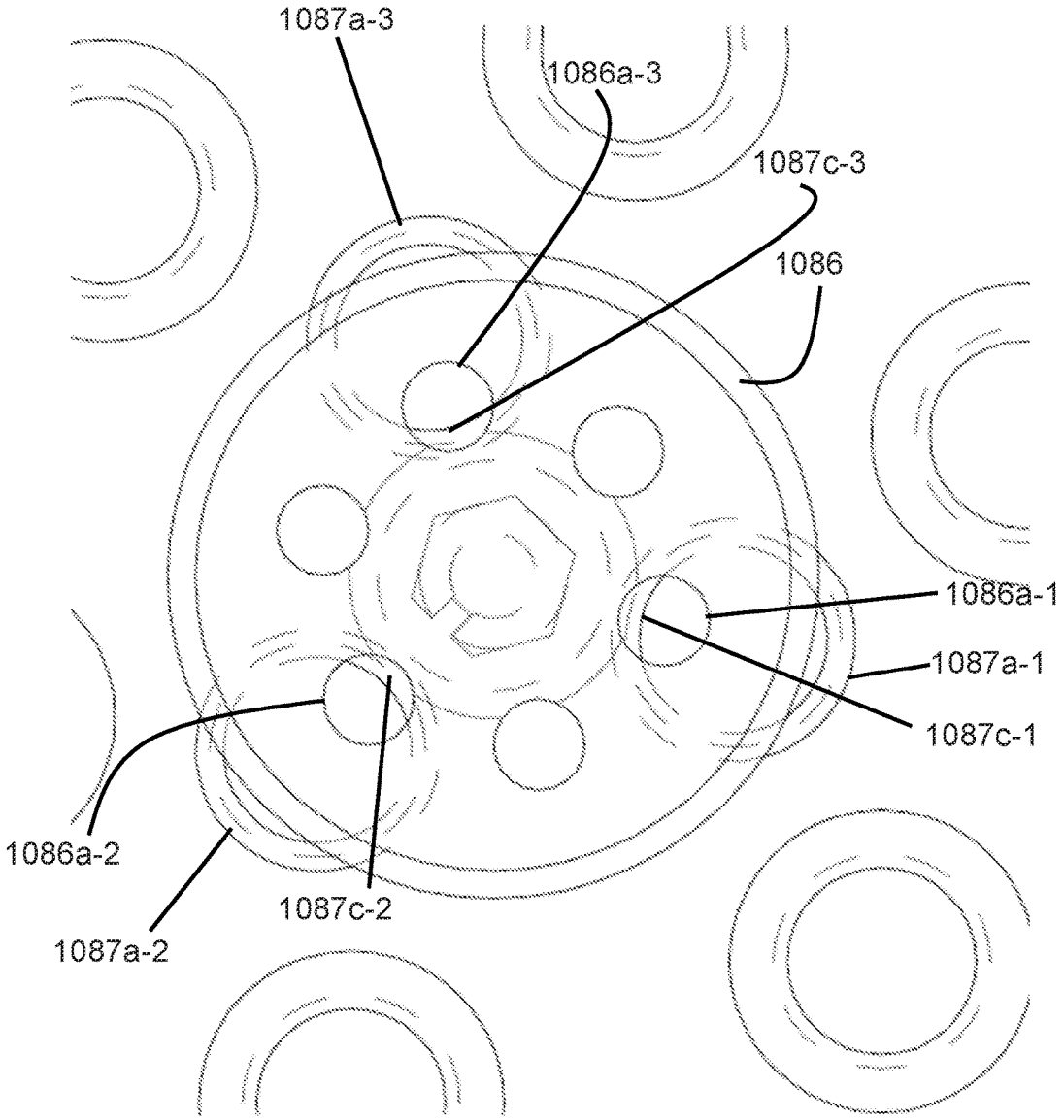
FIG. 42D is a blow-up of the central portion of FIG. 42B.

FIGS. 42B, C, and D show line drawings of the apparatus of FIGS. 40 and 41. It can be seen that the shower head assembly in one embodiment of the present invention includes three passageways (-1, -2, and -3) that have a line of sight from the inlet through deflecting member 1086 and through dispersing member 1084. Therefore, some of the water entering the shower head assembly from the inlet impinges directly upon the flattened mushroom-head of deflector 1086, but passes through apertures 1086*a*-1, -2, and -3. Referring to FIG. 42D, it can be seen that a portion of the flow areas of apertures 1086 area aligned with the larger flow areas of the three corresponding flow passages 1087. It is through these overlapping flow areas that water can flow directly in a line of sight from the inlet to the user. However, it can also be seen that the apertures 1086 describe an area having a different portion that results in water from the inlet impinging on the boundaries 1087*c* of the corresponding aperture 1087*a*. Thus, some of the water that enters through the inlets passes through the apertures of the mushroom-head, but are then deflected by the circumferentially inner-most boundary of the underlying aperture of the dispersing member 1084.

Figure 43:
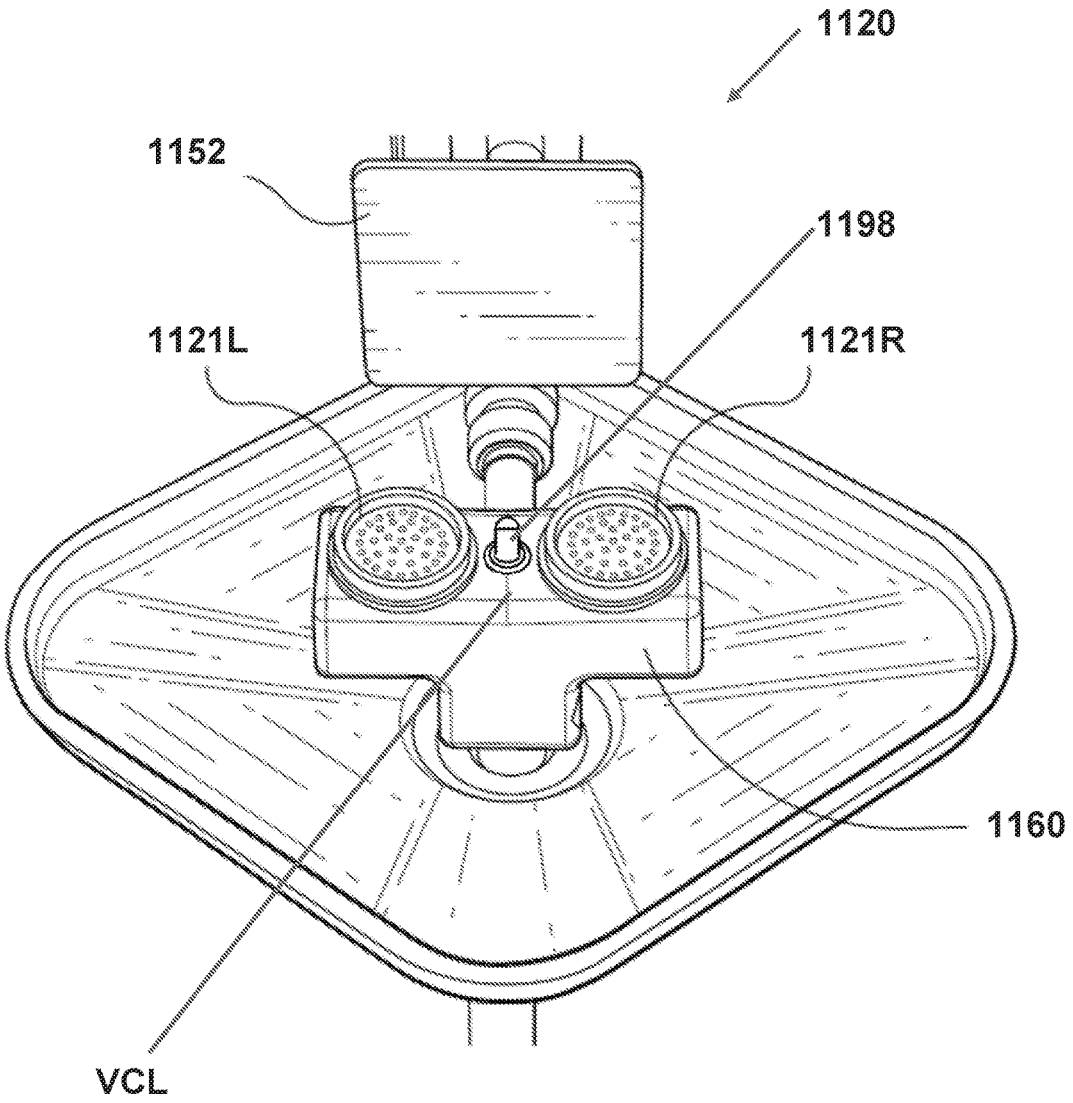
FIG. 43 is a top, front perspective line drawing of portions of an eye wash system according to another embodiment of the present invention.
Figure 44:
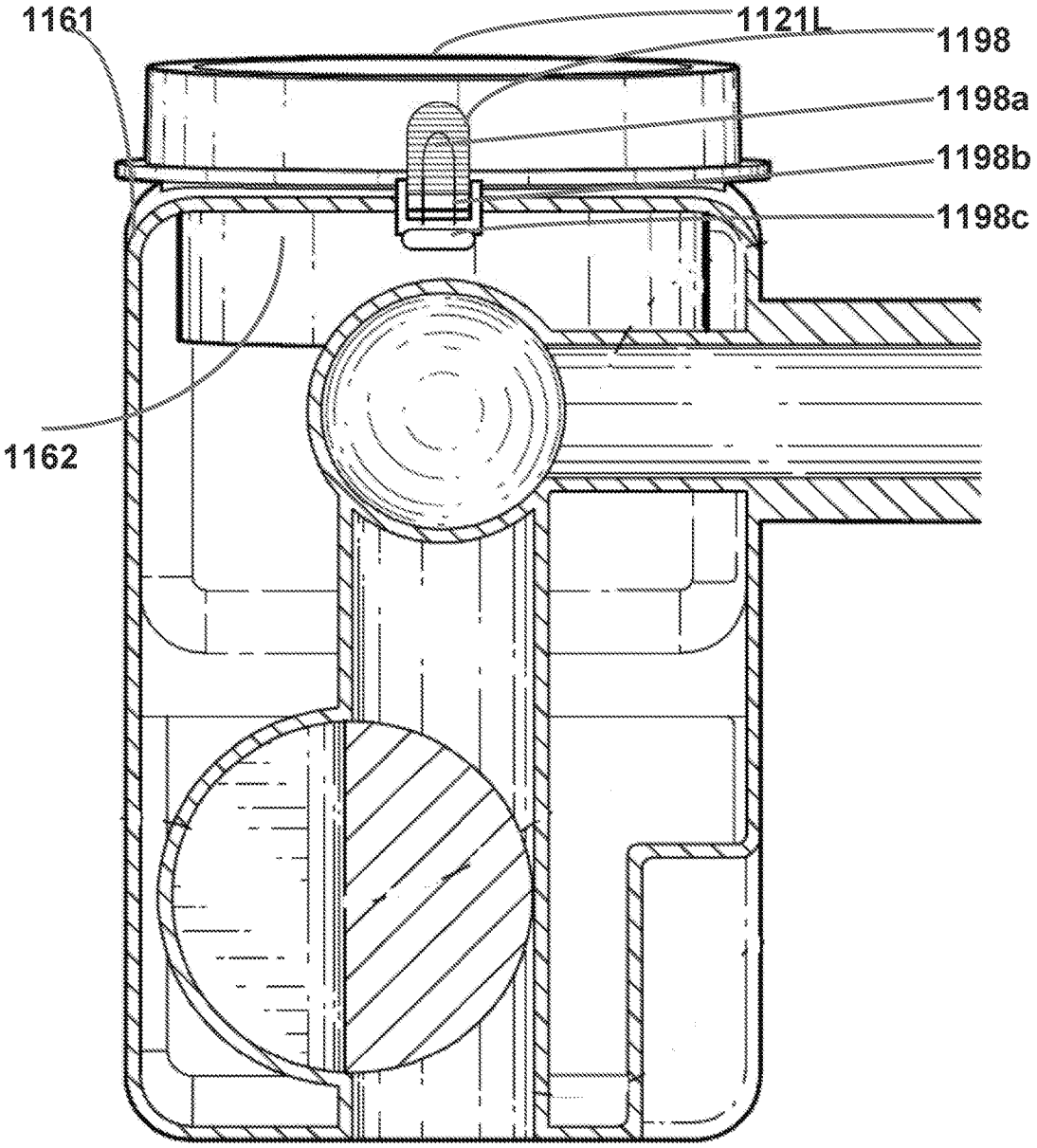
FIG. 44 is a side elevational, cross-sectional representation of a portion of the apparatus of FIG. 43 as taken down the middle of the apparatus.

FIGS. 43 and 44 depict various views of portions of an eye wash system 1120 according to another embodiment of the present invention. Eye wash 1120 is generally similar to eye wash systems X20 shown herein, including a shut off paddle 1152 that actuates a shut off valve for the supply of water to an outlet valve 1160. Outlet valve 1160 includes a pair of dispensing caps 1121L and 1121R that provide a flow of water to left and right eyes of a user.

Valve 1160 includes a visual indicator 1198 that assists the user in aligning his eyes for proper orientation with the dispensing caps 1121. As best seen in FIG. 44, visual indicator 1198 in one embodiment includes a light source 1198*a*, such as an LED. LED 1198*a* is operatively connected to a sensor 1198*c* that receives electrical power from a battery 1198*b*. Sensor 1198*c* in some embodiments is a sensor and switch that is normally open between leads, but closes the connection in the presence of water. For example, when the shut off valve 1150 is opened and water fills up internal chamber 1162, sensor 1198 closes its circuit in response to being wet and thereby provides a voltage to LED 1198*a*. Light from LED 1198*a* is visible to the user and identifies to the user the vertical center line (VCL) of valve 1160. The user recognizes that this light should be generally centered, and is thereby given a visual cue as to proper alignment of the user's head. In yet other embodiments, sensor 1198*c* is of the positional type and senses a change in the position of the shut off valve from the closed to the open state.

Figure 45:
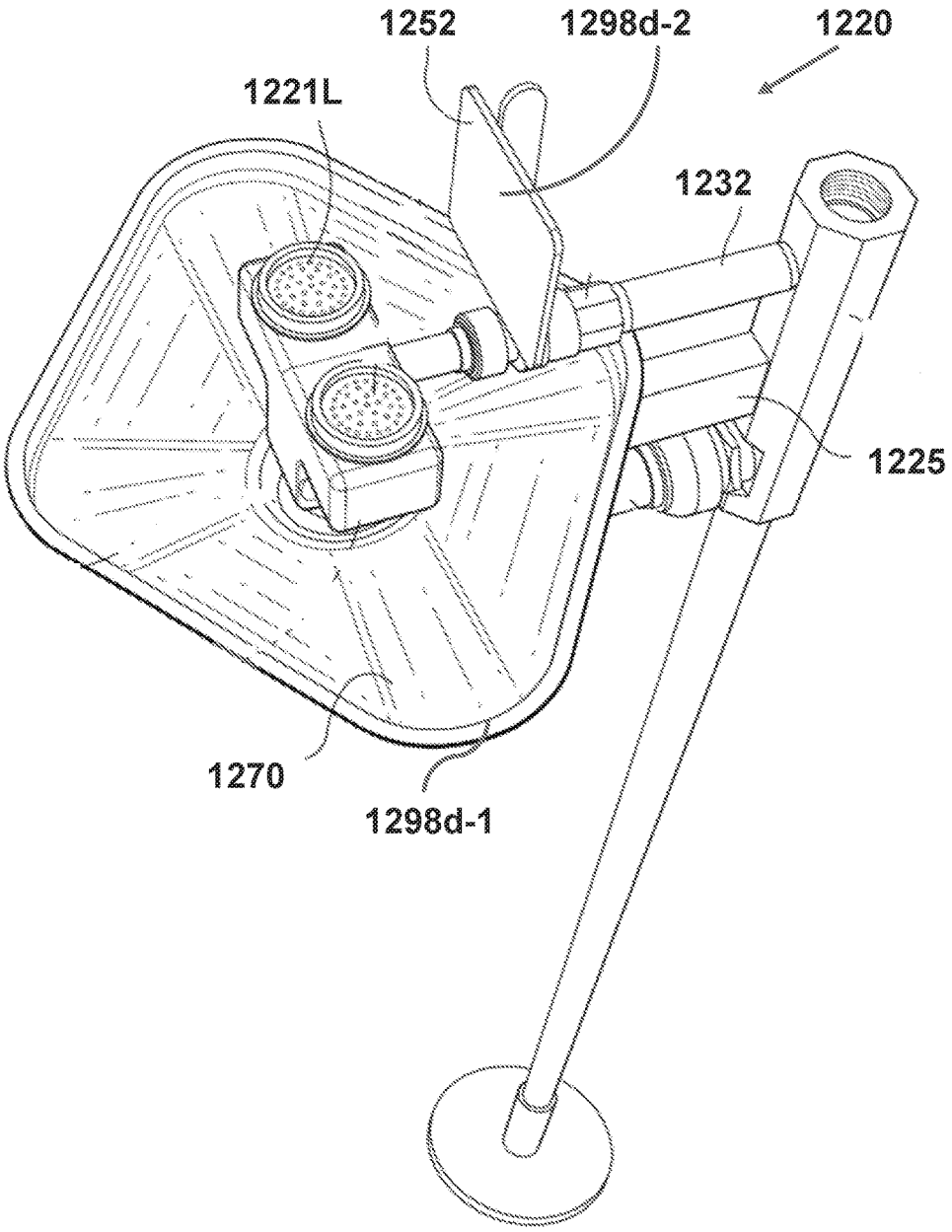
FIG. 45 is a top, right side perspective line drawing of an eye wash system according to another embodiment of the present invention.

FIG. 45 shows an eyewash system 1220 according to another embodiment of the present invention. Eyewash 1220 is similar to the eyewash systems X20 discussed herein except for including visual indicators 1298. Eyewash 1220 includes a return wash basin 1270 and a paddle shut off 1252 that also function as visual indicators 1298*d*-1 and 1298*d*-2, respectively. In one embodiment, basin 1270 is molded from a plastic material that incorporates a phosphorescent pigment, such as strontium aluminate, zinc sulfide, or similar materials that act as photoluminescent phosphors. In some embodiments the phosphorescent material is incorporated into the plastic during the molding procedure.

Paddle shut off 1252 also uses a phosphorescent material 1298*d*-2 to emit light. In some embodiments, the phosphorescent material is mixed into the plastic base material, whereas in other applications the phosphorescent material is applied as a paint (either to a plastic base material or a metallic base material).

The use of photo luminescent materials in eyewash basin can be helpful during any emergency situation, and especially those emergencies in which the need for the user to wash off is accompanied by a loss of power and subsequent darkness. In such cases, eyewash system 1220 is visible from a distance, with the phosphorescent glow of the basin 1270 and paddle 1252 persisting long enough to aid a user in determining the location of the emergency washbasin. It is further understood that any of the various components of the washbasin can be constructed with a phosphorescent material or coated with a phosphorescent material.

FIGS. 46 through 53 depict still further embodiments of the present invention directed toward emergency eyewash apparatus and methods. Those of ordinary skill in the art will recognize that the embodiments described and shown herein are further applicable to residential washing apparatus and methods, including for the face and hands in a bathroom or kitchen setting. It will be seen that various features and aspects of these eyewash systems (1320, 1420, and 1520) share various features and aspects common with other eyewash systems disclosed herein (including, as examples, a source of water, shut-off valve, and catch basin), while including different apertures, outlets, and functions that provide water for the use of the user. Those of ordinary skill in the art will readily recognize equivalents to these components that are typically used in a residential system, such as the type of shutoff valves (both mechanical and electronic) used in bathroom and kitchen applications, and further the sinks used in such residential applications.

Figure 46:
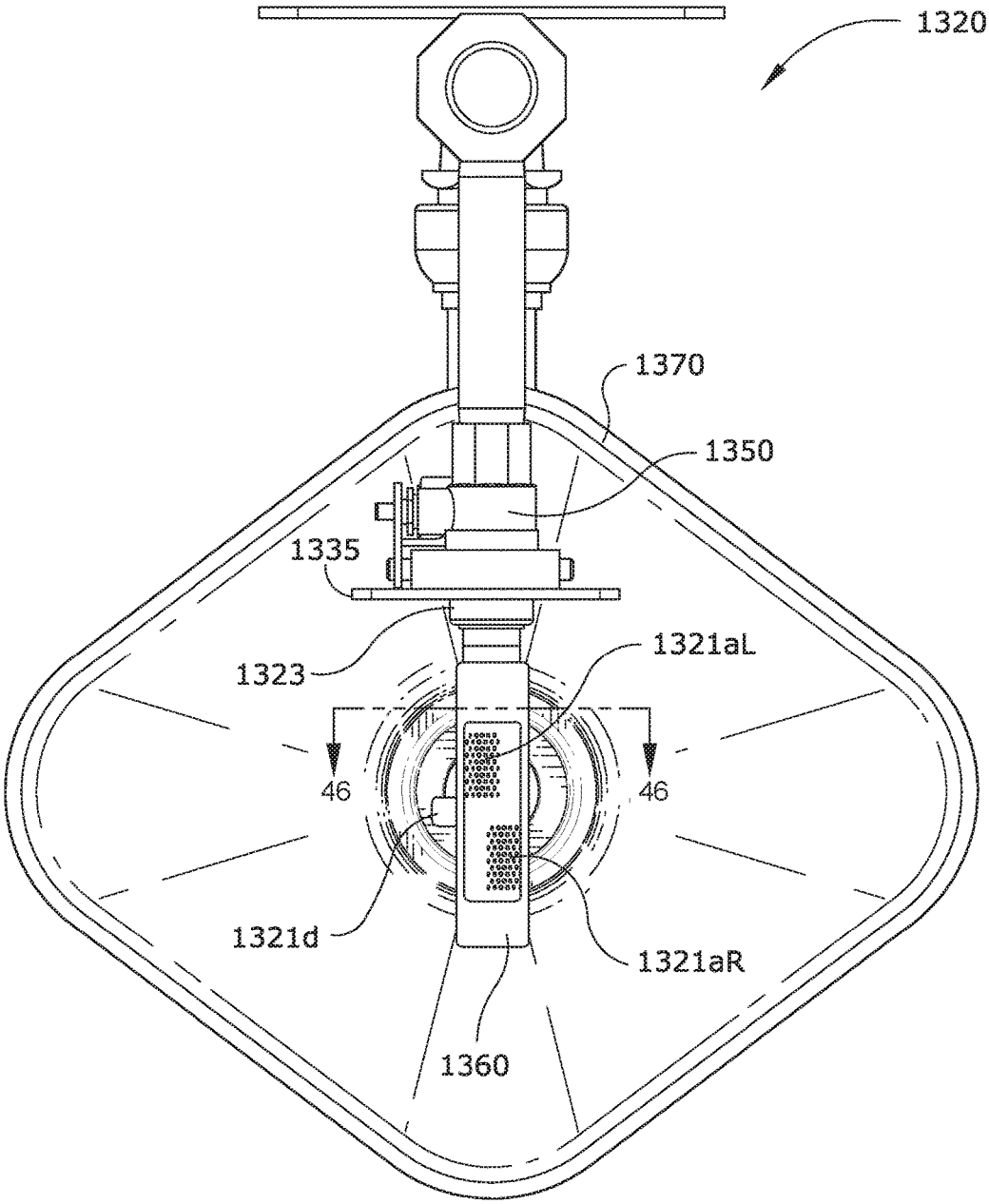
FIG. 46 is a top plan view of an apparatus according to another embodiment of the present invention.
Figure 47:
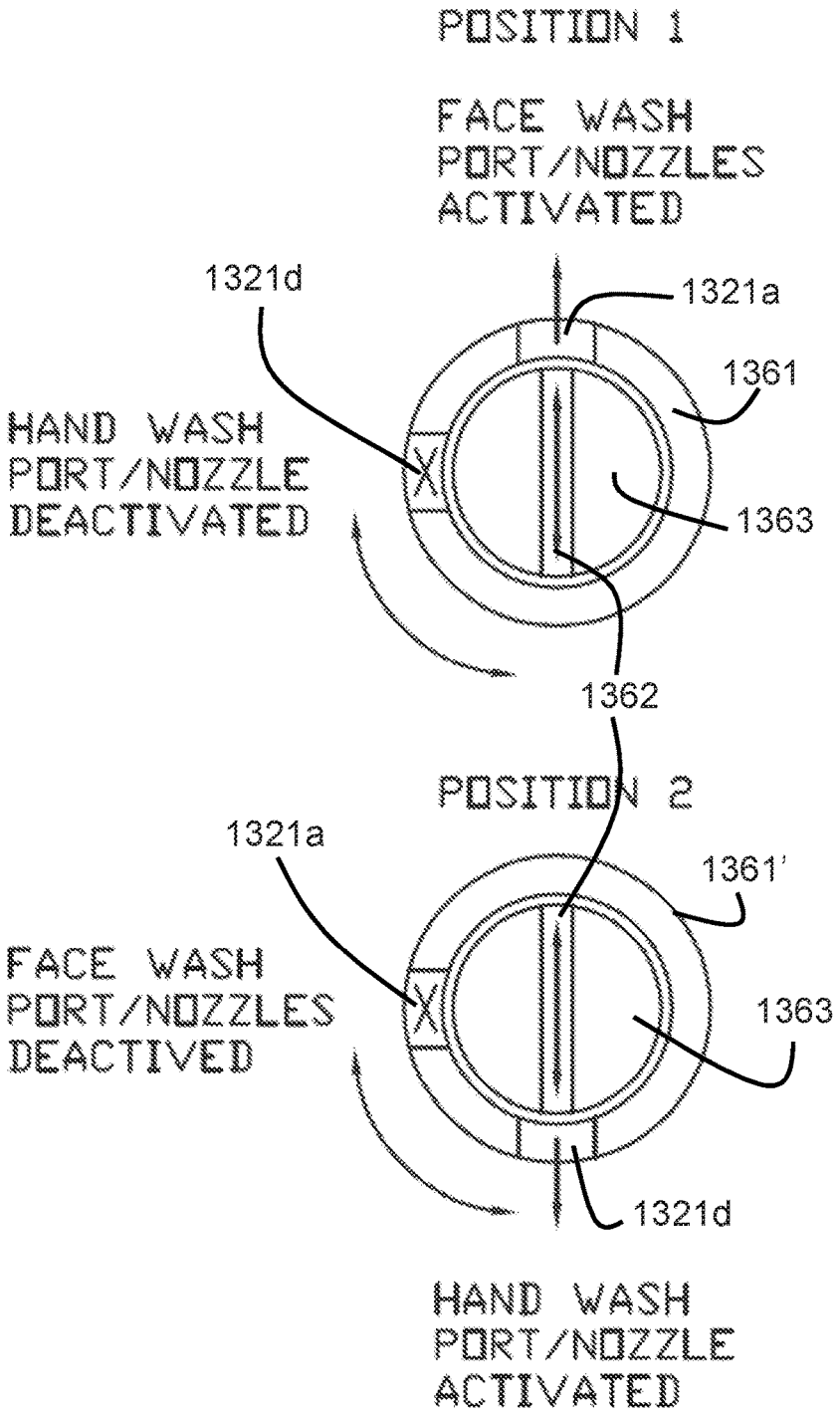
FIG. 47 shows schematic cross sectional views of FIG. 46 with the nozzles in a first position (top), and in a second, rotated position (bottom).

FIGS. 46 and 47 show various aspects of an eyewash system 1320 according to one embodiment of the present invention. System 1320 includes a valve assembly 1360 that comprises an inner member 1363 that is coaxially received within an outer member 1361. Outer member 1361 includes a plurality of flow orifices 1321*a*L directed generally toward the left eye of the user, and a second, axially and circumferentially spaced apart second set of flow apertures 1321*a*R directed generally at the user's right eye. Outer member 1361 further includes a flow outlet 1321*d* directed to provide flow in a direction generally orthogonal to the direction of flow from apertures 1321*a*. However, as will be described, valve assembly 1360 is adapted and configured such that water is provided either to apertures 1321*a*, or to flow outlet 1321*d*, but not to both at the same time.

Valve assembly 1360 preferably includes at least two water-handling components. An inner member 1363 is located at least partly within an outer member 1361. In some embodiments inner member 1363 includes a portion that is exterior to outer member 1361. This exterior portion is inserted into a fitting of system 1320, this fitting receiving water from the shut-off valve. The exterior portion of inner member 1363 includes one or more features that register valve 1360 relative to the fitting. A complementary-shaped set of registration features are located within the attachment fitting, and this complementary-shaped set is held fixed relative to the shut-off valve attachment fitting. Therefore, once the exterior portion of the inner member is inserted into the fitting, the registration features prevent rotation of the inner member.

The inner member receives water from the shut-off valve, and provides that water to one or more circumferential locations and on the inner member. The outer member can be rotated relative to these locations provided with water, such that some of the flow apertures and orifices of the outer member are receiving water, while other apertures or orifices are not receiving water. Preferably, the inner member is held in a static position by eyewash system 1320 so that the user can use a single hand to rotate the outer member, without needing to hold onto the inner member. Preferably, the inner member is held in a fixed position relative to the basin 1370 or relative to the stand holding the basin. Therefore, as the user uses his hand to rotate the outer member of valve 1360, the basin or stand hold the inner member static.

Valve assembly 1360 further includes an inner member 1363 having a flow passage 1362 that provides water from a fitting 1323 that in turn is provided with water from shut-off valve 1350. It is understood that passageway 1362 can receive water from any of various components or fittings, and including in some embodiments from the quick connect "shark fin" hydraulic coupling described elsewhere herein. However, it is also understood that the water provided to passageway 1362 could come from a thermostatically controlled valve, a flow regulating valve, and the like. Further, although passageway 1362 is shown as a single passageway extending through the center of inner member 1363, it is further understood that the provision of water from the shut-off valve could be provided to flow passages of other shapes, and further to flow channels formed between the outer periphery of inner member 1363 and the inner surface of outer member 1361.

As best seen in the top of FIG. 47, outer member 1361 is oriented such that flow is provided to the plurality of apertures 1321*a* identified schematically in FIG. 47. The apertures 1321*a* are generally aligned and therefore in fluid communication with inner passage 1362. However, one or more sealing surfaces are located between the outer surface of inner member 1363 and the inner surface of outer member 1361, such that flow exiting inner passage 1362 is not communicated to flow passage 1321*d* in the first eyewash and face wash position shown at the top of FIG. 47.

The bottom schematic of FIG. 47 shows a cross section of valve 1360 after outer member 1361 has been rotated counterclockwise by about ninety degrees. Since the inner member 1363 is held statically in a generally fixed position by the structure of eyewash system 1320, the counterclockwise rotation of outer member 1361 results in a movement of flow orifice 1321*d* to a bottommost position in which it achieves fluid communication with inner flow passage 1362. Flow from the shut-off valve is free to pass through inner passage 1362, and flow out of the preferably aerated flow nozzle receiving water from flow orifice 1321*d*. As shown in position 2, water from the shut-off valve flows directly toward basin 1370. In this location, the water could be used to wash the user's hands, to flow into a cup for drinking, or for other purposes. However, the sealing surfaces between inner member 1363 and outer member 1361 shut off the flow of water to the washing apertures 1321*a*, now located on the side of valve assembly 1360.

Figure 48:
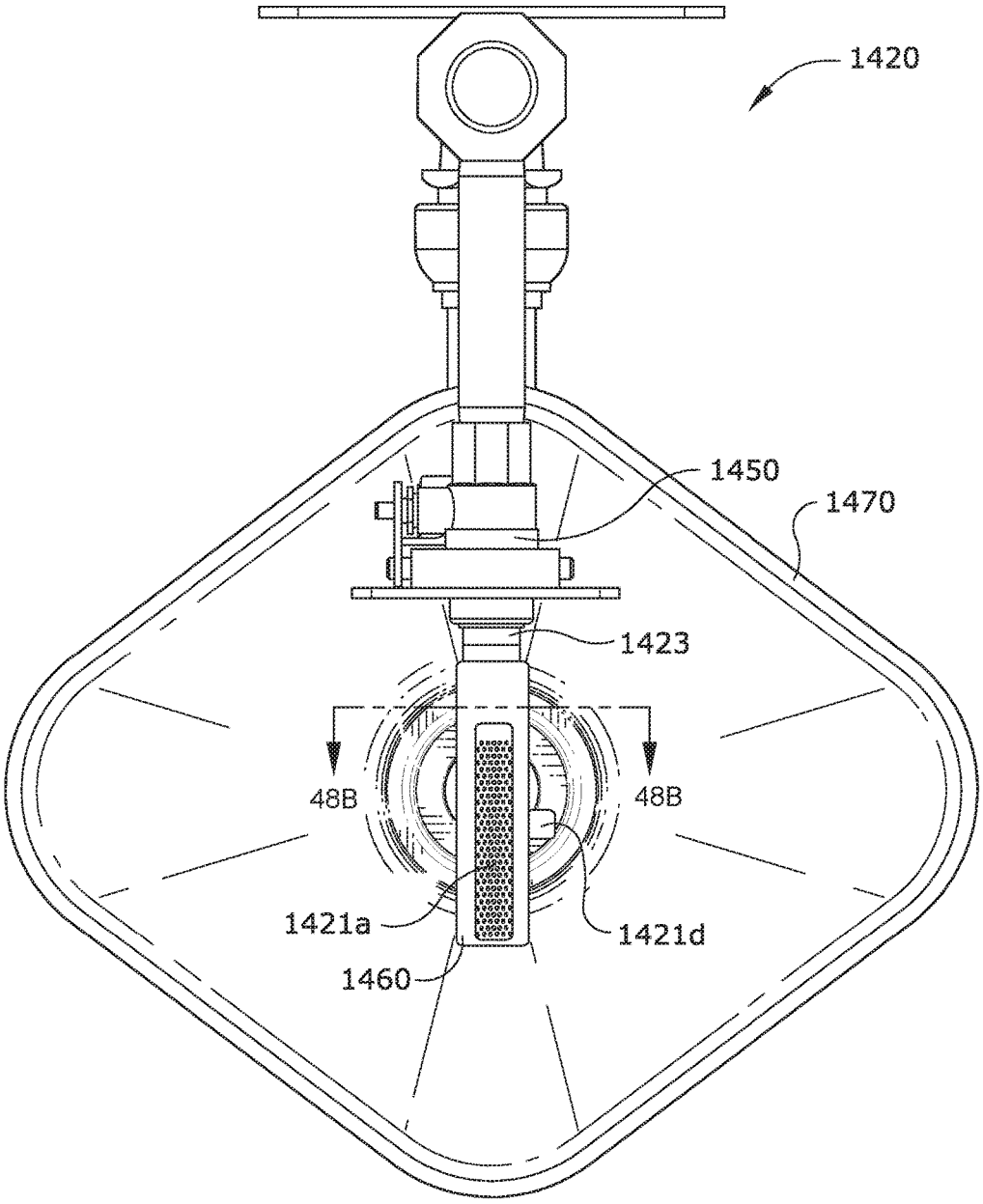
FIG. 48 is a top plan view of an apparatus according to another embodiment of the present invention.

FIGS. 48 and 49 depict a washing system 1420 similar to system 1320 discussed above. As best seen in FIG. 48, outlet valve 1460 includes a plurality of flow apertures 1421*a* aimed generally upward, and in flow orifice 1421*d* oriented in a lateral direction.

Figure 49A:
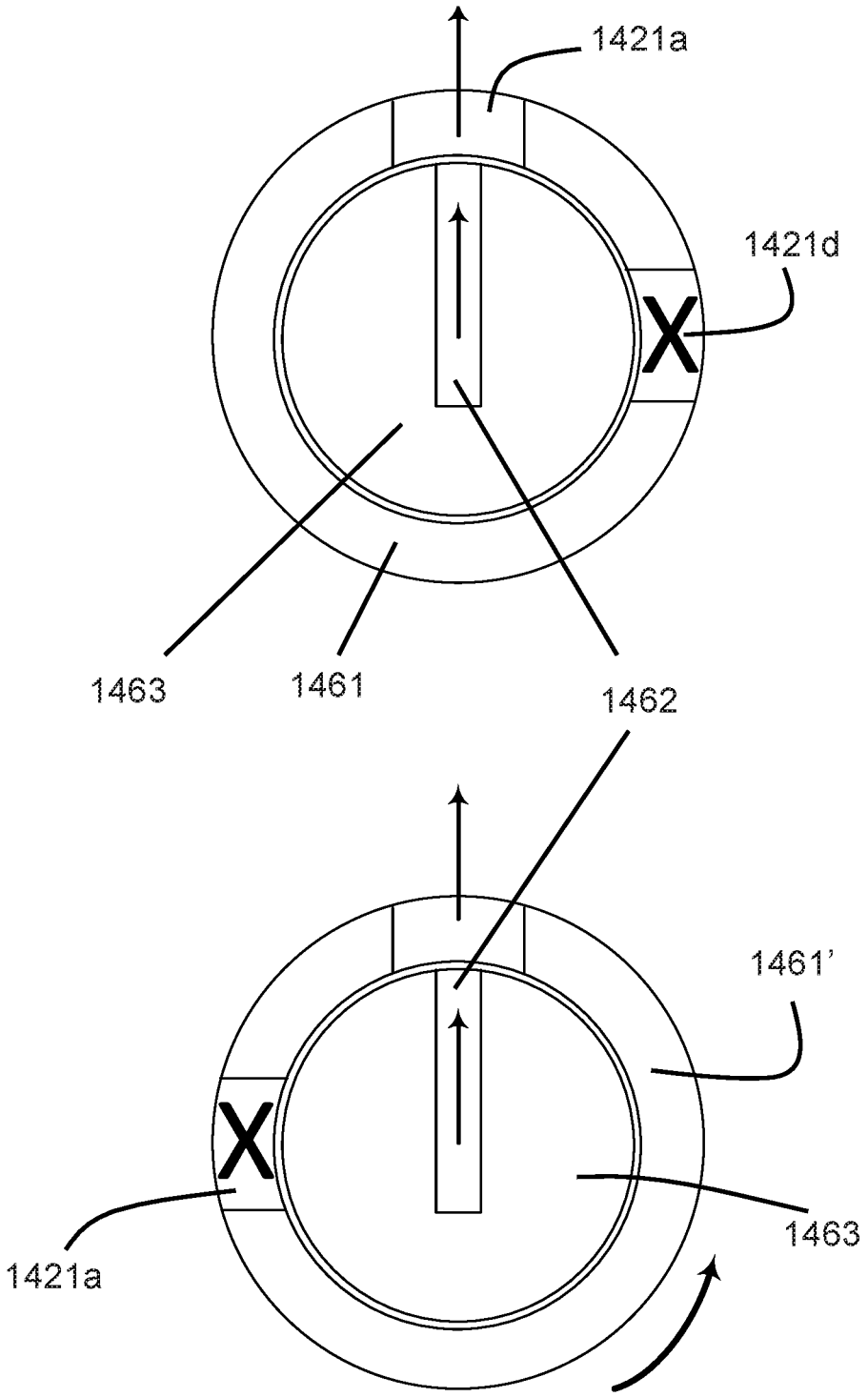
FIG. 49A shows schematic cross sectional views of FIG. 46 with the nozzles in a first position (top), and in a second, rotated position (bottom).

Referring to FIG. 49A, it can be seen that fixed inner member 1463 includes an inner flow passage 1462 that extends generally toward one surface of inner member 1463. As seen in the top figure, in first position the apertures 1421*a* are in fluid communication with and receiving water from inner passage 1462. Referring to the bottom figure of FIG. 49A, it can be seen that outer member 1461 has been rotated about 90 degrees counterclockwise, such that a flow orifice 1421*d* now receives water from inner passage 1462. Still further, the flow of water has been cut off from apertures 1421*a*, which are now oriented laterally on valve 1460.

Figure 49B:
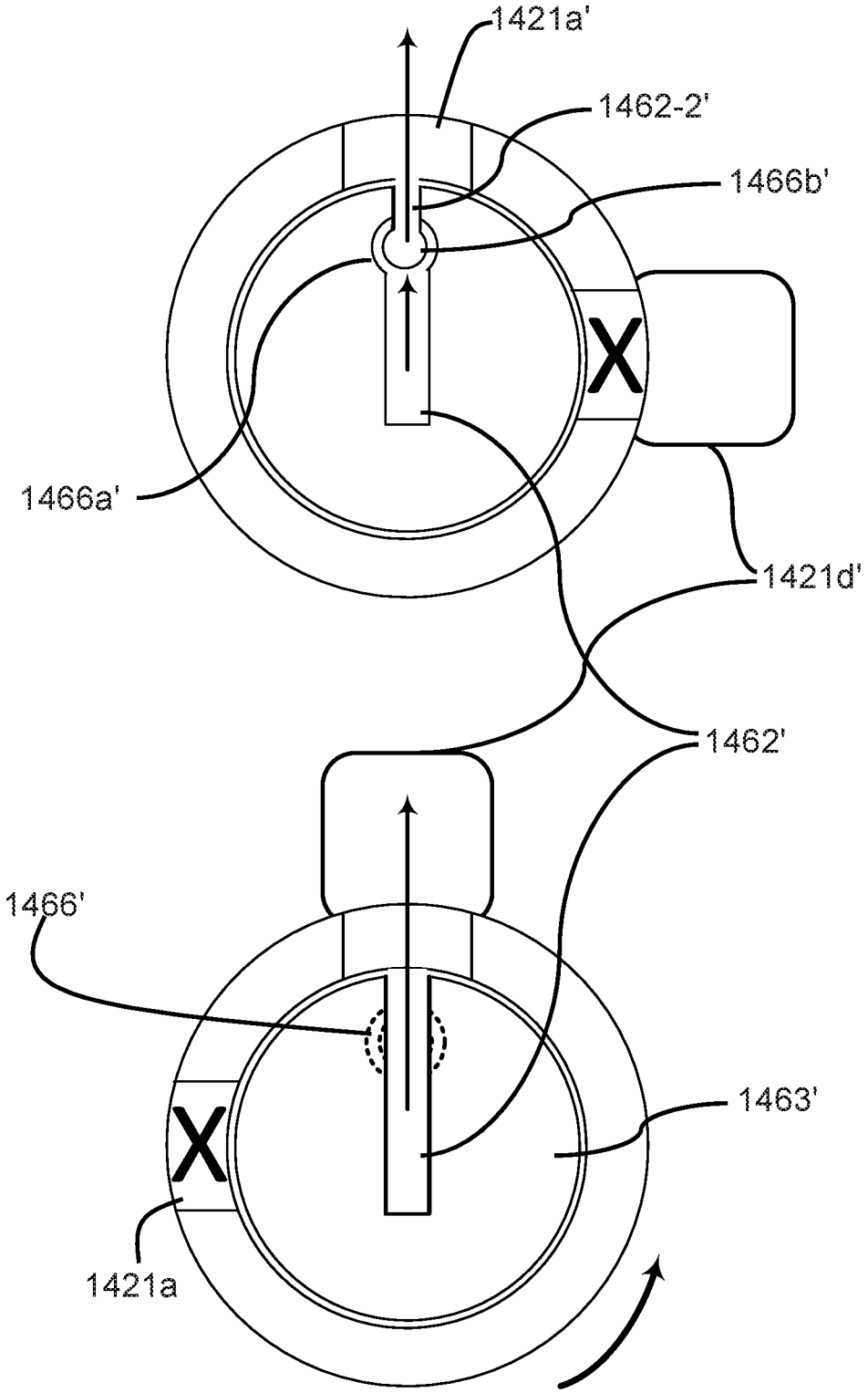
FIG. 49B is a cross sectional view of an alternative of FIG. 46, and including a flow control valve for metering and/or limiting of the output flow of the eyewash apertures to a predetermined range.

An alternative flow circuit can be seen in FIG. 49B. Various embodiments of the present invention include an alternative configuration in which there is a flow control valve 1466' that limits the amount of water flowing from the face wash or eyewash apertures to a predetermined range. In some of these embodiments, the internal chamber 1462' (that extends within water inlet 1463') extends a first length, at the end of which it provides fluid communication to aerator 1421*d'*, as shown in the bottom view. However, this internal chamber extends a second length (past the port providing fluid communication to the aerator) to an internal flow control valve 1466'. Water is provided through this extension of inlet 1462' to, in some embodiments, the fixed member 1466*a'* of the flow control device 1466'. The variable member 1466*b*' is in fluid communication with a flow passage extension 1462-2' that provides the limited range of flows to the eyewash apertures 1421*a*', as shown in the top view. In some embodiments, the flow controlling device 1466 can further be a simpler fixed orifice or other means for reducing flow.

In these embodiments, the flow provided to the eyewash nozzles (which is primarily directed vertically upward) has an upper limit of water flow that is less than the water flow provided to the aerated nozzle. In this manner, the full flow of aerated water typically expected by a user is provided through the aerated nozzle, but a lesser flow is provided for face washing, so as to keep the upward flow from extending too high and causing spillage. It is understood that the embodiment shown in FIG. 49A and 49B shows the aerated nozzle pointed vertically upward. Yet other embodiments are contemplated herein in which the flow of the aerated nozzle is provided vertically downward for washing of the user's hands.

FIGS. 50 to 53 show a washing system 1520 according to another embodiment of the present invention. System 1520 includes an inner member 1563 and outer member 1561 that are generally T-shaped. A plurality of apertures 1521*a* extend generally along the outer surface of valve 1560, in a pattern that extends across a portion of the cross sectional circumference, and generally along the length of the cylindrical shape parallel to the centerline of the outer member 1561. The inner member 1563 of system 1520 includes an interior portion that extends at least partly within the outer member 1561, so as to provide water to either of the flow outlets 1521*a* or 1521*b*. However, a portion of the inner member 1563 can have, in some embodiments, an exterior surface that is attachable by way of a shark fin or similar quick connect coupling 1523 to a complementary quick connect fitting, such that the exterior portion of inner member 1563 held in a fixed orientation relative to the basin 1570 or the stand of system 1520 as sealed and connected to a fitting of system 1520.

Figure 50:
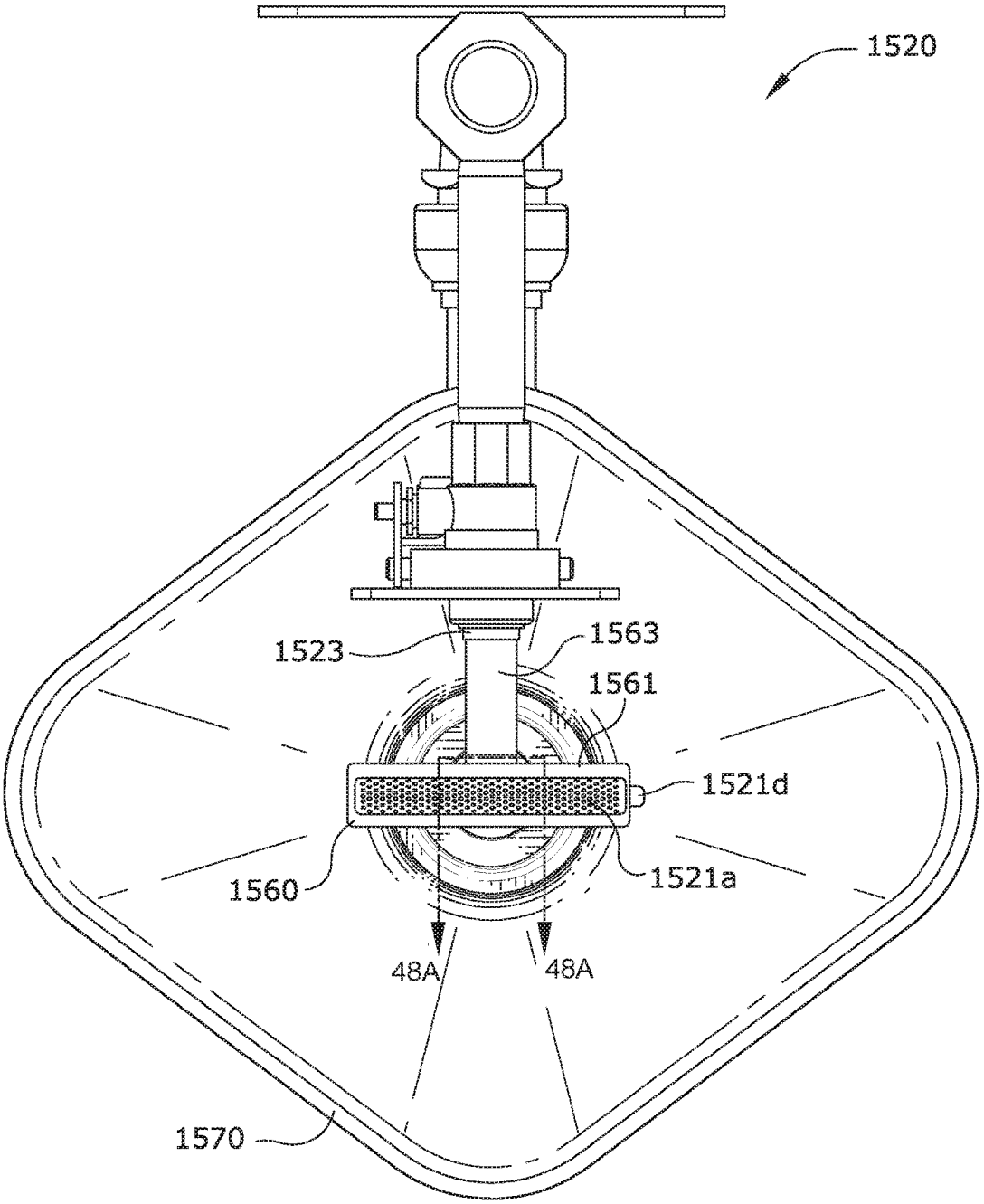
FIG. 50 is a top plan view of an apparatus according to another embodiment of the present invention.
Figure 51:
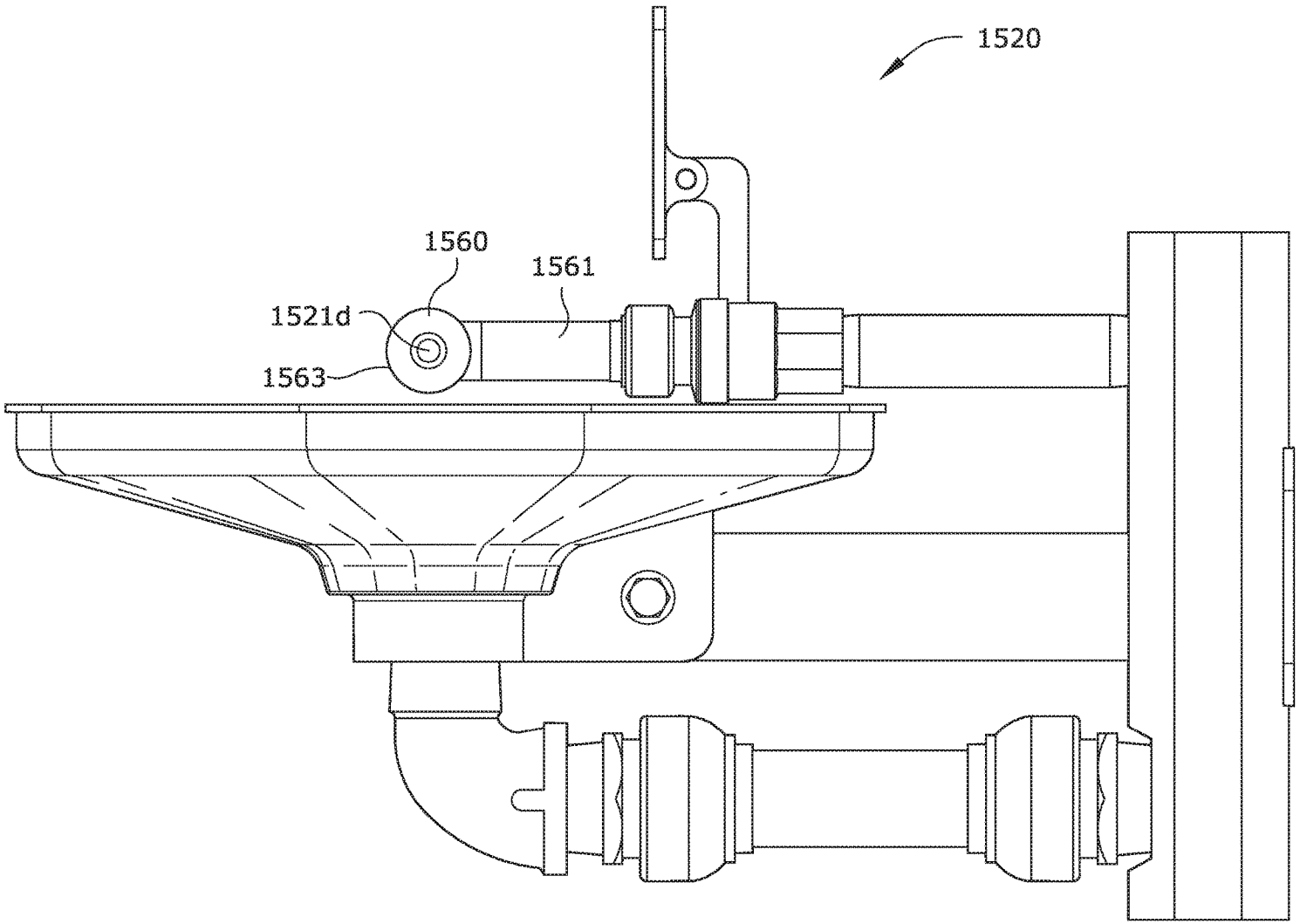
FIG. 51 is a side elevational view of the apparatus of FIG. 50.
Figure 52:
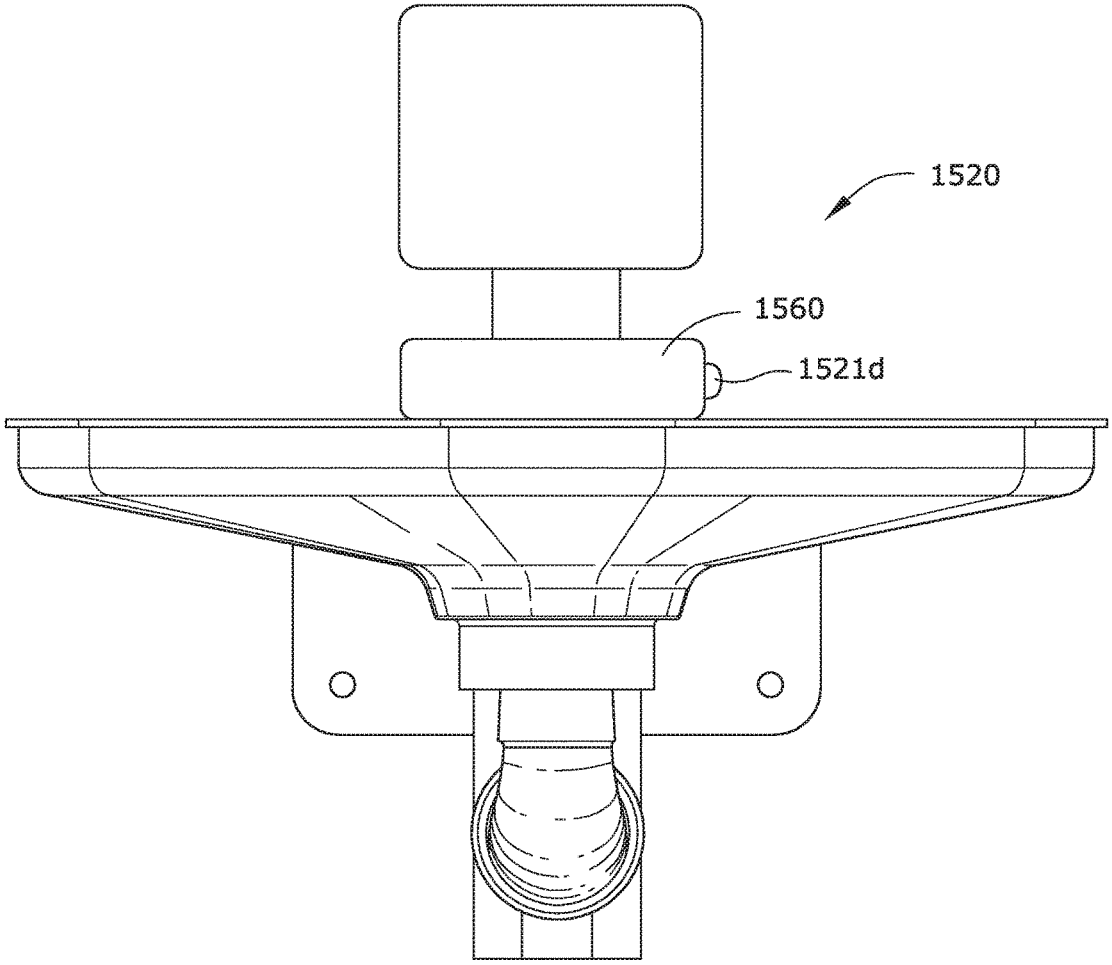
FIG. 52 is a front elevational view of the apparatus of FIG. 50.
Figure 53:
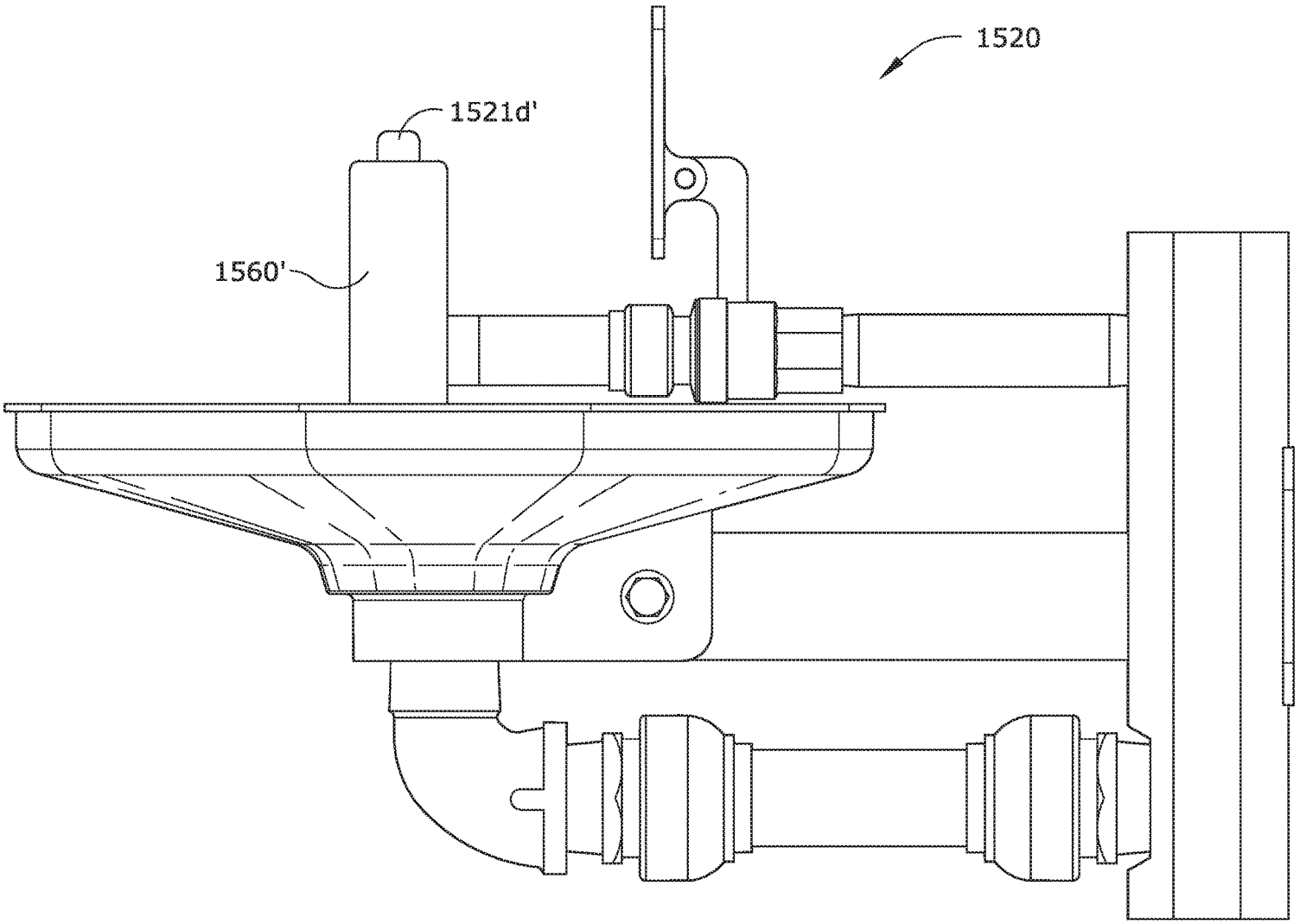
FIG. 53 shows the apparatus of FIG. 51 with the nozzles rotated to a second position.

FIGS. 51 and 52 show orthogonal representations of the apparatus 1520 shown in FIG. 50. FIG. 53 shows the valve 1560 rotated 90 degrees to a location in which water is provided to a flow outlet 1521*d*, and not to the flow apertures 1521*a*. Referring to FIG. 50, a cross sectional view of the apparatus of FIG. 50 is similar to the cross sectional view shown in FIGS. 49 or 47 (except as modified for the particular orientations of flow outlets in system 1520).

Figure 54:
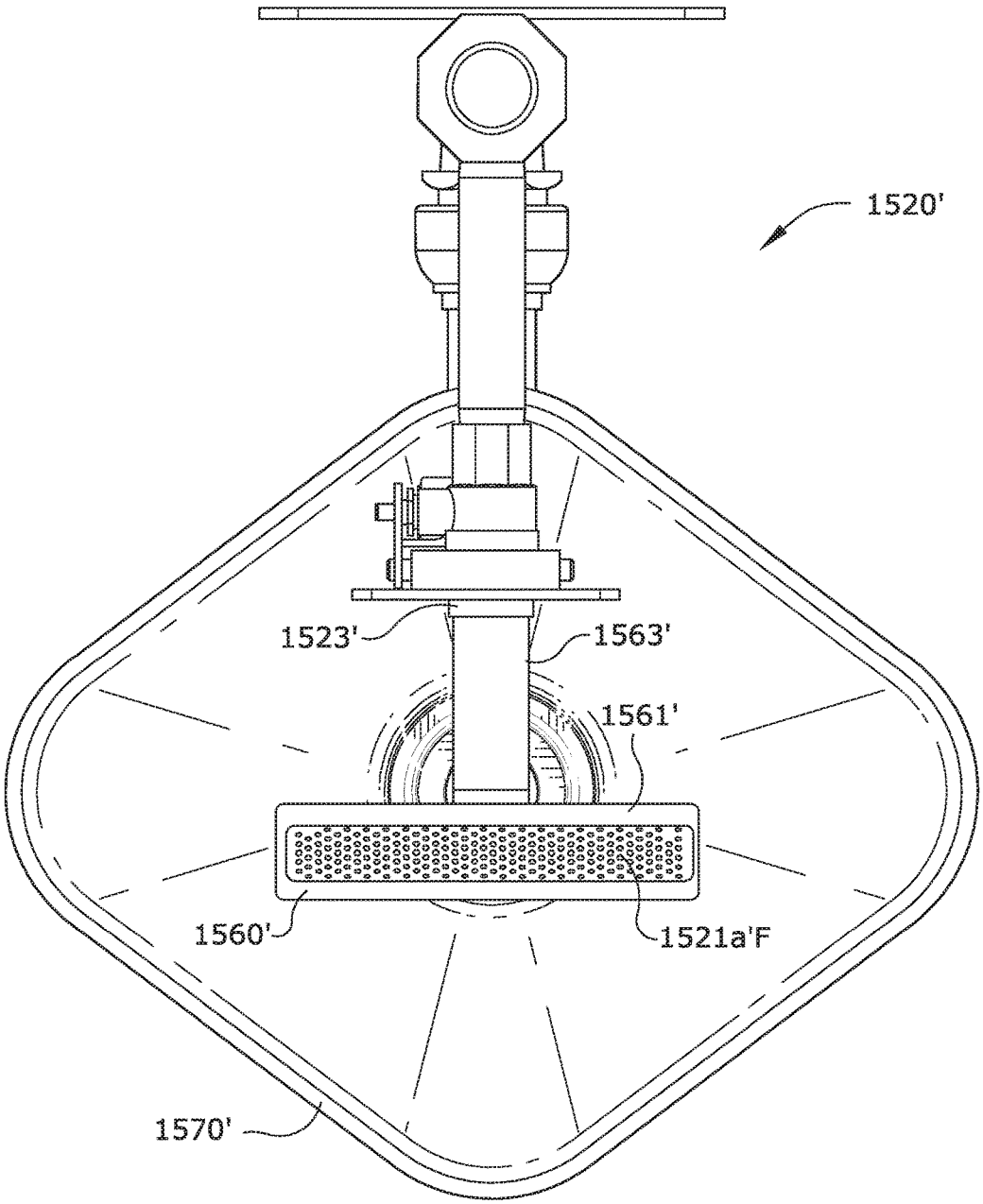
FIG. 54 is a top plan view of an apparatus according to another embodiment of the present invention, adjusted to provide a face wash.
Figure 55:
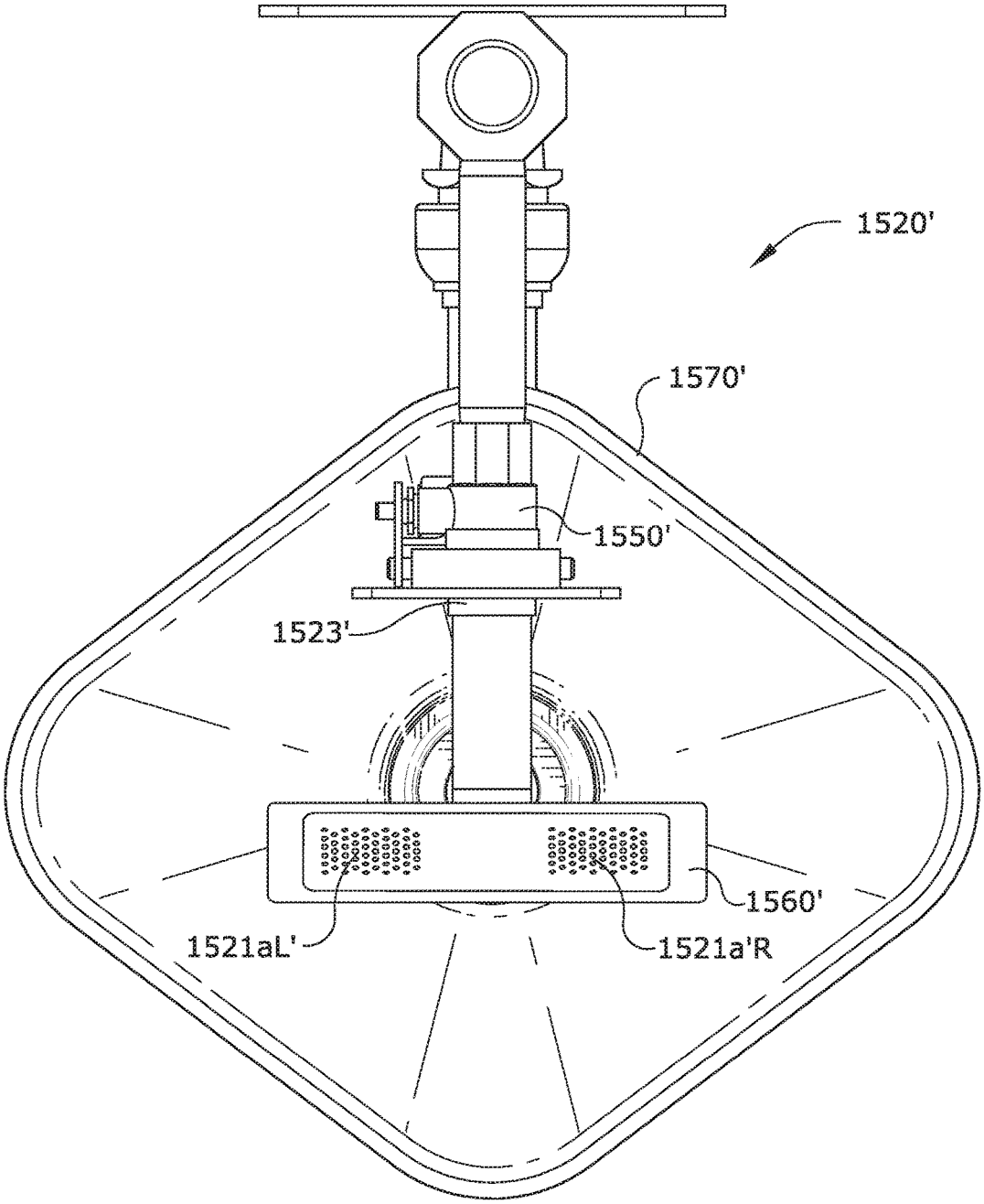
FIG. 55 shows the apparatus of FIG. 54 adjusted to provide an eyewash.
Figure 56:
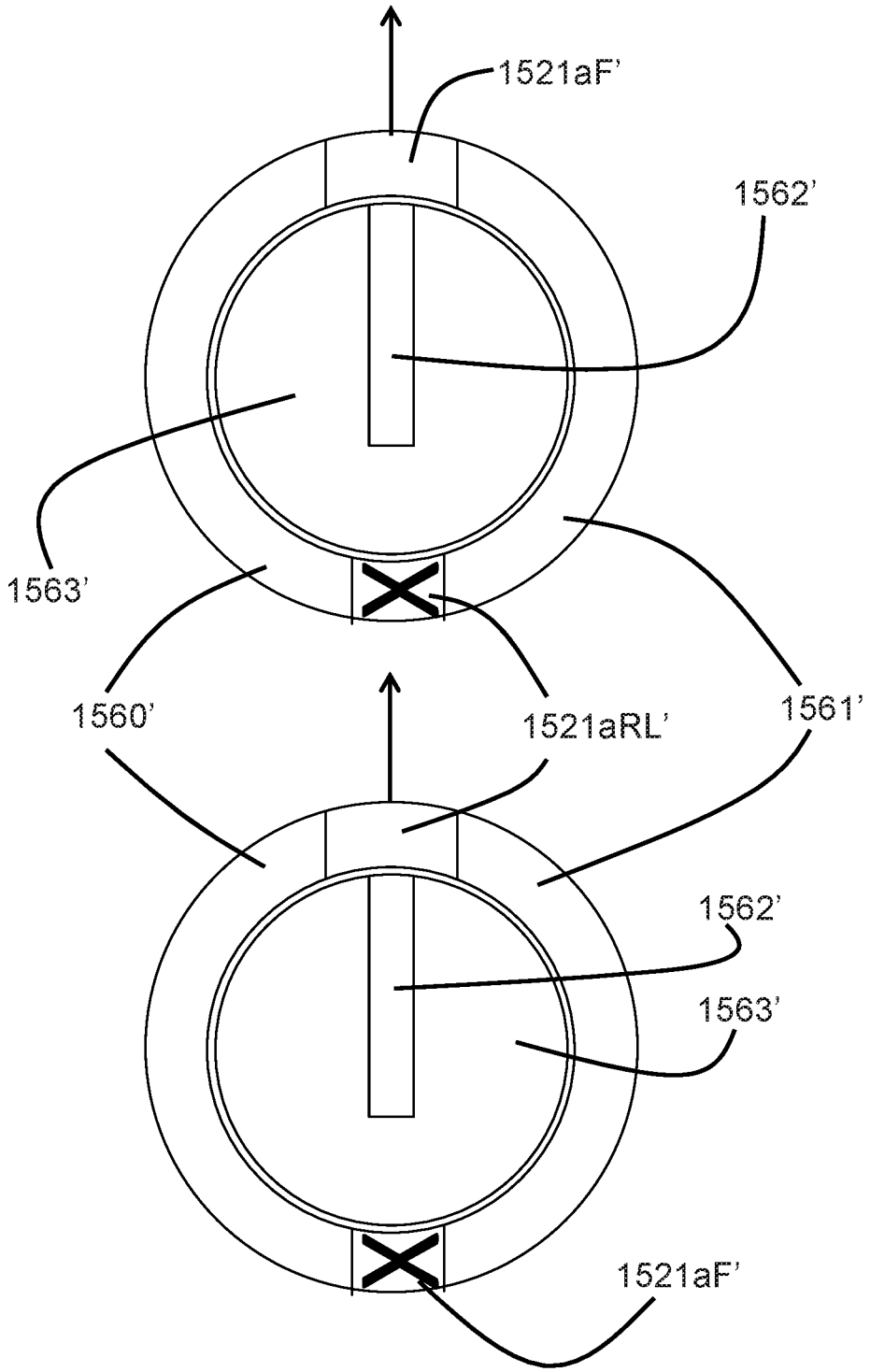
FIG. 56 shows cross sectional views of the two positions of the fluid connection between the inner flow passage and the face wash apertures (top view) and the eyewash apertures (bottom view).

FIGS. 54, 55, and 56 show a washing system 1520' according to another embodiment of the present invention. In some embodiments, washing system 1520' is adapted and configured to provide either an emergency facewash or an emergency eyewash, depending upon how the user has oriented the outer member 1561' of valve 1560' relative to an inner member 1563'. System 1520' includes an inner member 1563' and outer member 1561' that are generally T-shaped, but those of ordinary skill in the art will recognize combinations of inner members and outer members that may be in substantial alignment, Y-shaped, U-shaped, and other arrangements.

A plurality of facewash apertures 1521*a*F' extend generally along one side of the outer surface of valve 1560', in a pattern that extends across a portion of the cross sectional circumference, and generally along the length of the cylindrical shape perpendicular to the centerline of the outer member 1561'. A second plurality of apertures 1521*a*R' and 1521*a*L' extend generally along the opposite side of the outer surface of valve 1560', in a pattern that extends across a portion of the cross sectional circumference, generally along the length of the cylindrical shape parallel to the centerline of outer member 1561', and in left and right groupings that provide eyewashing to the corresponding left and right eyes.

The inner member 1563' of system 1520' includes an interior portion that can extend at least partly within the outer member 1561', so as to provide water to flow outlets 1521*a*F'. However, a portion of the inner member 1563' can have, in some embodiments, an exterior surface that is attachable by way of a shark fin or similar quick connect coupling 1523' to a complementary quick connect fitting, such that the exterior portion of inner member 1563' held in a fixed orientation relative to the basin 1570' or the stand of system 1520' as sealed and connected to a fitting of system 1520'.

Those of ordinary skill in the art will recognize that the description provided herein is further applicable to those washing systems 1520' that include a set of flow apertures 1521*a*F' that can be used (as shown in FIG. 50) for a first, relatively larger upward spray pattern adapted and configured to provide an upward flow of water suitable for washing the users face. The apparatus 1520' further includes a second set of flow nozzles 1521*a*R' and 1521*a*L' (similar to those best seen in FIG. 46), but located on the opposite side of body 1561', such that rotation of body 1561' about the axis defined by water inlet 1563' results in an upward spray in two discrete sprays, and suitable for washing of the user's eyes.

FIG. 56 schematically depicts an interface between the water inlet and the apertures of the outlet valve 1560' according to one embodiment of the present invention. It can be seen in the top view that the outer member of valve 1560' has been rotated such that the face washing orifices 1521*a*F' are pointed generally upward, and are in fluid communication with an internal chamber 1562' that receives water from the outlet of the shutoff valve 1550'. In the configuration shown in the top of FIG. 56, water is not able to flow into the downward-directed fittings 1521*a*RL'. However, as best seen in the bottom view of FIG. 56, the body 1561' can be rotated about the axis of its interface with the water inlet 1563', such that the right and left flow apertures 1521*a*R' and 1521*a*L' are in fluid communication with the internal passageway 1562'. However, as shown in the bottom of FIG. 56, water is not able to flow downward through the face wash orifices 1521*a*F'.

Referring to FIG. 56, it can be seen that fixed inner member 1563' includes an inner flow passage 1562' that extends generally toward one surface of inner member 1563'. As seen in the top figure, in first position the apertures 1521*a*' are in fluid communication with and receiving water from inner passage 1562'. Referring to the bottom figure of FIG. 56, it can be seen that outer member 1561 has been rotated about one hundred eighty degrees counterclockwise, such that a flow orifice 1521*d*' now receives water from inner passage 1562'. Still further, the flow of water has been cut off from apertures 1521*a*', which are now oriented laterally on valve 1560'.

Figure 57:
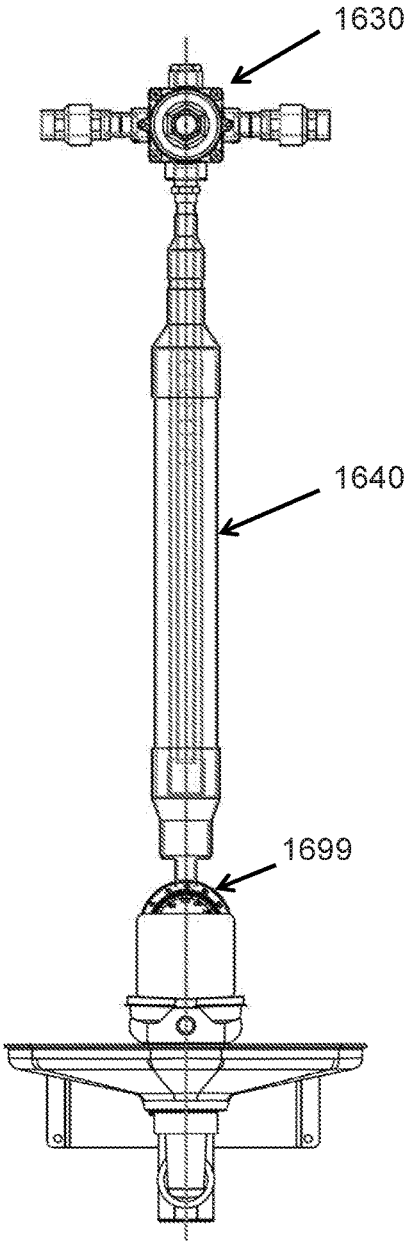
FIG. 57 is a front elevational view of an apparatus according to yet another embodiment of the present invention.
Figure 58:
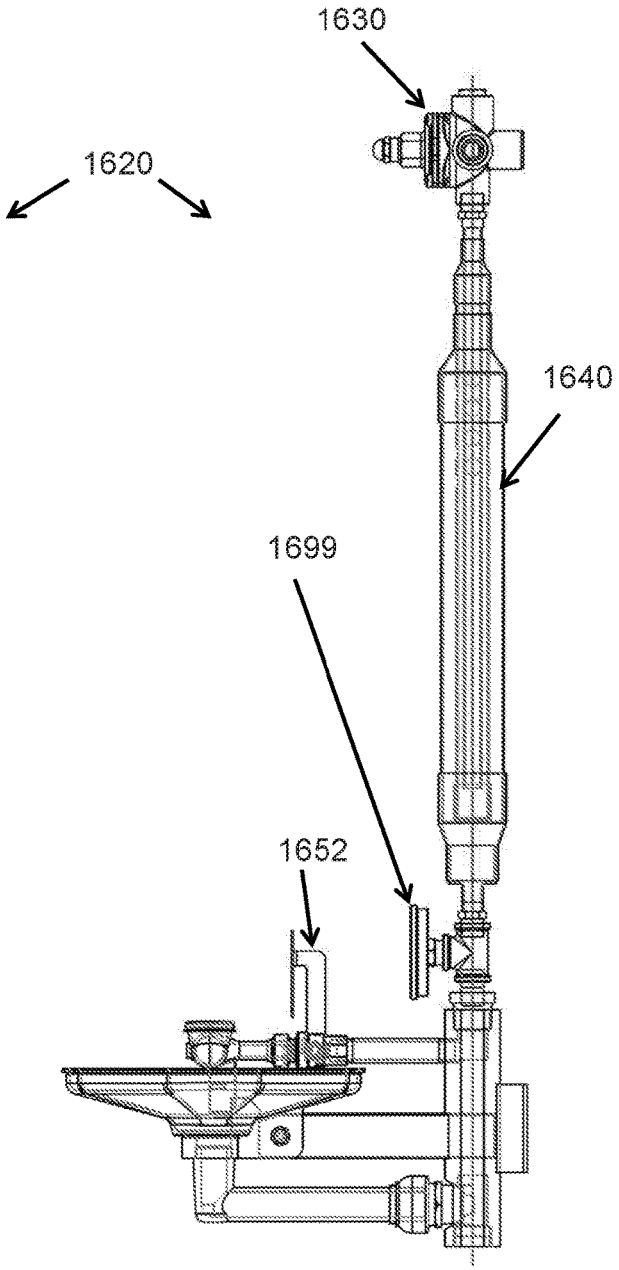
FIG. 58 is a side elevational view of the apparatus of FIG. 57.

FIGS. 57 and 58 depict yet a further embodiment of the present invention directed toward emergency eyewash apparatuses and methods. It will be seen that various features and aspects of the depicted eyewash system (1620) share various features and aspects common with other eyewash systems disclosed herein (including, as examples, a source of water, shut-off valve, and catch basin), while including different features and functions that provide water for the use of the user.

FIGS. 57 and 58 show various aspects of eyewash system 1620 according to one embodiment of the present invention. System 1620 includes a thermostatically controlled valve 1630, a diffusing heat exchanger 1640, and a thermometer 1699. After a user presses paddle shut-off 1652 to initiate water flow to the eyewash during use, the water departing thermostatic control valve 1630 can initially be hotter than desired as the thermostatic control valve 1630 adjusts to regulate the water temperature. Diffusing heat exchanger 1640, which may include a tube-within-a-tube arrangement with optional horizontal passageways (e.g., apertures in the tubes) to enhance mixing, retains a reservoir of water downstream of thermostatic control valve 1630. Since the water in diffusing heat exchanger 1640 has typically been held within diffusing heat exchanger 1640 for a period of time, the water has typically adjusted to ambient/room temperature. The water in diffusing heat exchanger 1640 mixes with water leaving thermostatic control valve 1630, which tempers potential temperature spikes that may otherwise occur and assists in avoiding burning or scalding of the user.

Thermometer 1699 may optionally be included, and may be located downstream of the diffusing heat exchanger 1640 (i.e., between diffusing heat exchanger 1640 and the eyewash dispensing caps). When included, thermometer 1699 provides a convenient means by which a user (or a person assisting the user) can monitor the temperature of the water flowing to the dispensing caps.

FIGS. 59 to 67 pertain to yet another embodiment of the present invention in which a flush line, preferably of high capacity flow, is provided proximate to an emergency wash system. Preferably, the flush line and associated valving is placed very close to the wash system, and in some embodiments made integral to the wash system. This close proximity of the flush line to the wash system minimizes any trapped water that cannot be flushed from the flush line. Various embodiments of the present invention pertain to a kit of parts that can be added to an existing emergency wash system, and still others pertain to emergency wash systems in which the means for flushing is integrated into other components of the emergency wash system.

In the plumbing systems of some facilities, water is supplied by a pipe to an emergency wash system. Water is supplied at system pressure levels in this pipe to the shutoff valve(s) of the emergency wash system. If there is no actuation of this emergency valve, then the water will remain in the plumbing feeding the emergency wash system, with no opportunity for flow to a drain or for recirculation.

Therefore, if the emergency wash system is not used for a long period of time, then it is possible that this plumbing that feeds the emergency wash system can contain water that has been contaminated. This contamination could include particulate matter that has entered the wash feeding plumbing by gravity, or include harmful chemicals that have diffused into the feed plumbing, or include bacteriological organisms (such as those that are responsible for Legionnaires disease) that have found their way into the feeding system. Should these contaminants exist in the water provided to the shutoff valve of the emergency wash system, then if the wash system is actuated to the open position, this contaminated water will be provided onto the body of the user. In those situations in which the washing system includes an eye rinse station, the contaminants may be provided directly onto the user's eyes.

Various embodiments of the invention described herein, especially with reference to FIGS. 59 to 67, pertain to an emergency wash system in which means for flushing the feed pipe is provided. Preferably, this flushing means includes a multi-position valve. This multi-position valve, which can be part of a kit for modifying an existing wash system, provided separately with the a new washing system, or integrated into a shutoff valve of the wash system, can be moved in one embodiment to multiple flow mode positions consistent with "off" (a complete stoppage of any flow); "in-use" (in which water is provided to the emergency system, either to a manually operated shutoff valve, or directly to the washing nozzles); and "flush" (in which water is flushed from the valve to a drain).

In yet another embodiment, water to the emergency wash system is provided from a feed pipe through a valve that has only two positions: "ready for use" (in which water is provided under pressure to a shutoff valve of the emergency system); and "flush" (in which water from the feed pipe is provided to a drain. In this embodiment, the multi-position valve does not have a setting in which water is not provided to the emergency wash shutoff valve. Even in the "flush" position and while water from the feed pipe is draining, water under pressure is still being provided to the face of the emergency system shutoff valve. This system may be preferable in some situations in which the owner of the emergency wash system wants a high degree of confidence that the emergency wash is always available, and to make the system less susceptible to a maintenance worker keeping the multi-position valve in a completely "off" position.

Figure 59:
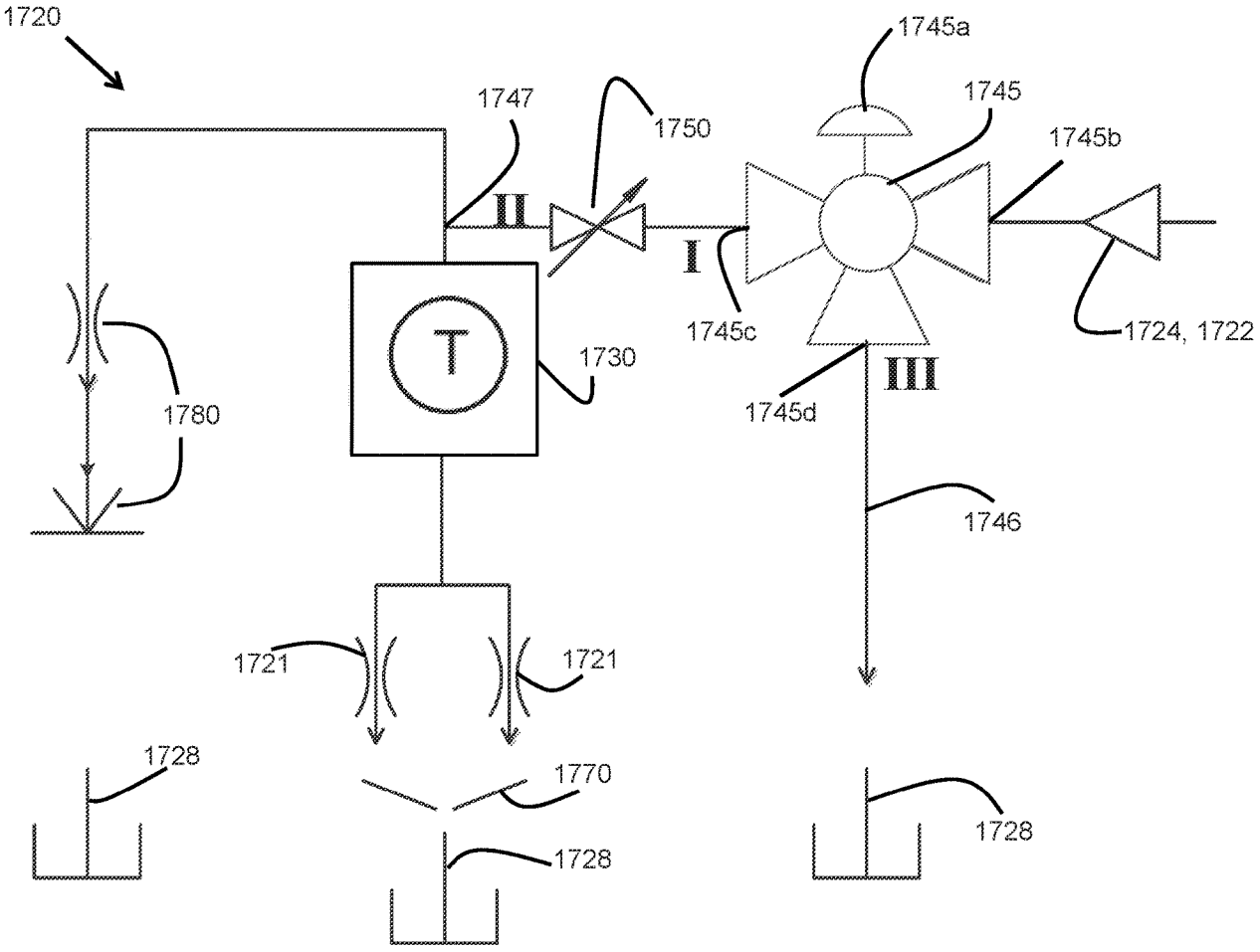
FIG. 59 is a hydraulic flow schematic of an emergency wash system according to another embodiment of the present invention.

FIG. 59 is a schematic representation of one embodiment of an emergency wash system provided with a flushing capability. It is understood that FIG. 59 represents a system that can be provided in a variety of configurations, and in that respect FIG. 59 could be considered a schematic representation of a schematic representation. For example, FIG. 59 shows a shut off valve receiving water from cold and hot sources 1722, 1724, respectively, and a thermostatically controlled valve having a single inlet for the introduction of water. It is understood that a person of ordinary skill in the art would recognize that the schematic shown in FIG. 59 is a blending of multiple concepts. For example, one concept would include a multi-way valve that includes separate inlets for hot and cold, and separate outlets for hot and cold (along with an alternate outlet that drains). Both of these outlet flows would be provided to the thermostatically controlled valve. In yet another embodiment, the separate cold and hot flows are provided to the inlet of a thermostatically controlled valve, and the tempered water exiting that valve would instead be provided to a shut off valve (such as 1750), and subsequently to a multi-way valve (such as 1745), that would provide one of its outlets to the dispensing cups, and the other of its outlets to the drain. Pictorially, this latter configuration conceptually swaps the positions of valves 1745 and 1730 in FIG. 59.

Referring to FIG. 59 water is provided from a source 1722, 1724 to the entrance of a multi-position valve 1745. It is understood that the source of water can be hot, cold, or tempered according to particular design aspects of the specific washing system. In one embodiment, multi-position valve 1745 includes an inlet 1745*b*, a first outlet 1745*c*, and a second outlet 1745*d*. A handle 1745*a* permits a user such as a maintenance worker to manually change the flowpath of the incoming water to either outlet 1745*c* or outlet 1745*d*. It is understood that in yet other embodiments, valve 1745 may be electrically actuated, in which case one or more solenoids are incorporated into multi-position valve 1745.

In one position of operation, water from the source is provided through the outlet 1745*c* to the inlet of a manually operated shutoff valve 1750. As discussed earlier with respect to shutoff valves X50, shutoff valve 1750 is manually operated by the user under emergency conditions. When open, water is provided to the nozzles of a shower 1780 over the user's head, and simultaneously to a pair of eyewash nozzles 1721.

In some embodiments, water is also provided to a thermostatically controlled valve 1730, which is shown in FIG. 59 providing water to the eyewash nozzles 1721. In yet other embodiments, this thermostatic control valve 1730 may also provide water to the overhead shower 1780, and those of ordinary skill in the art can recognize a change to the schematic of FIG. 59 that would reflect such a flowpath. Further, for the sake of clarity, a hot water inlet to thermostatically controlled valve 1730 is not shown, but again those of ordinary skill in the art can recognize that in some embodiments there is further a source of hot water (not shown in FIG. 59, but shown otherwise herein) provided to a hot water inlet (not shown in FIG. 59, but shown otherwise herein). In still further embodiments, the wash system may not include a thermostatically controlled mixing valve.

The operational modes of the system of FIG. 59 are shown in the following table. Persons of ordinary skill in the art will recognize the applicability of the concepts described by this table with regards to the alternative schematic interpretations provided earlier regarding alternative interpretations of FIG. 59. This table uses Roman numerals I, II, and III in reference to the outlets as shown on FIG. 59.

| Mode | I | II | III |
|---|---|---|---|
| ready for use | open | closed | closed |
| in use | open | open | closed |
| flush | closed | closed | open |

However, it is understood that the modes described in the above table apply to some embodiments of the present invention, but not others. As discussed earlier, there are yet other embodiments in which for the flush mode of operation outlets I and III are both open.

FIG. 59 also shows a common drain 1728 for water that exits system 1720. Water exiting the head wash 1780 is shown to the far left in the figure exiting into a far left drain 1728. Water exiting the eyewash nozzles is captured within a basin 1770, which drains to a central common drain 1728. Water exiting from a flush line 1746 is provided to a right-most common drain 1728.

System 1720 includes a flushing line 1746 that can be used by a maintenance worker to periodically flush potentially contaminated, dead-ended water provided to inlet 1745*b* of valve 1745. In use, valve 1745 is placed in a flush mode of operation such that water from source 1722, 1724 is sent to drain 1728 through flush line 1746. For purposes of facilitating this maintenance event, flush line 1746 and the outlet 1745*d* are preferably adapted and configured for high water flow rates, and in some embodiments flow rates that are significantly higher than the flow rate of the emergency washing water that would otherwise exit through nozzles 1780 and 1721. By adapting and configuring the flushing means of system 1720 for high flow, the maintenance event can be kept to a short duration of time. This can be especially important when the piping that feeds into inlet 1745*b* is of significant volume. In some embodiments, the effective flow diameter of pipe 1746 is greater than 2 inches, and in yet other embodiments greater than 3 inches, and in still further embodiments, greater than 4 inches. This is in contrast to the flow diameter of the emergency wash system, which can be less than 2 inches.

Figure 60:
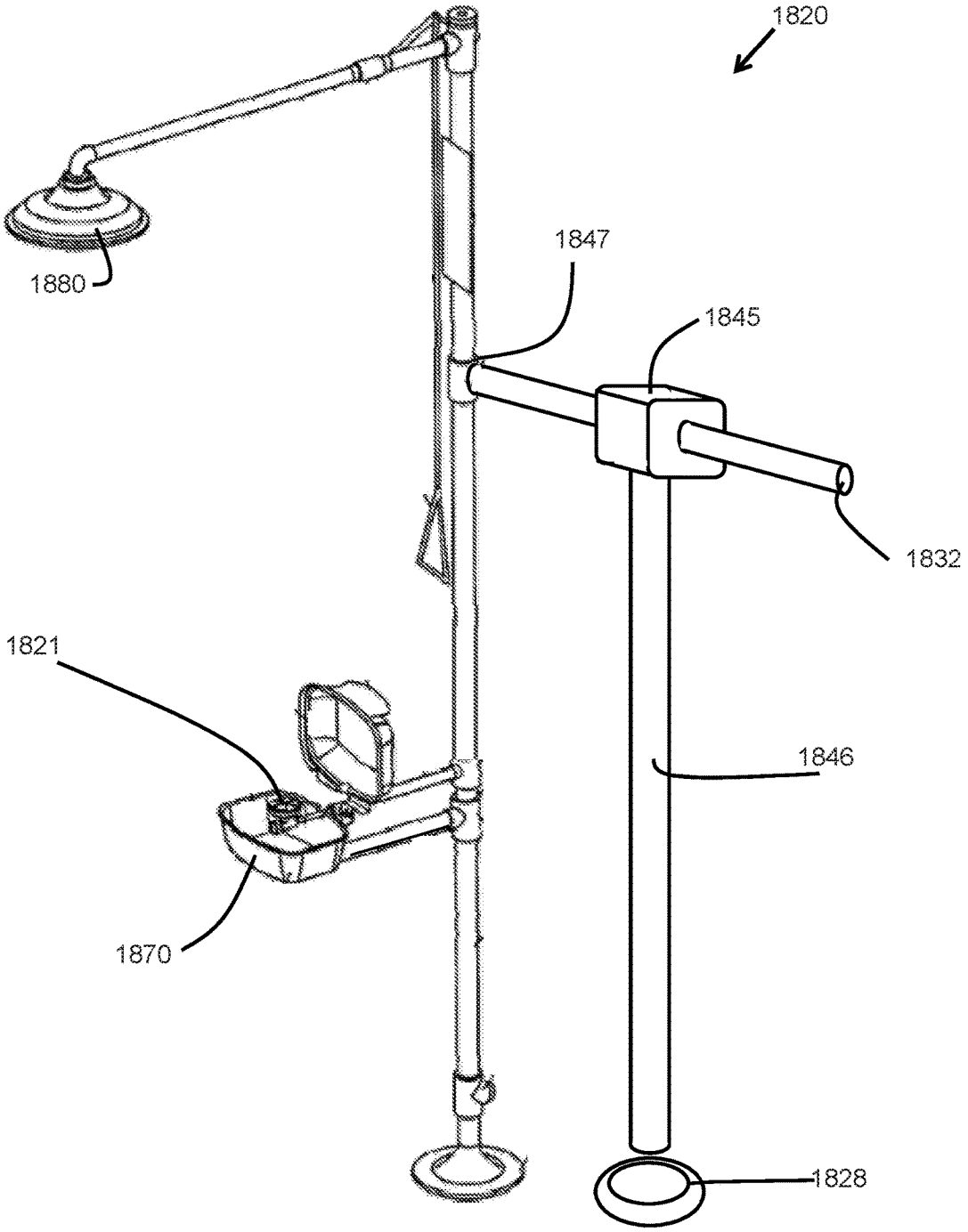
FIG. 60 is a side perspective view of an emergency wash station including some of the features of FIG. 59 or 67.
Figure 61:
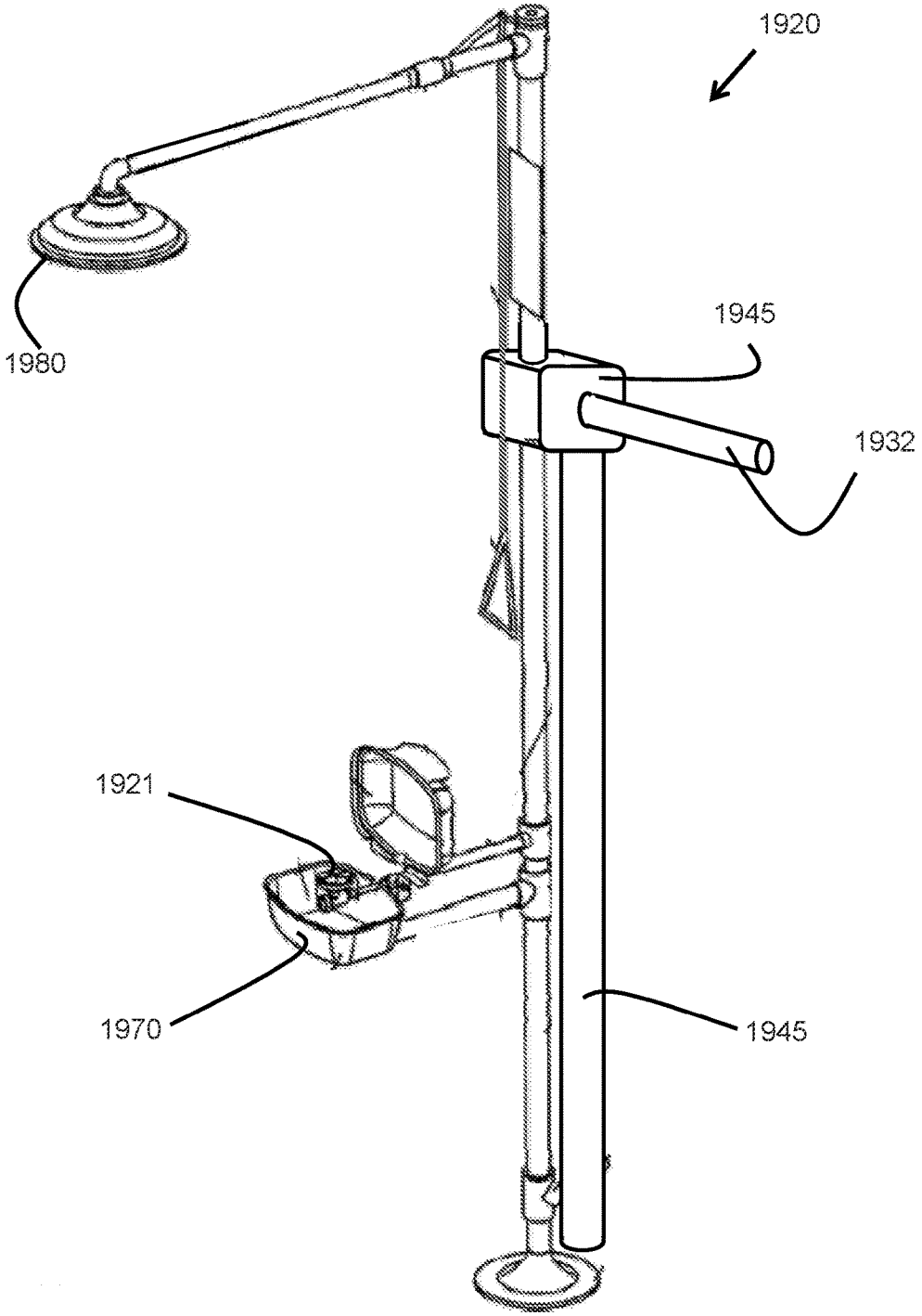
FIG. 61 is a side perspective view of an emergency wash station including some of the features of FIG. 59 or 67.

FIG. 60 shows an emergency wash system provided with flushing means 1820 according to one embodiment of the present invention. Water from a source is provided in a pipe to a multi-position valve 1845 (the valve being shown schematically). A flush tube 1846 extends generally downward from an outlet of valve 1845 toward a drain 1828. Another outlet of valve 1845 is connected by an intermediate pipe to a T-fitting 1847 of an emergency wash system. From this T-fitting 1847 water can be provided both upward to a shower nozzle 1880 and downward toward one or more eye and face washing nozzles 1821. In some embodiments, the use of a short length of intermediate pipe between the outlet of valve 1845 and an entrance into the emergency washing system is preferred because of the specific installation of the washing system. In some embodiments, a means for flushing kit is provided for installation with an existing wash system. Such a kit can include a multi-position valve (X45), a flush tube (X46), T-fitting (X47), and intermediate pipe (as graphically represented in FIG. 60). The diagram of FIG. 61 shows water being provided to the multi-way valve 1845 from the mixing outlet 1832 of a thermostatically controlled valve. It is further understood that, as discussed earlier with regards to FIG. 59, valve 1845 could include two, parallel input paths for hot and cold water, and two, commonly-controlled outputs providing that water to a thermostatically controlled mixing valve (not shown in FIG. 61).

FIG. 61 shows yet another embodiment of an emergency wash and flushing system 1920 similar to the system shown in FIG. 60. However, in system 1920 the multi-position valve 1945 is adapted and configured to fit integrally into the plumbing of an emergency wash system (including existing, installed systems). In such a system, the intermediate pipe (shown in FIG. 60 feeding T-fitting 1847) can be avoided. This intermediate pipe is potentially a source of dead-ended water, such as in those emergency washing systems that do not incorporate drain valves. In systems in which the means for flushing is integrated into the means for emergency washing, it is possible to combine the functions of the multi-purpose valve X45 and the emergency shutoff valve X50, suitable for operation by a single paddle shutoff X52.

The diagram of FIG. 61 shows water being provided to the multi-way valve 1945 from the mixing outlet 1932 of a thermostatically controlled valve. It is further understood that, as discussed earlier with regards to FIG. 59, valve 1945 could include two, parallel input paths for hot and cold water, and two, commonly-controlled outputs providing that water to a thermostatically controlled mixing valve (not shown in FIG. 61).

Figure 62:
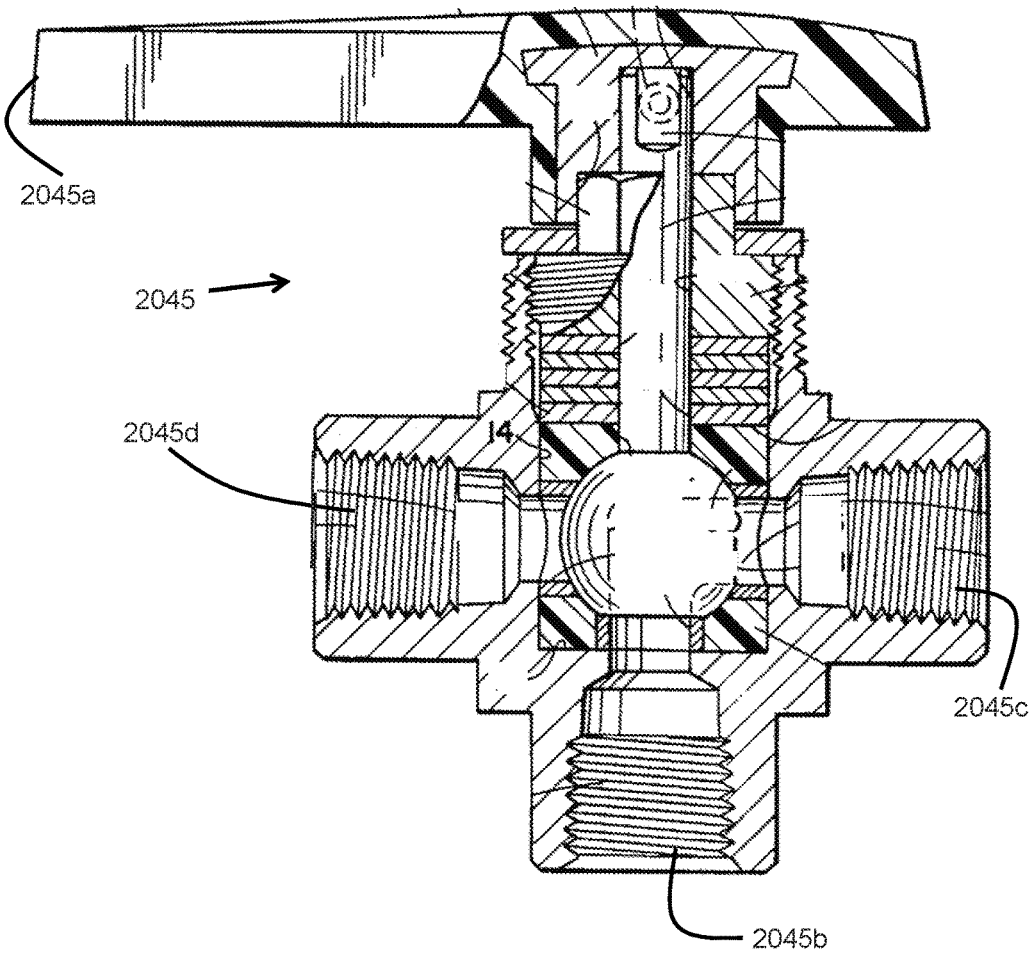
FIG. 62 is a cutaway side elevational view of a side elevational view of a multi-position valve according to one embodiment of the present invention.

FIG. 62 is a cutaway representation of a representation of a multi-position valve 2045 useful in some embodiments of the present invention. It can be seen that valve 2045 incorporates a single inlet 2045*b* and two outlets 2045*c* and 2045*d*. Preferably, movement of handle 2045*a* results in fluid communication between ports 2045*b* and 2045*c*, or between ports 2045*b* and 2045*d*. One of the outlets provides water to the flushing tube, and the other of the outlets provides water the emergency wash system.

In some embodiments, the water provided to the emergency wash system from valve 2045 flows directly to the shower nozzle and eye nozzles that provide the water onto the user. However, in still further embodiments, water from an outlet of valve 2045 is provided to one or more downstream shutoff valves. In one embodiment (such as that shown in FIG. 59) the downstream shutoff valve, such as a valve 1750, has an output which is adapted to flow simultaneously to both the shower nozzle and the eyewash nozzles. In still other embodiments, there are separate shutoff valves for the shower nozzle and eyewash nozzle. Some embodiments of eyewash systems shown herein include a shutoff valve X-50 that controls the flow of water to the eyewash dispensing caps. In still further embodiments, an outlet of multi-position valve 2045 directs flow to a shower shutoff valve 2080.1, as best seen in FIG. 63B. The user pulls on actuating handle 2080.2 to initiate flow of water from shower fixture 2080. It is understood that the design features of this valve 2045, as well as design features of other existing multi-directional valves, can be integrated into any of the multi-position valves X45 shown and described herein.

Figure 63A:
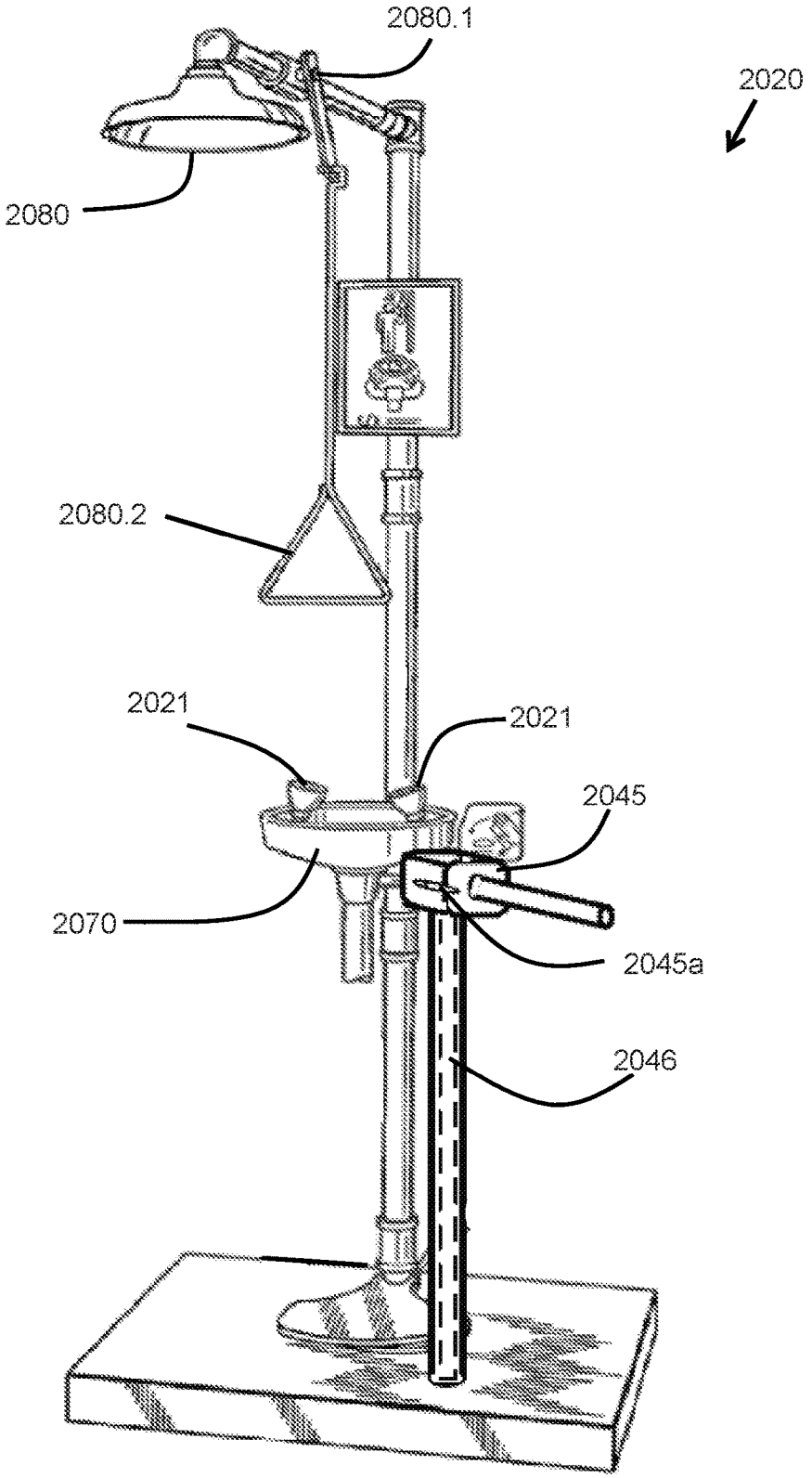
FIG. 63A is a side perspective view of an emergency wash station including some of the features of FIG. 59 or 67.
Figure 63B:
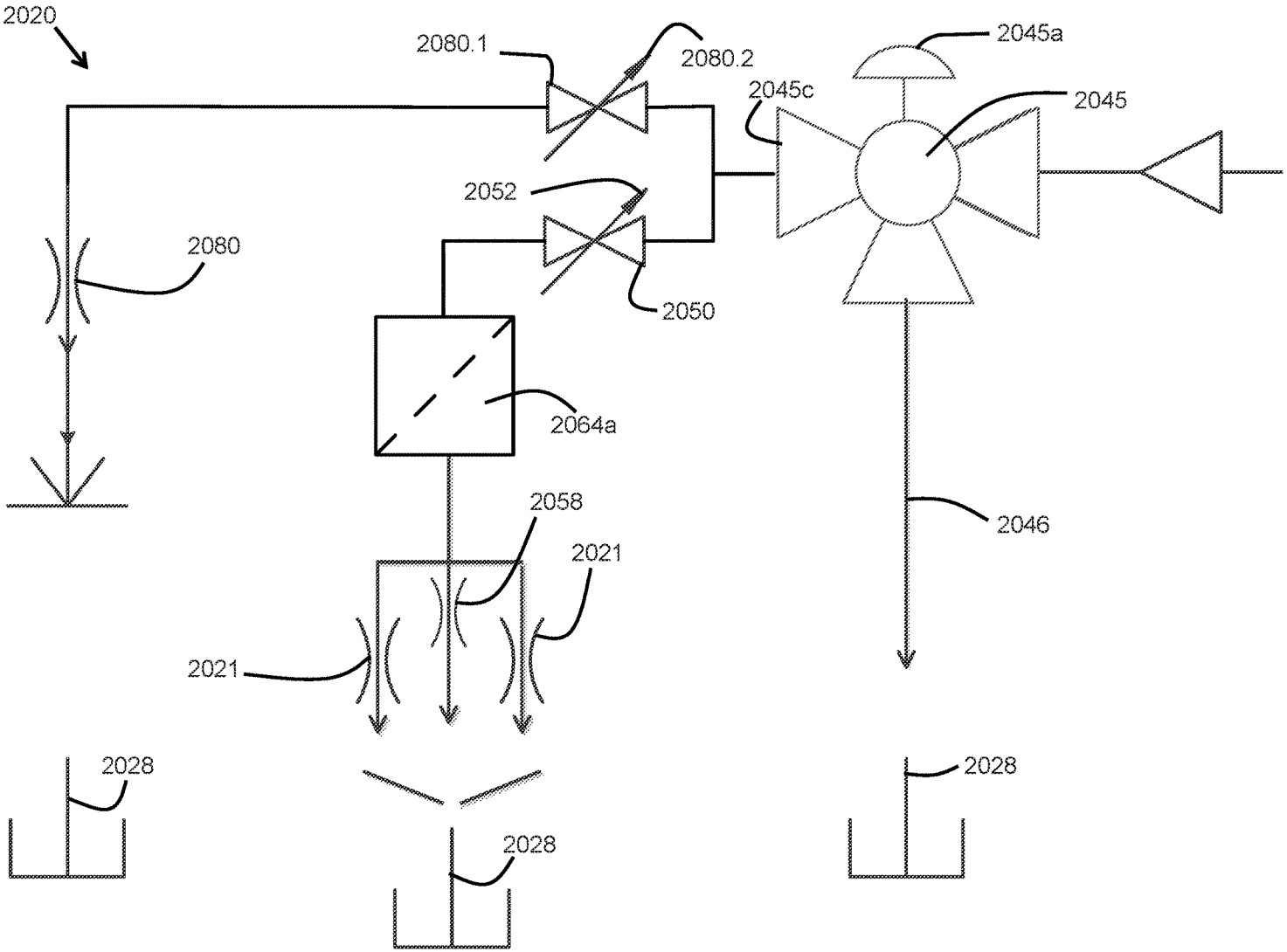
FIG. 63B is a schematic representation of the emergency wash system of FIG. 63A.

FIG. 63A shows an emergency wash and flushing system 2020 according to another embodiment of the present invention. Valve 2045 is shown closely integrated into an existing emergency wash system. As can be seen in comparing FIGS. 63 and 61, various embodiments of the present invention contemplate hydraulically coupling into the emergency wash system at any location between nozzles X80 and X21.

FIG. 63B schematically represents various features of an emergency wash and flushing system 2020. Water flowing from exit 2045*c* of multi-position valve 2045 is directed to the inlets of manually-operated shutoff valves 2080.1 and 2050. Upon actuation of shutoff valve 2080.1 by pulling on handle 2080.2, water is provided to shower fixture 2080. In a similar manner, actuation of paddle 2052 by the user permits the flow of water through shutoff valve 2050 to one or more filters 2064*a*, and then through one or more dispensing caps 2020 and onto the eyes of the user. Although valves 2045, 2080.1, and 2050 have been shown separately, it is understood that the various on and off features of these components can be integrated into a single package, and further that the actuation handles 2045*a*, 2080.1, and 2052 can likewise be integrated from three handles into two handles, and in some embodiments from three handles into a single, multi-position handle.

System 2020 further includes a draining orifice 2058 that is in fluid communication with any chamber that feeds dispensing caps 2021. Preferably, draining orifice 2058 is a draining hole that is located in the appropriate housing of the dispenser caps at a location that is at the lowest point of that housing. Drain orifice 2058 in some embodiments is an aperture (preferably of a diameter greater than one-eighth of an inch) that is always able to provide water into drain 2028. Therefore, even when shutoff valve 2050 is closed, any water within the system from the outlet of shutoff valve 2050 to the internal chamber of the housing of dispensing caps 2020 is able to drain. Still further, when shutoff valve 2050 is opened and water under pressure is provided through filter 2064 to dispensing caps 2021, water likewise flows out of drain aperture 2058.

Still further, FIG. 63A shows a flushing tube 2046 that is substantially transparent. By having a transparent flushing tube 2046, the maintenance operator is able to visually verify that water is being flushed from the supply to the drain. This confirmation can be important in providing an entry in a maintenance log (which may be legally required in some jurisdictions) that the flushing did occur. Still further, in those embodiments in which tube 2046 is sufficiently transparent, the maintenance operator may be able to visually sense the clarity of the water being flushed. In yet other embodiments, the flushing means includes an electronic sensor located downstream of the outlet of the multi-purpose valve to verify by electronic signal that water was being flushed from the piping system through the flush tube.

Figure 64:
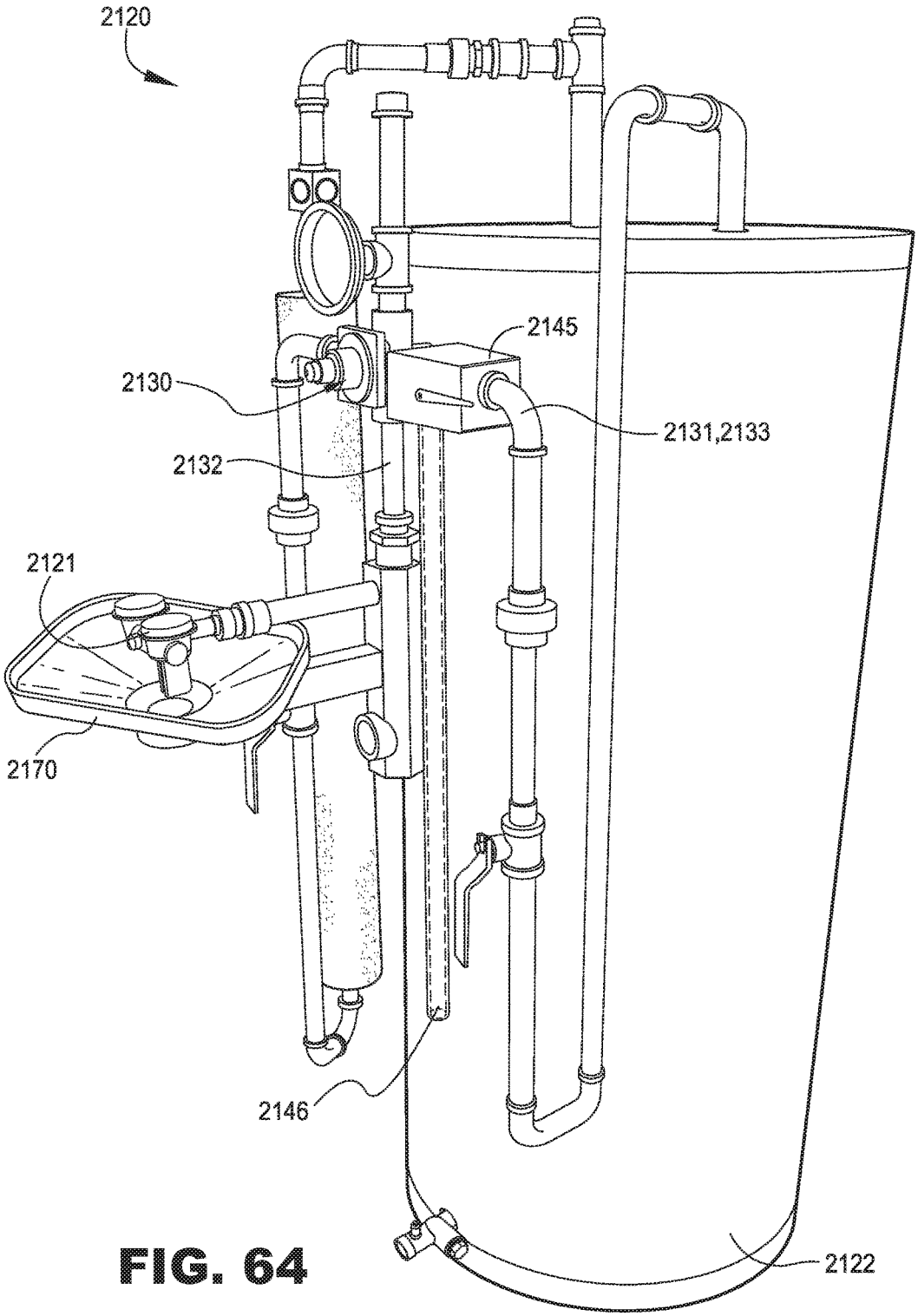
FIG. 64 is a side perspective view of an emergency wash station including some of the features of FIG. 59 or 67.

FIG. 64 shows an emergency wash and flushing system 2120 according to another embodiment of the present invention. System 2120 includes a source of hot water from a water heater that is provided to the eye washing nozzles 2120 by way of a thermostatically controlled valve. FIG. 64 schematically shows a multi-position valve 2145 and flushing tube 2146 provided to either or both of the cold inlet 2131 or hot inlet 2133 to the wash system. Although a single multi-position valve is shown and described, it is understood that still other embodiments include a second multi-position valve for the other of the hot or cold sources. Still further embodiments include a multi-position flushing valve that is located downstream of the thermostatically controlled valve (not shown in FIG. 64 for purposes of clarity).

Figure 65:
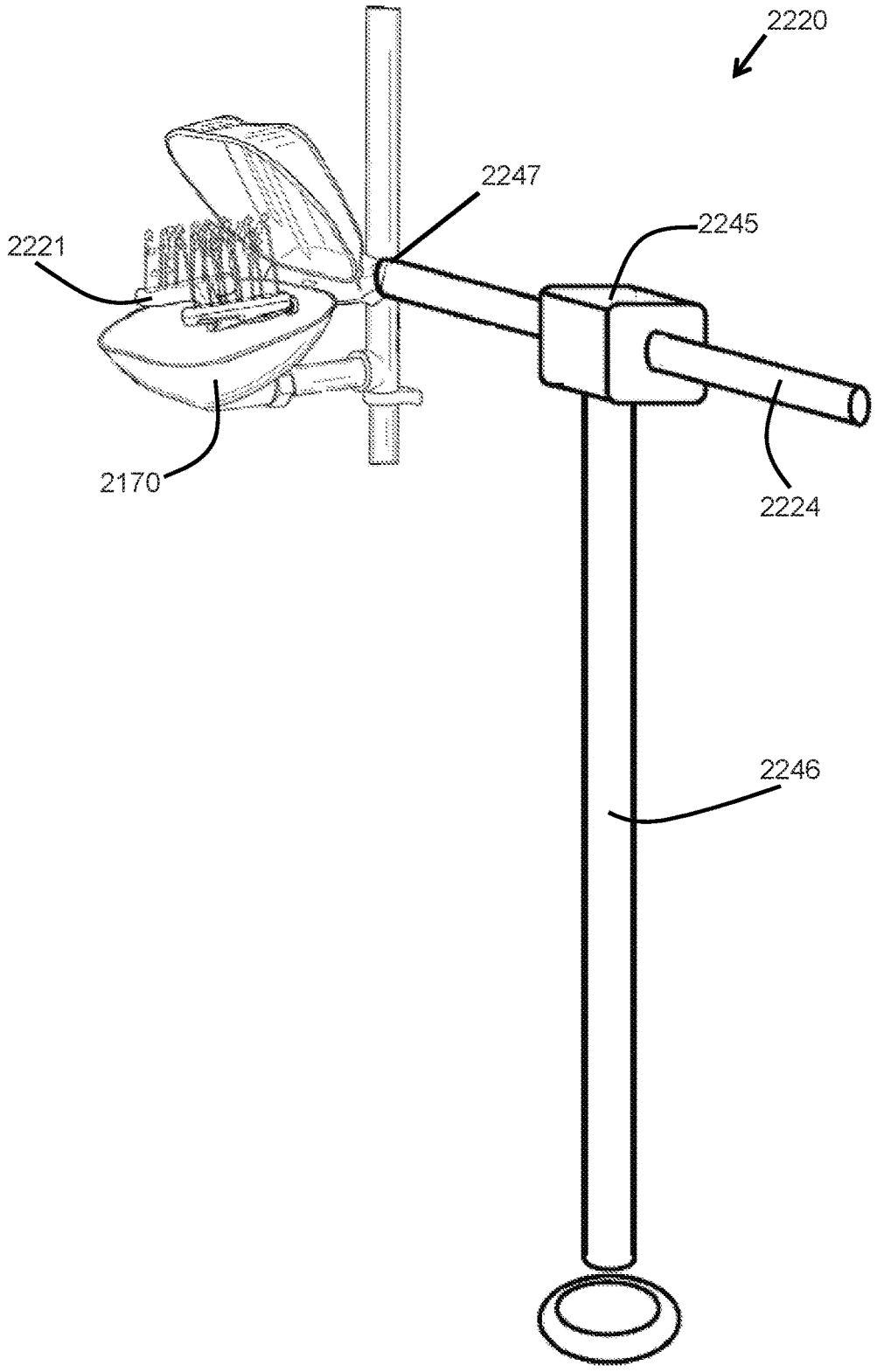
FIG. 65 is a side perspective view of an emergency wash station including some of the features of FIG. 59 or 67.
Figure 66:
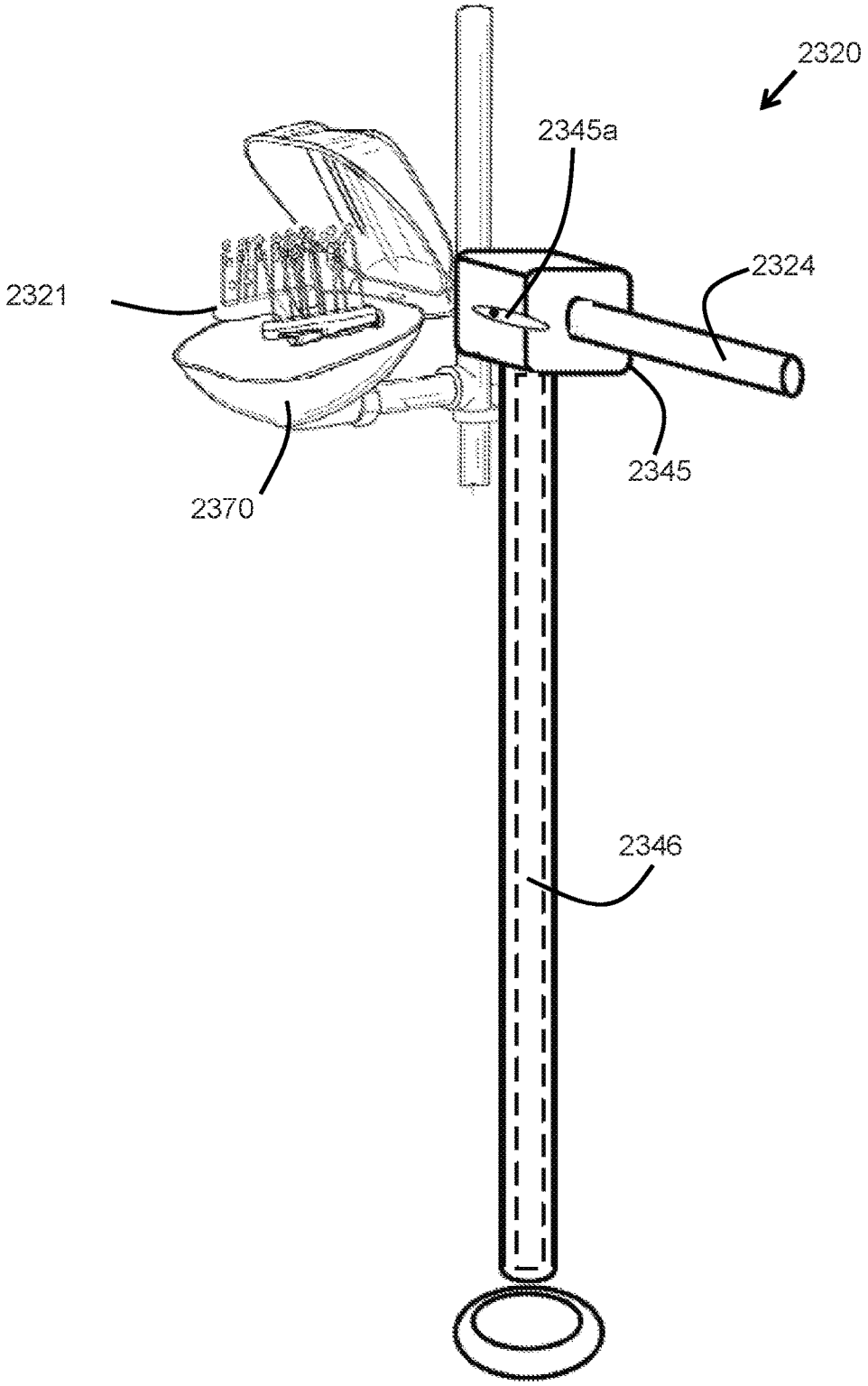
FIG. 66 is a side perspective view of an emergency wash station including some of the features of FIG. 59 or 67.

FIG. 65 shows a washing and flushing system 2220 according to yet another embodiment of the present invention. System 2220 illustrates that the flushing means described herein can be integrated into any type of emergency washing system. FIG. 66 illustrates the coupling of a washing system similar to that of FIG. 65, but incorporating a close coupled flushing system, and further incorporating a generally transparent flushing tube 2346.

Figure 67:
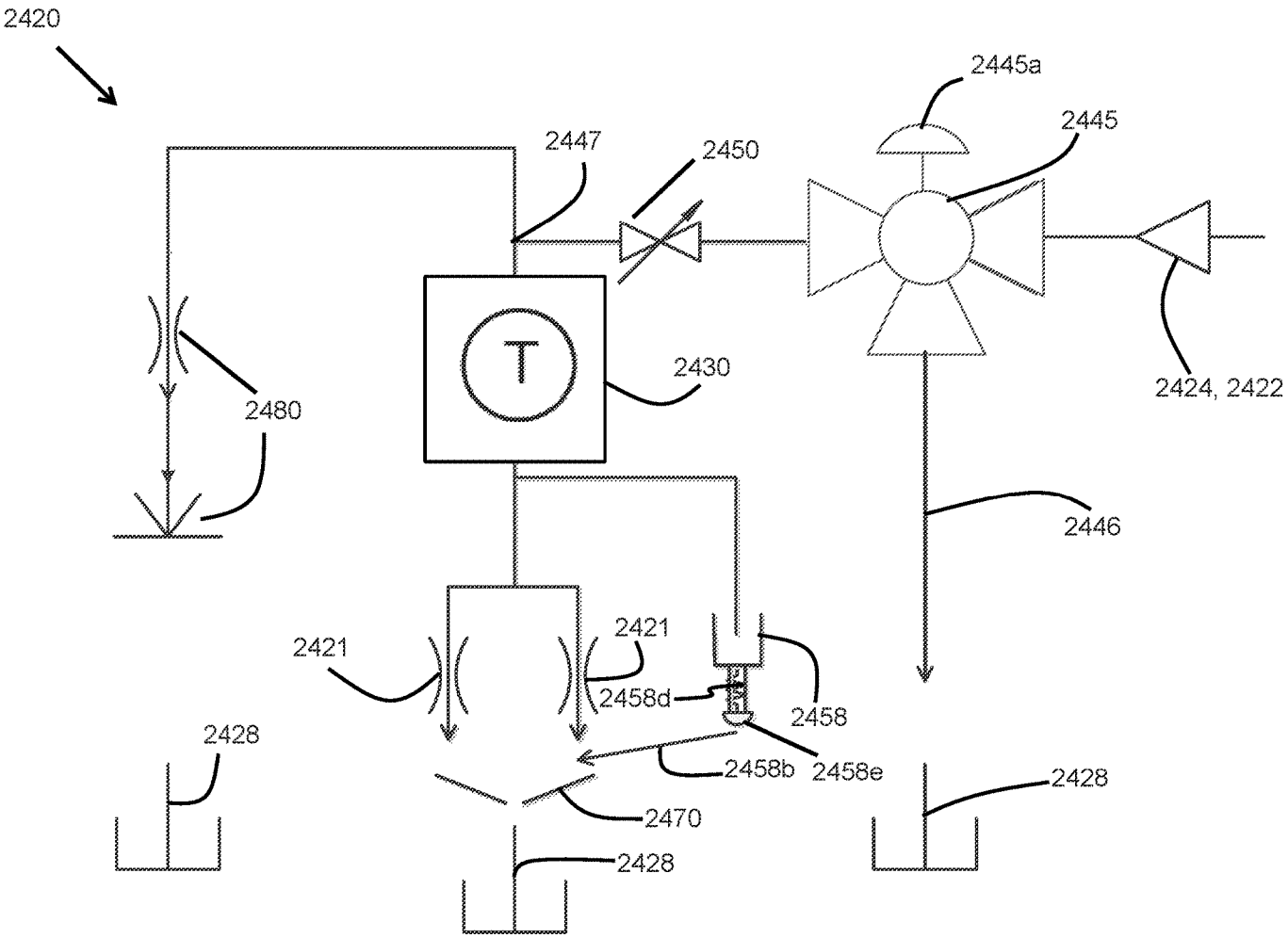
FIG. 67 is a hydraulic flow schematic of an emergency wash system according to yet another embodiment of the present invention.

FIG. 67 schematically represents a washing and flushing system 2420 according to another embodiment of the present invention. It is understood that FIG. 67 represents a system that can be provided in a variety of configurations, and in that respect FIG. 67 could be considered a schematic representation of a schematic representation. For example, FIG, 67 shows a shut off valve receiving water from cold and hot sources 2422, 2424, respectively, and a thermostatically controlled valve having a single inlet for the introduction of water. It is understood that a person of ordinary skill in the art would recognize that the schematic shown in FIG. 10-9 is a blending of multiple concepts. For example, one concept would include a multi-way valve that includes separate inlets for hot and cold, and separate outlets for hot and cold (along with an alternate outlet that drains). Both of these outlet flows would be provided to the thermostatically controlled valve. In yet another embodiment, the separate cold and hot flows are provided to the inlet of a thermostatically controlled valve, and the tempered water exiting that valve would instead be provided to a shut off valve (such as 2450), and subsequently to a multi-way valve (such as 2445), that would provide one of its outlets to the dispensing cups, and the other of its outlets to the drain. Pictorially, this latter configuration conceptually swaps the positions of valves 2445 and 2430 in FIG. 67.

System 2420 incorporates an expulsion valve 2458 located downstream of the emergency shutoff valve 2450. In some embodiments, expulsion valve 2458 is manually actuated by a maintenance operator to permit drainage of water that is downstream of outlet 2445*c* of multi-position valve 2445. By actuation of this manual valve, the maintenance operator is able to periodically flush any water that could be trapped in the emergency wash system, which could also contain contaminants. In one embodiment, valve 2548 includes a push button 2458*e* that is biased by a spring 2458*d* to maintain the valve at a closed position. When the maintenance operator pushes inward on button 2458*e*, water drains from the expulsion valve by way of drain 2458*b*. It is further understood that the other expulsion valves X58 disclosed and discussed herein can also be incorporated into a washing and flushing system.

Figure 68A:
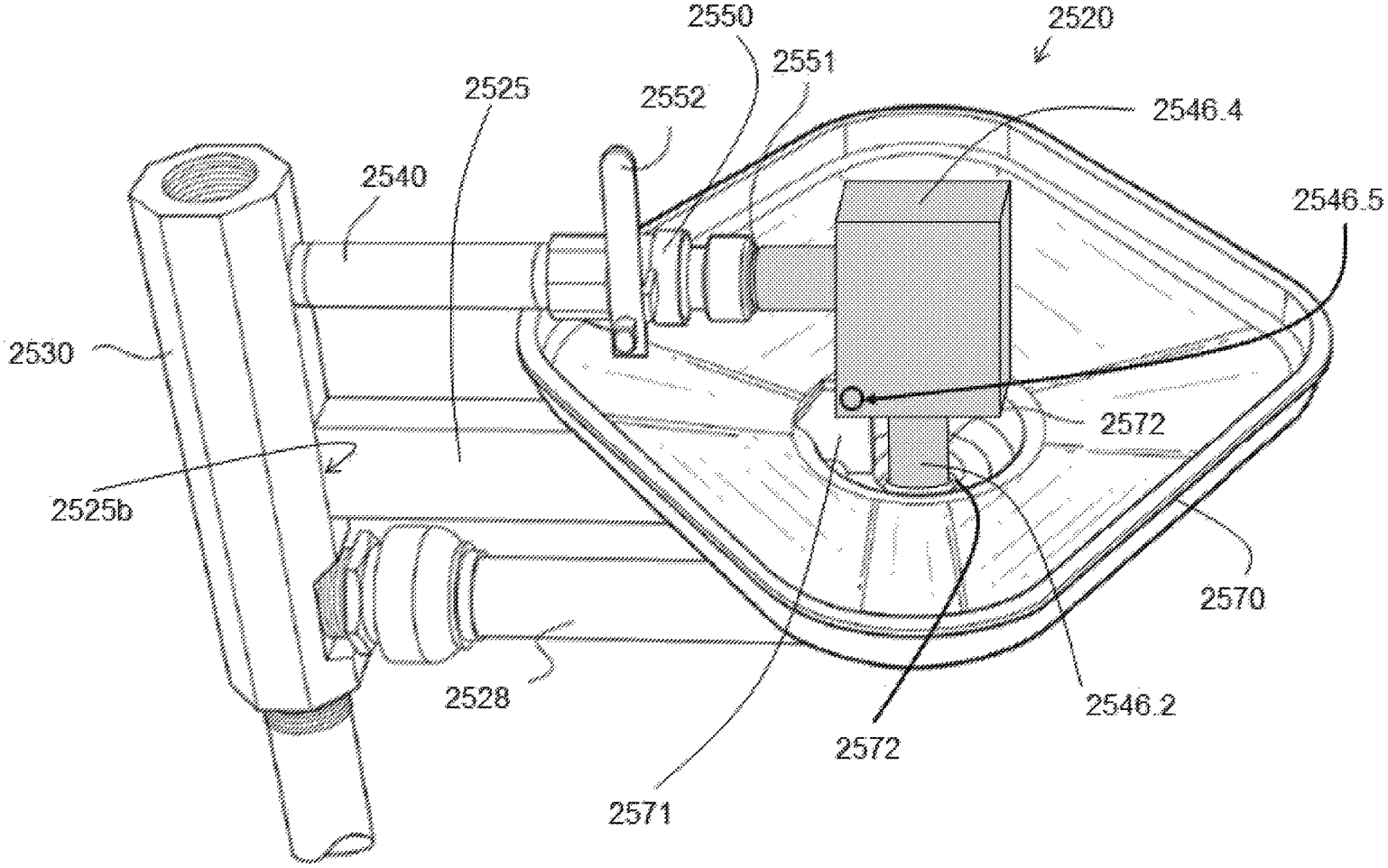
FIG. 68A is a left side, top perspective line drawing of an apparatus according to one embodiment of the present invention.
Figure 68B:
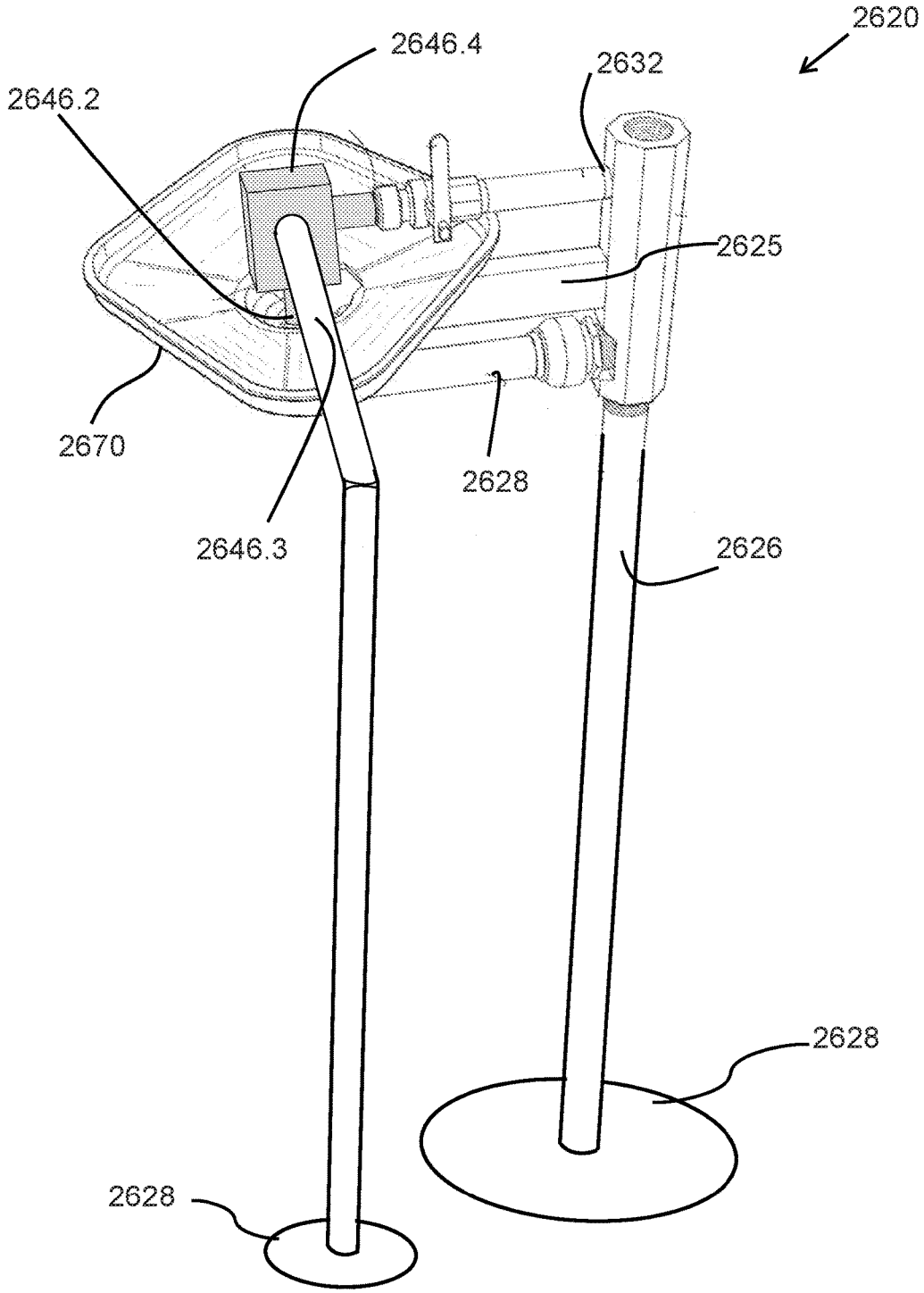
FIG. 68B is a top, right side perspective view of an apparatus according to yet another embodiment of the present invention.

FIGS. 68A and 68B show various embodiments of emergency washing systems adapted and configured to provide flushing of various components of the emergency washing system, and also to provide flushing of the source of water. It has been found in some applications that if the emergency washing system is not used on a regular basis that the stagnant water within the source plumbing can become unhealthy to use. Still further, simply flowing water through the standard emergency washing system may not adequately flush the source plumbing if the operator does not run a sufficient quantity of water through the emergency washing system. Since these washing systems typically have flow rates less than seven gallons per minute, and sometimes half of that, it is possible that the operator will not run the emergency washing system for a sufficient period of time to remove all of the contaminated water in the source plumbing.

In FIG. 68A, it can be seen that the outlet valve that incorporates the eyewash dispensing caps has been removed in its entirety, and replaced with a flushing housing 2546.4. In some embodiments, this outlet valve (X60) can include various water flow conditioning features (such as filters (X64*a*), flow restrictors, or flow control valves (X66), as examples), which create pressure drops that lower the flowrate. In order to achieve a fast flush, it is helpful to remove these water flow conditioning features. These features preferably are not present in flushing housing 2546.4 that replaces the outlet valve (X60). A flushing housing according to various embodiments of the present invention preferably has an internal flowpath substantially unobstructed, so as to permit the large flow of water with minimum pressure drop. However, it is understood that in some embodiments the flushing housing may include sediment traps, filters, and the like for collecting samples of the contamination that was present in the dead end leg of the plumbing for later analysis.

Preferably, flush housing 2546.4 is internally configured to provide minimal restriction to the flow of water, in order to facilitate a quick flushing. Still further, the body of the flush housing 2546.4 preferably includes at least one transparent portion in order to provide assurance of a sufficient flushing. As shown in FIG. 68A, flushing member 2546.4 includes an inlet that preferably couples to the same connection as the washing valve. In one embodiment, flush housing 2546.4 includes a quick connect fitting that readily couples to quick connect fitting 2551 of shutoff valve 2550. Water received from the shutoff valve is provided through this inlet into a system flushing outlet 2546.2 that provides the flushed water to the drain 2572 of basin 2570.

When the shutoff lever arm 2552 is moved to the flow position, water flows at a rate that is at least twice the flow rate when the eyewash dispensing caps are dispensing water for an emergency wash. Therefore, eye washing system 2520 can be operated in two modes: a flushing mode that is preferably optimized to provide a high flow rate of water, and an eyewash mode, in which the system provides tepid water at a range of flow rates suitable for washing the eyes of a person bent over basin 2570. In some embodiments, flush housing 2546.4 includes a portion that is substantially transparent, which permits the flushing operator to maintain the flush mode of operation until there is visual indication of clear water.

It can be seen that system 2520 includes an indexing feature 2571 on bowl 2570. This indexing feature 2571 couples into a complementary-shaped indexing feature (such as a groove) of the body of flushing housing 2546.4. Further, it has been found in some systems that if there is a sufficiently high flowrate through flushing block 2546.4, that the source drain may not be able to accommodate the high flowrate, such that water backs up through drain 2572, and subsequently spills out of basin 2570. To address this situation, various embodiments of the present invention include a system flushing connection 2546.2 that seals within the drain 2572. In such embodiments, the first connection of housing 2546.4 to shutoff valve 2550 can include a flexible joint (or flexible tube) to permit the alignment created by the sealing of connection 2546.2 within drain 2572. In still further embodiments, flush housing 2546.4 includes means for attaching the flush housing to the basin 2570. As shown in FIG. 68A, in one embodiment there is a setscrew 2546.5 that can be tightened to provide a frictional fit with attachment feature 2571. In still further embodiments, instead of a setscrew, this coupling feature includes a cylindrical pin that extends through the flush housing, and also through a hole in alignment feature 2571.

In still further embodiments of the present invention, the flushing housing can be substantially the same as the body XX61 of an outlet valve XX60. As previously discussed, an outlet valve assembly XX60 in one embodiment includes a body XX61, filters XX64*a*, flow control valve XX66, and supports a pair of dispensing caps (or spray nozzle assemblies) XX21. Some embodiments of the present invention utilize only the body XX61 as a flushing housing XX46. By removing the filters, flow control valve, and spray nozzle assembly, the internal flowpath of the body XX61 is substantially unobstructed in comparison to the assembled outlet valve XX60. Therefore, in some embodiments, an emergency washing system XX20 can be provided in kit form, and including a second outlet valve body XX61. When used as a flush housing, this body XX61 is preferably turned upside down, so that the outlets XX64 are directed toward the return basin XX70. In still further embodiments, the flushing housing is the same as the body of the outlet valve XX60 being used, except that the maintenance technician removes the obstructions in the outlet valve assembly, including the filters, flow control valve, and removing the dispensing caps.

Referring to FIG. 68B, there can be seen an emergency eyewash system 2620 similar to the system 2520, except for having a flush housing 2646.4 that incorporates two outlets. A first system flush outlet 2646.2 provides water to the normal drain for the washing system, and a second flushing flowpath 2646.3 provides a parallel route for flushed water into a drain 2628.

Figure 69:
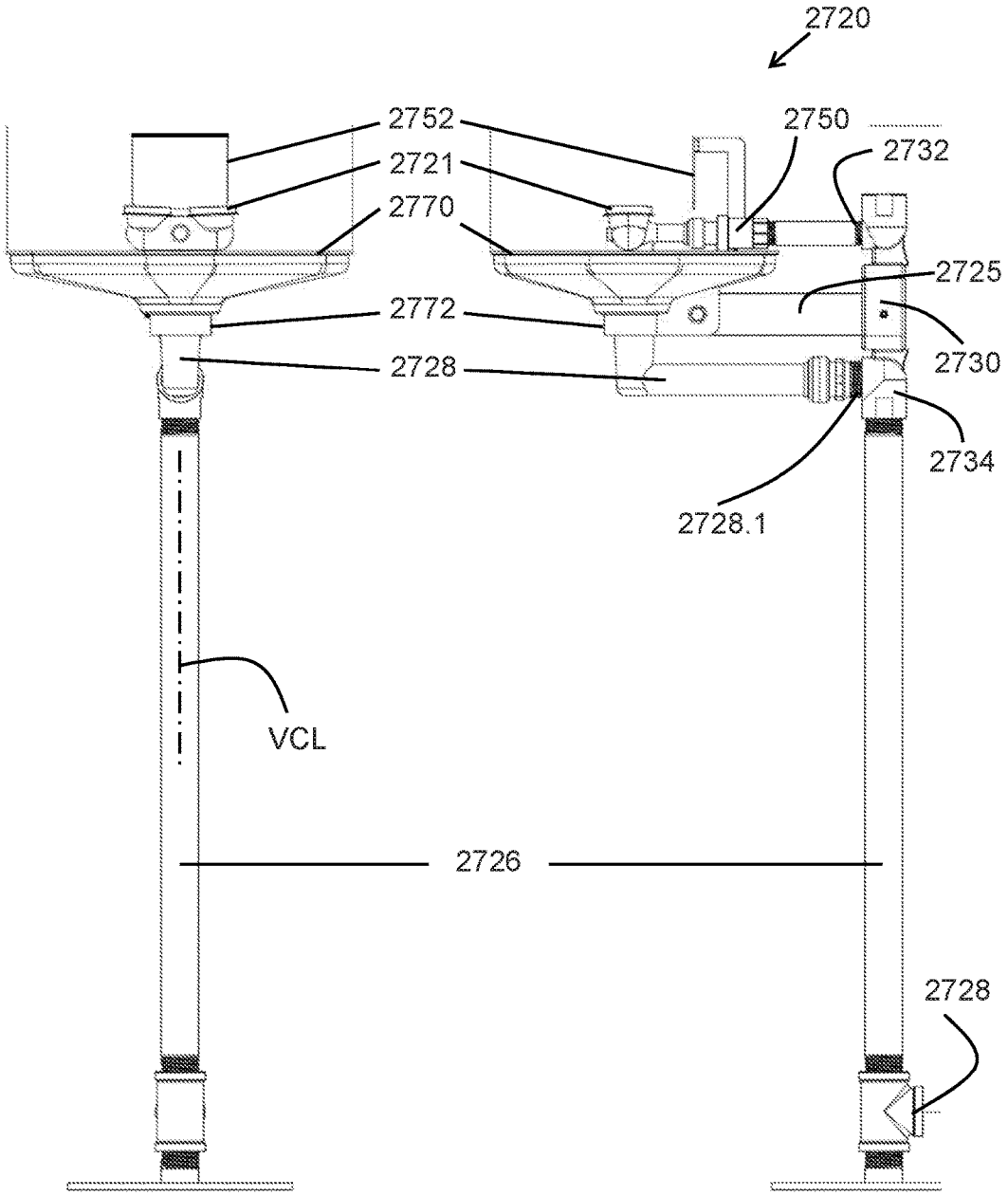
FIG. 69 shows front and side elevational views of an eye washing system according to another embodiment of the present invention.

FIGS. 69 through 73 show various aspects of an emergency washing system 2720 according to another embodiment of the present invention. Referring to FIG. 69, system 2720 can be seen in front and side orthogonal views. A stand 2726 that also functions as part of a flowpath leading to drain 2728 can be seen connected to the housing 2734 of a thermostatically controlled mixing valve 2730. Housing 2734 is preferably an integrally cast body that provides both water flow functions as well as support functions for system 2720.

As best seen in the side view of FIG. 69, housing 2734 incorporates a cartridge valve for thermostatic mixing, two water inlets, two water outlets, a water return outlet, an attachment feature (such as an aperture) for physical support of the drain basin, and a provision for supporting the entire emergency washing system, including the shutoff valve, flow control valve, water dispensing caps, and the like. Extending in a frontal direction from housing 2734 can be seen a topmost tube that provides flow communication and physical support from the metered flow outlet 2732 to the inlet of the shutoff valve 2750. A bottommost tube also extending frontally outward can be seen interconnecting a water return port 2728.1 to the draining aperture 2772 of basin 2770. In between these tubes is a support arm 2725 that extends frontally outward in the same direction as the two tubes, and which is coupled at one end to body 2734, and at the other end to basin 2770. Referring to the front elevational view of FIG. 69, it can be seen that the top tube, support arm, and bottom tube are in substantial alignment along a vertical centerline (VCL) of system 2720.

In one embodiment, washing system 2720 is substantially balanced above a pedestal base. With this packaging and alignment, there are substantially no right and left imbalances that act to topple system 2720 to either the right or left. Instead, the pedestal base can be adapted and configured primarily for support of the vertical weight, and for support of the imbalance extending frontward (as best seen in the side elevational view of FIG. 69). In another embodiment (not shown), washing system 2720 includes a flow return pipe that receives drained water from second water compartment 2730b and provides the drained water to the plumbing system return (such as a sewer system). However, the pipe providing the returned water to the floor drain is preferably supported above the floor drainage hole by an air gap. This air gap is established to limit the possibility of back flow.

FIGS. 70 through 73 show additional exterior and cross sectional views of valve 2730. It can be seen that the housing 2734 incorporates cold water and hot water inlets 2731 and 2733, respectively, and each being oriented substantially perpendicular to a mixed flow outlet 3732. For purposes of efficient packaging of the internal mechanisms of valve 2730, preferably the cold and hot inlets 2731 and 2733 are placed at different elevations. In some embodiments, there is an auxiliary tempered fluid outlet 2732*b* that provides mixed water to a showerhead or other dispensing nozzle.

Figure 70A:
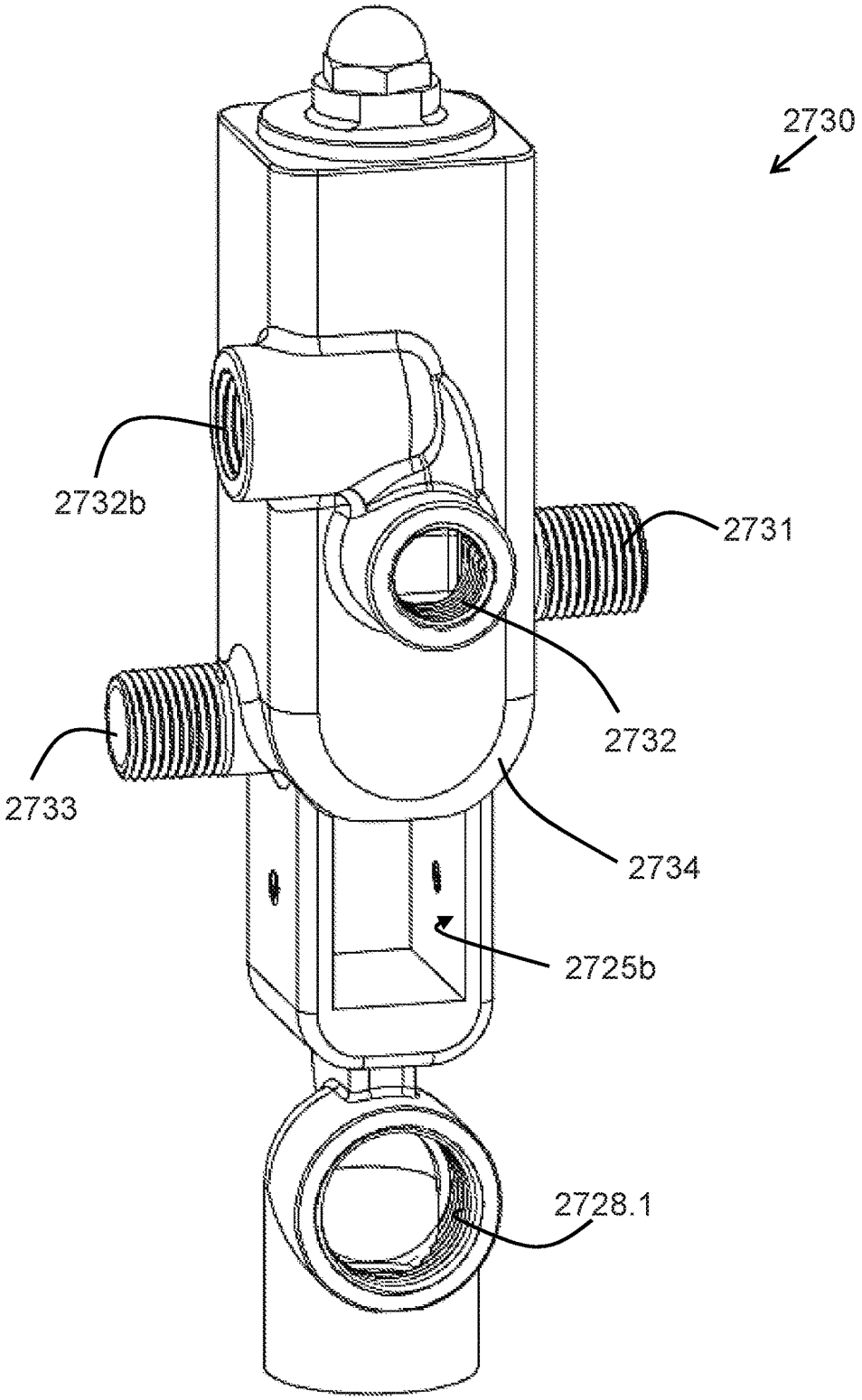
FIG. 70A is a left, front, top perspective line drawings of the integrated assembly according to one embodiment of the present invention as shown in FIG. 69.
Figure 70B:
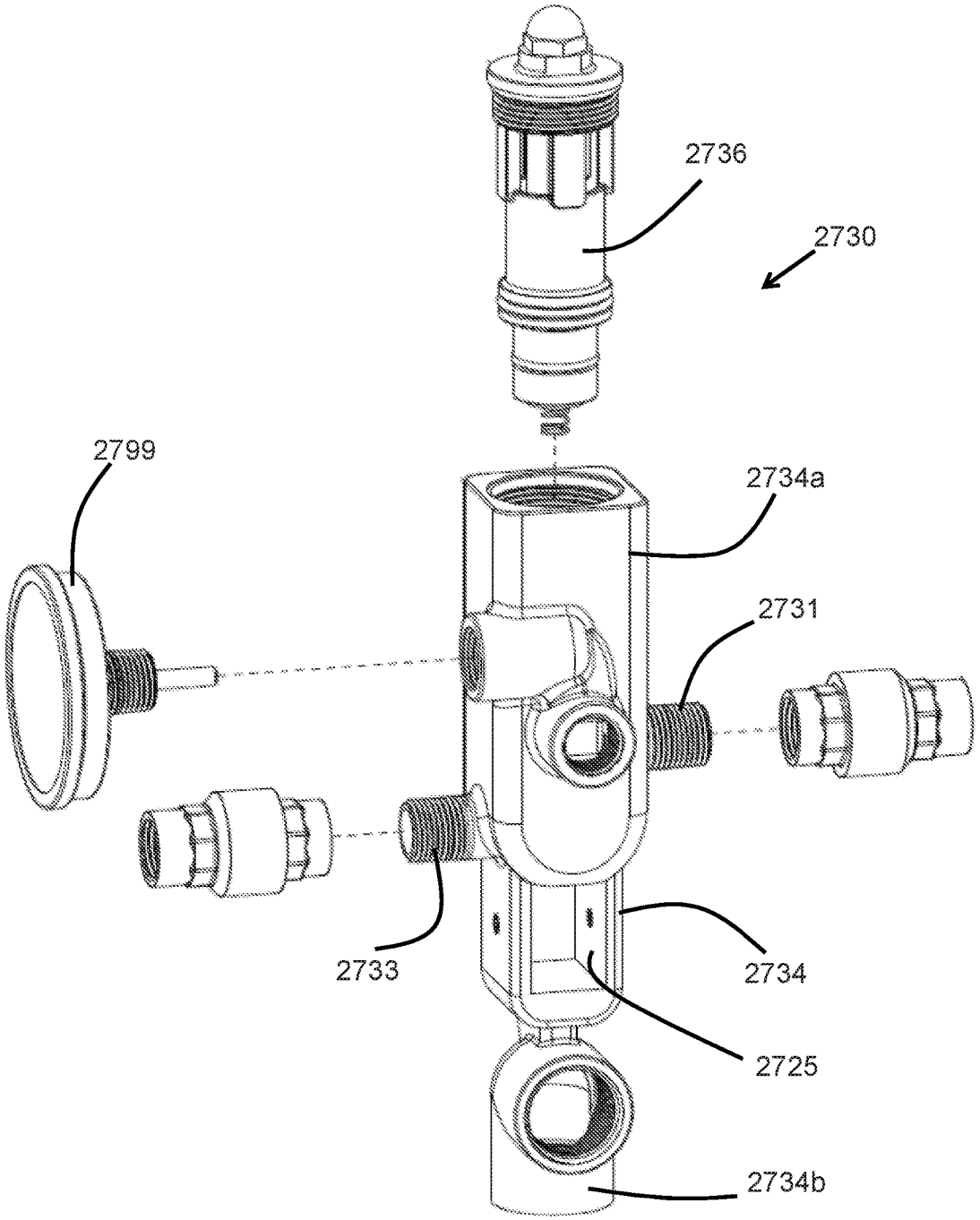
FIG. 70B is an exploded view of the apparatus of FIG. 70A, and including some other components typically attached thereto.

FIG. 70B presents an exploded view of a thermostatically controlled mixing valve 2730 according to one embodiment of the present invention. Valve 2730 preferably includes a body 2734 having a first water compartment 2734*a* located above a second, separate water compartment 2734*b*. Separating the two compartments is a structural section that defines a support aperture 2725*b*. The first water compartment 2734*a* preferably receives an assembled cartridge valve 2736. Cold and hot inlets 2731 and 2733 are preferably coupled to sources of cold and hot water, respectively, by way of check valves. In the embodiment shown in FIG. 70B, a thermometer 2799 is threadably received within a port of body 2734, by which a temperature sensor is placed in the contact with mixed fluid within first water compartment 2734*a*.

Figure 70C:
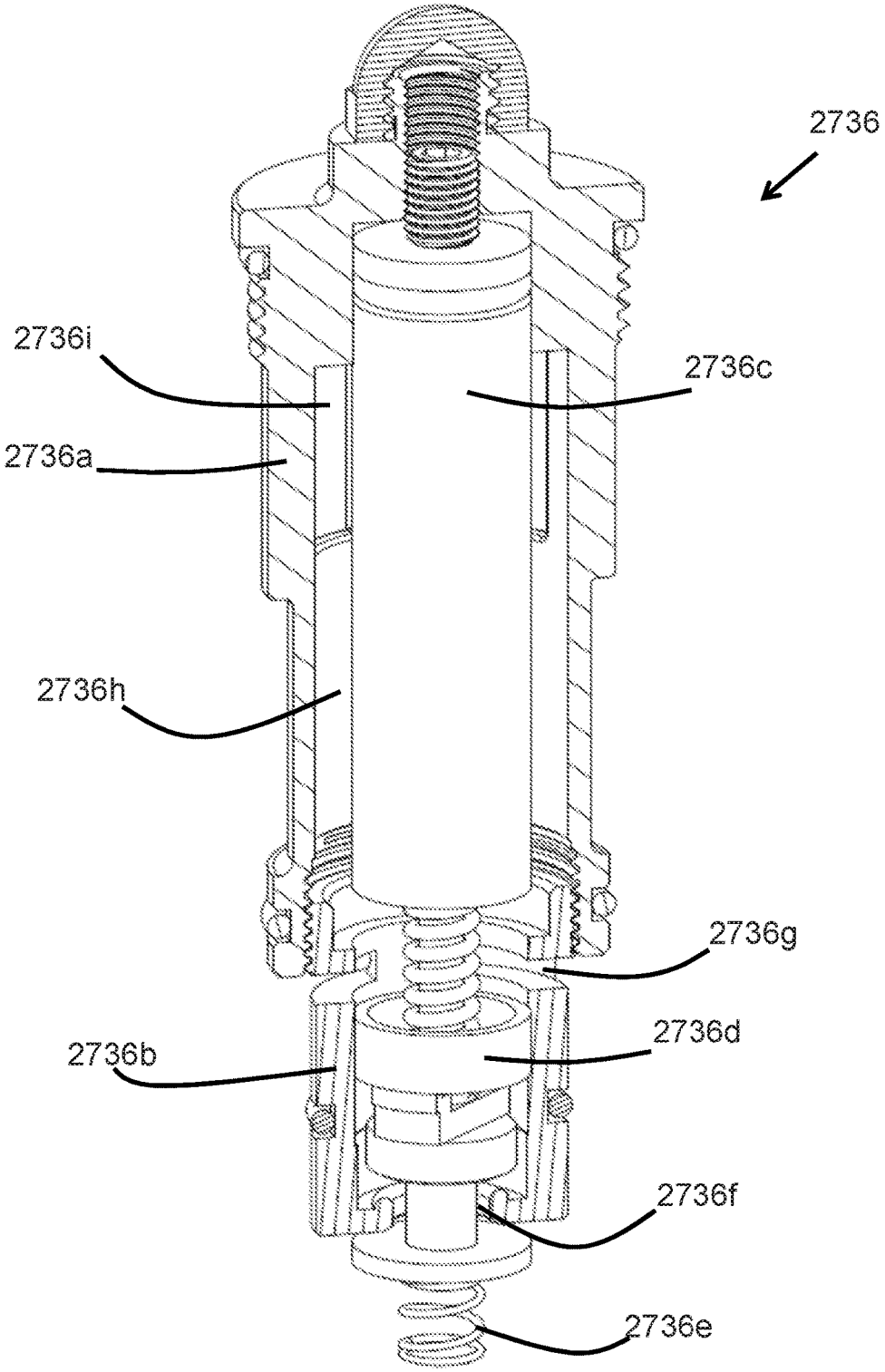
FIG. 70C is a partial cross sectional view of a portion of the apparatus of FIG. 70A.

FIG. 70C shows a partial cutaway view of a cartridge valve 2736 according to one embodiment of the present invention. Cartridge valve 2736 comprises a first cartridge body 2736*a* that is threadably coupled to a second cartridge body 2736*b*. It can been seen that first body 2736*a* includes a sealing O-ring near the top and a second sealing O-ring outside of the threads, this top O-ring sealing the cartridge within the valve housing 2734, the bottom O-ring sealing an internal chamber containing mixed flow from internal chamber containing cold flow. Second cartridge body 2736*b* includes an O-ring around its outer diameter that separates the hot flow chamber from the cold flow chamber.

Contained within the first cartridge body is a thermostat assembly 2736*c*. An acorn nut at the top of the cartridge assembly covers a temperature adjusting screw.

The bottom end of thermostat assembly 2736*c* extends downward and controls the position of a multi-piece shuttle valve 2736*d*. Second cartridge body 2736*b* includes hot and cold inlet passages 2736*f* and 2736*g*, respectively, each of which is in fluid communication with the corresponding source of water. The sliding movement of shuttle 2736*d* relative to the slots 2736*f* and g controls the relative proportions of hot and cold water that flow into a mixing chamber 2736*h* that generally surrounds thermostat assembly 2736*c*. Mixed water from chamber 2736*h* flows out of one or more mixed flow outlet slots 2736*i*, and on toward the emergency wash nozzle housing. The sliding action of the shuttle valve relative to the second cartridge body 2736*b* establishes variable flow area openings for each of the hot and cold water flows. Each variable flow opening has one boundary defined by the second cartridge body 2736*b*, and the other boundary defined by the relative placement of shuttle valve 2736*d*.

A coil spring 2736*e* biases the shuttle valve 2736*d* upward toward a position that would seal hot inlet 2736*f*. In the event of some types of failure of the thermostat assembly 2736*c*, the axial load of the thermostat on the shuttle is relieved, and the biasing force from spring 2736*e* pushes shuttle 2736*d* to a position that seals off the flow of hot water, and prevents hot water from entering chamber 2736*h*.

It can be seen by inspection of FIG. 70B that the top, first water compartment 2734*a* is generally maintained at an internal pressure that is about the same as the pressure of the source water of the building's plumbing system. In contrast, the internal pressure within the bottom, second compartment 2734*b* is maintained substantially at atmospheric pressure. Preferably, this lower water compartment is in fluid communication with the return system of the building plumbing, and it is still further preferred that the drain pipe extending downward from compartment 2734*b* be provided with an air gap relative to the floor return opening, either of which maintain this compartment at ambient pressure.

Body 2734 further includes a water return port 2728.1 located below mixed fluid outlet 2732. Return port 2728.1 provides water expelled from the dispensing caps and collected in the basin into a flow channel that provides the water to a drain system. In between the mixed flow outlet 2732 and the water return port 2728.1, there can be seen a support aperture 2725*b* that is adapted and configured to provide physical support and stability to the support basin 2720. If a user of the emergency wash system 2720 were to place their weight on wash basin 2770, at least part of this weight would be supported by a load path from the basin 2720 to an arm 2725, and ultimately into housing 2734 by way of support aperture 2725*b*. Otherwise, the weight of the user would be supported by the bottommost drain tube. In some applications, this bottommost drain tube may not be structurally sufficient to support the leaning weight of user, and in yet other embodiments may be a flexible coupling incapable of supporting any weight. Still further, supporting the weight of the user through the bottommost tube can lead to leakage at the couplings.

In one embodiment body 2734 is cast to include a support aperture 2725*b* that has a cross sectional shape that is substantially the same as the cross sectional shape of the support arm 2725 which is received in the aperture in an assembled system 2720. In some embodiments, aperture 2725*b* is a thru-aperture that is substantially rectangular and close-fitting around the rectangular periphery of a support arm 2725. By having a non-circular cross sectional shape, aperture 2725*b* is able to resist any torque that is applied to arm 2725 by the weight of the user or the weight of the basin 2770. The interconnection of the support arm 2725 and basin 2770 can be of any type, including by way of example the connection depicted in FIG. 28.

Figure 71A:
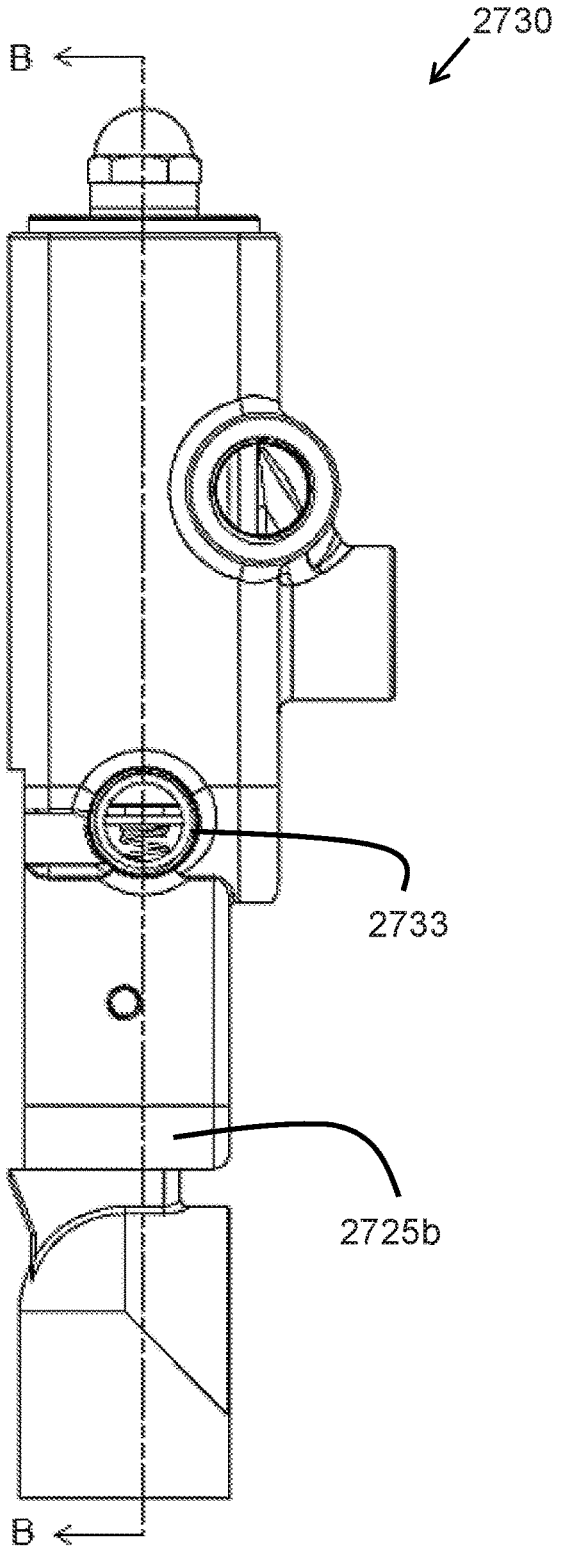
FIG. 71A shows an elevational exterior side view of the apparatus of FIG. 70A.
Figure 72A:
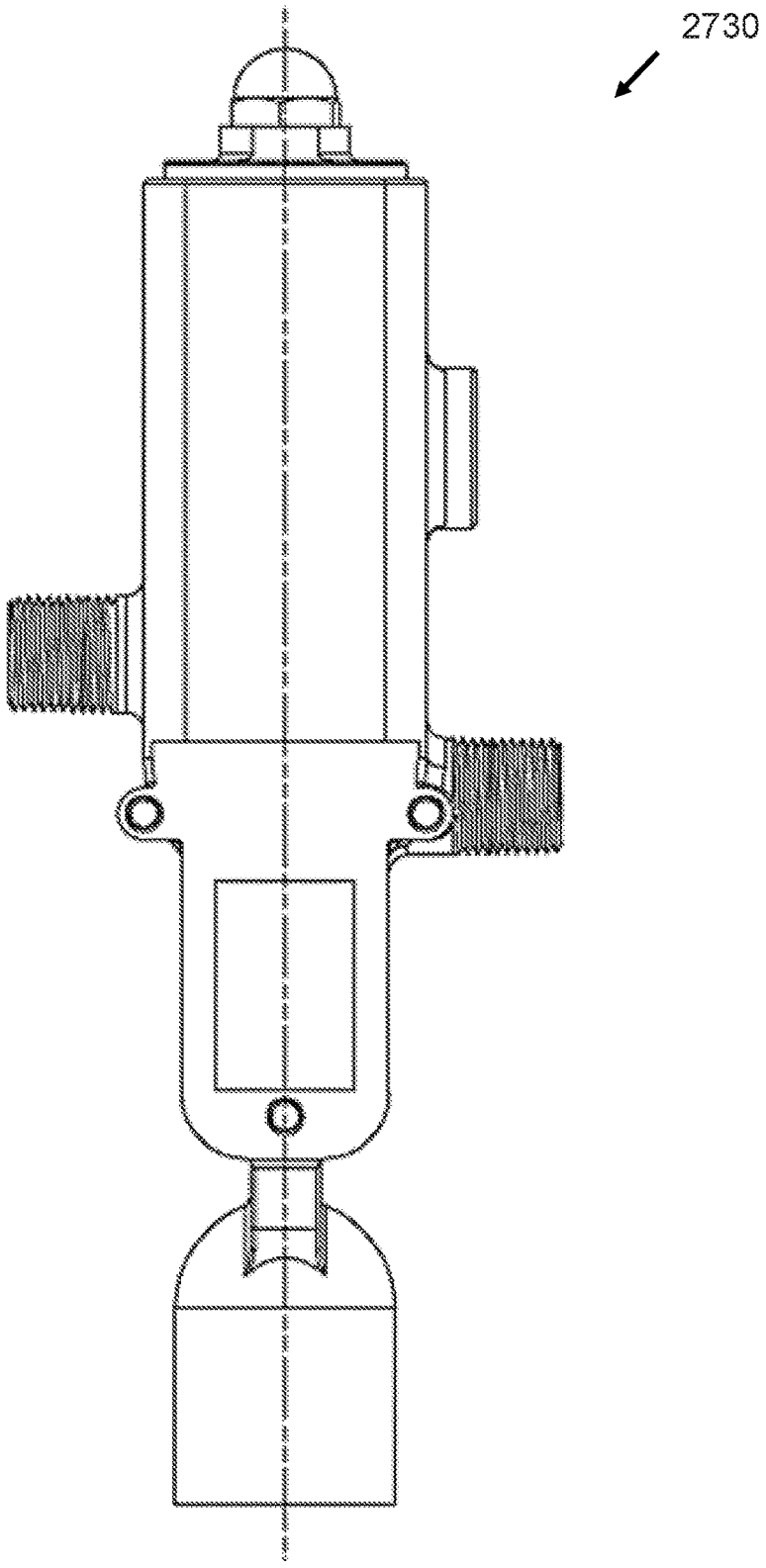
FIG. 72A shows an elevational rear exterior side view of the apparatus of FIG. 70A.
Figure 72B:
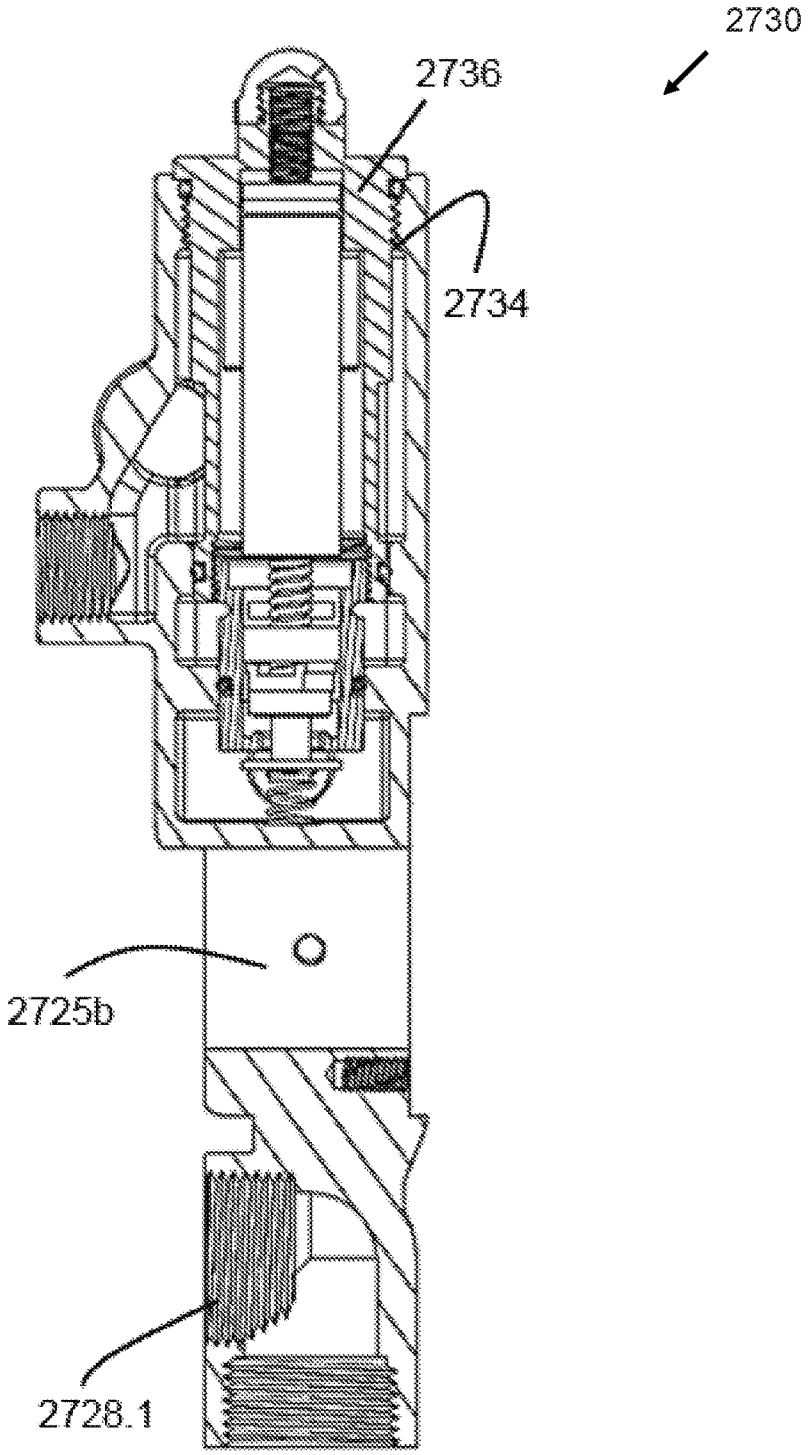
FIG. 72B is a cross sectional view of the apparatus of FIG. 72A as taken along line B-B.

As can be seen in FIGS. 70, 71A and 72B, a sidewall that partially defines aperture 2725*b* can include, in some embodiments, a threaded hole. In such applications, and especially where support arm 2725 is close fitting within the aperture, a setscrew can be torqued into the threaded hole to remove any looseness between the support arm and the support aperture.

Figure 71B:
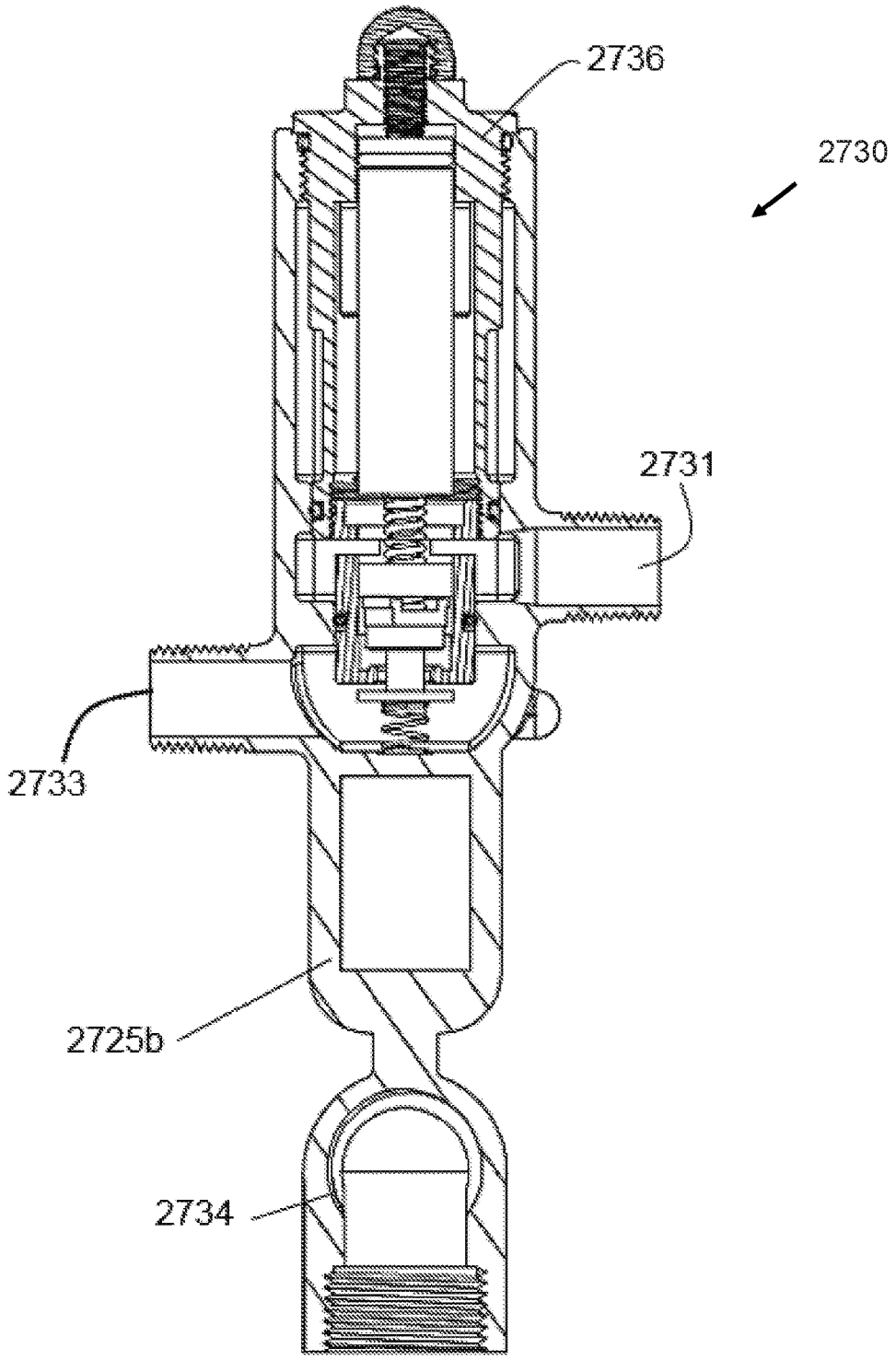
FIG. 71B is a cross sectional view of the apparatus of FIG. 71A as taken along line B-B.

Referring to FIGS. 71 and 72, it can be seen that the structure surrounding the aperture blends into the structure surrounding the water return 2728.1. In some embodiments, this structural interconnection between the support aperture 2725*b* and the water return 2728.1 is necked down to minimize the usage of material (such as brass), while still maintaining a vertical support structure able to support vertical loads, lateral loads, and bending moments applied to body 2734.

Figure 73:
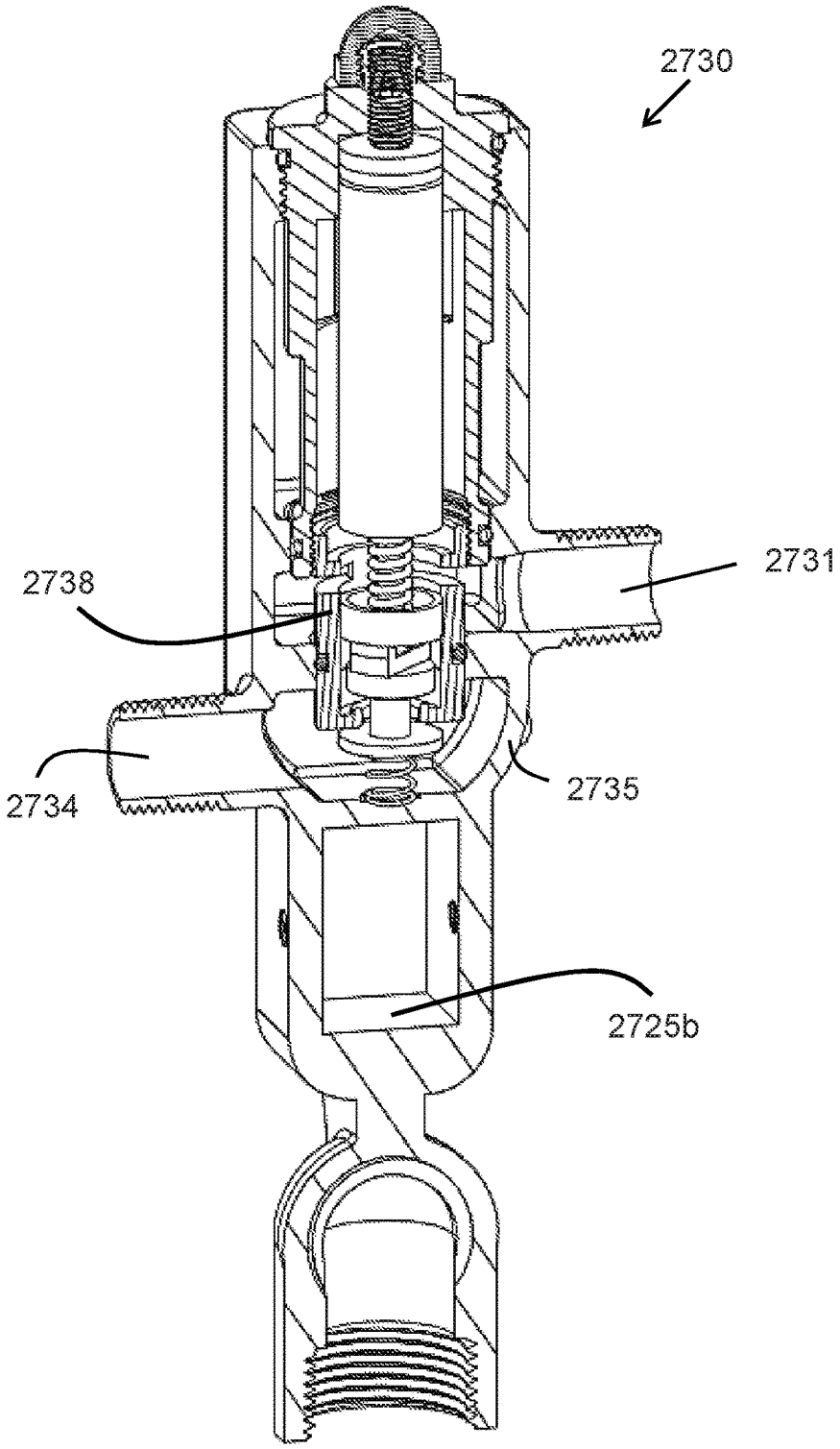
FIG. 73 is a perspective representation of the apparatus of FIG. 71B.

FIGS. 71B, 72B, and 73 show the internal structure of one embodiment of valve 2730. Preferably, a cartridge-type thermostatically control valve is threadably received within housing 2734. Cartridge valve 2736 includes a thermostat that is operably connected to a metering section in order to mix hot and cold flows of water, and provide a mixed, tempered water at a tepid temperature to outlets 2732. In yet other embodiments the body 2734 is further configured to include one or more check valves (X39) or pressure modifying valves (X57) or the heater (X90), each of which will be discussed with regards to emergency washing system 2820.

Figure 74:
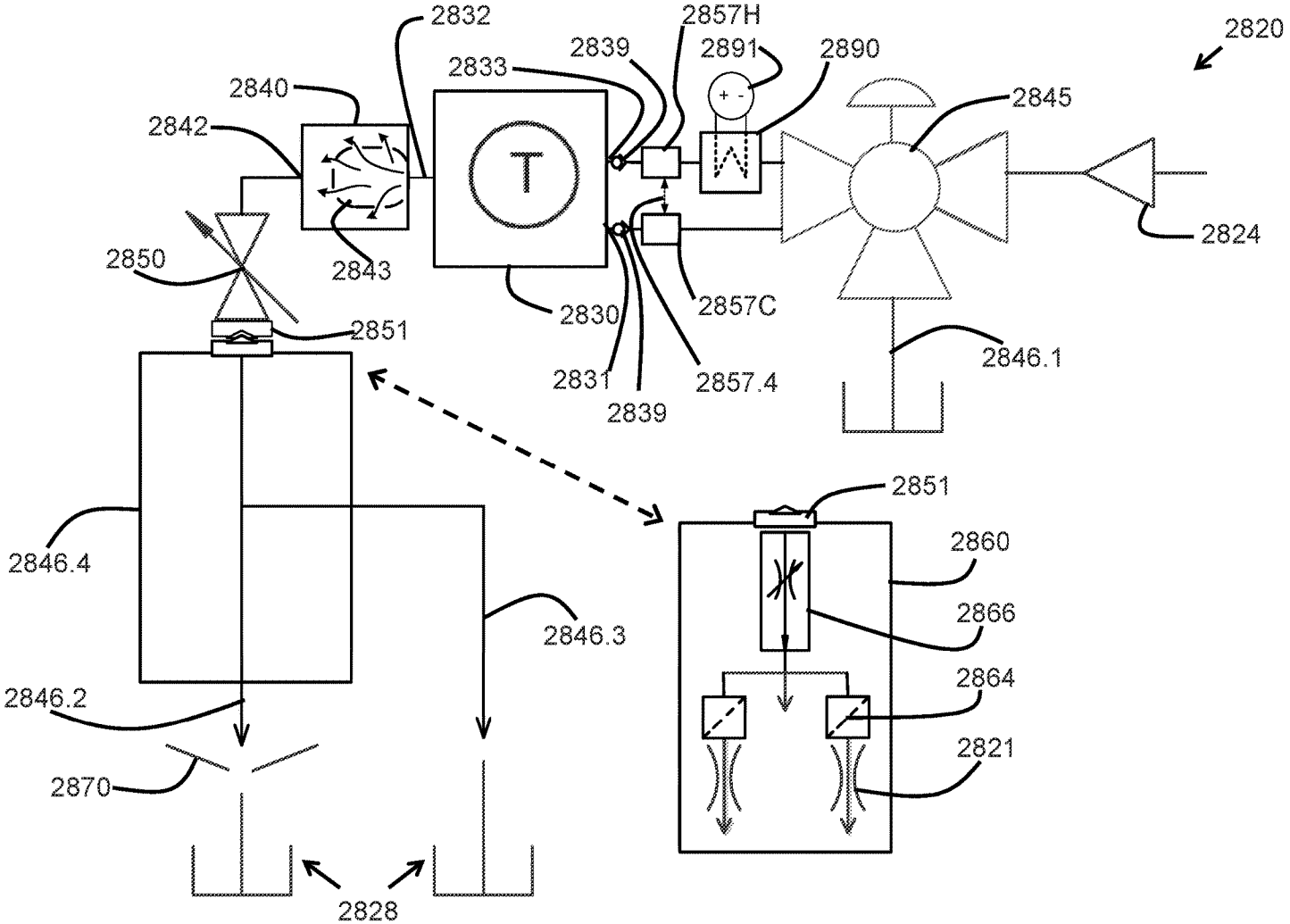
FIG. 74 is a schematic representation of a flushable emergency eyewash system according to one embodiment of the present invention.

FIGS. 74, 75, 76, and 77 depict various aspects of an emergency washing system 2820 according to another embodiment of the present invention. FIG. 74 presents a hydraulic schematic representation of a system 2820 that includes the flushing capability discussed in connection with FIG. 68B. Water flowing from a source 2824 is provided to a three-way valve 2845 that includes provisions for a flush of the water source by way of flushing line 2846.1. Water from the outlet of valve 2845 is provided in two outlets to system 2820. A first outlet provides source water to an electric heater 2890 that is heated by electricity from a source 2891.

In one embodiment, heater 2890 is a point-of-use water heater such as a model GL6 manufactured by Ariston. In other embodiments, heater 2890 is an electric heater that is rated to about 1500 watts, producing water in the range of 65 F. to 145 F. In some embodiments, heater 2890 includes a reservoir (not shown) of five to ten gallons. It is understood that the emergency eye washing system is preferably adapted and configured to provide tepid water for flushing of the user's eyes, and various components of the eye washing system are adapted and configured to provide this tepid flow of water. For example, the power consumption of heater 2890 may be limited to something less than its maximum power capacity so as to provide a flow of hot water at a flow rate to a thermostatically controlled valve that is within the range of operation of the valve. In yet other embodiments, there may be an electronic controller that varies the input power to the heater, such as a controller that provides a first, higher power level for a short period of time (such as a few seconds) to overcome the thermal inertia of the downstream components, followed by a second period of steady state operation at a lower power.

The heated water is supplied in some embodiments to a pressure modifying valve 2857H, and from this pressure modifying valve through a check valve 2839 and into the inlet 2833 of a thermostatically controlled mixing valve 2830. A second path for water from valve 2845 is provided in some embodiments to a pressure modifying valve 2857C, the outlet of which provides water at a lower pressure to the inlet of a second check valve 2839, and thereafter into the cold water inlet 2831 of valve 2830. In still further embodiments, tempered fluid from outlet 2832 is provided into the serpentine passages 2843 of a diffuser 2840, and from the outlet 2842 of that diffuser into a shutoff valve 2850.

Schematic FIG. 74 further illustrates the interchangeability of an eye washing housing assembly 2860 with a flush housing assembly 2846.4. As depicted in FIG. 74, the eye wash housing has been disconnected by the quick connect fitting 2851, and the flush housing 2846.4 is shown in a position to provide flushed water through parallel system and source flush lines 2846.2 and 2846.3, respectively.

It has been found in some applications that the use of a large water heater can be a limiting factor in the placement of an emergency eyewash. Further, if there is no local water heater, then any hot water supplied to the emergency eye wash will necessarily run through an excessive length of piping, which will delay the delivery of hot water and result in the user's eyes being flushed with cold water. Such a cold water flush can be discouraging to users, and either limit their use of the eyewash under emergency conditions, or result in squinting or partial closure of the eyes, which results in a less effective flush. In some applications the placement of a water heater near the emergency eyewash is not practical, and can still further result in a delayed delivery of hot water as the internal tubing from the cold initial conditions of the water heater outlet tubing.

Eye washing system 2820 addresses some of these problems by incorporating a local electric water heater. However, such water heaters can require substantial operating current if the eyewash flow is in the range of four or five gallons per minute. If an emergency eyewash system requires more electrical power than is readily available at a particular worksite, then it is either less likely that the eye washing system will be installed, or the cost of installation will be greatly increased by the need to bring in sufficiently high power electrical lines.

In one embodiment, eye washing system 2820 is adapted and configured to provide a flow of washing water through a spray nozzle that substantially meets federal requirements, but has a flowrate that is less about two gallons per minute. With such a low flow system, the electrical heating requirements are reduced, and the power requirements of source 2891 are reduced. Thus, a low flow eye washing system permits the introduction of emergency eyewash stations into locations where the station was previously not feasible.

Referring to the schematic of FIG. 74, it can be seen that if water from source 2824 is provided through a water heater 2891 to one inlet of valve 2830, but provided directly to the other, then the heated water will necessarily be at a lower pressure than the non-heated source water. It has been found that this difference in water pressure can result in improper operation of thermostatically controlled mixing valve 2830, and subsequently deficient operation of the emergency eye washing system 2820. Therefore, some embodiments of the present invention envision the use one or more pressure modifying valves 2857 in either the cold line (2857C) and/or the hot line (2857H).

Emergency eyewash system 2820 in some embodiments includes one or more pressure modifying valves 2857. Each of these valves provides water to the thermostatically controlled valve at pressures that permit acceptable operation. If there is too much variation between the hot inlet and cold inlet water pressures, then it is possible that the pressure balance within the mixing valve can be imbalanced to the point of improper operation, which in extreme cases can include a shutoff of one or both of the water inlets. The emergency washing system 2820 reduces the risk of such imbalances by: (1) lowering the overall flow level going through the dispensing caps; and (2) modifying the thermostatic valve inlet pressure for the cold inlet, hot inlet, or both inlets.

With regards to lowering the flowrate through the dispensing caps, system 2820 can include a flow controlling valve 2860 adapted and configured to provide water flows less than about 5 gpm and more preferably less than about 2 gpm. Still further, other similar flow controlling devices can be incorporated elsewhere in system 2820. As yet another example, in some embodiments a flow controlling valve is provided in the flowpath from three-way valve 2845 to hot inlet 2833. Still further, an additional flow controlling valve can be provided in the flowpath from valve 2845 to cold inlet 2831. Preferably, these flow controlling valves would limit the upper range of flows to an upper limit that is lower than the upper limit of a main or central flow controlling valve 2866, due to the fact that these individual flow controlling valves (X66) are intended to limit cold or hot flows only, and the central valve 2866 limits total flow. In still further embodiments of the present invention, it is contemplated that the function of the three-way valve 2845 and flushing line 2846.1 can be accomplished downstream of the diffuser 2840 and upstream of the shut off valve 2850. With such a modification, it is further possible to flush water from the hot water heater, thermostatically controlled mixing valve, and diffuser when the dead ended leg of the building plumbing is flushed.

With regards to the pressure modifying valves, at least three different types of valves can be used in various embodiments of the present invention. One example is a pressure regulating valve that preferably includes an adjusting device (which can be set once and not intended for adjustment by unqualified persons). Such a valve can include one or more internal features that automatically compensate for changes in water pressure. Yet another type of pressure modifying valve is a pressure reducing valve. Such valves can include either static or moving internal members that provide with relative simplicity a pressure drop based on flow characteristics. A third type of pressure modifying valve include a pressure balancing valve. These balancing valves include one or more moving internal features that are repositioned to affect the flow to one of the inlets based on the pressure provided to the other inlet. As one example, and referring to pressure communication path 2857.4 of FIG. 74, a pressure balancing valve 2857.3*c* is provided with a signal pressure from the hot inlet, and this pressure signal is used to move an internal member and adjust the pressure drop to the cold inlet of valve 2830.

Figure 75:
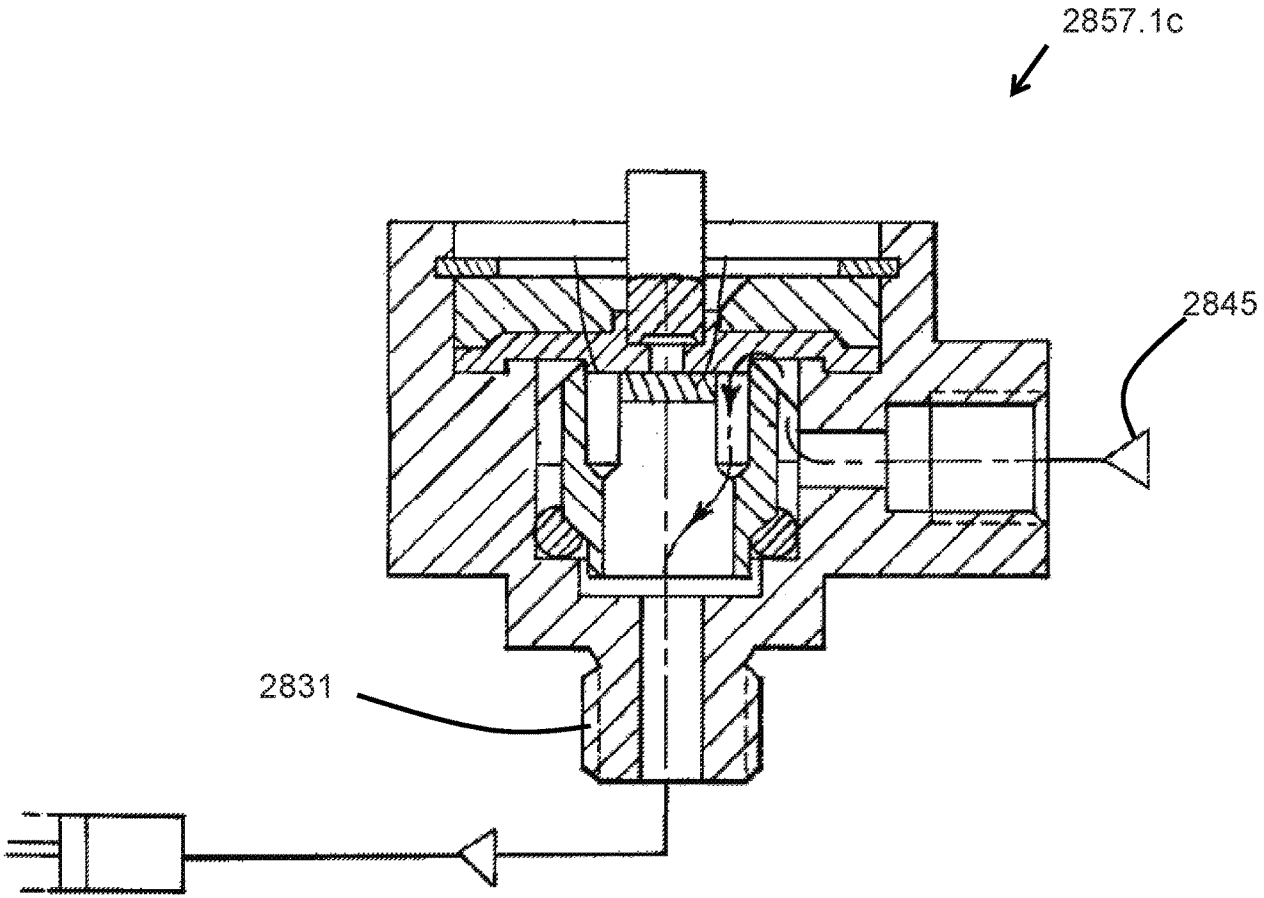
FIG. 75 is a cutaway view of a pressure modifying valve according to one embodiment of the present invention and useful in the eyewash system of FIG. 74.

FIG. 75 shows a cross sectional representation of a pressure modifying valve according to one embodiment of the present invention. A cutaway of a pressure regulating valve 2857.1C is shown. The direction of water flow through this valve is indicated by the arrows. Water exits from a port that provides water to cold inlet 2831 of thermostatically controlled valve 2830. Further description of the operation of valve 2857.1C can be found in U.S. Pat. No. 4,625,750, titled FORCE-CONTROLLED PRESSURE REGULATING VALVE.

Figure 76:
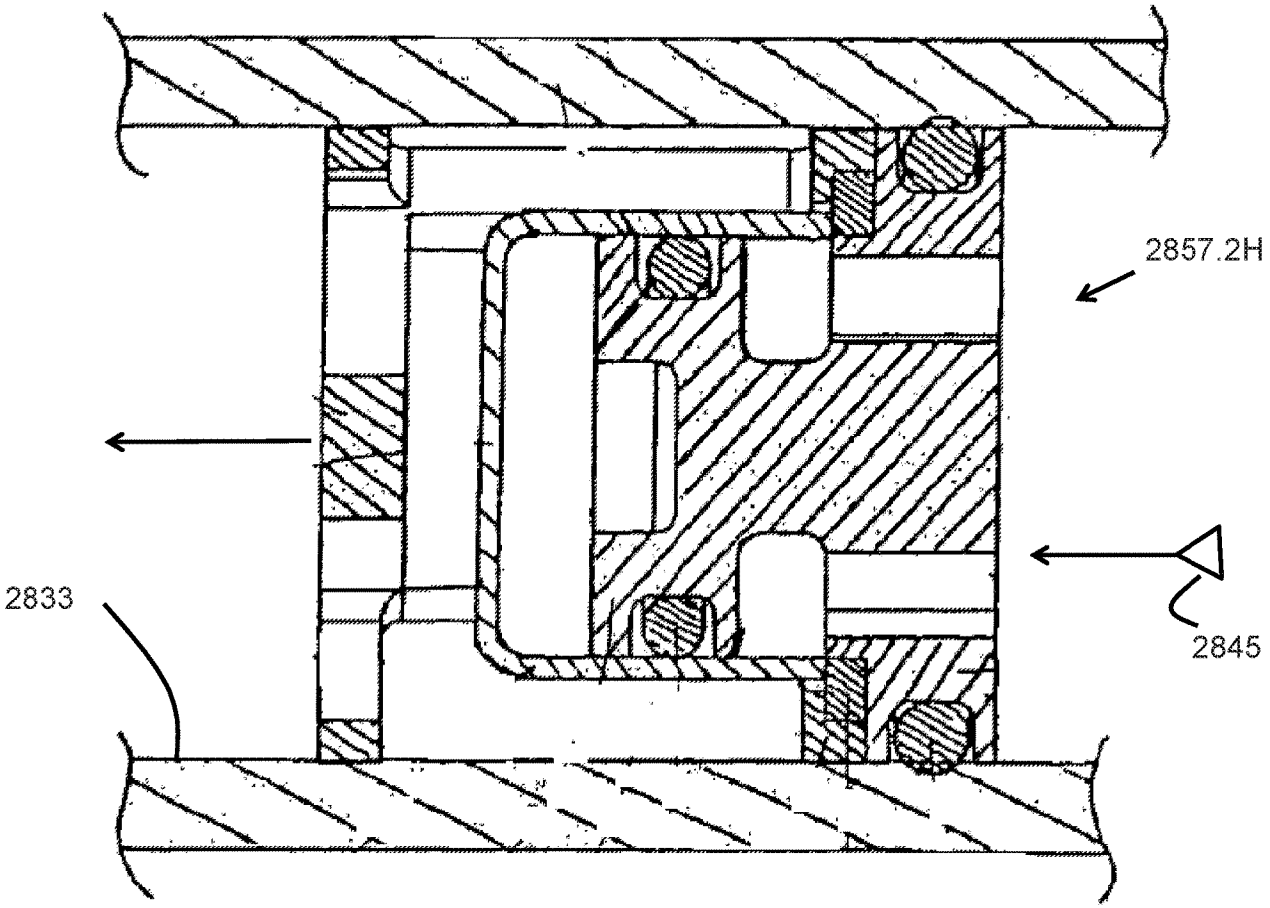
FIG. 76 is a cutaway view of a pressure modifying valve according to one embodiment of the present invention and useful in the eyewash system of FIG. 74.

FIG. 76 shows a cross sectional representation of a pressure modifying valve according to one embodiment of the present invention. A cutaway of a pressure reducing valve 2857.2H is shown. The direction of water flow through this valve is indicated by the arrows. Water exits from a port that provides water to cold inlet 2831 of thermostatically controlled valve 2830. Further description of the operation of valve 2857.2H can be found in U.S. Pat. No. 7,258,133, titled PRESSURE REDUCING VALVE.

Figure 77:
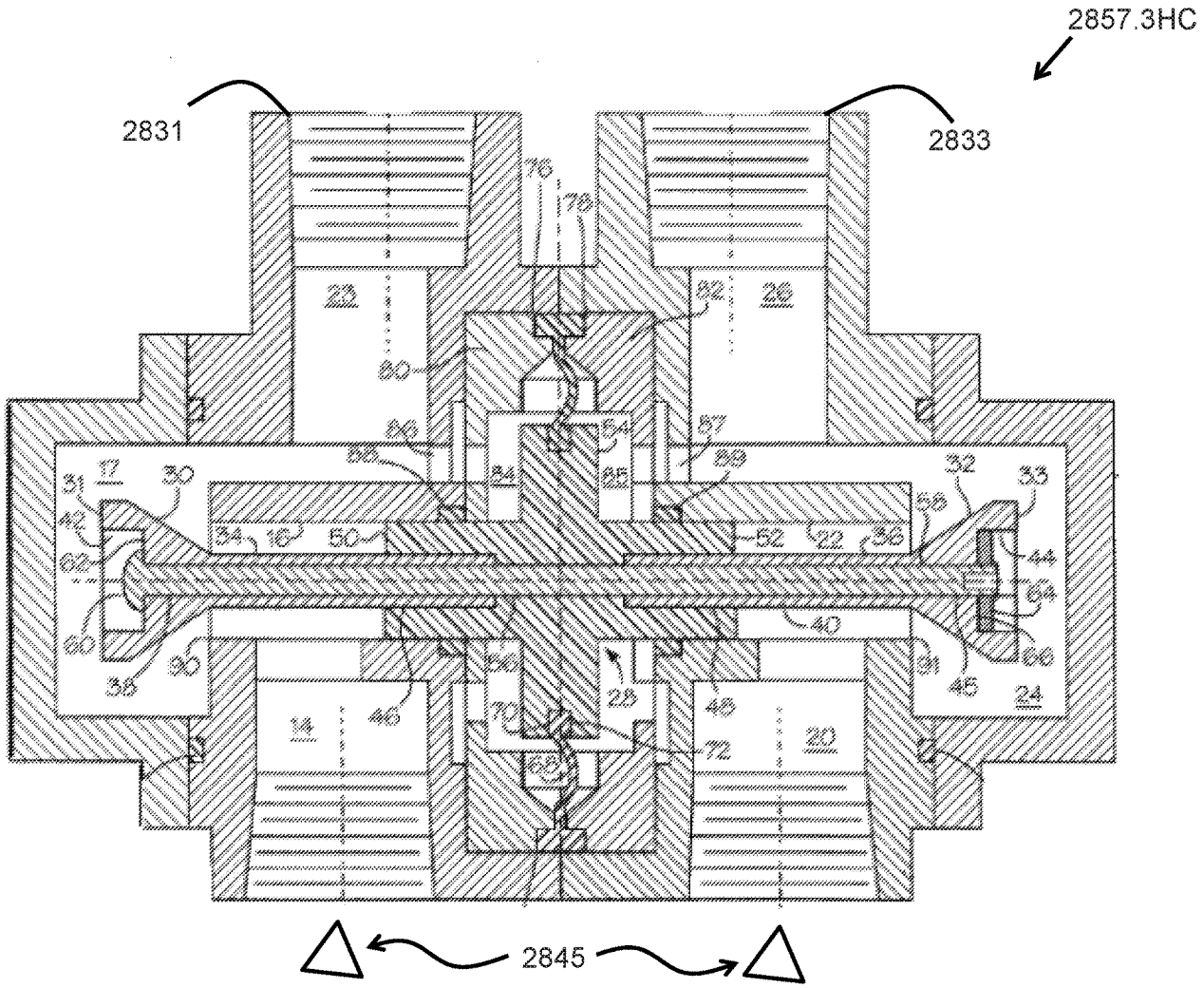
FIG. 77 is a cutaway view of a pressure modifying valve according to one embodiment of the present invention and useful in the eyewash system of FIG. 74.

FIG. 77 shows a cross sectional representation of a pressure modifying valve according to one embodiment of the present invention. A cutaway of a pressure balance valve 2857.3HC is shown. The direction of water flow through this valve is indicated by the arrows. Water exits from a port that provides water to cold inlet 2831 of thermostatically controlled valve 2830. Water exits from the other port to provide water to the hot inlet 2833 of valve 2830. It is understood that some pressure balancing valves operate more effectively if there is a constant flow of hot and cold water. Without this constant flow, even if the flow is small, the valving of such pressure balancing valves could provide a shut off of either hot or cold flow. Preferably such pressure balance and valves should include such features to maintain hot and cold flow. Further description of the operation of valve 2857.3HC can be found in U.S. Patent Publication No. 2003/0131882, titled PRESSURE BALANCING VAVLE.

In order to achieve an emergency wash system with a low flowrate, it is helpful to account for the wide variation in water pressure typically found within the plumbing of a building. Based on the age of the plumbing, the codes it was constructed to, the design selected by the plumber, and the presence or absence of other water-carrying devices proximate to the eyewash system, there can be a very wide variation in pressure. In a low flow system according to one embodiment of the present invention, the emergency wash system is made tolerant of the wide range of source pressure of the pressurized water by the use of a flow control valve providing a substantially constant flow of water to a large, low velocity, uniform pressure chamber that provides the water in parallel (with a little or no lateral flow) to a plurality of spray apertures. The various types of flow control valves contemplated herein provide one or both of a variable flow area or a variable flow coefficient, based on the upstream pressure, the downstream pressure, and the desired flowrate.

It has been found by installing a large number of emergency wash systems, that it is not possible to design a low flow system that operates using higher pressure. This is because the range of high pressure in a building plumbing system varies considerably. However, it has been found that the minimum low pressures of a building plumbing system are more consistent. Therefore, a low flow emergency wash system according to one embodiment of the present invention is adapted and configured to include a flow control valve (or emergency wash housing) that operates with both a relatively low pressure drop from inlet to outlet, and further a relatively low overall gauge internal pressure.

Figure 78A:
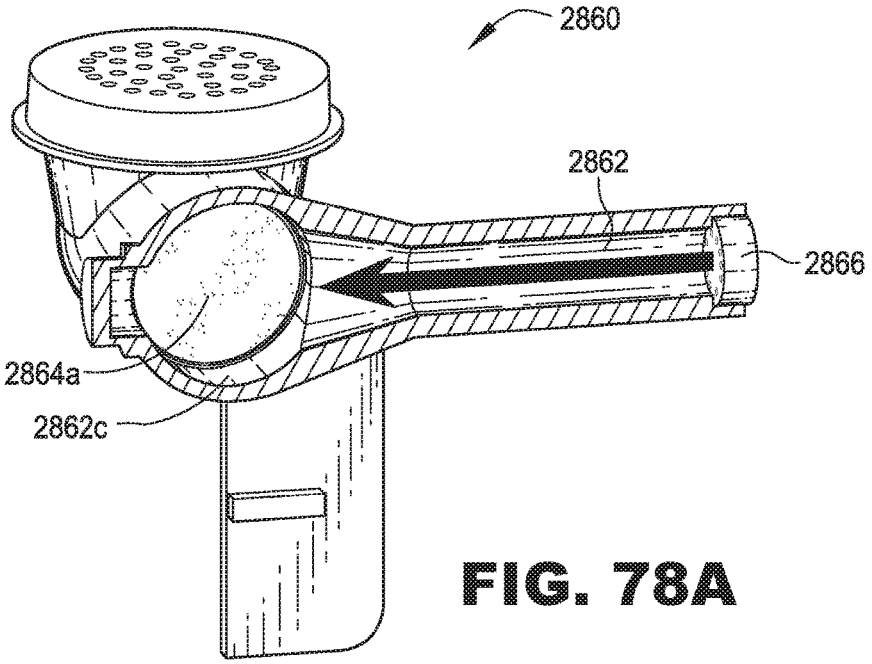
FIG. 78A is a graphical depiction of the distribution of water flow within an outlet valve according to one embodiment of the present invention. This is a scaled drawing of a flow outlet housing according to one embodiment of the present invention.
Figure 78B:
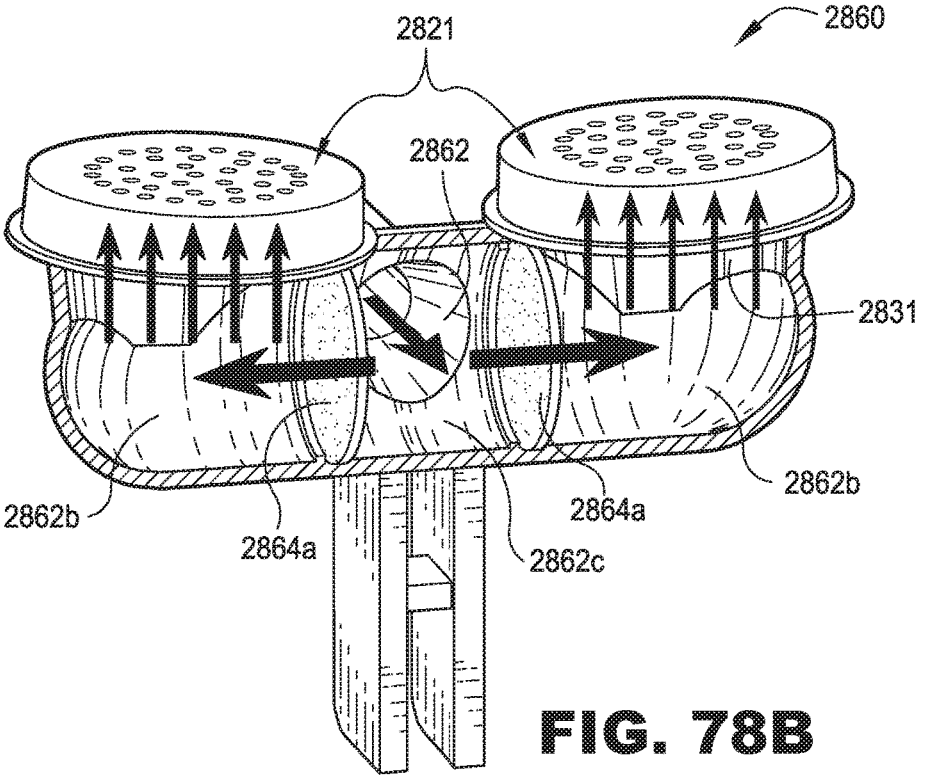
FIG. 78B is another graphical depiction of the internal water distribution within an outlet valve according to one embodiment of the present invention. This is a scaled drawing of a flow outlet housing according to one embodiment of the present invention.

FIGS. 78A and 78B schematically depict the flow distribution within the flow outlet valve 2860 (sometimes referred to herein as an emergency wash housing). A flow control valve 2866 is placed at the inlet to the main flow conduit 2862. Flow control valve 2866 is adapted and configured to provide, in one embodiment, a flow of about one gallon per minute for the range of pressure encountered in typical building plumbing systems. If the building system has a high source pressure, the flow control valve 2866 will correspondingly reduce its internal flow area and/or decrease its internal flow coefficient. In this manner, the emergency flow outlet valve 2860 has an internal pressure that is isolated from the high source pressures that may exist in the building plumbing. The low water flowrate of about one gallon per minute is represented by a large arrow located centrally within the main flow chamber 2862.

FIG. 78B graphically depicts how the total flow within the main flow chamber 2862 is evenly divided to the right and left large internal chambers 2862*b* after flowing through a central large flow chamber 2862*c*. Referring briefly to FIG. 78A, it can be seen that the flowpath of the internal chamber 2862 is substantially cylindrical, and then gradually increases in a conical section in the vicinity of the central chamber 2862*c*, which is bounded on either side by filters 2864*a*. In this manner, the relatively high velocity and turbulent flow within the cylindrical portion of the flow chamber has reduced velocity and reduced turbulence as it enters the central chamber 2862*c*. It is believed that the filters (which in one embodiment are about two hundred mesh) further decrease the turbulence of the water moving from the central chamber to a lateral chamber.

FIG. 78B shows that the total flow coming out of the flow control valve is "dead ended" into central chamber 2862*c*, meaning that the chamber acts to stagnate the flow coming down the flow passage 2862. Further, the central chamber has a cross sectional area (esp. through the center line of the filters) that is substantially greater than the cross sectional flow area of the relatively narrow passage 2862. As a result of these design considerations, the flow into the outlet valve 2860 slows abruptly, and further changes direction to pass through the parallel filters 2864*a*. The total flow through these filters is represented by the two opposing arrows of FIG. 78B, each carrying half of the total flow. The flow exiting these filters passes into a chamber that has an inlet cross sectional flow area (at the exit of the filer) that is substantially the same as the flow area of the filters themselves. Therefore, the flow profile through the filter is generally intact as an inlet profile to the large internal chambers 2862*b*. These chambers have cross sectional flow areas along two planes (one plane at the filter outlet, and the other plane at the inlet to cap 2821) that are about the same, and further are both substantially larger than the cross sectional area of the inlet 2862. Therefore, flow from the central chamber 2862*c* into the side chambers 2862*b* is at a low velocity, with greatly decreased turbulence, and in some embodiments may achieve a laminar flowpath from filter exit to cap spray aperture. The plurality of parallel, upward arrows underneath each cap 2821 graphically depict a substantially uniform pressure profile underneath the cap.

It has also been determined that this low pressure chamber is helpful in some embodiments to achieve the desired dispersal pattern through the cups 2821, even at a low overall flow, of about one-half gallon to less than one gallon per minute through each cup. It has been found that it is useful to arrange the internal flowpath of the large chamber 2862*b* relative to the respective cap 2821 such that flow from the chamber through an aperture of the cap is substantially parallel for each of the apertures. For example, the flow exiting an aperture that is outermost from the outlet valve center line does not have to first pass by an innermost aperture, which is the case with some current designs.

In such other designs, all of the flow exiting a distalmost (outermost) spray aperture first passes past a proximal (innermost) spray aperture, which requires that the overall design account for an internal pressure at the innermost aperture that is greater than the pressure at the outermost aperture. In various embodiments of the present invention, this is not the case. Instead, there is a generally uniform pressure distribution within the large internal chamber 2862*b*. This further means that, proximate to the discharge caps 2821, the velocity profile into the caps is substantially upward and axial through the apertures. There is relatively little lateral flow proximate to the apertures. Again, this differs from current designs in which there may be considerable lateral flow under an innermost aperture, this lateral flow being the portion of flow delivered in those other designs to the outermost aperture.

Figure 79:
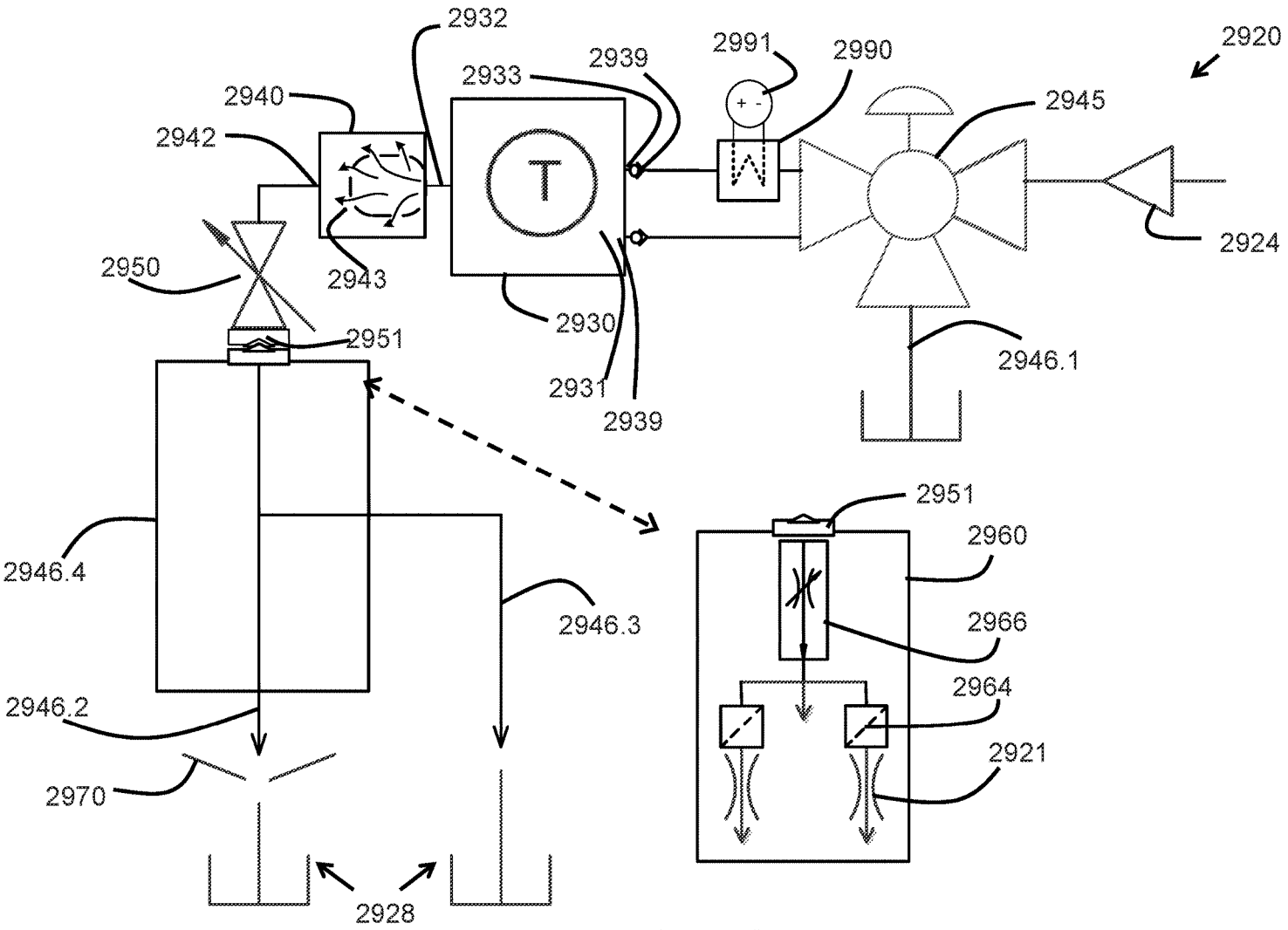
FIG. 79 is a schematic representation of a low flow emergency wash system according to another embodiment of the present invention.

FIG. 79 depicts yet another embodiment of the present invention for an emergency washing system 2920 that is similar to the washing system 2820 previously described, but with the changes that will be discussed.

Considering the description of the characteristics of a low-flow emergency wash system presented with regards to FIGS. 78A and 78B, a low flow system 2920 preferably does not include the various pressure modifying valves 2857. Further, system 2920 includes an electric water heater 2991 that further includes a reservoir. As previously stated, the presence of a reservoir (a hot water tank) often prevents a tepid emergency wash system from being located at various locations within a building because of the floor space required by the hot water tank. However, it has been determined if the emergency wash system has a sufficiently low flow (under two gpm, and preferably around one gpm), the sides of the hot water tank can be greatly reduced, thus permitting small hot water tanks that can be attached to a wall, and thus not require floor space.

It is generally recognized that the emergency washing system should provide tepid water for about fifteen minutes. Considering the example of a system flowing about one gpm total, then approximately one-half of this flow will come from the hot water reservoir for a period of fifteen minutes, which results in a capacity requirement of about seven and one-half gallons for the hot water reservoir. A reservoir of this size can weigh less than one hundred pounds, which makes the tank suitable for wall mounting. A more conventional emergency wash system flowing three to five gpm would require a take three to five times larger, and can result in a hot water reservoir weighing in excess of two hundred pounds. Still further, it has been the use of a hot water tank combined with a hot water heater provides for less pressure drop of the hot water source. This decreased pressure drop of the hot water, especially in consideration that this is a pressure drop that may not be experienced by the cold water source, results in a system 2920 that does not need pressure balancing valves in order to provide acceptable inlet pressures to the hot and cold inlets of the thermostatically controlled mixing valve 2930. For these reasons, in some embodiments of the present invention the operation of the low flow system is enhanced by the use of a low pressure drop, hot water reservoir instead of the higher pressure drop associated with instantaneous water heaters.

Figure 80A:
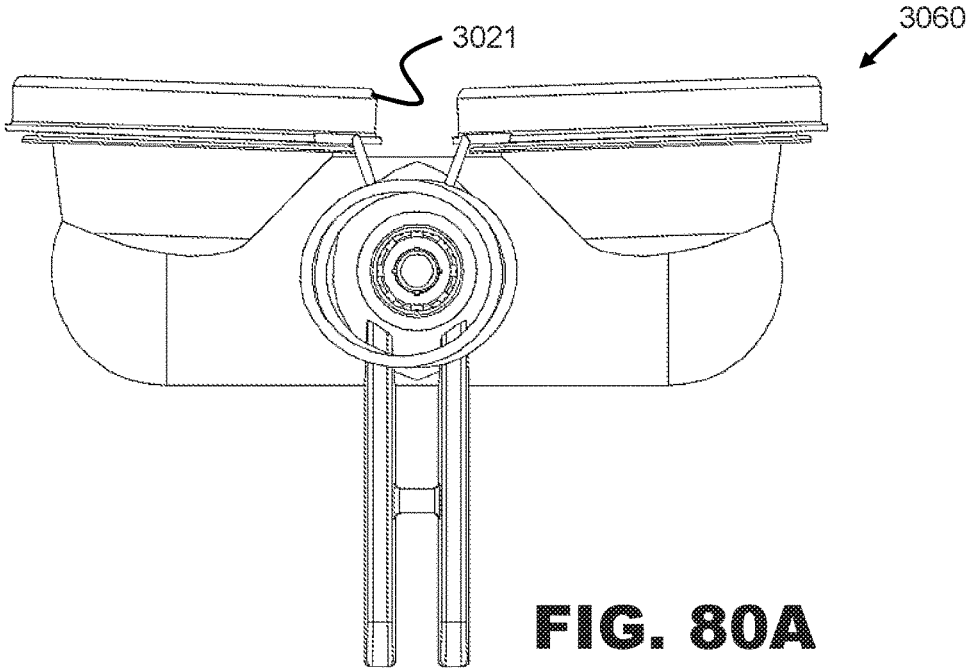
FIG. 80A is a scaled rear end view of an outlet flow housing according to one embodiment of the present invention.
Figure 80B:
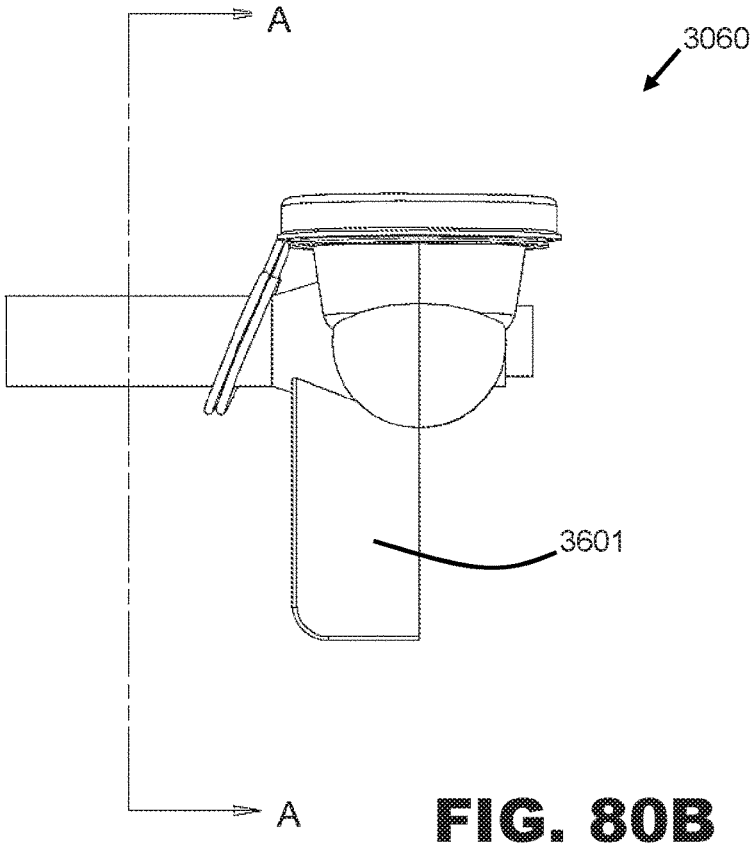
FIG. 80B is a scaled side elevational view of the outlet flow housing of FIG. 80A.
Figure 80C:
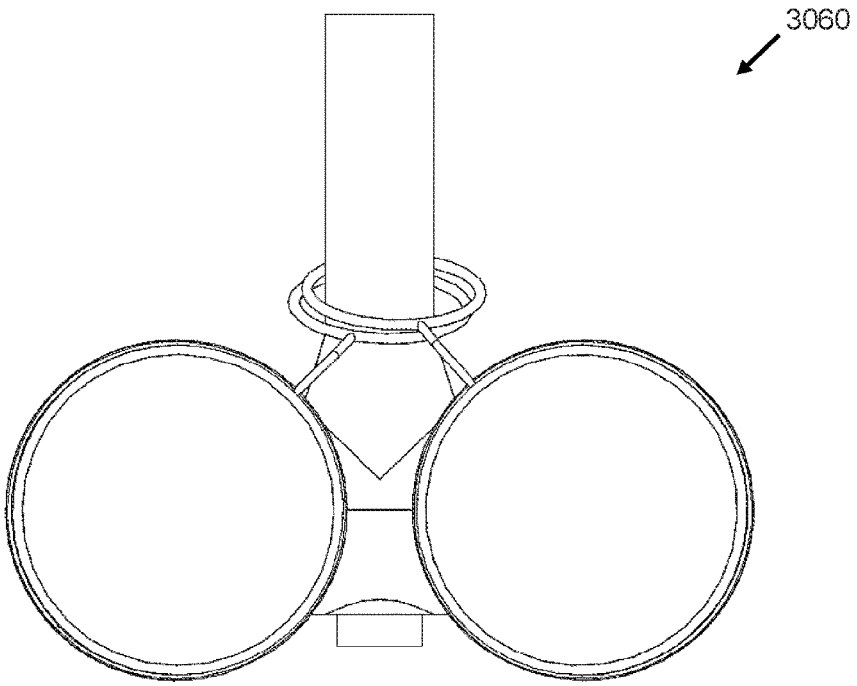
FIG. 80C is a scaled top plan view of the outlet flow housing of FIG. 80A.
Figure 80D:
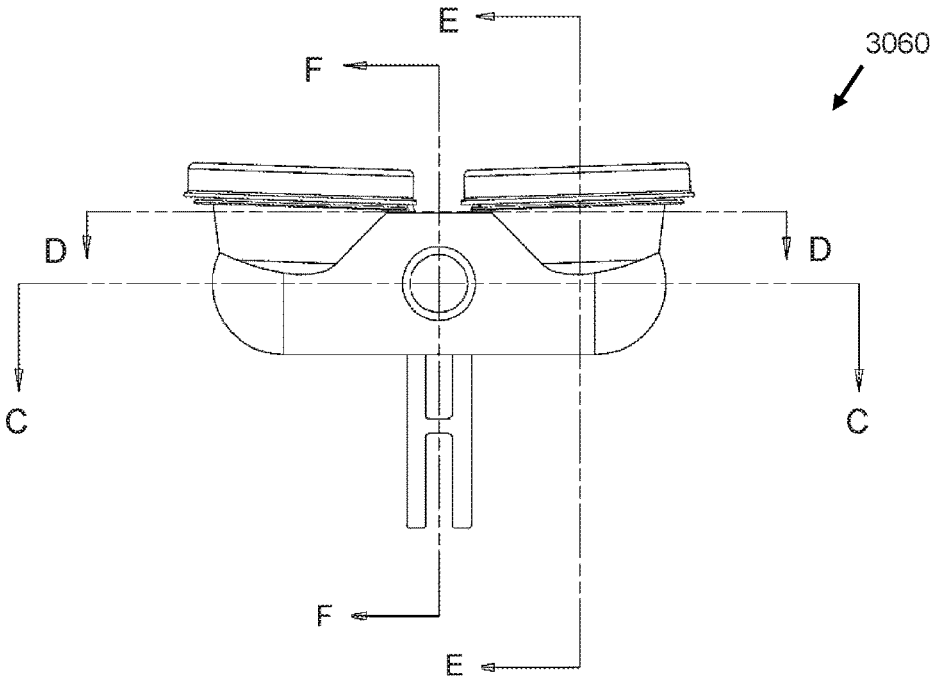
FIG. 80D is a scaled front end view of the outlet flow housing of FIG. 80A.
Figure 80E:
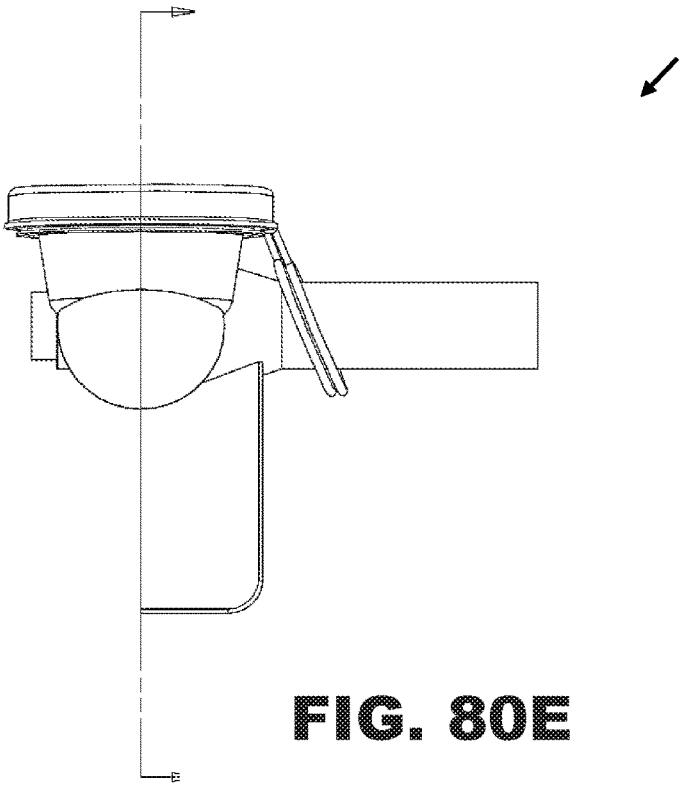
FIG. 80E is a scaled side elevational view of the outlet flow housing of FIG. 80A.
Figure 80F:
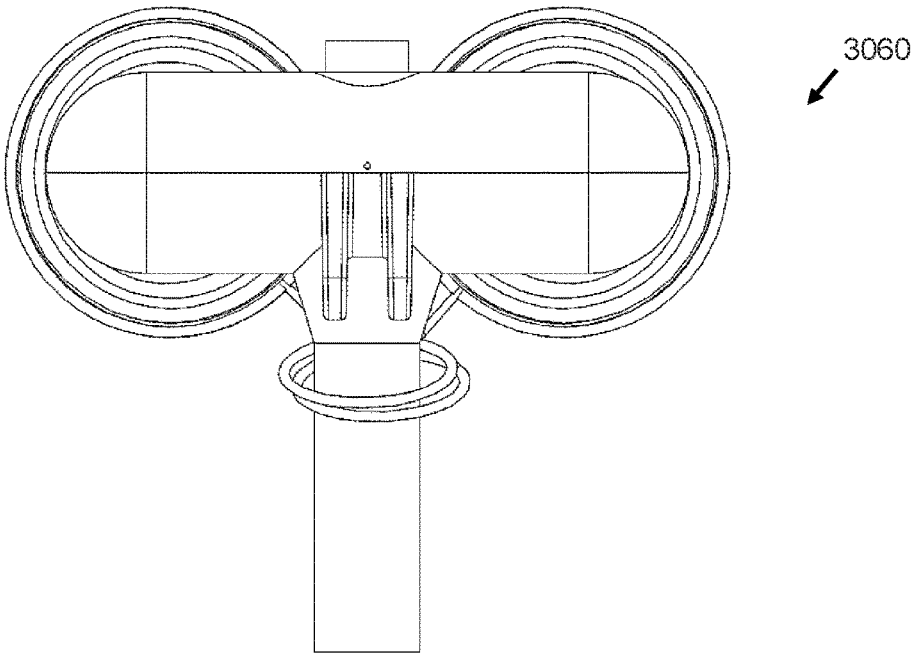
FIG. 80F is a scaled bottom plan view the outlet flow housing of FIG. 80A.
Figure 81A:
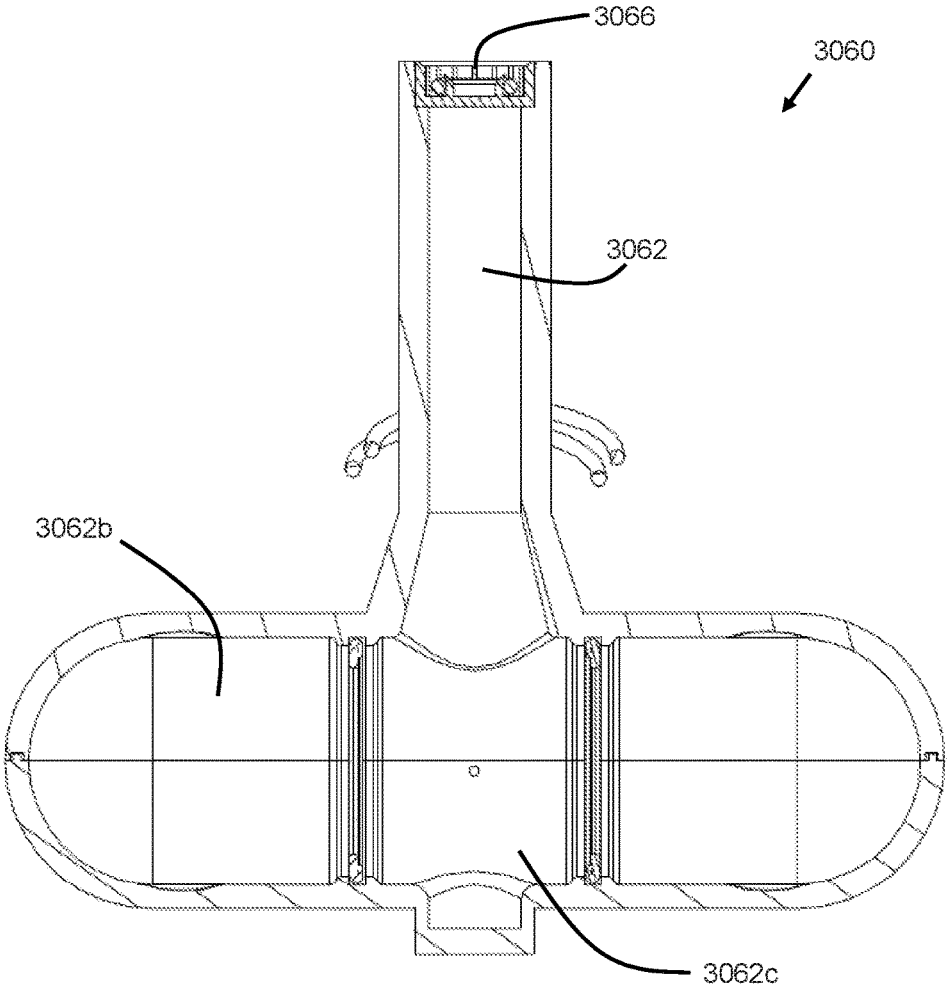
FIG. 81A is a scaled cross sectional view of the apparatus of FIG. 80A as taken along line C-C of FIG. 80D.
Figure 81B:
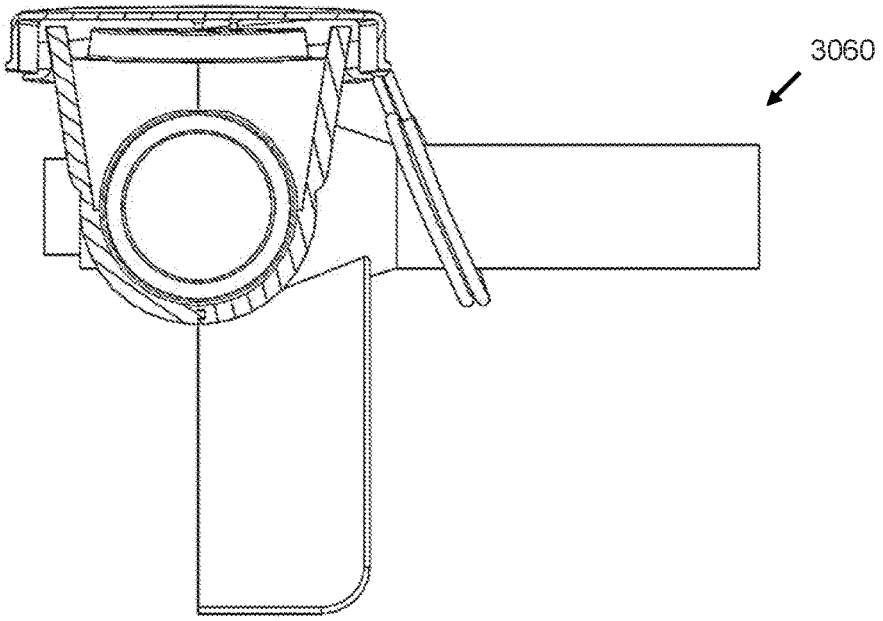
FIG. 81B is a scaled cross sectional view of the apparatus of FIG. 80D as taken along line E-E.
Figure 81C:
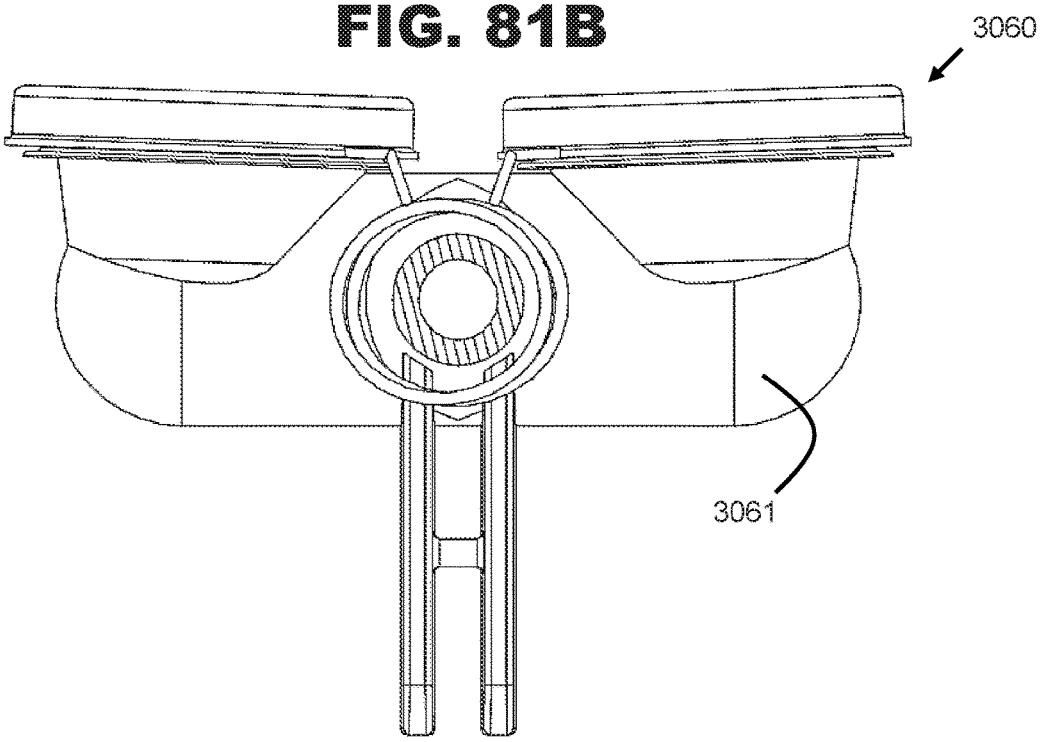
FIG. 81C is a scaled cross sectional view of the apparatus of FIG. 80B as taken along line A-A.
Figure 81D:
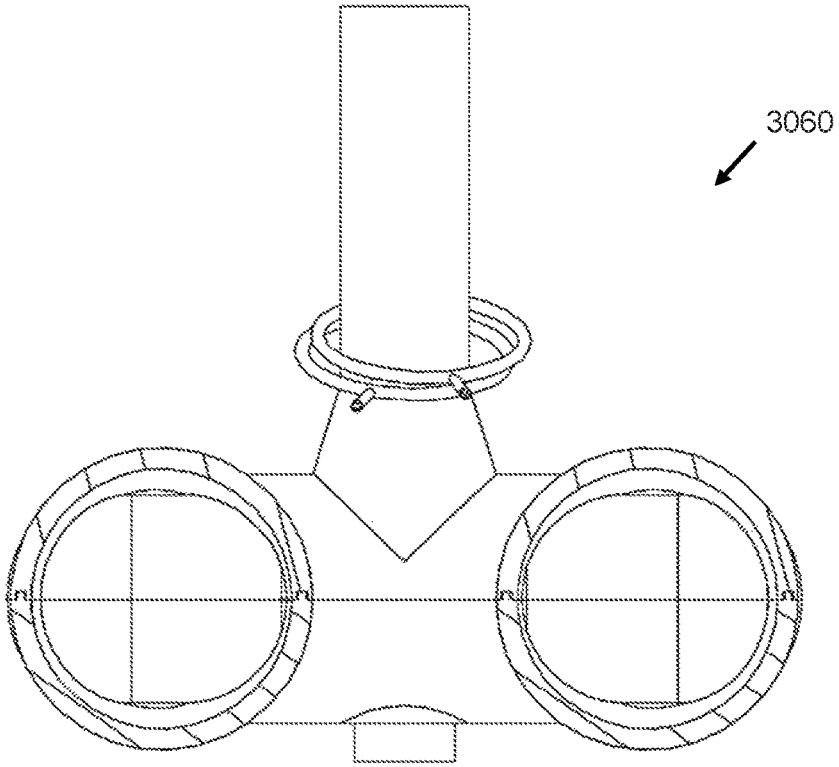
FIG. 81D is a scaled cross sectional view of the apparatus of FIG. 80D as taken along line D-D.
Figure 81E:
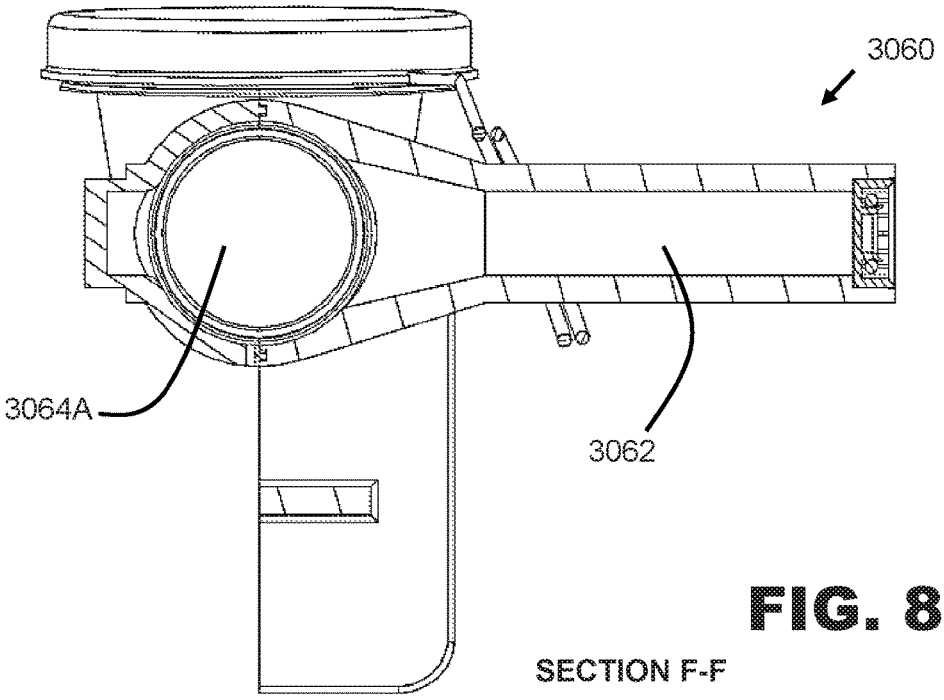
FIG. 81E is a scaled cross sectional view of the apparatus of FIG. 80D as taken along line F-F.
Figure 81F:
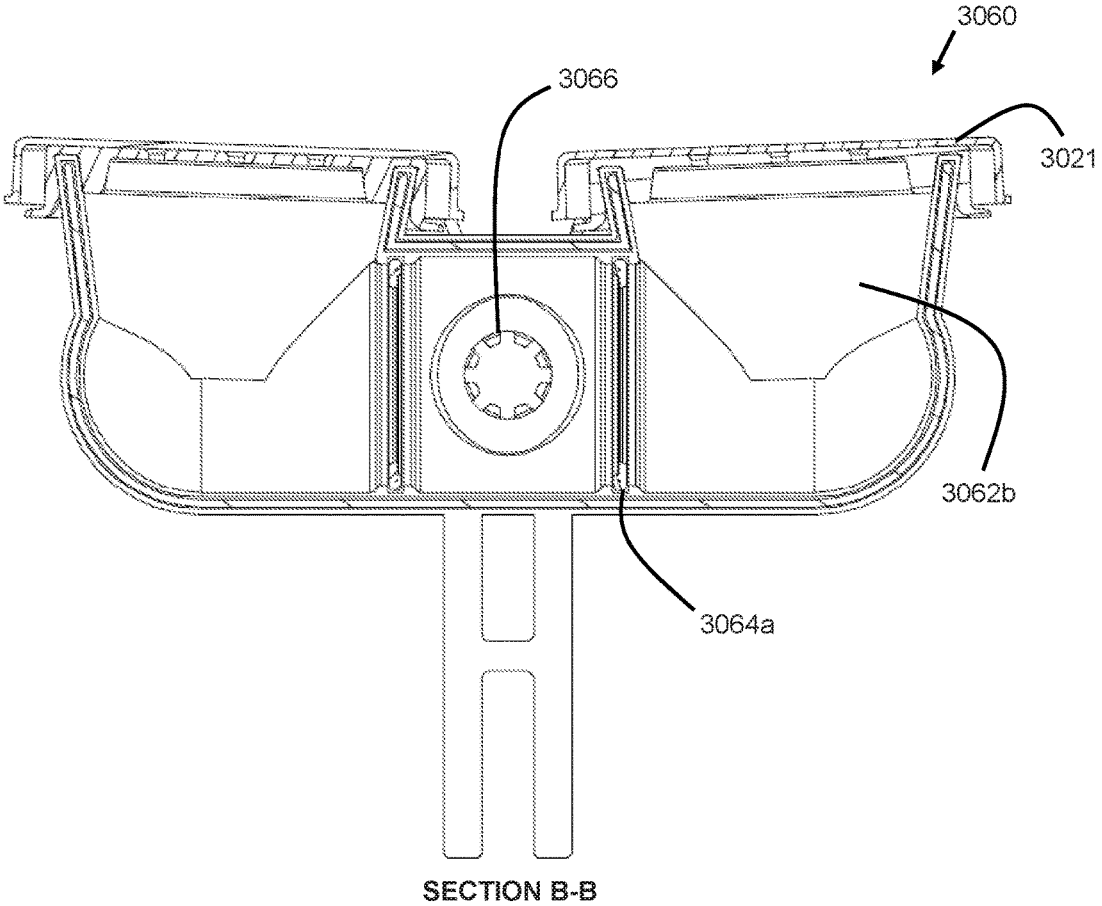
FIG. 81F is a scaled cross sectional view of the apparatus of FIG. 80E as taken along line B-B.

FIGS. 80A, B, C, D, E, and F and FIGS. 81A, B, C, D, E, and F represent various views of the housing of an outlet valve for a low flow emergency eyewash system according to one embodiment of the present invention.

FIGS. 80 show various external views, arranged orthogonally, of an outlet valve according to one embodiment of the present invention. Views C, D, and F are top, end, and bottom views, respectively. Views B and E are corresponding orthogonal views of view D. View A is an end view, generally opposite of view D. FIGS. 81 show the cross sectional representations identified on FIGS. 80. It is to be noted that the cross sectional nomenclature (A through F) is consistent on FIGS. 80 and FIGS. 81, but is different than the lettering nomenclature that identifies the six figures themselves. It can be seen in particular by looking at FIGS. 81A (section C-C), E (section F-F), and F (section B-B) that the flow area of the cross sectional flow area is considerably larger than the cross sectional flow area in the central chamber 3062*c*, both when viewed as the dead-headed cross sectional area (best seen in the center of FIG. 81F), or the lateral cross sectional flow areas of the central section 3062*c*, as best seen in FIGS. 81A, B, and E. Further, it can be seen that the cross sectional flow areas of the lateral chambers 3062 are considerably larger than the cross sectional flow area of inlet flow passage 3062. The cross sectional flow areas for lateral flow coming out of the central chamber 3062*c* and into the lateral chambers can be measured on either of drawings A or F or FIGS. 81. Still further, the cross sectional areas perpendicular to the upward flow through the nozzles can be calculated from the views of drawing F or B of 81. It is to be appreciated that all of the figures on FIGS. 80 and 81 are scaled relative to one another, thus permitting scaling from the drawing of the areas of one flow area relative to the area of another flow area. It is contemplated that in various embodiments of the present invention, that the following ratios, a can be determined from FIGS. 81, can be at least twenty percent less than the area ratios calculated from these figures, or calculated from the table presented below, and still larger, to at least a doubling in some embodiments, and with no upper limit in yet other embodiments:

area of central chamber, dead ended direction, as measured from filter face to filter face, relative to the cross sectional area of passage 3062;

cross sectional area of the inlet to the dispensing cap 30-21 (on the exit of the flow valve 3060), relative to the cross sectional flow area of the inlet 3062.

The ratio of one-half of the entrance into a lateral chamber from a filter, relative to the cross sectional area of the flow passage 3062.

It is contemplated that in various embodiments of the present invention, that the following ratios, a can be determined from FIGS. 81, can be at least twenty percent less than the area ratios calculated from these figures, and still larger, to at least a doubling in some embodiments, and with no upper limit in yet other embodiments:

CROSS SECTIONAL AREA

| DESCRIPTION | SECTIONAL AREA (IN^2) |
|---|---|
| POST FLOW REGULATOR | 0.113 |
| JUST PRIOR TO FILTER (PER SIDE) | 0.792 |
| FILTER(NOT FACTORING IN MESH) (PER SIDE) | 0.442 |
| JUST PRIOR TO CAPS (PER SIDE) | 1.419 |

Various aspects of different embodiments of the present invention are expressed in paragraphs X1, X2, X3, X4, X5, X6 and X7 as follows:

X1. On aspect of the present invention pertains to an emergency washing system in fluid communication with a source of water. The system preferably includes a catch basin having a drain, a shutoff valve having a first connection feature, said shutoff valve being located proximate to said basin. The system preferably includes an emergency eyewash housing having an inlet adapted and configured to receive water from said valve outlet, said eyewash housing inlet having a second connection feature adapted and configured to connect to said first connection feature and form a water-tight connection. The system preferably includes a flush housing having an inlet adapted and configured to receive water from said valve outlet and an outlet, said flush housing inlet having a third connection feature identical to said second connection feature, wherein said system operates in a washing mode with said eyewash housing connected to said valve or a flushing mode with said flush housing connected to said valve.

X2. Another aspect of the present invention pertains to an emergency washing system in fluid communication with a source of water. The system preferably includes an electric water heater receiving water from the source and adapted and configured to provide heated water to an outlet. The system preferably includes a pressure modifying valve receiving water from the source and providing water at a reduced pressure to an outlet. The system preferably includes a thermostatically controlled mixing valve having a hot water inlet receiving heated water, and cold water inlet receiving water from the outlet of said pressure modifying valve, and an outlet provide mixed water. The system preferably includes an emergency eyewash housing having an inlet receiving water from said mixing valve outlet, wherein said system is adapted and configured to provide a sprayed flow of water that is less than about two gallons per minute.

X3. Yet another aspect of the present invention pertains to an emergency washing system in fluid communication with a source of water and a drain. The system preferably includes an emergency eyewash housing having an inlet for receiving water and at least one upwardly directed spray nozzle. The system preferably includes a catch basin located beneath said spray nozzle and having a draining aperture for receiving water sprayed from said nozzle. The system preferably includes a mixing valve including a housing having an inlet for hot water, an inlet for cold water, an outlet for mixed water, and a water return port for receiving water from the draining aperture, said housing containing within it a thermostat operably controlling a metering section to provide mixed water within a predetermined range of temperatures, said housing including a basin support section, the outlet, water return port.

X4. Still another aspect of the present invention pertains to an emergency washing system in fluid communication with a source of water. The system preferably includes a shutoff valve receiving water from the source and providing the water to an outlet, said valve outlet having a first quick connection feature, said shutoff valve being located proximate to said basin. The system preferably includes an emergency eyewash housing having an inlet adapted and configured to receive water from said valve outlet and an outlet, said eyewash housing inlet having a second quick connection feature adapted and configured to easily and quickly connect to said first quick connection feature and form a water-tight connection. The system preferably includes a plurality of upwardly directed spray nozzles, said nozzles receiving water from the eyewash housing outlet and being adapted and configured to spray the water upwards in a pattern acceptable to wash the eyes of a user standing next to said eyewash housing. The system preferably includes a flush housing having an inlet adapted and configured to receive water from said valve outlet and a flowpath leading to an outlet, said flush housing inlet having a third quick connection feature substantially identical to said second connection feature, wherein said system operates in a washing mode expelling water at the substantially constant rate with said eyewash housing connected to said valve or in a flushing mode expelling water at a substantially higher rate than the constant rate with said flush housing connected to said valve.

X5. Still another aspect of the present invention pertains to an emergency washing system in fluid communication with a source of pressurized water. The system preferably includes an electric water heater receiving water from the pressurized source and adapted and configured to provide heated water. The system preferably includes a thermostatically controlled mixing assembly including a thermostat coupled to a movable valve member and having first and second variable area openings, said mixing assembly having a hot water inlet receiving heated water from said water heater and providing the heated water to the first variable opening, a cold water inlet receiving water from the pressurized source and providing the pressurized water to the second variable opening, and said mixing assembly having an outlet providing mixed water, said movable valve member being spring biased to close the first variable opening. The system preferably includes a flow control valve having an inlet receiving mixed water from said mixing assembly and providing mixed water to an outlet, said flow control valve being adapted and configured to limit the flow of mixed water to a substantially constant flow less than about two gallons per minute. The system preferably includes an emergency eyewash assembly including a housing having an inlet receiving mixed from said flow control valve outlet, a plurality of upwardly directed spray nozzles, and a large internal chamber therebetween, said large chamber being adapted and configured to provide mixed water to each of the plurality of spray nozzles in parallel.

X6. Yet another aspect of the present invention pertains to an emergency washing system in fluid communication with a water source and a water return. The system preferably includes an emergency eyewash housing having an inlet for receiving water and at least one upwardly directed spray nozzle. The system preferably includes a catch basin located beneath said spray nozzle and having a draining aperture for receiving water sprayed from said nozzle. The system preferably includes a thermostatically controlled mixing valve including a body having a first water compartment and a second water compartment, said first and second compartments being separated by a support aperture therebetween. The system preferably includes said first water compartment including an inlet for hot water and an inlet for cold water, both inlets being in fluid communication with a thermostatic cartridge valve, said first water compartment including an outlet receiving mixed water from said cartridge valve, said second water compartment including a water return port for receiving water from the draining aperture and a drain for providing the received water to the water return. The system preferably includes means for support of the basin.

Another aspect of the present invention pertains to an emergency washing system in fluid communication with a source of water and a water return. The system preferably includes a multi-flowpath directional valve receiving water from the source and including an internal, movable valve member capable of directing the water to a first outlet and a second outlet. The system preferably includes a shutoff valve in fluid communication with from the first outlet and providing the water to a shutoff valve outlet The system preferably includes an emergency eyewash housing having an inlet adapted and configured for fluid communication with said shutoff valve outlet and having a plurality of upwardly directed spray nozzles adapted and configured to spray the water upwards in a pattern acceptable to wash the eyes of a user standing next to said eyewash housing. The system preferably includes a draining conduit in fluid communication with the second outlet, said draining conduit being in fluid communication with the water return, wherein said movable valve member can be moved to a first washing position in which water is directed to the first outlet and the second outlet is shut off, or to a second flushing position in which the second outlet is open.

Yet other embodiments pertain to any of the previous statements X1, X2, X3, X4, X5, X6 and X7 which are combined with one or more of the following other aspects. It is also understood that any of the aforementioned X paragraphs include listings of individual features that can be combined with individual features of other X paragraphs.

Wherein in the washing mode the flow of water is a first flowrate, in the flushing mode the flow of water is a second flowrate, and the second flowrate is at least twice the first flowrate.

Wherein the first connection feature is one of a male or female quick connect fitting and said second and third connection features are the other of the male or female quick connect fitting.

Wherein said flush housing includes a portion that is substantially transparent to permit viewing of water flowing therethrough.

Which further comprises a water flow limiting device to limit the maximum flow of water through said spray nozzle.

Wherein said water flow limiting device is a flow control valve.

Wherein said water flow limiting device is a flow restriction.

Wherein in the flushing mode said flush housing outlet is located directly above said drain.

Wherein said basin includes a first indexing feature, said eyewash housing includes a second indexing feature, and say flush housing includes a third indexing feature, and each of the second and third indexing features cooperate with the first indexing feature to locate the eyewash housing or flush housing, respectively, relative to the drain.

Wherein said pressure modifying valve is a pressure reducing valve, pressure regulating valve, or pressure balancing valve, said heated water is provided to the hot water inlet at a hot pressure, and said valve provides water to the cold water inlet at a cold pressure that is substantially the same as the hot pressure.

Wherein the slidably received end of said arm is affixed to said other of the support aperture or said basin by a set screw.

Which further comprises a first water pipe coupled to said outlet and supporting said eyewash housing and a second water pipe coupled to draining aperture and supporting at least some of the weight of said basin.

Wherein the centers of the support aperture, water return port, and outlet are aligned along a vertical line.

Wherein the support aperture has a cross-sectional shape the same as the cross-sectional shape of said arm.

While the inventions have been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An emergency washing system in fluid communication with a water source and a water return, comprising:

an emergency eyewash housing having an inlet for receiving water and at least one upwardly directed spray nozzle;

a catch basin located beneath said spray nozzle and having a draining aperture for receiving water sprayed from said nozzle;

a thermostatically controlled mixing valve including a body having a first water compartment and a second water compartment, said first and second compartments being separated by a support aperture therebetween, wherein said body does not place said first water compartment and said second water compartment in fluid communication;

said first water compartment including an inlet for hot water and an inlet for cold water, both inlets being in fluid communication with a thermostatic cartridge valve, said first water compartment including outlet receiving mixed water from said cartridge valve;

said second water compartment including a water return port for receiving water from the draining aperture and a drain for providing the received water to the water return; and a support arm having two ends with one end structurally could to the support aperture and the other end structurally coupled to said catch basin.

2. The system of claim 1 wherein said arm is slidably received by one of the support aperture or said basin and pinned to the other of said support aperture or said basin.

3. The system of claim 1 which further comprises a first water pipe providing fluid communication with said first water compartment outlet, a second water pipe providing fluid communication with said draining aperture, and said support arm, said first water pipe and said second water pipe are parallel.

4. The system of claim 1 wherein the support aperture has a cross-sectional shape the same as the cross-sectional shape of said arm.

5. The system of claim 4 wherein the cross-sectional shape is non-circular and resists rotation of said basin relative to the mixing valve body.

6. The system claim 1 wherein the slidably received end of said arm is affixed within said support aperture by a set screw.

7. The system of claim 1 which further comprises a multi-flowpath directional valve receiving water from the source and including an internal, movable valve member capable of directing the water to a first directional valve outlet and a second directional valve outlet;

a shutoff valve in fluid communication with water from the first directional valve outlet and providing the water to the inlet of the emergency eyewash housing; and a draining conduit in fluid communication with the second directional valve outlet, said draining conduit being in fluid communication with the water return;

wherein said movable valve member can be moved to a first washing position in which water is directed to the first directional valve outlet and the second directional valve outlet is shut off, or to a second flushing position in which the second directional valve outlet is open.

8. The system of claim 7 wherein said conduit includes a substantially transparent portion adapted and configured for viewing by a user.

9. The system of claim 7 wherein said directional valve cannot close both the first directional valve outlet and the second directional valve outlet simultaneously.

10. The system of claim 7 wherein said directional valve cannot shut off the first directional valve outlet.

11. The system of claim 7 wherein said directional valve is a ball valve manually adjustable to direct the water to the first directional valve outlet or to the second directional valve outlet.

12. The system of claim 1 which further comprises an electric water heater receiving water from the source and adapted and configured to provide heated water to the inlet for hot water.

13. The system of claim 12 which further comprises a flow control valve receiving mixed water from the outlet, said flow control valve being adapted and configured to limit the flow of mixed water therethrough to a substantially constant flow less than about two gallons per minute.

14. An emergency washing system in fluid communication with a water source and a water return, comprising:

an emergency eyewash housing having an inlet for receiving water and at least one upwardly directed spray nozzle;

a catch basin located beneath said spray nozzle and having a draining aperture for receiving water sprayed from said nozzle;

a thermostatically controlled mixing valve including a body having a first water compartment and a second water compartment, said first and second compartments being separated by a support aperture therebetween;

said first water compartment including an inlet for het water and an inlet for cold water, both inlets being in fluid communication with a thermostatic cartridge valve, said first water compartment including an outlet receiving mixed water from said cartridge valve;

said second water compartment including a water return port for receiving water from the draining aperture and a drain for providing the received water to the water return; and a support arm having two ends with one end structurally coupled to the support aperture and the other end structurally coupled to said catch basin, said support arm being slidably received by one of the support aperture or said basin and pinned to the other of said support aperture or basin.

15. The system of claim 14 which further compriises a first conduit pipe providing fluid communication with said first water compartment outlet and a second conduit providing fluid communication with said drain.

16. The system of claim 14 wherein the support aperture has a cross-sectional shape about the same as the cross-sectional shape of said arm.

17. The system of clam 16 wherein the cross-sectional shape resists rotation of said basin relative to the mixing valve body.

18. The system of claim 15 wherein the slidably received end of said arm is affixed within said support aperture by a fastener.

19. The system of claim 15 wherein said body does not place said first water compartment and said second water compartment in fluid communication.

20. The system of claim 14 wherein said first water compartment receives hot water at a pressure higher than ambient pressure and cold water at a pressure higher than ambient pressure, and said second water compartment being at about ambient pressure.

21. An emergency washing system in fluid communication with a water source and a water return, comprising:

an emergency eyewash housing having an inlet for receiving water and at least one upwardly directed spray nozzle;

a catch basin located beneath said spray nozzle and having a draining aperture for receiving water sprayed from said nozzle;

a thermostatically controlled mixing valve including a body having a first water compartment and a second water compartment, said first and second compartments being separated by a support aperture therebetween;

said first water compartment including an inlet for hot water and an inlet for cold water, both inlets being in fluid communication with a thermostatic cartridge valve, said first water compartment including an outlet receiving mixed water from said cartridge valve;

said second water compartment including a water return port for receiving water from the draining aperture and a drain for providing the received water to the water return; and a support arm having two ends with one end structurally coupled to the support aperture and the other end structurally coupled to said catch basin;

wherein the support aperture has a cross-sectional shape the same as the cross-sectional shape of said arm, and the cross-sectional shape is non-circular and resists rotation of said basin relative to the mixing valve body.

22. The system of claim 21 wherein said arm is slidably received by one of the support aperture or said basin.

23. The system of claim 21 which further comprises a first water pipe providing fluid communication with said first water compartment outlet separated from a second water pipe providing fluid communication with said draining aperture.

24. The system of claim 21 wherein the slidably received end of said arm is affixed by a fastener.

25. The system of claim 21 wherein said body does not place said first water compartment and said second water compartment in fluid communication.

26. The system of claim 21 wherein said first water compartment receives hot water at a pressure higher than ambient pressure and cold water at a pressure higher than ambient pressure, and said second water compartment being at about ambient pressure.

27. An emergency washing system in fluid communication with a water source and a water return, comprising:

an emergency eyewash housing having an inlet for receiving water and at least one upwardly directed spray nozzle;

a catch basin located beneath said spray nozzle and having a draining aperture for receiving water sprayed from said nozzle;

a thermostatically controlled mixing valve including a body having a first water compartment and a second water compartment, said first and second compartments being separated by a support aperture therebetween;

said first water compartment including an inlet for hot water and an inlet for cold water, both inlets being in fluid communication with a thermostatic cartridge valve, said first water compartment including an outlet receiving mixed water from said cartridge valve;

said second water compartment including a water return port for receiving water from the draining aperture and a drain for providing the received water to the water return; and a support arm having two ends with one end structurally coupled to the support aperture and the other end structurally coupled to said catch basin;

wherein said arm is slidably received by the support aperture and the slidably received end of said arm is affixed within said support aperture by a set screw.

28. The system of claim 27 wherein said first water compartment receives hot water at a pressure higher than ambient pressure and cold water at a pressure higher than ambient pressure, and said second water compartment being at about ambient pressure.

29. The system of claim 28 wherein the inlet of said eyewash housing and the water return port of said second water compartment are generally parallel.

30. The system of claim 27 wherein the support aperture has a cross-sectional shape that resists rotation of said basin relative to the mixing valve body.

31. The system of claim 1 wherein said first water compartment receives hot water at a pressure higher than ambient pressure and cold water at a pressure higher than ambient pressure, and said second water compartment being at about ambient pressure.

* * * * *